US007793721B2

(12) United States Patent
Watson et al.

(10) Patent No.: US 7,793,721 B2
(45) Date of Patent: Sep. 14, 2010

(54) APPARATUS FOR RADIALLY EXPANDING AND PLASTICALLY DEFORMING A TUBULAR MEMBER

(75) Inventors: Brock Wayne Watson, Carrollton, TX (US); David Paul Brisco, Duncan, OK (US)

(73) Assignee: Eventure Global Technology, LLC, Houston, TX (US)

( * ) Notice: Subject to any disclaimer, the term of this patent is extended or adjusted under 35 U.S.C. 154(b) by 906 days.

(21) Appl. No.: 10/548,934

(22) PCT Filed: Mar. 11, 2004

(86) PCT No.: PCT/US2004/007711

§ 371 (c)(1),
(2), (4) Date: Sep. 12, 2005

(87) PCT Pub. No.: WO2004/081346

PCT Pub. Date: Sep. 23, 2004

(65) Prior Publication Data

US 2006/0225892 A1 Oct. 12, 2006

Related U.S. Application Data

(60) Provisional application No. 60/453,678, filed on Mar. 11, 2003.

(51) Int. Cl.

| | |
|---|---|
| ***E21B 33/128*** | (2006.01) |
| ***E21B 33/129*** | (2006.01) |
| ***E21B 23/00*** | (2006.01) |
| ***E21B 29/08*** | (2006.01) |

(52) U.S. Cl. ..... 166/298; 166/118; 166/195; 166/202; 166/207

(58) Field of Classification Search ..... None
See application file for complete search history.

(56) References Cited

U.S. PATENT DOCUMENTS 46,818 A 3/1865 Patterson (Continued)

FOREIGN PATENT DOCUMENTS

AU 767364 2/2004

(Continued)

OTHER PUBLICATIONS

Arbuckle, "Advanced Laser Texturing Tames Tough Tasks," Metal Forming Magazine.

(Continued)

*Primary Examiner*—Zakiya W. Bates
(74) *Attorney, Agent, or Firm*—Conley Rose, P.C.

(57) ABSTRACT

An apparatus and method for radially expanding and plastically deforming a tubular member. The apparatus includes a support member, an expansion device coupled to the support member and at least one of a cutting device coupled to the support member, an actuator coupled to the support member, a sealing assembly, or a packer assembly coupled to the support member. The apparatus may further include a gripping device for coupling the tubular member to the support member. The expansion device may be used for radially expanding and plastically deforming the tubular member which may be coupled to the support member. The cutting device may be used for cutting the tubular member. The actuator may be used for displacing the expansion device relative to the support member. The sealing assembly may be used for sealing an annulus defined between the support member and the tubular member.

32 Claims, 85 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,225,005 | A | 5/1917 | Boyd et al. |
| 1,233,888 | A | 7/1917 | Leonard |
| 1,358,818 | A | 11/1920 | Bering |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,739,932 | A | 12/1929 | Ventresca |
| 1,756,531 | A | 4/1930 | Aldeen et al. |
| 1,880,218 | A | 10/1932 | Simmons |
| 1,952,652 | A | 3/1934 | Brannon |
| 1,981,525 | A | 11/1934 | Price |
| 2,046,870 | A | 7/1936 | Clasen et al. |
| 2,087,185 | A | 7/1937 | Dillom |
| 2,110,913 | A | 3/1938 | Lowrey |
| 2,122,757 | A | 7/1938 | Scott |
| 2,134,311 | A | 10/1938 | Minor et al. |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,293,938 | A | 8/1942 | Dunn et al. |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,331,439 | A | 7/1967 | Sanford |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,387 | A | 9/1972 | Blackburn |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,789,648 | A | 2/1974 | Ames |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,834,742 | A | 9/1974 | McPhillips |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |

3,942,824 A 3/1976 Sable
3,945,444 A 3/1976 Knudson
3,948,321 A 4/1976 Owen et al.
3,970,336 A 7/1976 O'Sickey et al.
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,003,433 A 1/1977 Goins
4,011,652 A 3/1977 Black
4,019,579 A 4/1977 Thuse
4,026,583 A 5/1977 Gottlieb
4,047,568 A 9/1977 Aulenbacher
4,053,247 A 10/1977 Marsh, Jr.
4,068,711 A 1/1978 Aulenbacher
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchinson et al.
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,703,802 A 11/1987 Bryan et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,751,836 A 6/1988 Breese
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.

4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet et al.
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,253,713 A 10/1993 Gregg et al.
5,265,675 A 11/1993 Hearn et al.
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,377,753 A 1/1995 Haberman et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Bäro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.

5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,794,840 A 8/1998 Hohl et al.
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,887,476 A 3/1999 Damsohn et al.
5,895,079 A 4/1999 Carstensen et al.
5,899,268 A 5/1999 Lynde et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,073,698 A 6/2000 Shultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,158,963 A 12/2000 Hollis
6,167,970 B1 1/2001 Stout
6,182,775 B1 2/2001 Hipp
6,189,616 B1 2/2001 Gano et al.
6,196,336 B1 3/2001 Fincher et al.
6,226,855 B1 5/2001 Maine
6,230,843 B1 5/2001 Geiss
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,614 B1 9/2001 Gano et al.
6,302,211 B1 10/2001 Nelson et al.
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,323 B1 9/2002 Metcalfe et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.

6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson et al.
6,585,053 B2 7/2003 Coon
6,591,905 B2 7/2003 Coon
6,598,677 B1 7/2003 Baugh et al.
6,598,678 B1 * 7/2003 Simpson et al. ..... 166/297
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,758,278 B2 7/2004 Cook et al.
6,772,841 B2 8/2004 Gano
6,796,380 B2 9/2004 Xu
6,814,147 B2 11/2004 Baugh
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrack
6,935,430 B2 8/2005 Harrell et al.
6,966,370 B2 11/2005 Cook et al.
6,968,618 B2 11/2005 Cook et al.
6,976,539 B2 12/2005 Metcalfe et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring et al.
7,048,067 B1 5/2006 Cook et al.
7,055,608 B2 6/2006 Cook et al.
7,063,142 B2 6/2006 Cook et al.
7,063,149 B2 6/2006 Simpson et al.
7,114,559 B2 10/2006 Sonnier et al.
7,164,964 B2 1/2007 Stacklies
7,185,710 B2 3/2007 Cook et al.
7,191,841 B2 3/2007 Sivley, IV
7,198,100 B2 4/2007 Cook et al.
7,201,223 B2 4/2007 Cook et al.
7,204,007 B2 4/2007 Cook et al.
7,216,701 B2 5/2007 Cook et al.
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
7,243,731 B2 7/2007 Watson et al.
7,246,667 B2 7/2007 Cook et al.
7,258,168 B2 8/2007 Cook et al.
7,270,188 B2 9/2007 Cook et al.
7,275,601 B2 10/2007 Cook et al.
7,290,605 B2 11/2007 Waddell et al.
7,290,616 B2 11/2007 Cook et al.
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.

2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley, IV
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0195826 A1 10/2004 Goto
2004/0216506 A1 11/2004 Simpson et al.
2004/0216873 A1 11/2004 Frost, Jr. et al.
2004/0221996 A1 11/2004 Burge
2004/0231839 A1 11/2004 Ellington et al.
2004/0231843 A1 11/2004 Simpson et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1* 3/2005 Ring et al. ..... 166/384
2005/0056434 A1 3/2005 Watson et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0172473 A1 8/2005 Cook et al.
2005/0173108 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230124 A1 10/2005 Cook et al.
2005/0236159 A1 10/2005 Costa et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0032640 A1 2/2006 Costa et al.
2006/0048948 A1 3/2006 Noel
2006/0054330 A1 3/2006 Ring et al.
2006/0065403 A1 3/2006 Watson et al.
2006/0065406 A1 3/2006 Shuster et al.
2007/0131431 A1 6/2007 Shuster et al.
2007/0143987 A1 6/2007 Cook et al.
2007/0144735 A1 6/2007 Lloyd et al.
2007/0151360 A1 7/2007 Ring et al.
2007/0151725 A1 7/2007 Cook et al.
2007/0154270 A1 7/2007 Waddell et al.
2007/0169939 A1 7/2007 Costa et al.
2007/0169944 A1 7/2007 Parker et al.
2007/0175630 A1 8/2007 Costa et al.
2007/0227730 A1 10/2007 Brisco et al.
2007/0246934 A1 10/2007 Heertjes et al.

FOREIGN PATENT DOCUMENTS

AU 2004/202805 B9 7/2004
AU 2004/202809 B8 7/2004
AU 2004/202812 B8 7/2004
AU 2004/202813 B2 7/2004
AU 2004/202815 B2 7/2004
AU 770008 7/2004
AU 770359 7/2004
AU 771884 8/2004
AU 776580 1/2005
AU 780123 3/2005
AU 2001269810 8/2005
AU 782901 9/2005
AU 783245 10/2005
AU 2001294802 10/2005
AU 2001/292695 B2 10/2006
AU 2003/257878 B2 8/2007
AU 2003/257881 B2 8/2007
CA 736288 6/1966
CA 771462 11/1967
CA 1171310 7/1984
CA 2292171 6/2000
CA 2298139 8/2000
CA 2419806 4/2002

| | | | |
|---|---|---|---|
| CA | 2453034 | | 1/2003 |
| CA | 2234386 | | 3/2003 |
| CA | 2466685 | | 3/2004 |
| CA | 2249139 | | 1/2007 |
| CA | 2536716 | A1 | 7/2007 |
| DE | 174521 | | 4/1953 |
| DE | 1549823 | | 12/1970 |
| DE | 1549824 | | 5/1971 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 620289 | A1 | 10/1994 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1106778 | A1 | 6/2001 |
| EP | 1141515 | A | 10/2001 |
| EP | 1152119 | A2 | 11/2001 |
| EP | 1152120 | A2 | 11/2001 |
| EP | 1152120 | A3 | 11/2001 |
| EP | 1375820 | A1 | 3/2002 |
| EP | 1235972 | A | 9/2002 |
| EP | 1306519 | A2 | 5/2003 |
| EP | 1505251 | A2 | 2/2005 |
| EP | 1555386 | A1 | 7/2005 |
| EP | 1505251 | A3 | 2/2007 |
| EP | 1549824 | B1 | 7/2007 |
| FR | 1325596 | | 6/1962 |
| FR | 1325596 | | 3/1963 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1107902 | A | 3/1968 |
| GB | 1111536 | | 5/1968 |
| GB | 1448304 | | 9/1976 |
| GB | 1460864 | | 1/1977 |
| GB | 1542847 | | 3/1979 |
| GB | 1549823 | | 8/1979 |
| GB | 1549824 | | 8/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2124275 | A | 2/1984 |
| GB | 2125876 | A | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2275705 | A | 9/1994 |
| GB | 2279383 | | 1/1995 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2350137 | A | 11/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2385622 | A | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |

| | | | |
|---|---|---|---|
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396634 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2404677 | A | 2/2005 |
| GB | 2404680 | A | 2/2005 |
| GB | 2384807 | C | 3/2005 |
| GB | 2387861 | B | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |

| | | | |
|---|---|---|---|
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2396639 | B | 3/2006 |
| GB | 2418216 | A | 3/2006 |
| GB | 2418217 | A | 3/2006 |
| GB | 2422860 | A | 8/2006 |
| GB | 2427636 | A | 1/2007 |
| GB | 2429482 | A | 2/2007 |
| GB | 2410280 | B | 4/2007 |
| GB | 2430953 | A | 4/2007 |
| GB | 2431179 | A | 4/2007 |
| GB | 2431181 | A | 4/2007 |
| GB | 2412178 | B | 5/2007 |
| GB | 2415215 | B | 5/2007 |
| GB | 2426993 | B | 5/2007 |
| GB | 2427636 | B | 5/2007 |
| GB | 2432383 | A | 5/2007 |
| GB | 2432384 | A | 5/2007 |
| GB | 2432385 | A | 5/2007 |
| GB | 2432386 | A | 5/2007 |
| GB | 2415003 | B | 6/2007 |
| GB | 2416556 | B | 7/2007 |
| GB | 2433756 | A | 7/2007 |
| GB | 2415454 | B | 8/2007 |
| GB | 2429226 | B | 8/2007 |
| GB | 2429996 | B | 8/2007 |
| GB | 2433281 | B | 8/2007 |
| GB | 2435280 | A | 8/2007 |
| GB | 2415983 | B | 9/2007 |
| GB | 2415987 | B | 9/2007 |
| GB | 2416361 | B | 9/2007 |
| GB | 2421529 | B | 9/2007 |
| GB | 2429480 | B | 9/2007 |
| GB | 2429482 | B | 9/2007 |
| GB | 2436114 | A | 9/2007 |
| GB | 2415988 | B | 10/2007 |
| GB | 2424437 | B | 10/2007 |
| GB | 2427886 | B | 10/2007 |
| GB | 2429481 | B | 10/2007 |
| GB | 2432388 | B | 10/2007 |
| GB | 2433757 | B | 10/2007 |
| GB | 2433758 | B | 10/2007 |
| GB | 2435064 | B | 10/2007 |
| GB | 2436931 | A | 10/2007 |
| GB | 2437045 | A | 10/2007 |
| GB | 2437467 | A | 10/2007 |
| GB | 2416794 | B | 11/2007 |
| GB | 2429224 | B | 11/2007 |
| GB | 2429225 | B | 11/2007 |
| GB | 2436743 | B | 11/2007 |
| GB | 2437044 | B | 11/2007 |
| GB | 2437879 | A | 11/2007 |
| GB | 2437880 | A | 11/2007 |
| GB | 2408277 | A | 5/2008 |
| ID | 044.392/2005 | | 9/2005 |
| JP | 59-197323 | | 11/1984 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| JP | P2001-47161 | A | 2/2001 |
| JP | 2006-525483 | | 8/2007 |
| NL | 6505793 | A | 11/1965 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |

| | | | |
|---|---|---|---|
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO 93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO 96/10710 | | 11/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO 98/22690 | | 5/1998 |
| WO | WO98/22690 | | 5/1998 |
| WO | WO98/26152 | | 6/1998 |
| WO | WO 98/42947 | | 10/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO 00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO 01/18354 | A1 | 3/2001 |
| WO | WO01/18354 | A1 | 3/2001 |
| WO | WO01/21929 | A1 | 3/2001 |
| WO | WO01/26860 | A1 | 4/2001 |
| WO | WO 01/33037 | A1 | 5/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO 01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO 02/38343 | A2 | 5/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO 03/023178 | A2 | 3/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |

| | | | |
|---|---|---|---|
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO 03/093623 | A2 | 11/2003 |
| WO | WO03/093623 | A2 | 11/2003 |
| WO | WO03/093623 | A3 | 11/2003 |
| WO | WO 03/093624 | | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO 2004/026500 | A2 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO 2004/027201 | A2 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO 2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020913 | A2 | 2/2006 |
| WO | WO2006/020960 | A2 | 2/2006 |
| WO | WO2006/033720 | A2 | 3/2006 |
| WO | WO 2006/096762 | A1 | 9/2006 |
| WO | WO 2007/047193 | A2 | 4/2007 |
| WO | WO 2007/076078 | A2 | 7/2007 |
| WO | WO 2007/079321 | A2 | 7/2007 |

OTHER PUBLICATIONS

Baker Hughes, "Expatch Expandable Cladding System," Oct. 2002.

Baker Hughes, "Express Expandable Screen System,".

Baker Hughes, "Formlock Expandable Liner Hangers,".

Banabic, "Research Projects," Jan. 30, 1999.

Blasingame et al., "Solid Expandable Tubular Technology in Mature Basins," *Society of Petroleum Engineers* 2003.

Brass et al., "Water Production Management—PDO's Successful Application of Expandable Technology," *Society of Petroleum Engineers,* 2002.

Brizmer et al., "A Laser Surface Textured Parallel Thrust Bearing," *Tribology Transactions,* 46(3):397-403, 2003.

Brock et al., "An Expanded Horizon," Hart's E&P, Feb. 2000.

Buckler et al., "Expandable Cased-hole Liner Remediates Prolific Gas Well and Minimizes Loss of Production," *Offshore Technology Conference,* 15151.

Bullock, "Advances Grow Expandable Applications," *The American Oil & Gas Reporter,* Sep. 2004.

Cales, "The Development and Applications of Solid Expandable Tubular Technology," *Enventure Global Technology,* Paper 2003-136, 2003.

Cales et al., "Reducing Non-Productive Time Through the Use of Solid Expandable Tubulars: How to Beat the Curve Through Pre-Planning," *Offshore Technology Conference,* 16669, 2004.

Cales et al., "Subsidence Remediation—Extending Well Life Through the Use of Solid Expandable Casing Systems," *AADE Houston Chapter,* Mar. 27, 2001.

Campo et al., "Case Histories—Drilling and Recompletion Applications Using Solid Expandable Tubular Technology," *Society of Petroleum Engineers,* SPE/IADC 72304, 2002.

Carstens et al., "Solid Expandable Tubular Technology: The Value of Planned Installations vs. Contingency,".

Case History, "Eemskanaal—2 Groningen," Enventure Global Technology, Feb. 2002.

Case History, "Graham Ranch No. 1 Newark East Barnett Field" Enventure Global Technology, Feb. 2002.

Case History, "K.K. Camel No. 1 Ridge Field Lafayette Parish, Louisiana," Enventure Global Technology, Feb. 2002.

Case History, "Mississippi Canyon 809 URSA TLP, OSC-G 5868, No. A-12," Enventure Global Technology, Mar. 2004.

Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore,* Jul. 2002.
Cottrill, "Expandable Tubulars Close in on the Holy Grail of Drilling," *Upstream,* Jul. 26, 2002.
Daigle et al., "Expandable Tubulars: Field Examples of Application in Well Construction and Remediation," *Society of Petroleum Engineers,* SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers,* SPE/IADC 79790, 2003.
Demong et al., "Breakthroughs Using Solid Expandable Tubulars to Construct Extended Reach Wells," *Society of Petroleum Engineers,* IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore,* Jun. 2003.
Demong et al., "Planning the Well Construction Process for the Use of Solid Expandable Casing," *Society of Petroleum Engineers,* SPE 85303, 2003.
Demoulin, "Les Tubes Expansibles Changent La Face Du Forage Petrolier," *L'Usine Nouvelle,* 2878:50-52, Jul. 3, 2003.
Dupal et al., "Realization of the MonoDiameter Well: Evolution of a Game-Changing Technology," *Offshore Technology Conference,* OTC 14312, 2002.
Dupal et al., "Solid Expandable Tubular Technology—A Year of Case Histories in the Drilling Environment," *Society of Petroleum Engineers,* SPE/IADC 67770, 2001.
Dupal et al., "Well Design with Expandable Tubulars Reduces Cost and Increases Success in Deepwater Applications," *Deep Offshore Technology,* 2000.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology,* Feb. 2003.
Enventure Global Technology, "Solid Expandable Tubulars are Enabling Technology," *Drilling Contractor,* Mar.-Apr. 2001.
"Enventure Ready to Rejuvinate the North Sea," *Roustabout,* Sep. 2004.
Escobar et al., "Increasing Solid Expandable Tubular Technology Reliability in a Myriad of Downhole Environments," *Society of Petroleum Engineers,* SPE/IADC 81094, 2003.
Etsion, "Improving Tribological Performance of Mechanical Seals by Laser Surface Texturing," *Surface Technologies, Ltd.*
Etsion, "A Laser Surface Textured Hydrostatic Mechanical Seal," *Sealing Technology,* Mar. 2003.
"Expandable Casing Accesses Remote Reservoirs," *Petroleum Engineer International,* Apr. 1999.
"Expandable Sand Screens," *Weatherford Completion Systems,* 2002.
Filippov et al., "Expandable Tubular Solutions," *Society of Petroleum Engineers,* SPE 56500, 1999.
"First ever SET Workshop Held in Aberdeen," *Roustabout,* Oct. 2004.
Fischer, "Expandables and the Dream of the Monodiameter Well: A Status Report", *World Oil,* Jul. 2004.
Fontova, "Solid Expandable Tubulars (SET) Provide Value to Operators Worldwide in a Variety of Applications," *EP Journal of Technology,* Apr. 2005.
Fraunhofer IWU, "Research Area: Sheet Metal Forming—Superposition of Vibrations," 2001.
Furlow, "Casing Expansion, Test Process Fine Tuned on Ultra-deepwater Well," *Offshore,* Dec. 2000.
Furlow, "Expandable Casing Program Helps Operator Hit TD With Larger Tubulars," *Offshore,* Jan. 2000.
Furlow, "Expandable Solid Casing Reduces Telescope Effect," *Offshore,* Aug. 1998.
Furlow, "Agbada Well Solid Tubulars Expanded Bottom Up, Screens Expanded Top Down," *Offshore,* 2002.
Gilmer et al., "World's First Completion Set Inside Expandable Screen," *High-Tech Wells,* 2003.
Grant et al., "Deepwater Expandable Openhole Liner Case Histories: Learnings Through Field Applications," *Offshore Technology Conference,* OCT 14218, 2002.
Guichelaar et al., "Effect of Micro-Surface Texturing on Breakaway Torque and Blister Formation on Carbon-Graphite Faces in a Mechanical Seal," *Lubrication Engineering,* Aug. 2002.
Gusevik et al., "Reaching Deep Reservoir Targets Using Solid Expandable Tubulars" *Society of Petroleum Engineers,* SPE 77612, 2002.
Haefke et al., "Microtexturing of Functional Surfaces for Improving Their Tribological Performance," *Proceedings of the International Tribology Conference,* 2000.
Halliburton Completion Products, 1996.
Haut et al., "Meeting Economic Challenges of Deepwater Drilling with Expandable-Tubular Technology," *Deep Offshore Technology Conference,* 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Linzell, "Trib-Gel A Chemical Cold Welding Agent," 1999.
Lizotte, "Scratching The Surface," *PT Design,* Jun. 19993.
Lohoefer et al., "Expandable Liner Hanger Provides Cost-Effective Alternative Solution," *Society of Petroleum Engineers,* IADC/SPE 59151, 2000.
Mack et al., "How in Situ Expansion Affects Casing and Tubing Properties," *World Oil,* Jul. 1999. pp. 69-71.
Mack et al., "In-Situ Expansion of Casing and Tubing—Effect on Mechanical Properties and Resistance to Sulfide Stress Cracking,".
Merritt, "Casing Remediation—Extending Well Life Through The Use of Solid Expandable Casing Systems,".
Merritt et al., "Well Remediation Using Expandable Cased-Hole Liners", *World Oil.,* Jul. 2002.
Merritt et al., "Well Remediation Using Expandable Cased-Hole Liners- Summary of Case Histories".
Mohawk Energy, :Minimizing Drilling Ecoprints Houston, Dec. 16, 2005.
Moore et al., "Expandable Liner Hangers: Case Histories," *Offshore Technology Conference,* OTC 14313, 2002.
Moore et al., "Field Trial Proves Upgrades to Solid Expandable Tubulars," *Offshore Technology Conference,* OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference,* OTC 14315, 2002.
Patin et al., "Overcoming Well Control Challenges with Solid Expandable Tubular Technology," *Offshore Technology Conference,* OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers,* SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers,* SPE 90821, 2004.

Rivenbark et al., "Window Exit Sidetrack Enhancements Through the Use of Solid Expandable Casing," *Society of Petroleum Engineers,* IADC/SPE 88030, 2004.
Roca et al., "Addressing Common Drilling Challenges Using Solid Expandable Tubular Technology," *Society of Petroleum Engineers,* SPE 80446, 2003.
Ronen et al., "Friction-Reducing Surface-Texturing in Reciprocating Automotive Components," *Tribology Transactions,* 44(3):359-366, 2001.
Rky et al., "Experimental Investigation of Laser Surface Texturing for Reciprocating Automotive Components," *Tribology Transactions,* 45(4):444-449, 2002.
Sanders et al., Practices for Providing Zonal Isolation in Conjuction with Expandable Casing Jobs-Case Histories, 2003.
Sanders et al., "Three Diverse Applications on Three Continents for a Single Major Operator," *Offshore Technology Conference,* OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference,* OTC 15149, 2003.
"Slim Well:Stepping Stone to MonoDiameter," *Hart's E & P,* Jun. 2003.
Smith, "Pipe Dream Reality," *New Technology Magazine,* Dec. 2003.
"Solid Expandable Tubulars," *Hart's E & P,* Mar. 2002.
Sparling et al., "Expanding Oil Field Tubulars Through a Window Demonstrates Value and Provides New Well Construction Option," *Offshore Technology Conference,* OTC 16664, 2004.
Sumrow, "Shell Drills World's First Monodiameter Well in South Texas," *Oil and Gas,* Oct. 21, 2002.
Touboul et al., "New Technologies Combine to Reduce Drilling Cost in Ultradeepwater Applications," *Society of Petroleum Engineers,* SPE 90830, 2004.
Turcotte et al., "Geodynamics Applications of Continuum Physics to Geological Problems," 1982.
Van Noort et al., "Using Solid Expandable Tubulars for Openhole Water Shutoff," *Society of Petroleum Engineers,* SPE 78495, 2002.
Van Noort et al., "Water Production Reduced Using Solid Expandable Tunular Technology to "Clad," in Fractured Carbonate Formation " *Offshore Technology Conference,* OTC 15153, 2003.
Von Flatern, "From Exotic to Routine—the Offshore Quick-step," *Offshore Engineer,* Apr. 2004.
Von Flatern, "Oilfield Service Trio Target Jules Verne Territory," *Offshore Engineer,* Aug. 2001.
Waddell et al., "Advances in Single-diameter Well Technology: The Next Step to Cost-Effective Optimization," *Society of Petroleum Engineers,* SPE 90818, 2004.
Waddell et al., "Installation of Solid Expandable Tubular Systems Through Milled Casing Windows," *Society of Petroleum Engineers,* IADC/SPE 87208, 2004.
Williams, "Straightening the Drilling Curve," *Oil and Gas Investor,* Jan. 2003.
www.JETLUBE.com. "Oilfield Catalog—Jet-Lok Product Applicatin Descriptions," 1998.
www.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications—Spur Industries," 2000.
"Expand Your Opportunities." *Enventure*. CD-ROM. Jun. 1999.
"Expand Your Opportunities," *Enventure*. CD-ROM. May 2001.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/00631, Mar. 2, 2006.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
International Preliminary Report on Patentability, Application PCT/US04/28438, Sep. 20, 2005.
Written Opinion to Application No. PCT/US01/19014, Dec. 10, 2002.
Written Opinion to Application No. PCT/US01/23815, Jul. 25, 2002.

Written Opinion to Application No. PCT/US01/28960, Dec. 2, 2002.
Written Opinion to Application No. PCT/US01/30256, Nov. 27, 2002.
Written Opinion to Application No. PCT/US02/00093, Apr. 21, 2003.
Written Opinion to Application No. PCT/US02/00677, Apr. 17, 2003.
Written Opinion to Application No. PCT/US02/04353, Apr. 11, 2003.
Written Opinion to Application No. PCT/US02/20256, May 9, 2003.
Written Opinion to Application No. PCT/US02/24399, Apr. 28, 2004.
Written Opinion to Application No. PCT/US02/25608, Sep. 13, 2004.
Written Opinion to Application No. PCT/US02/25608, Feb. 2, 2005.
Written Opinion to Application No. PCT/US02/25727, May 17, 2004.
Written Opinion to Application No. PCT/US02/39418, Jun. 9, 2004.
Written Opinion to Application No. PCT/US02/39425, Nov. 22, 2004.
Written Opinion to Application No. PCT/US02/39425, Apr. 11, 2005.
Written Opinion to Application No. PCT/US03/06544, Feb. 18, 2005.
Written Opinion to Application No. PCT/US03/11765, May 11, 2004.
Written Opinion to Application No. PCT/US03/13787, Nov. 9, 2004.
Written Opinion to Application No. PCT/US03/14153, Sep. 9, 2004.
Written Opinion to Application No. PCT/US03/14153, Nov. 9, 2004.
Written Opinion to Application No. PCT/US03/18530, Sep. 13, 2004.
Written Opinion to Application No. PCT/US03/19993, Oct. 15, 2004.
Written Opinion to Application No. PCT/US03/25675, Nov. 24, 2004.
Written Opinion to Application No. PCT/US03/25675, May 9, 2005.
Written Opinion to Application No. PCT/US03/29858, Jan. 21, 2004.
Written Opinion to Application No. PCT/US03/38550, Dec. 10, 2004.
Written Opinion to Application No. PCT/US04/08171, May 5, 2005.
Combined Search Report and Written Opinion to Application No. PCT/US04/00631, Mar. 28, 2005.
Combined Search Report and Written Opinion to Application No. PCT/US04/02122, Feb. 24, 2005.
Combined Search Report and Written Opinion to Application No. PCT/US04/04740, Jan. 19, 2005.
Combined Search Report and Written Opinion to Application No. PCT/US04/06246, Jan. 26, 2005.
Combined Search Report and Written Opinion to Application No. PCT/US04/08030, Jan. 6, 2005.
Combined Search Report and Written Opinion to Application No. PCT/US04/08073, Mar. 4, 2005.
Combined Search Report and Written Opinion to Application No. PCT/US04/08170, Jan. 13, 2005.
Combined Search Report and Written Opinion to Application No. PCT/US04/08171, Feb. 16, 2005.
Combined Search Report and Written Opinion to Application No. PCT/US04/10762, Sep. 1, 2005.
Combined Search Report and Written Opinion to Application No. PCT/US04/11177, Feb. 14, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28438, Mar. 14, 2005.
Combined Search Report and Written Opinion to Application No. PCT/US04/28831, Dec. 19, 2005.
Combined Search Report and Written Opinion to Application No. PCT/US04/28889, Nov. 14, 2005.
Search Report to Application No. GB 0003251.6, Jul. 13, 2000.
Search Report to Application No. GB 0004282.0, Jul. 31, 2000.
Search Report to Application No. GB 0004282.0, Jan. 15, 2001.
Search Report to Application No. GB 0004285.3, Jul. 12, 2000.
Search Report to Application No. GB 0004285.3, Jan. 17, 2001.
Search Report to Application No. GB 0005399.1, Jul. 24, 2000.
Search Report to Application No. GB 0005399.1, Feb. 15, 2001.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Search Report to Application No. GB 0219757.2, Nov. 25, 2002.
Search Report to Application No. GB 0219757.2, Jan. 20, 2003.
Search Report to Application No. GB 0220872.6, Dec. 5, 2002.
Search Report to Application No. GB 0220872.6, Mar. 13, 2003.
Search Report to Application No. GB 0225505.7, Mar. 5, 2003.
Search Report to Application No. GB 0415835.8, Dec. 2, 2004.
Search Report to Application No. GB 0415835.8, Mar. 10, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Search Report to Application No. GB 9930398.4, Jun. 27, 2000.
Examination Report to Application No. GB 0004285.3, Aug. 28, 2002.
Examination Report to Application No. GB 0004285.3, Mar. 28, 2003.
Examination Report to Application No. GB 0005399.1, Oct. 14, 2002.
Examination Report to Application No. GB 0013661.4, Nov. 25, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Examination Report to Application No. GB 0219757.2, May 10, 2004.
Examination Report to Application No. GB 0219757.2, Oct. 31, 2004.
Examination Report to Application No. GB 0220872.6, Oct. 29, 2004.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0303220.8, Jun. 30, 2004.
Examination Report to Application No. GB 0306046.4, Sep. 10, 2004.
Examination Report to Application No. GB 0310836.2, Aug. 7, 2003.
Examination Report to Application No. GB 0311596.1, May 18, 2004.
Examination Report to Application No. GB 0314846.7, Jul. 15, 2004.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0320747.9, May 25, 2004.
Examination Report to Application No. GB 0325071.9, Feb. 2, 2004.
Examination Report to Application No. GB 0325072.7, Feb. 2, 2004.
Examination Report to Application No. GB 0325072.7, Apr. 13, 2004.
Examination Report to Application No. GB 03701281.2, Jan. 31, 2006.
Examination Report to Application No. GB 03723674.2, Feb. 6, 2006.

Examination Report to Application No. GB 0400018.8, Oct. 29, 2004.
Examination Report to Application No. GB 0400018.8, May 17, 2005.
Examination Report to Application No. GB 0400019.6, Oct. 29, 2004.
Examination Report to Application No. GB 0400019.6, May 19, 2005.
Examination Report to Application No. GB 0400019.6, Sep. 2, 2005.
Examination Report to Application No. GB 0400019.6, Nov. 4, 2005.
Examination Report to Application No. GB 0403891.5, Feb. 14, 2005.
Examination Report to Application No. GB 0403891.5, Jun. 30, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5, May 20, 2004.
Examination Report to Application No. GB 0404796.5, Apr. 14, 2005.
Examination Report to Application No. GB 0404830.2, Aug. 17, 2004.
Examination Report to Application No. GB 0404833.6, Aug. 19, 2004.
Examination Report to Application No. GB 0404837.7, Jul. 12, 2004.
Examination Report to Application No. GB 0406257.6, Jun. 28, 2004.
Examination Report to Application No. GB 0406257.6, Jan. 25, 2005.
Examination Report to Application No. GB 0406257.6, Mar. 3, 2005.
Examination Report to Application No. GB 0406257.6, Jun. 16, 2005.
Examination Report to Application No. GB 0406257.6, Sep. 2, 2005.
Examination Report to Application No. GB 0406257.6, Nov. 9, 2005.
Examination Report to Application No. GB 0406258.4, May 20, 2004.
Examination Report to Application No. GB 0406258.4, Jan. 12, 2005.
Examination Report to Application No. GB 0406258.4, Jul. 27, 2005.
Examination Report to Application No. GB 0406258.4, Dec. 20, 2005.
Examination Report to Application No. GB 0408672.4, Jul. 12, 2004.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Examination Report to Application No. GB 0412876.5, Feb. 13, 2006.
Examination Report to Application No. GB 0415835.8, Dec. 23, 2005.
Examination Report to Application No. GB 0416625.2, Jan. 20, 2005.
Examination Report to Application No. GB 0416834.0, Nov. 16, 2004.
Examination Report to Application No. GB 0422419.2, Dec. 8, 2004.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6, Sep. 15, 2005.
Examination Report to Application No. GB 0428141.6, Feb. 21, 2006.
Examination Report to Application No. GB 0500184.7, Feb. 9, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Examination Report to Application No. GB 0507979.3, Jan. 17, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Examination Report to Application No. GB 9926450.9, May 15, 2002.
Examination Report to Application No. GB 9926450.9, Nov. 22, 2002.
Search and Examination Report to Application No. GB 0004282.0, Jun. 3, 2003.
Search and Examination Report to Application No. GB 0225505.7, Jul. 1, 2003.
Search and Examination Report to Application No. GB 0308290.6, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308295.5, Jun. 2, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308299.7, Jun. 2, 2003.

Search and Examination Report to Application No. GB 0308302.9, Jun. 2, 2003.
Search and Examination Report to Application No. GB 0308303.7, Jun. 2, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Search and Examination Report to Application No. GB 0313406.1, Sep. 3, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search and Examination Report to Application No. GB 0318545.1, Sep. 3, 2003.
Search and Examination Report to Application No. GB 0318547.7; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Search and Examination Report to Application No. GB 0325072.7, Dec. 3, 2003.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.1, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0412876.5, Sep. 27, 2005.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3, Sep. 10, 2004.
Search and Examination Report to Application No. GB 0418427.1, Sep. 10, 2004.
Search and Examination Report to Application No. GB 0418429.7, Sep. 10, 2004.
Search and Examination Report to Application No. GB 0418430.5, Sep. 10, 2004.
Search and Examination Report to Application No. GB 0418431.3, Sep. 10, 2004.
Search and Examination Report to Application No. GB 0418432.1, Sep. 10, 2004.
Search and Examination Report to Application No. GB 0418433.9, Sep. 10, 2004.
Search and Examination Report to Application No. GB 0418439.6, Sep. 10, 2004.
Search and Examination Report to Application No. GB 0418442.0, Sep. 10, 2004.

Search and Examination Report to Application No. GB 0422893.8, Nov. 24, 2004.
Search and Examination Report to Application No. GB 0423416.7, Nov. 12, 2004.
Search and Examination Report to Application No. GB 0423417.5, Nov. 12, 2004.
Search and Examination Report to Application No. GB 0423418.3, Nov. 12, 2004.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0426155.8, Jan. 12, 2005.
Search and Examination Report to Application No. GB 0426156.6, Jan. 12, 2005.
Search and Examination Report to Application No. GB 0426157.4, Jan. 12, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2001278196, Apr. 21, 2005.
Examination Report to Application No. AU 2002237757, Apr. 28, 2005.
Examination Report to Application No. AU 2002240366, Apr. 13, 2005.
Examination Report to Application No. AU 2003257878, Jan. 19, 2006.
Examination Report to Application No. AU 2003257881, Jan. 19, 2006.
Search Report to Application No. EP 02806451.7; Feb. 9, 2005.
Search Report to Application No. EP 03071281.2; Nov. 14, 2005.
Search Report to Application No. EP 03723674.2; Nov. 22, 2005.
Search Report to Application No. EP 03728326.4; Mar. 13, 2006.
Search Report to Application No. EP 03752486.5; Feb. 8, 2006.
Search Report to Application No. EP 03759400.9; Mar. 3, 2006.
Search Report to Application No. Norway 1999 5593, Aug. 20, 2002.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 27, 2004.
International Search Report, Application PCT/US02/25608, May 24, 2004.
International Search Report, Application PCT/US02/25727, Feb. 19, 2004.
International Search Report, Application PCT/US02/29856, Dec. 16, 2002.
International Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.

International Search Report, Application PCT/US03/04837, May 28, 2004.
International Search Report, Application PCT/US03/06544, Jun. 9, 2004.
International Search Report, Application PCT/US03/10144, Oct. 31, 2003.
International Search Report, Application PCT/US03/11765, Nov. 13, 2003.
International Search Report, Application PCT/US03/13787, May 28, 2004.
International Search Report, Application PCT/US03/14153, May 28, 2004.
International Search Report, Application PCT/US03/15020, Jul. 30, 2003.
International Search Report, Application PCT/US03/15020, Nov. 14, 2005.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
International Search Report, Application PCT/US03/25676, May 17, 2004.
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan. 13, 2005.
International Search Report, Application PCT/US03/25742, May 27, 2004.
International Search Report, Application PCT/US03/29460, May 25, 2004.
International Search Report, Application PCT/US03/29858, Jun. 30, 2003.
International Search Report, Application PCT/US03/29859, May 21, 2004.
International Search Report, Application PCT/US03/38550, Jun. 15, 2004.
Examination Report dated Nov. 12, 2007 on Australian Patent Application No. 2002301204.
Examination Report dated Nov. 12, 2007 on Australian Patent Application No. 2002301542.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Oct. 16, 2007 on Brazilian patent application No. PI 0003319-7.
Examination Report dated Nov. 13, 2007 on Canadian Patent Application No. 2397480.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Oct. 11, 2007 on European Patent Application No. 2806451.7.
Examination Report dated Jul. 4, 2007 on European Patent Application No. 3728326.4.
Examination Report dated Apr. 2, 2007 on European Patent Application No. 3701281.2.
Examination Report dated Jan. 10, 2007 on European Patent Application No. 3723674.2.
Examination Report dated Sep. 14, 2007 on German Patent Application No. 199 58 399.4-24.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated Aug. 7, 2007 on British Patent application No. 613924.0.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Oct. 26, 2007 on British patent application No. 624328.1.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.

Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.

* cited by examiner

*Fig. 11A1*
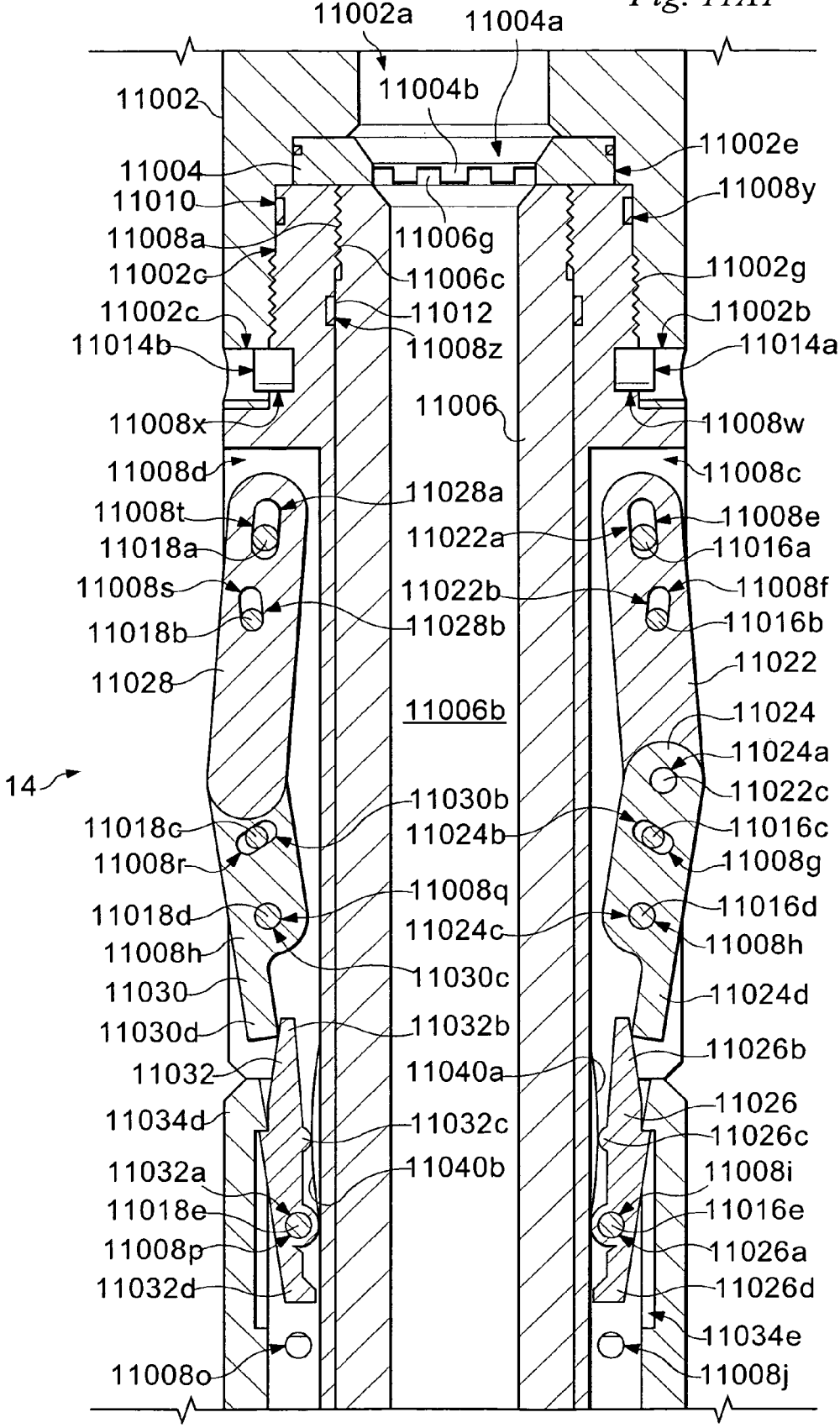

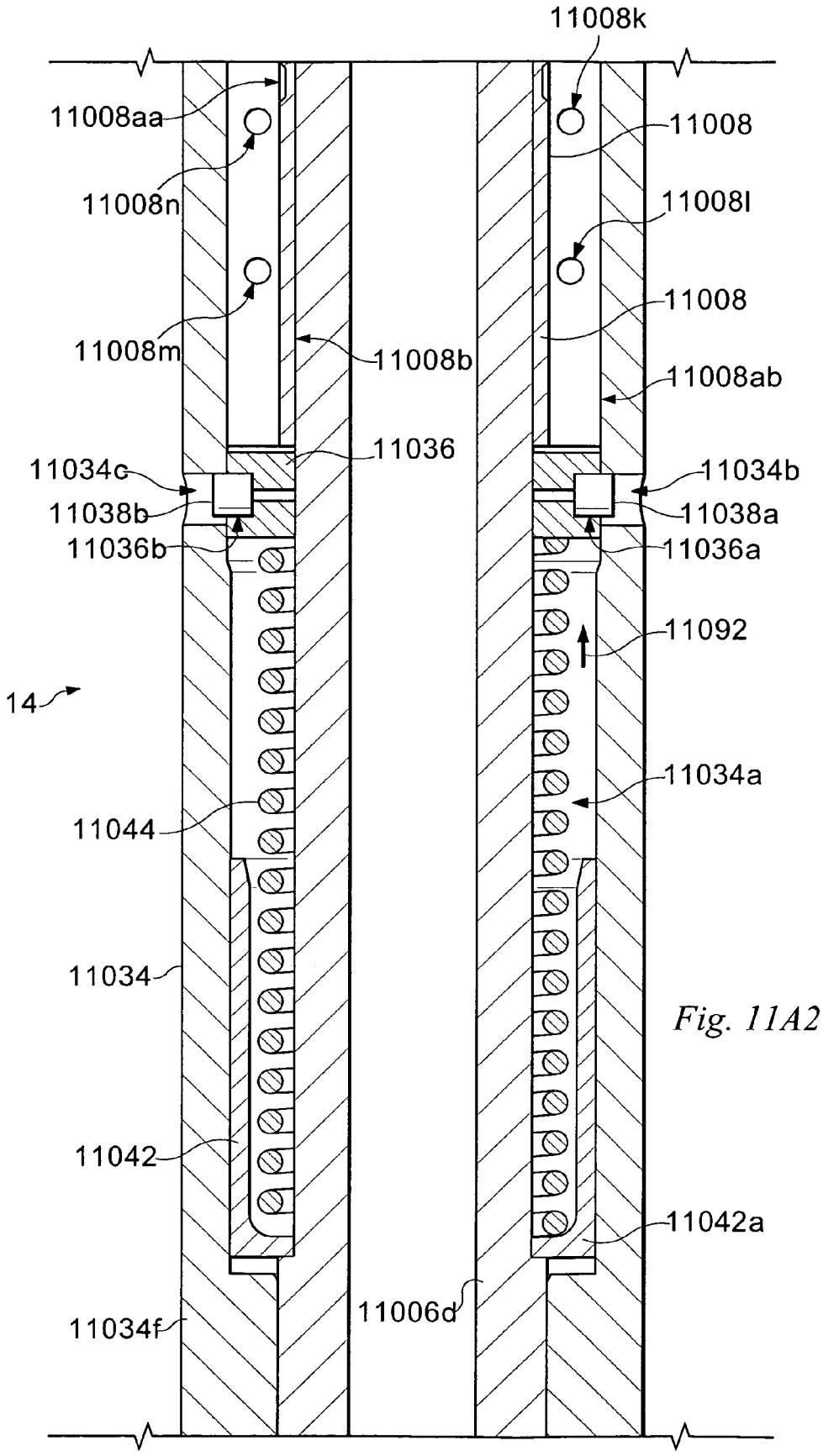
*Fig. 11A2*

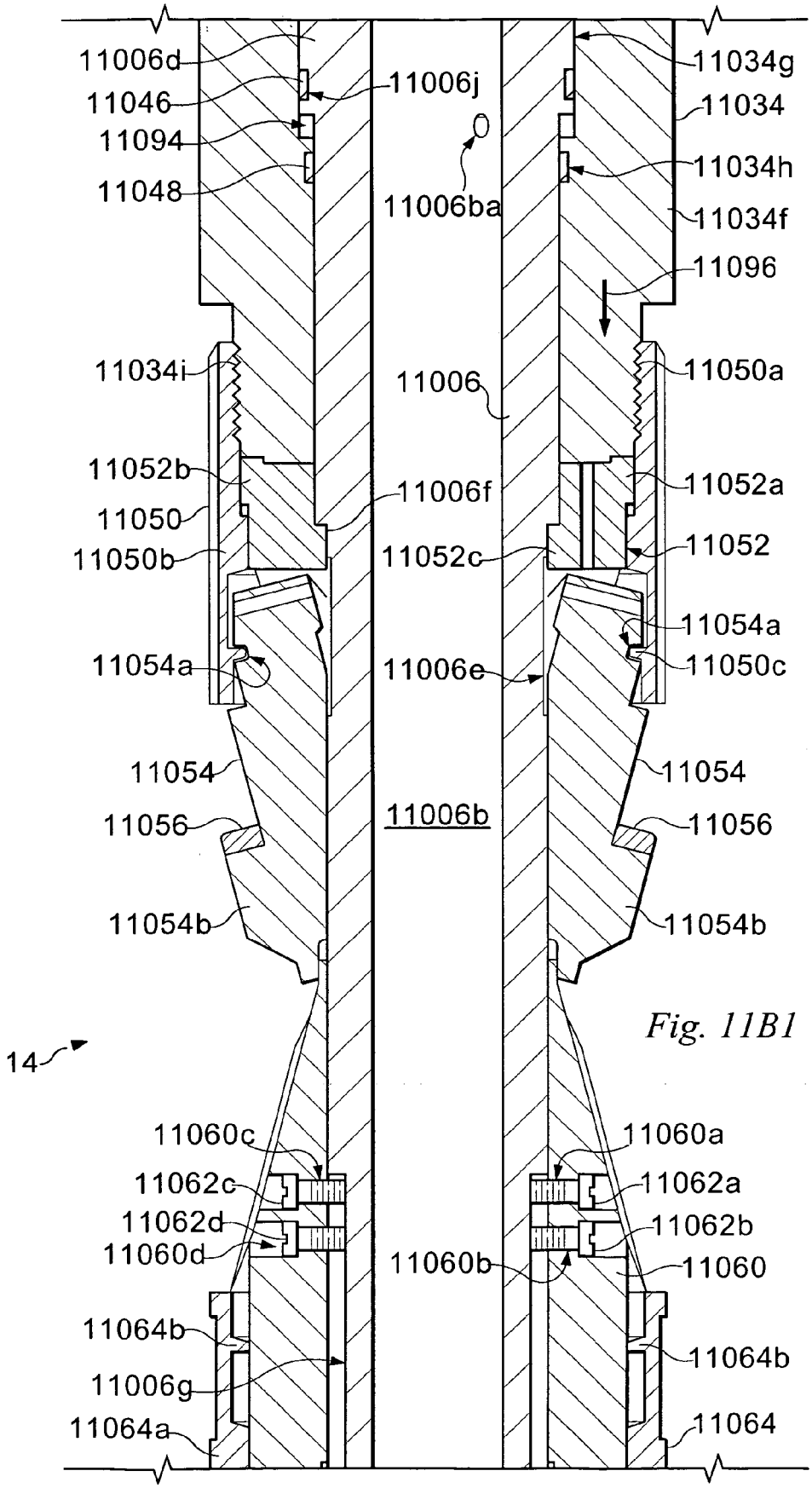
Fig. 11B1

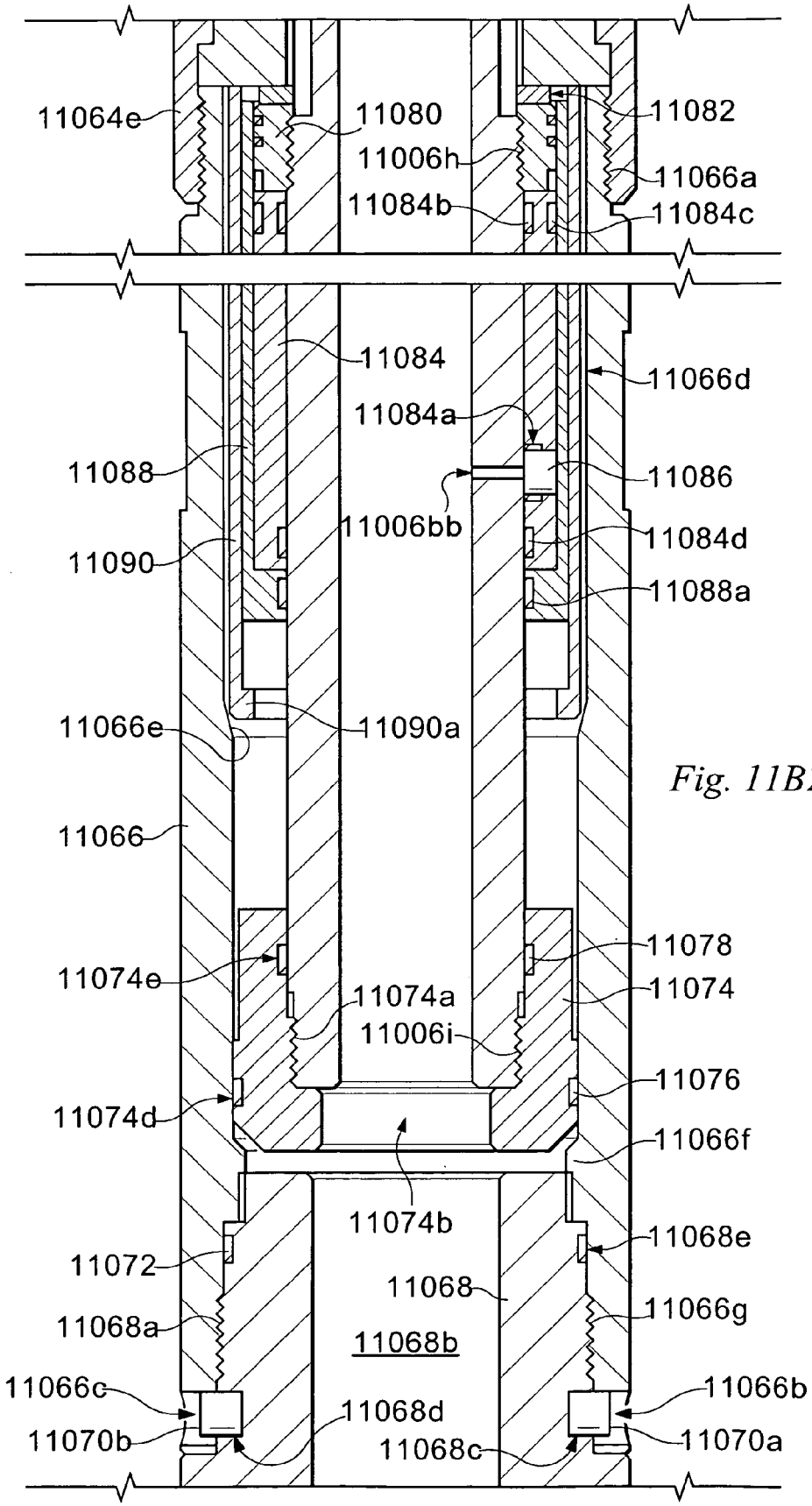
*Fig. 11B2*

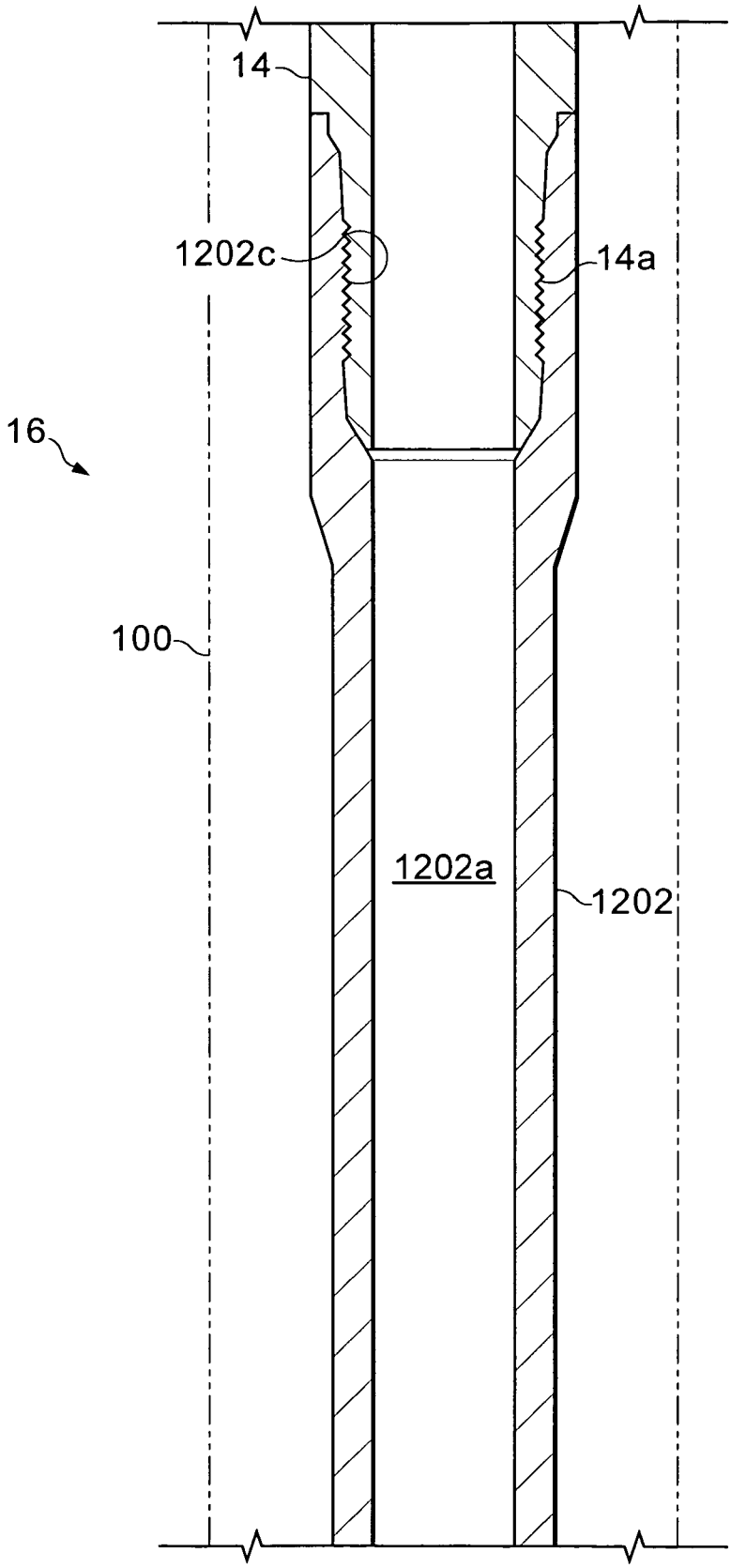
*Fig. 12A1*

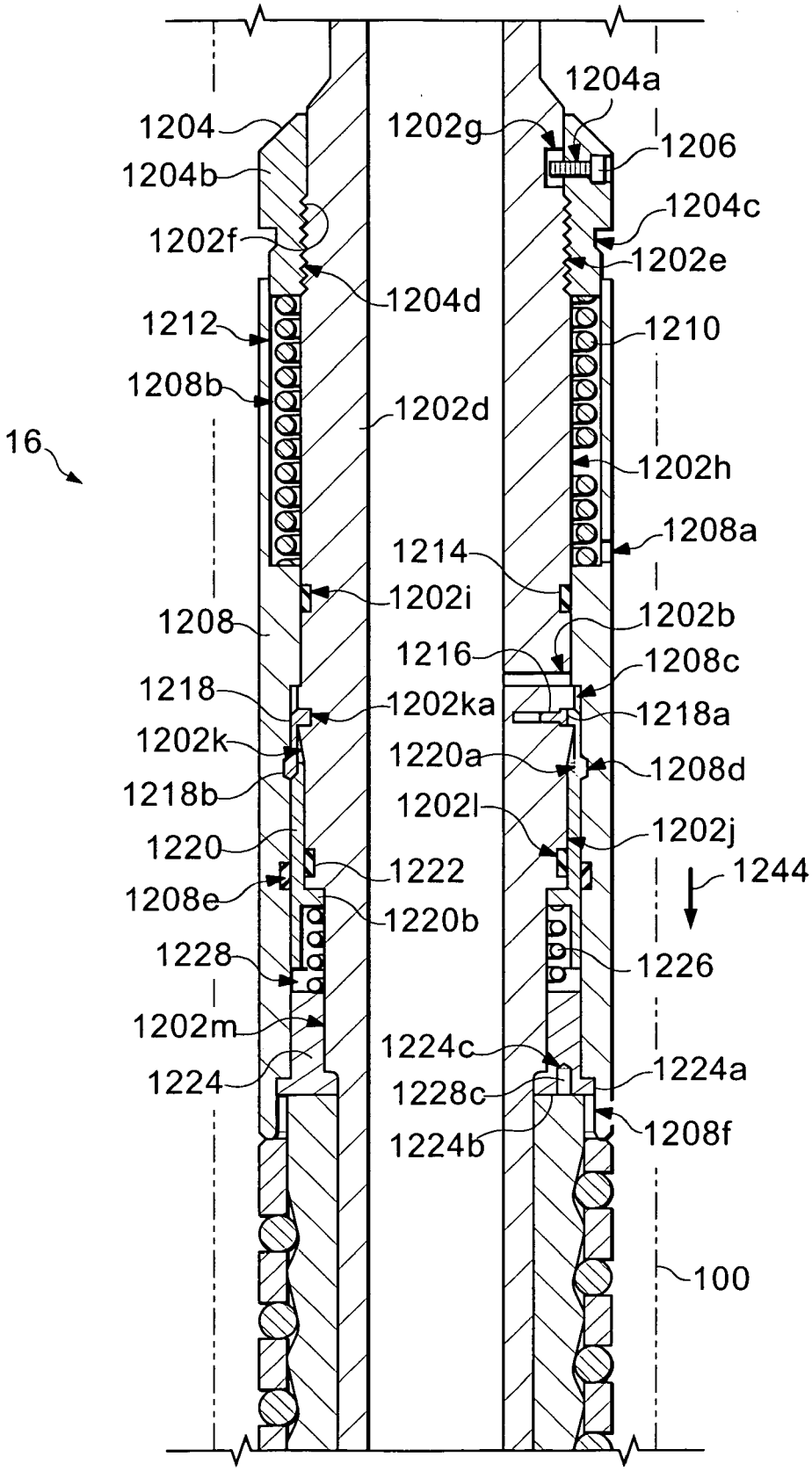
*Fig. 12A2*

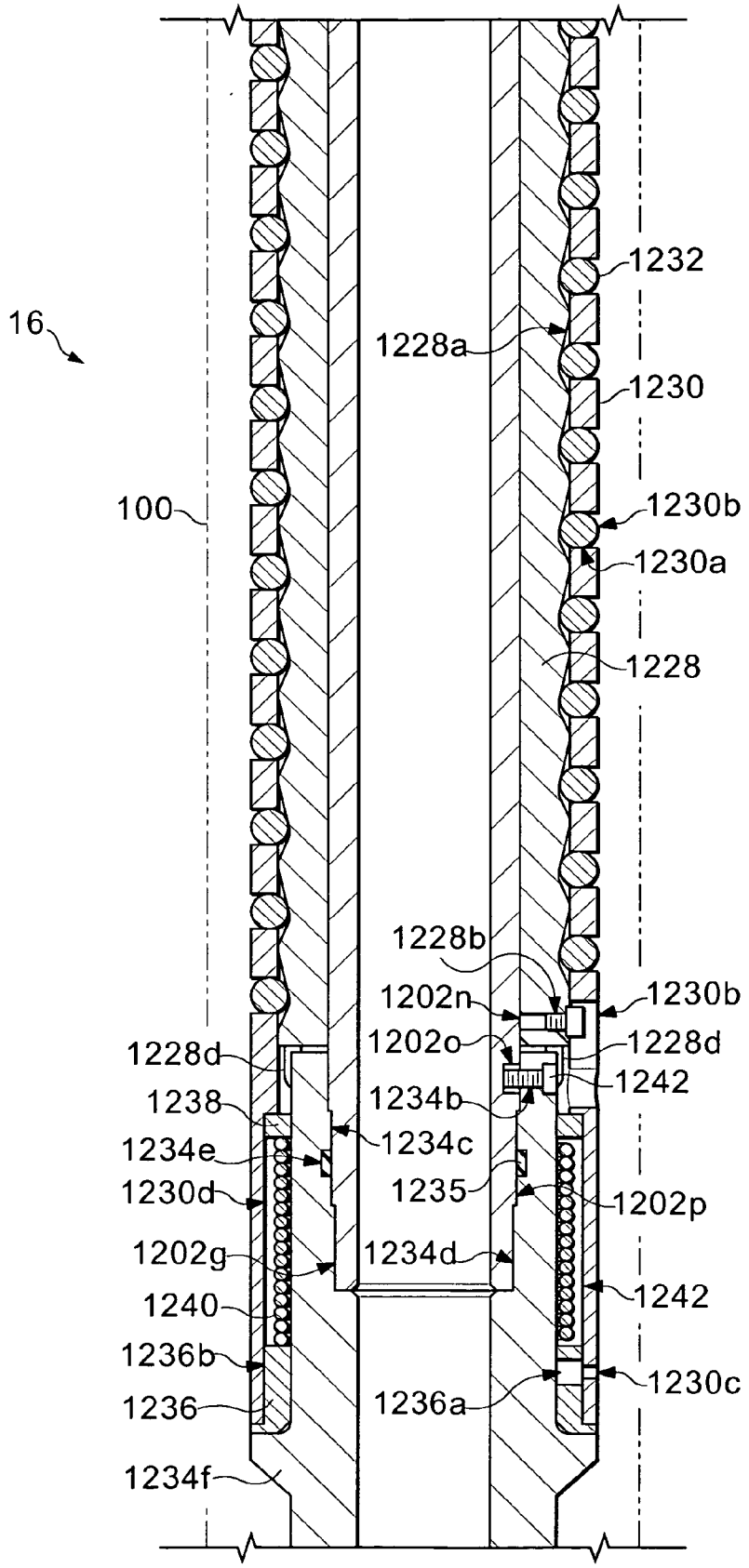
*Fig. 12A3*

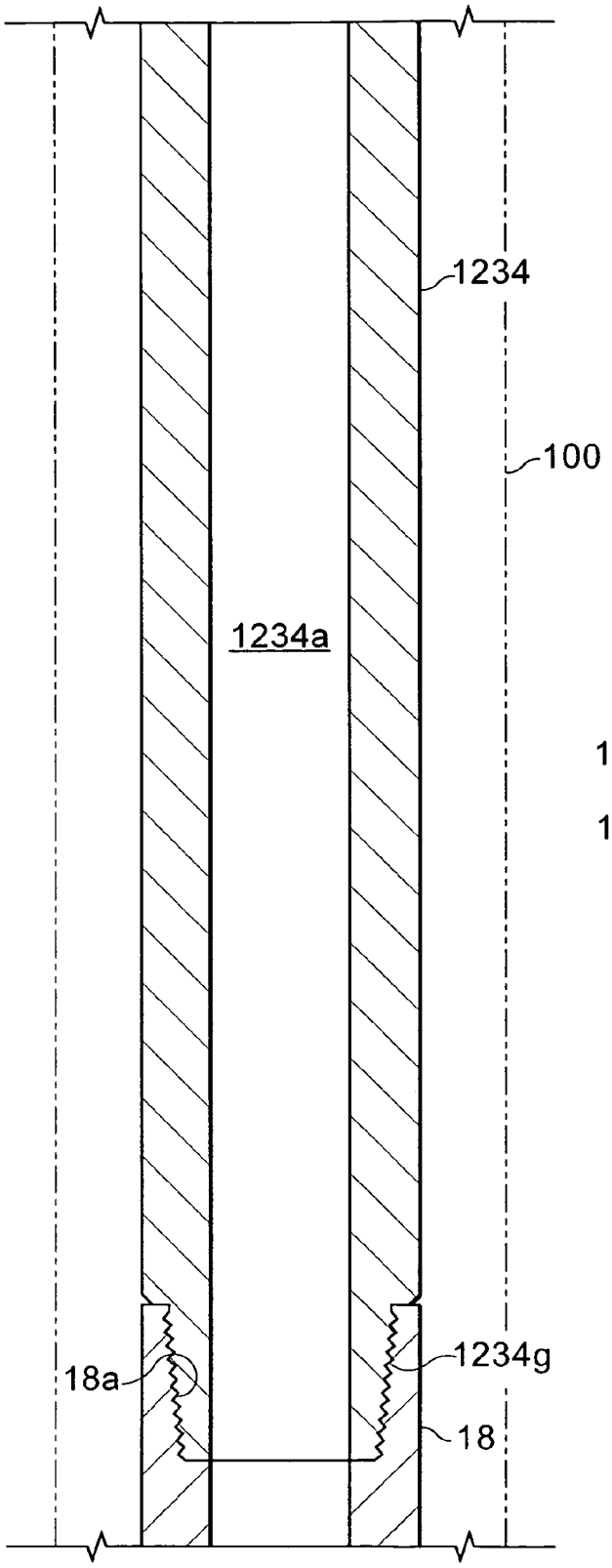
Fig. 12A4
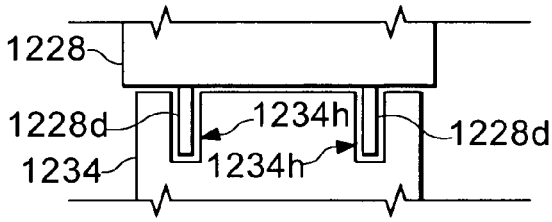
Fig. 12B

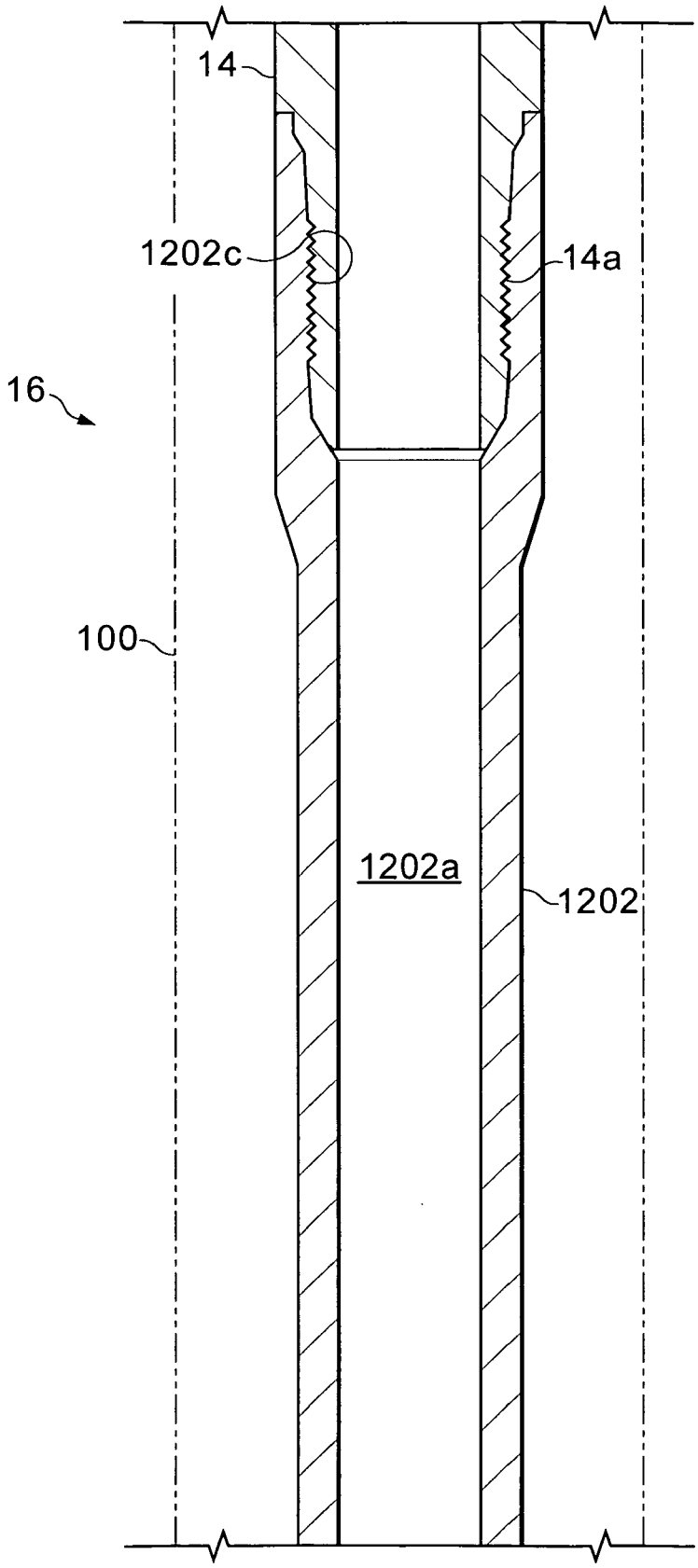
*Fig. 12C1*

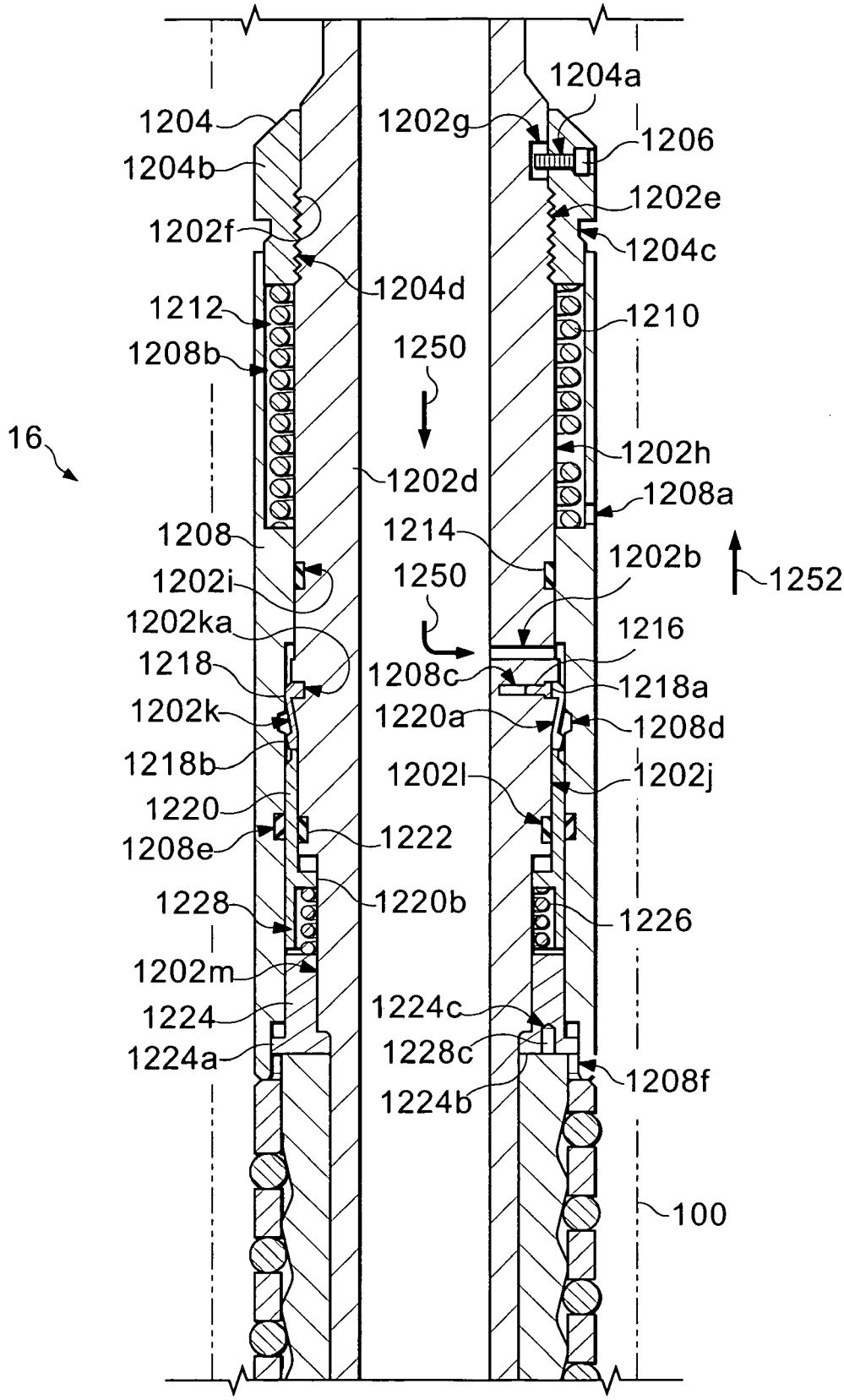
*Fig. 12C2*

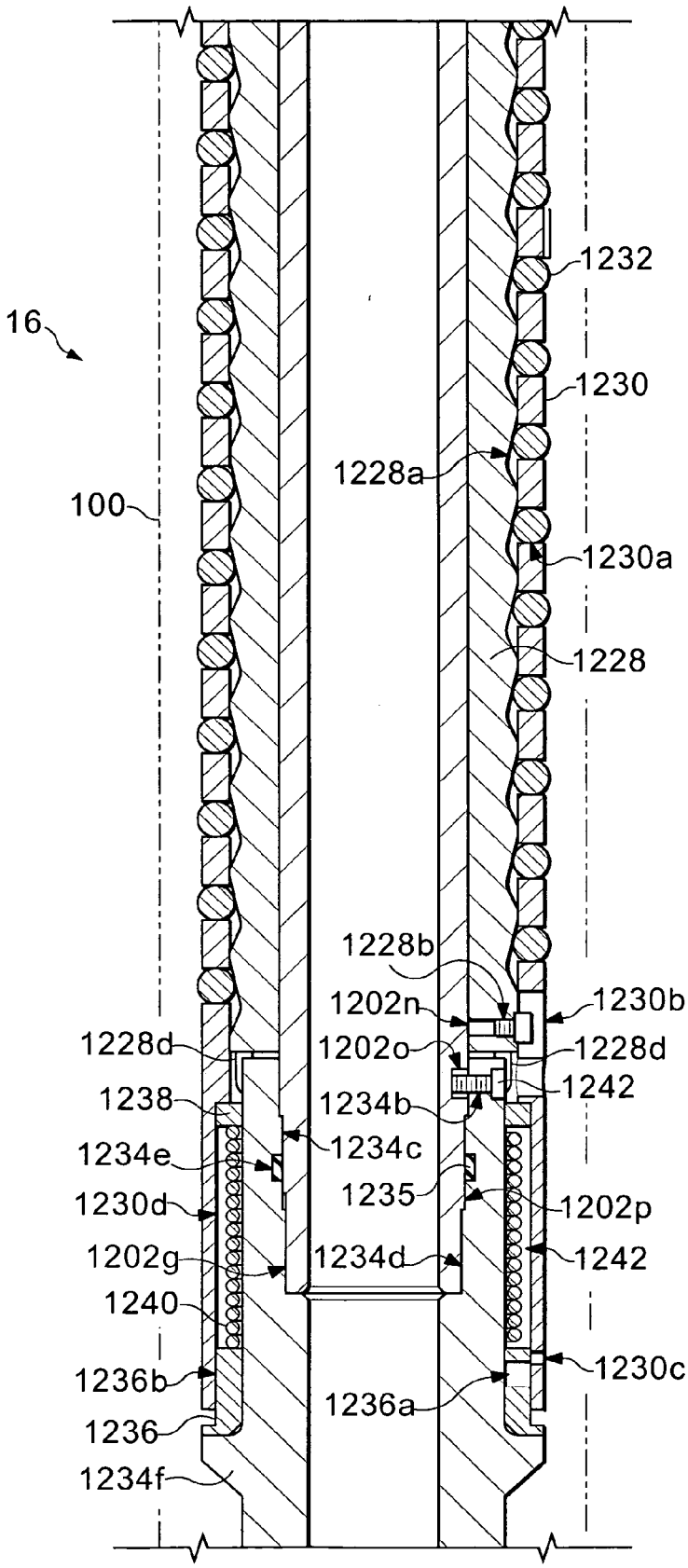
*Fig. 12C3*

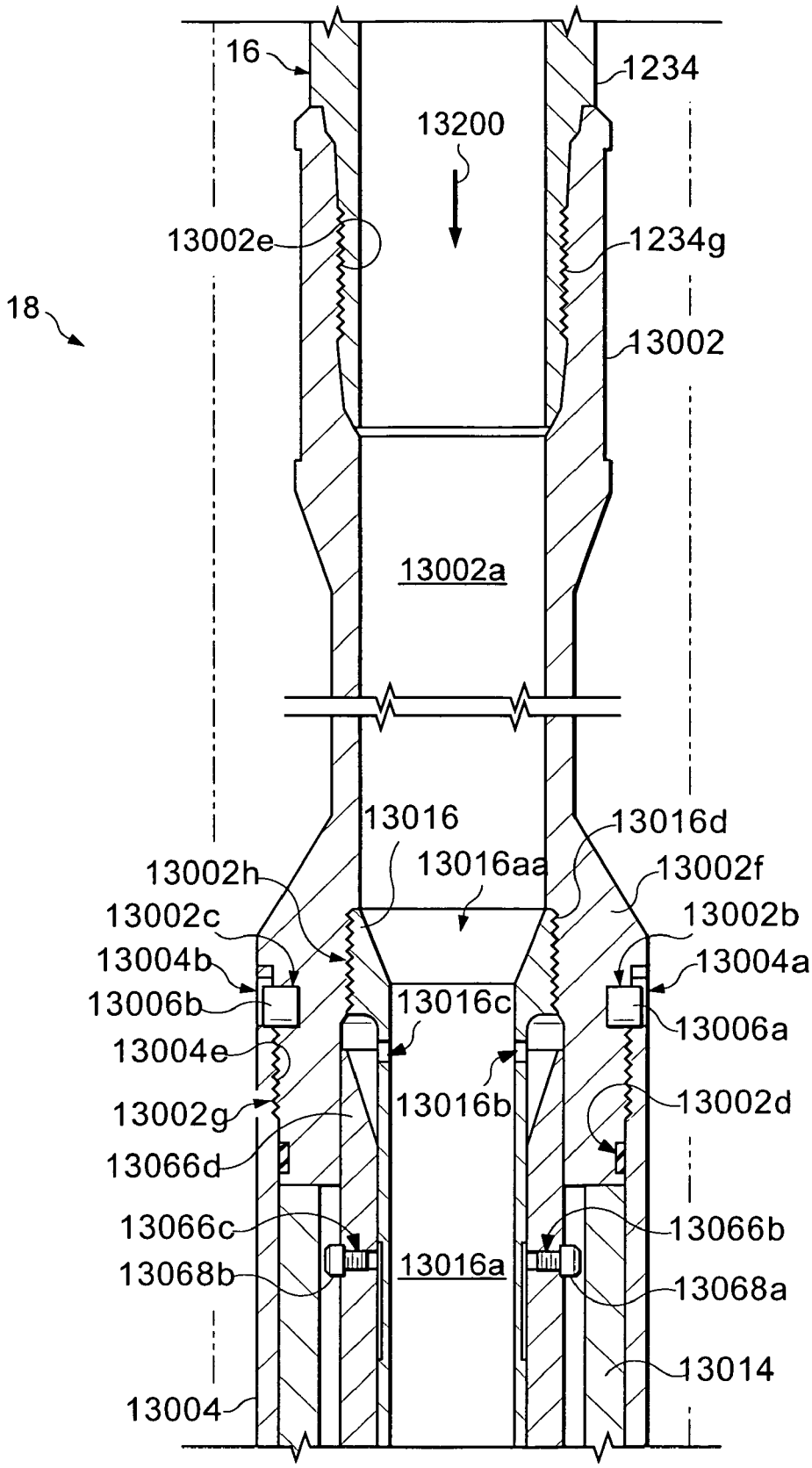
*Fig. 13B1*

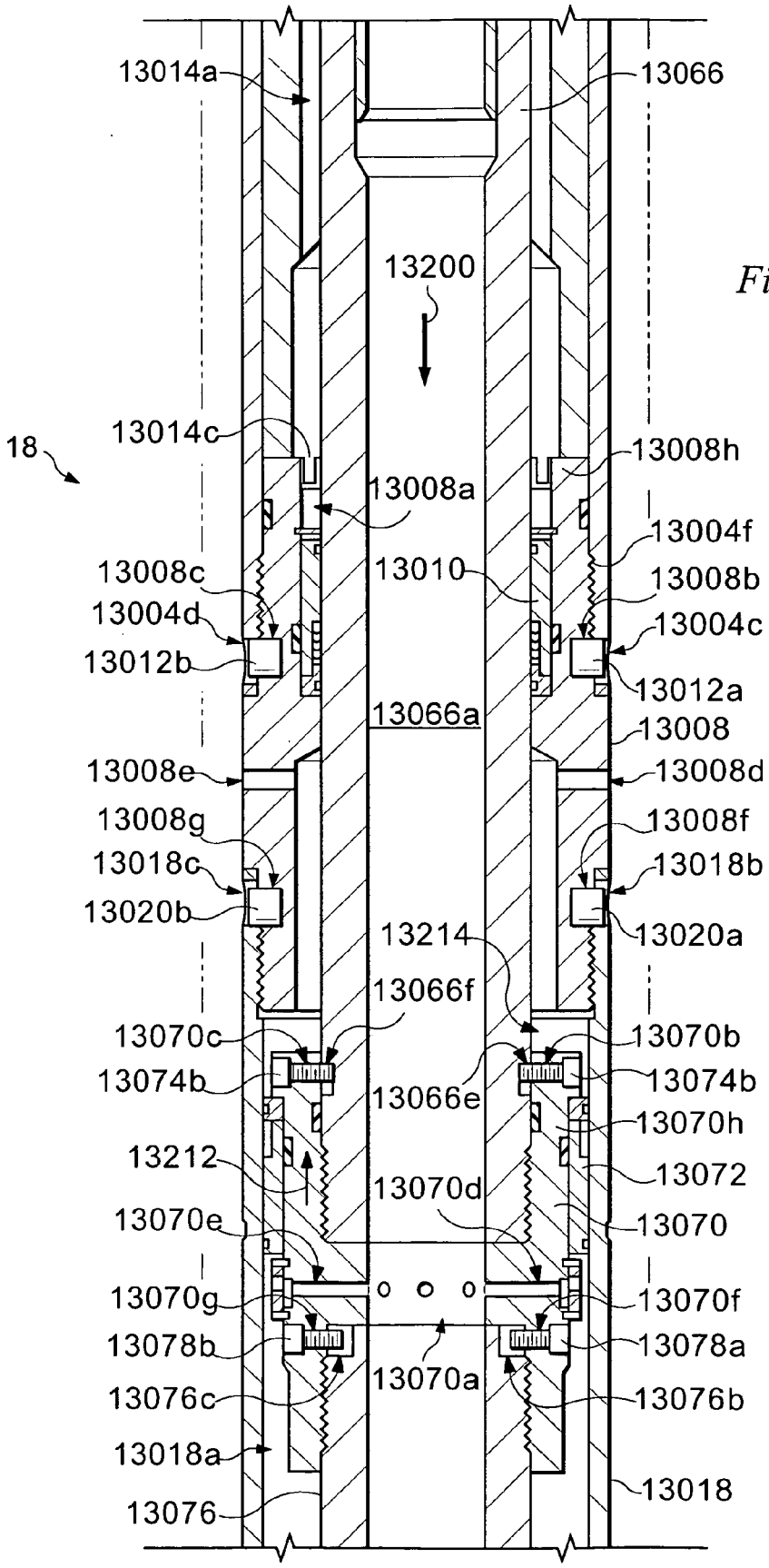
*Fig. 13B2*

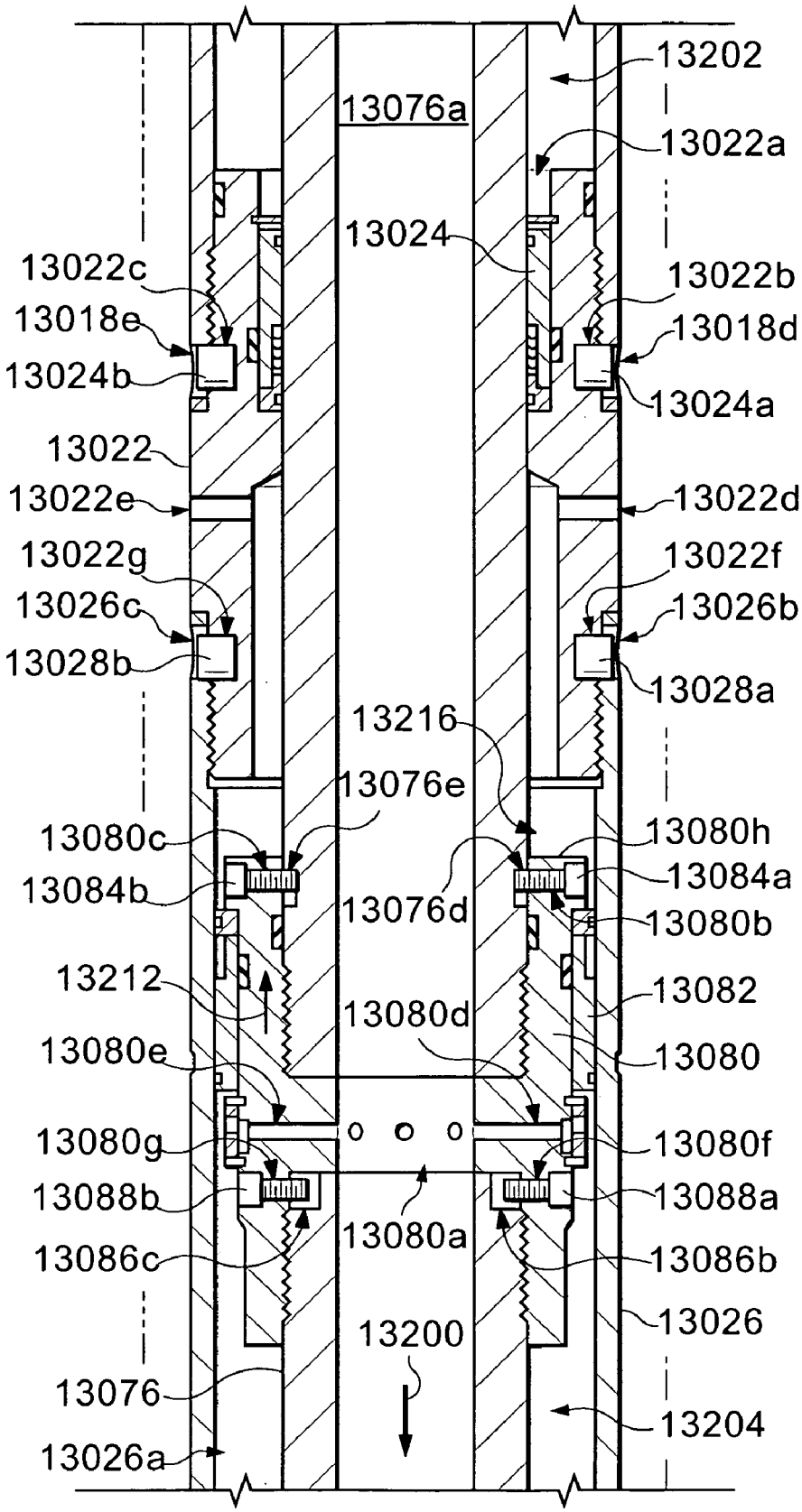
*Fig. 13B3*

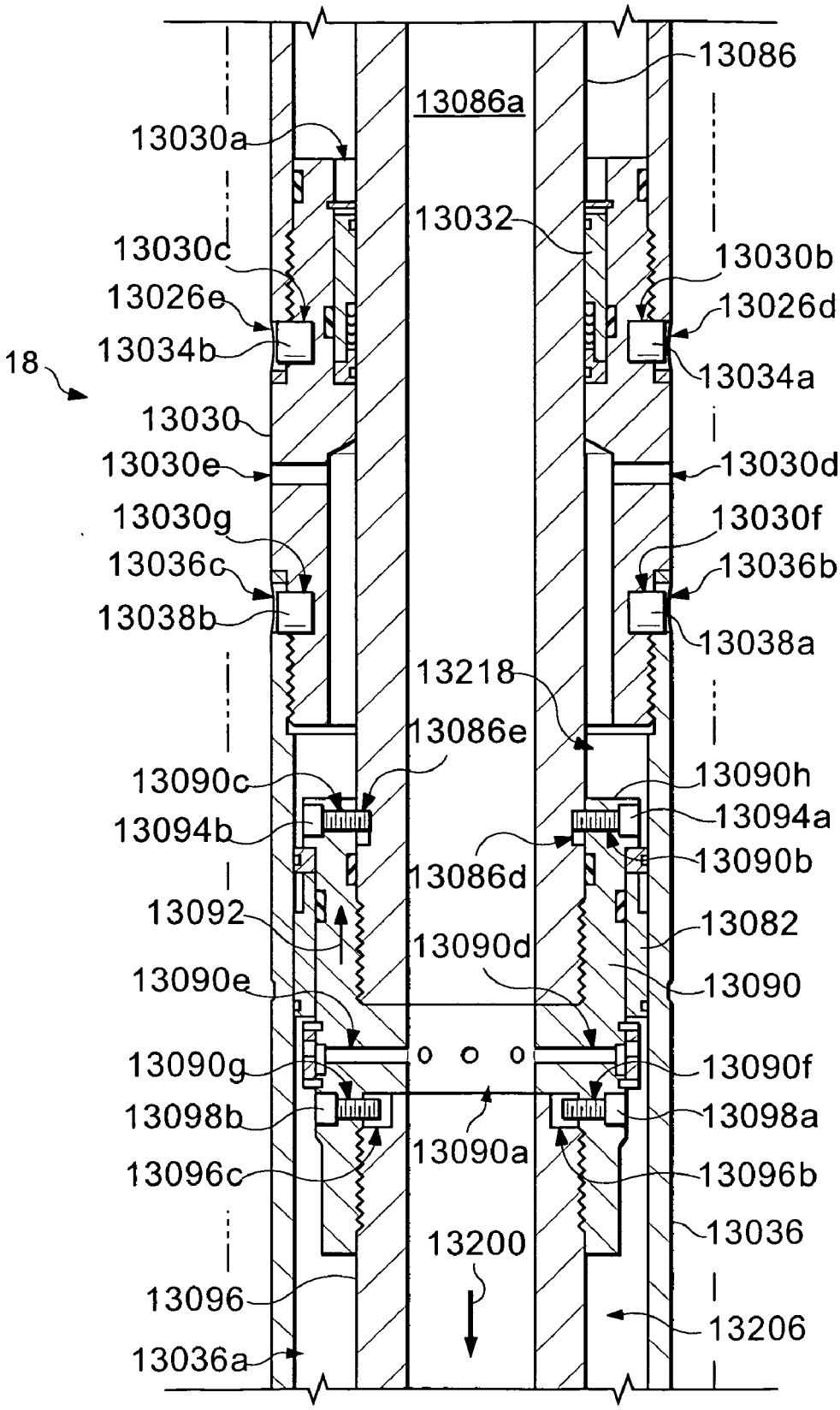
*Fig. 13B4*

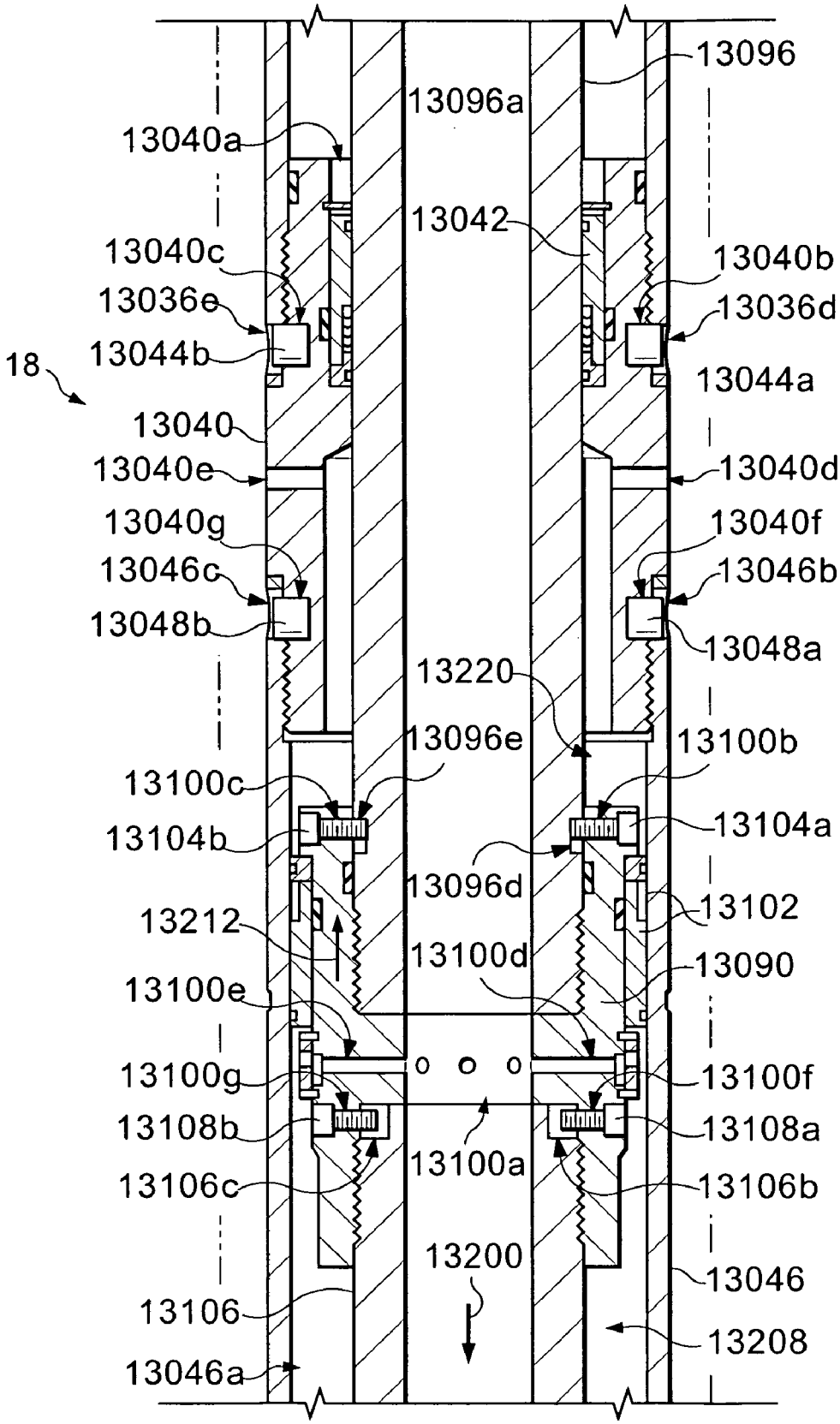
*Fig. 13B5*

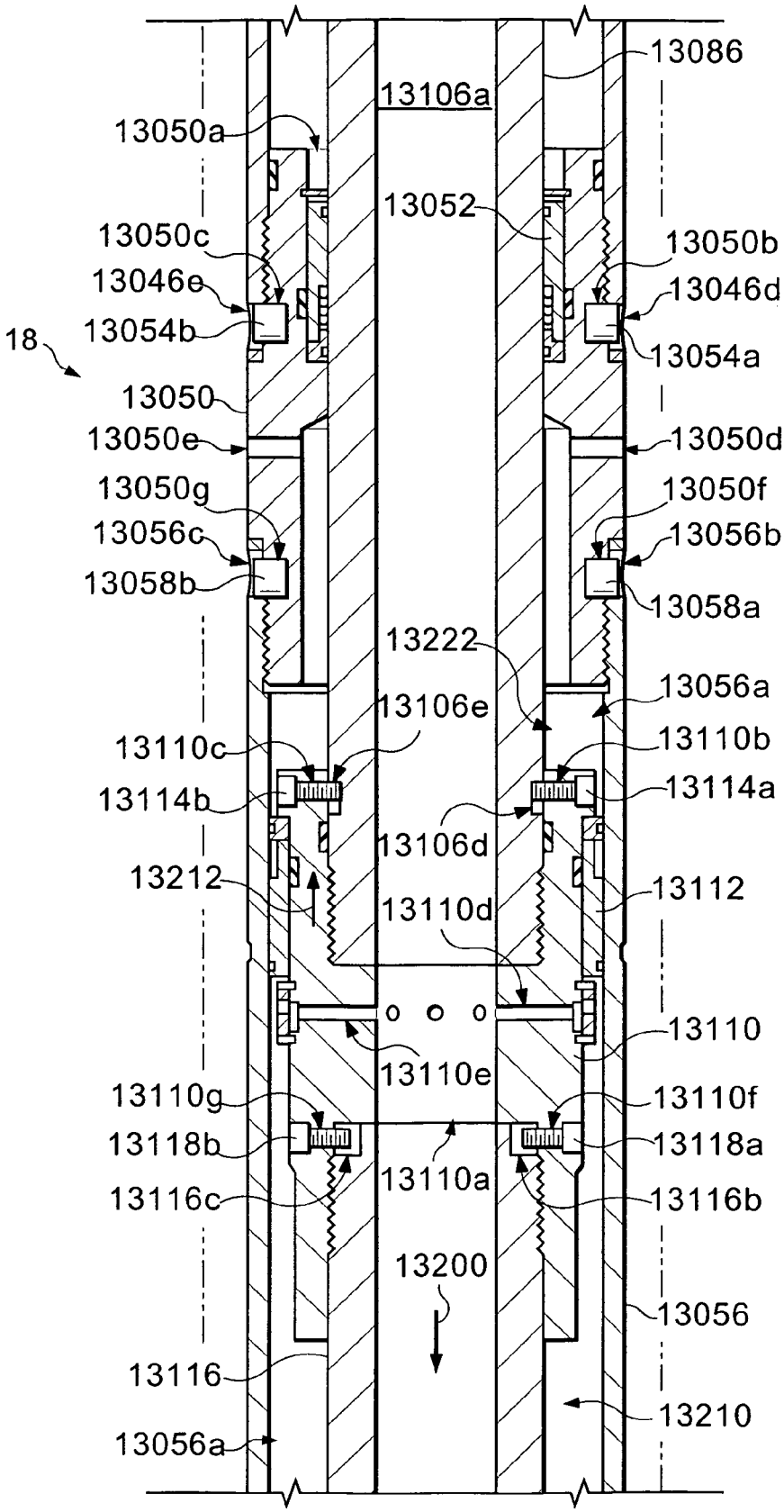
*Fig. 13B6*

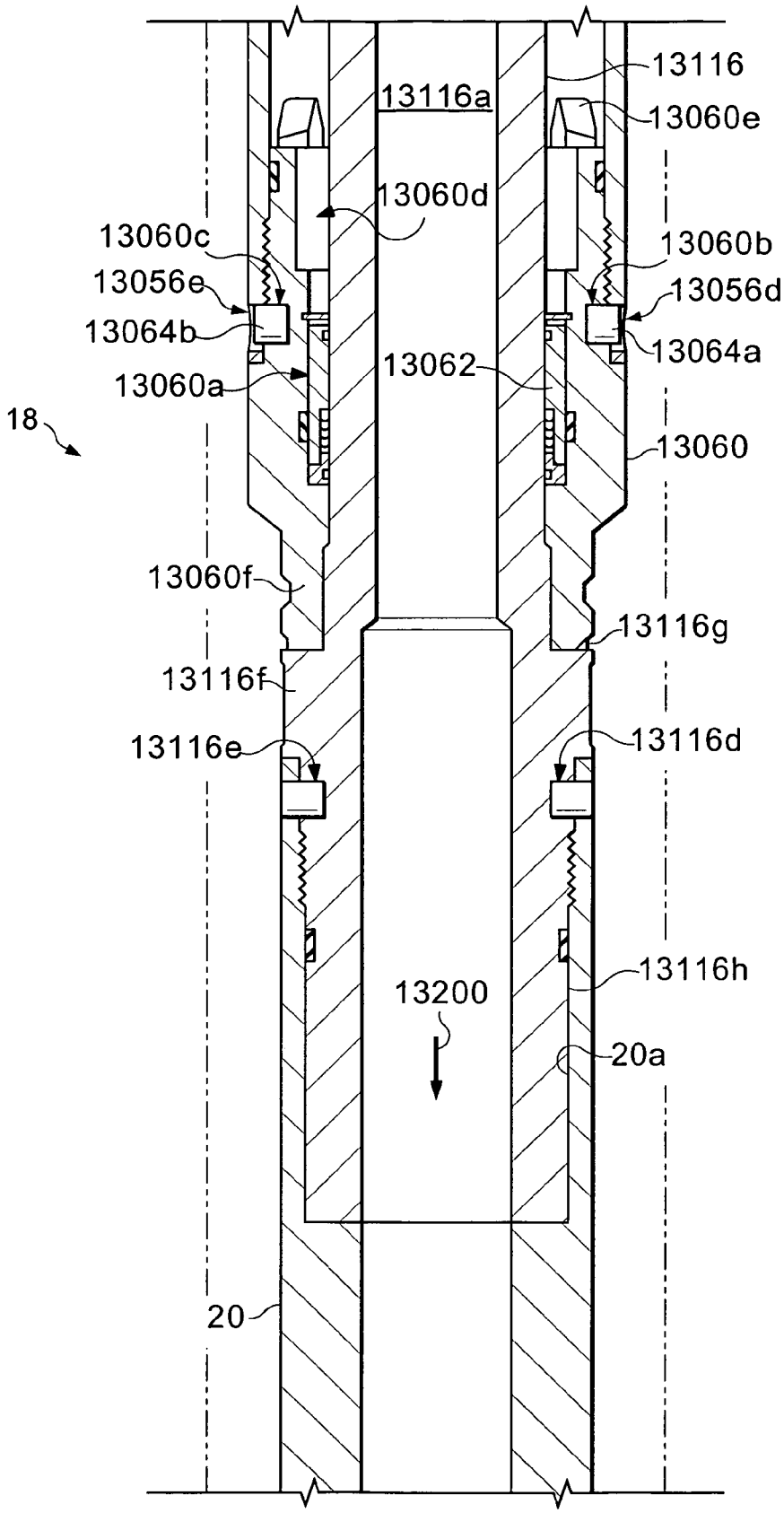
*Fig. 13B7*

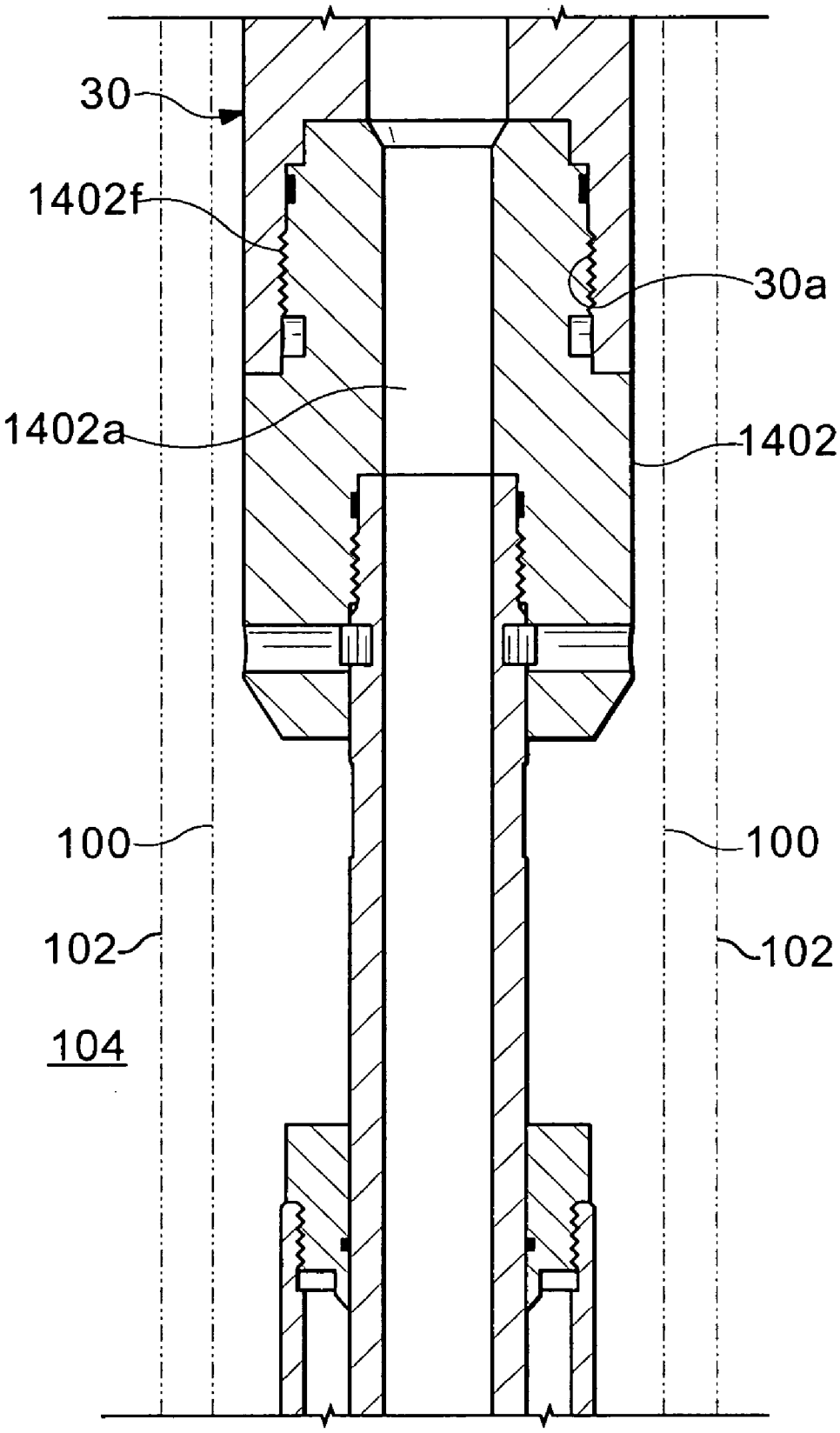
*Fig. 16A1*

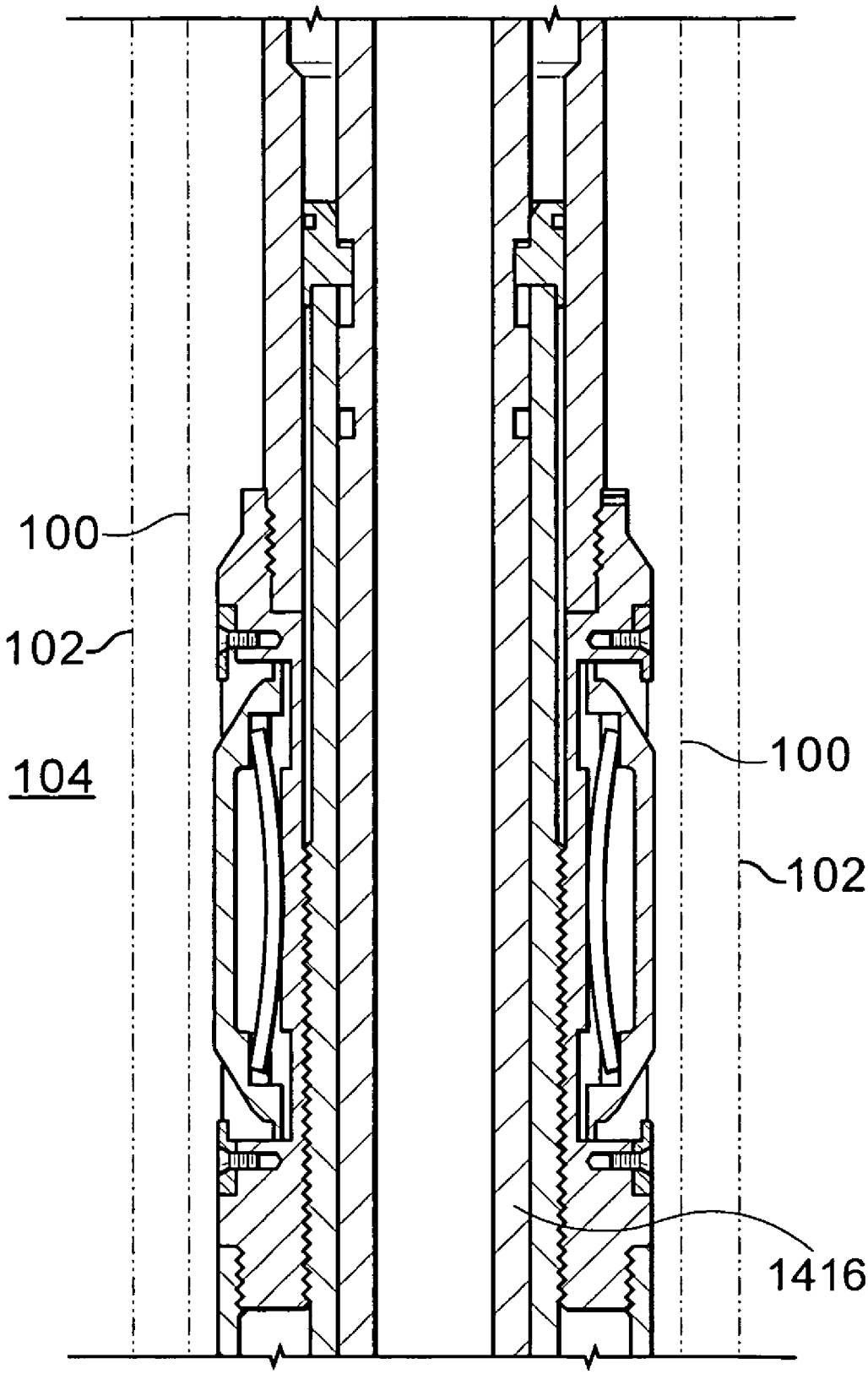
*Fig. 16A2*

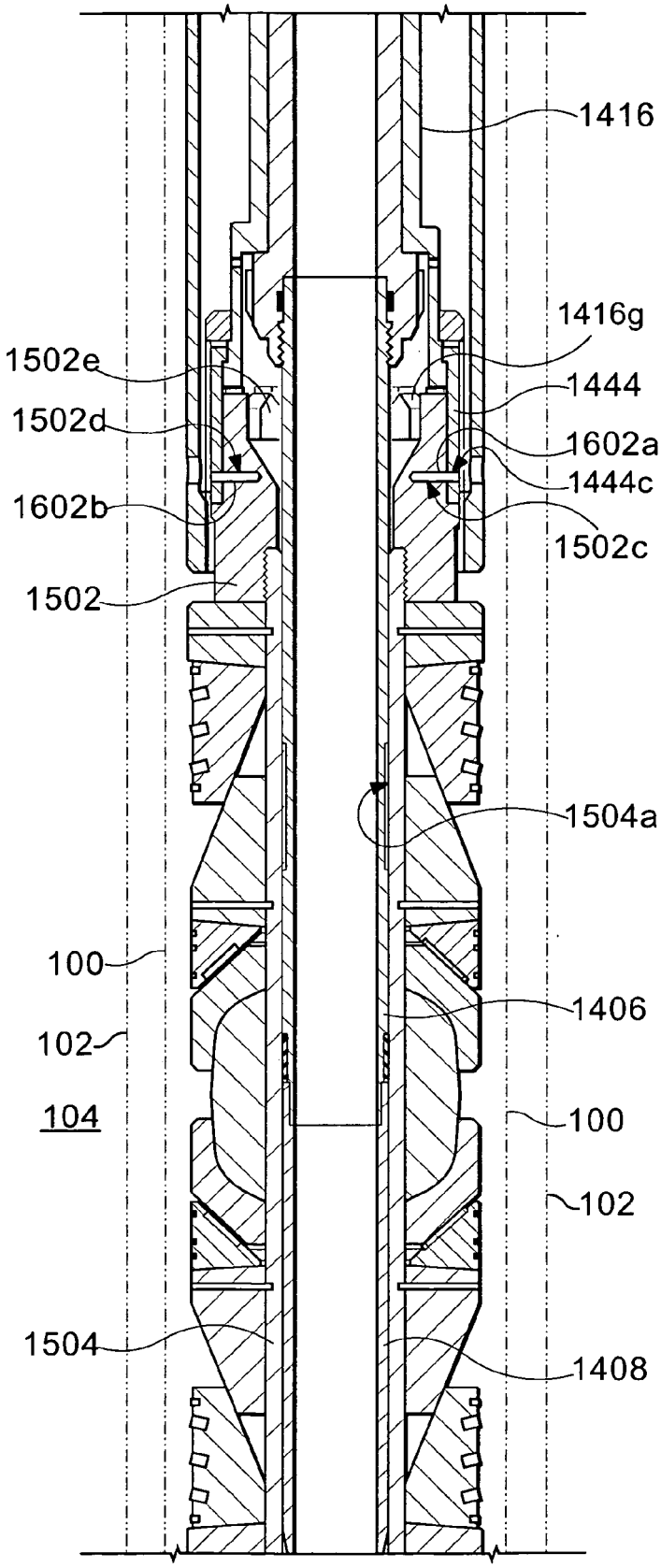
*Fig. 16A3*

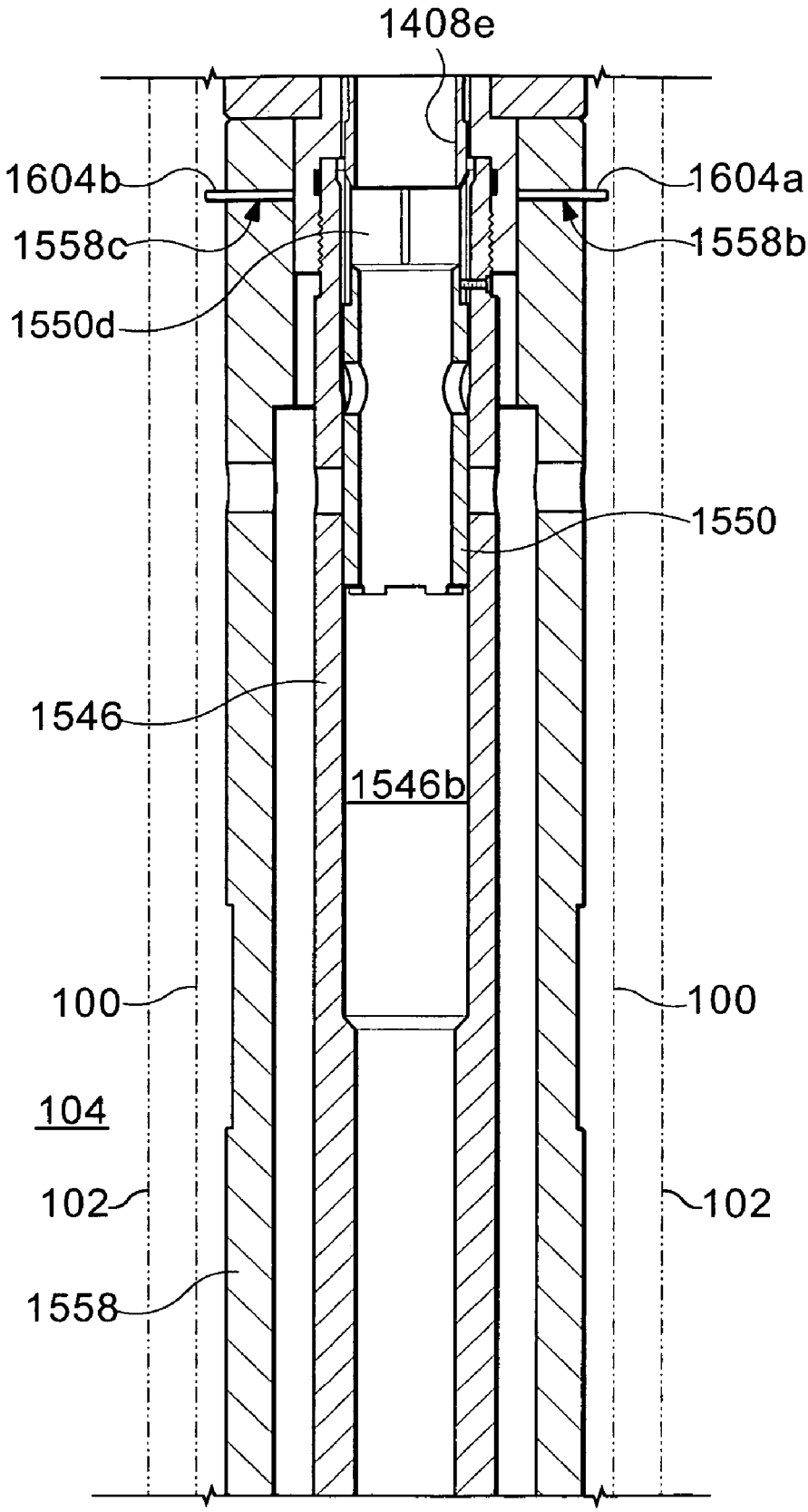
*Fig. 16A4*

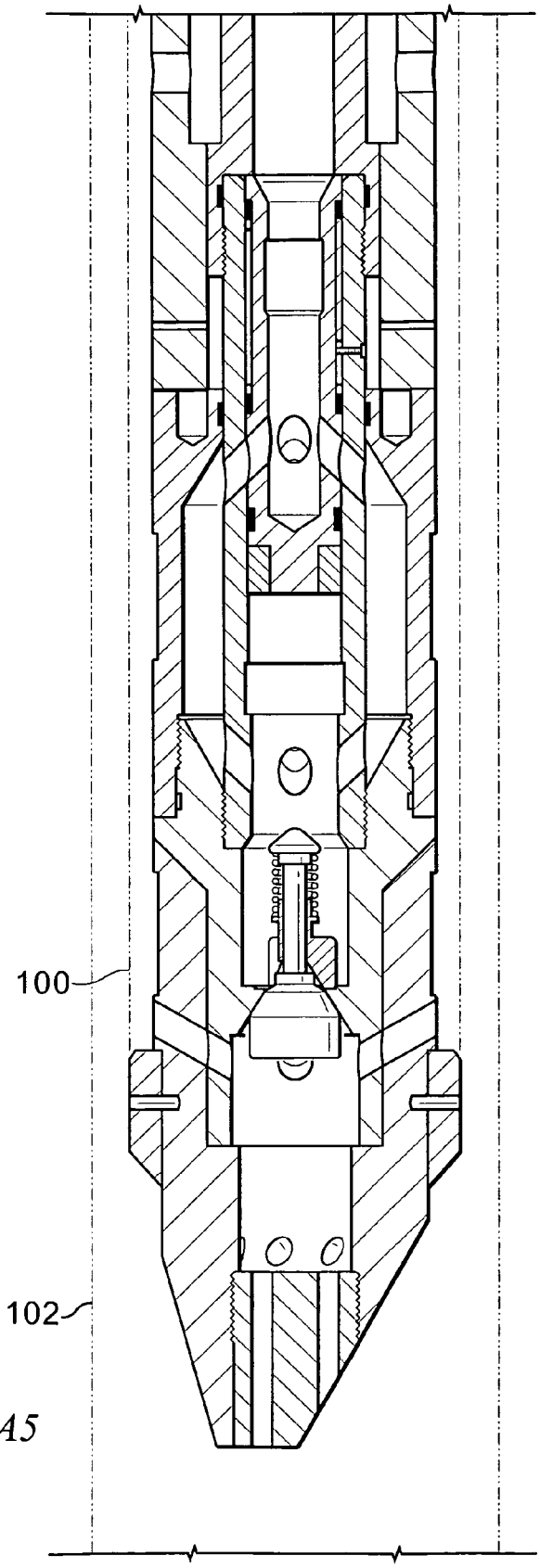
*Fig. 16A5*

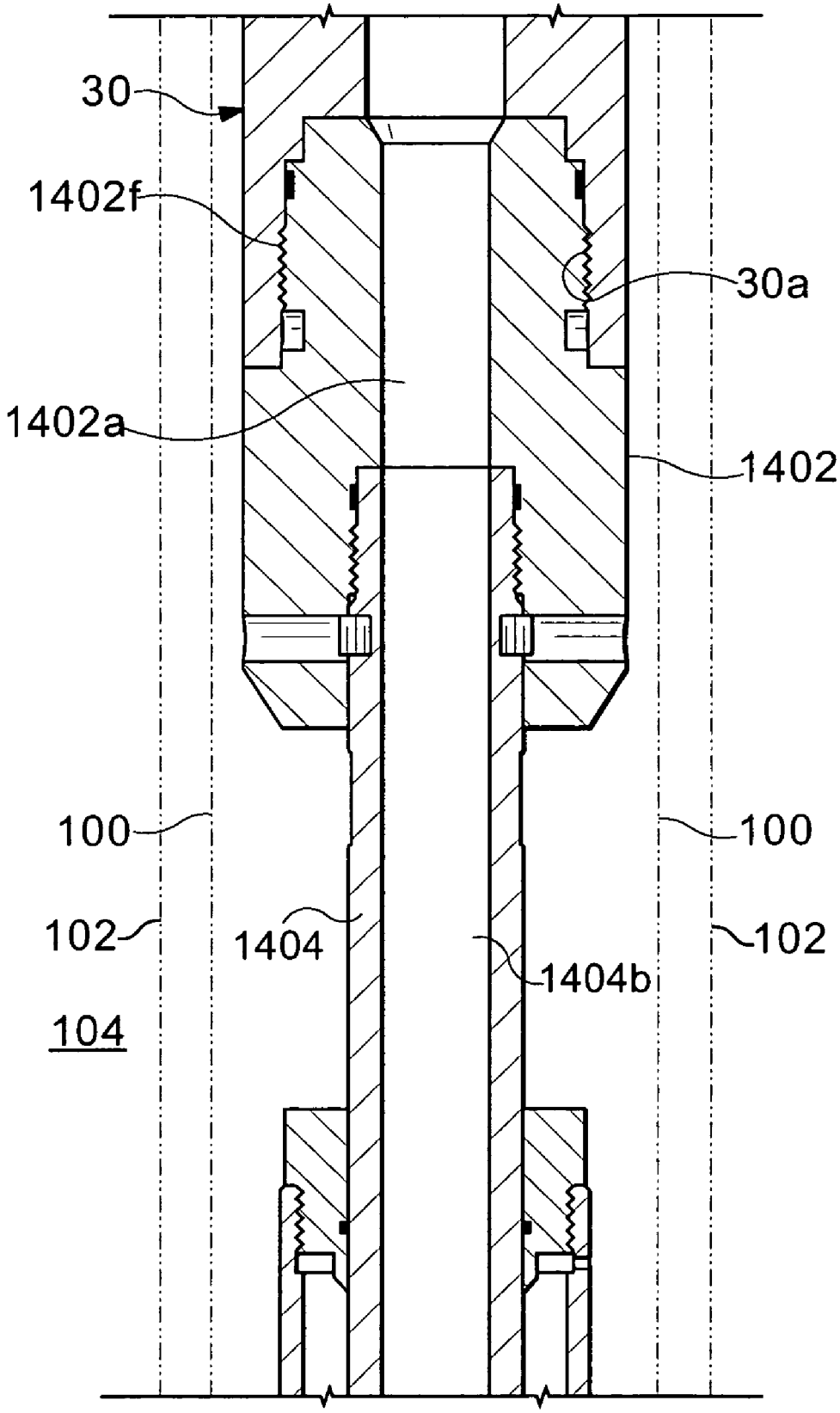
*Fig. 16B1*

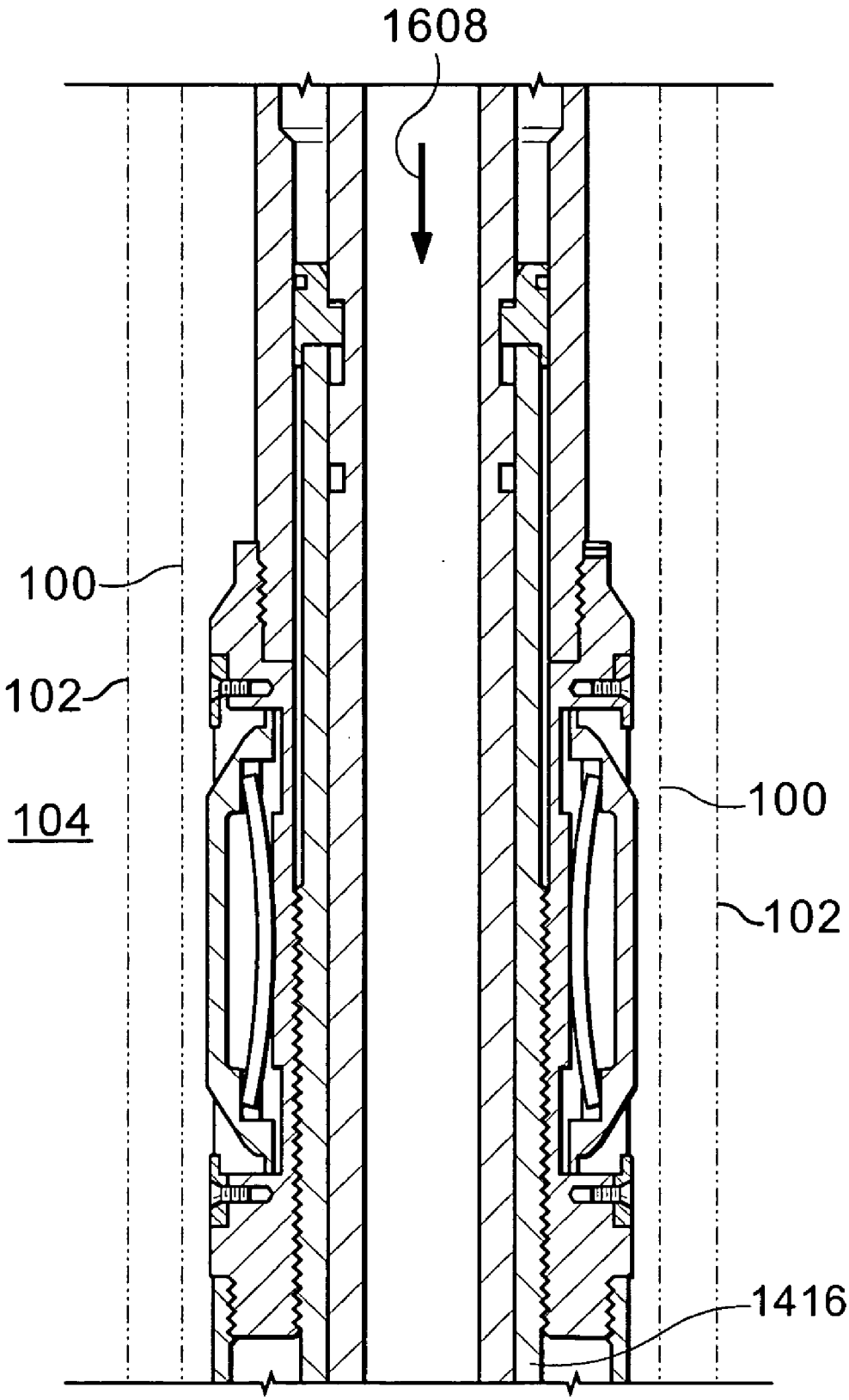
*Fig. 16B2*

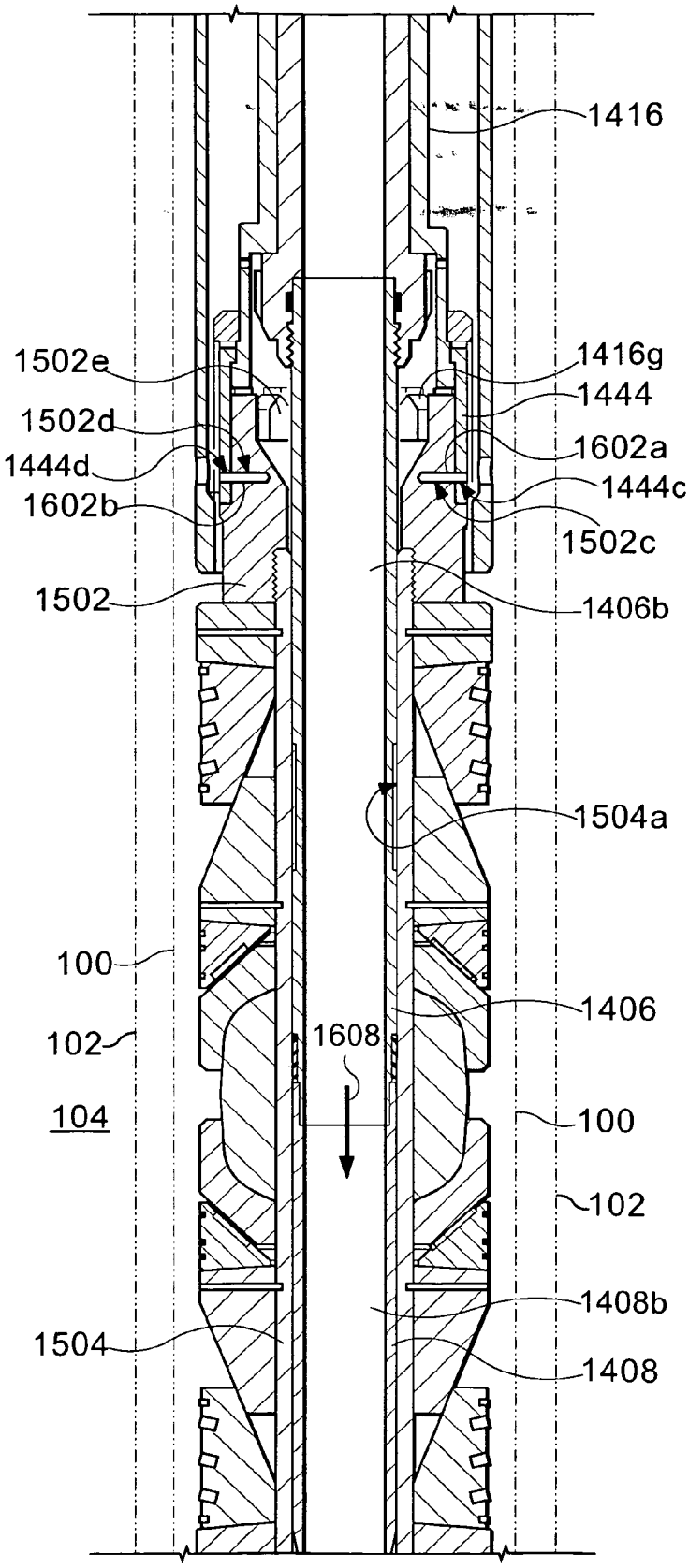
*Fig. 16B3*

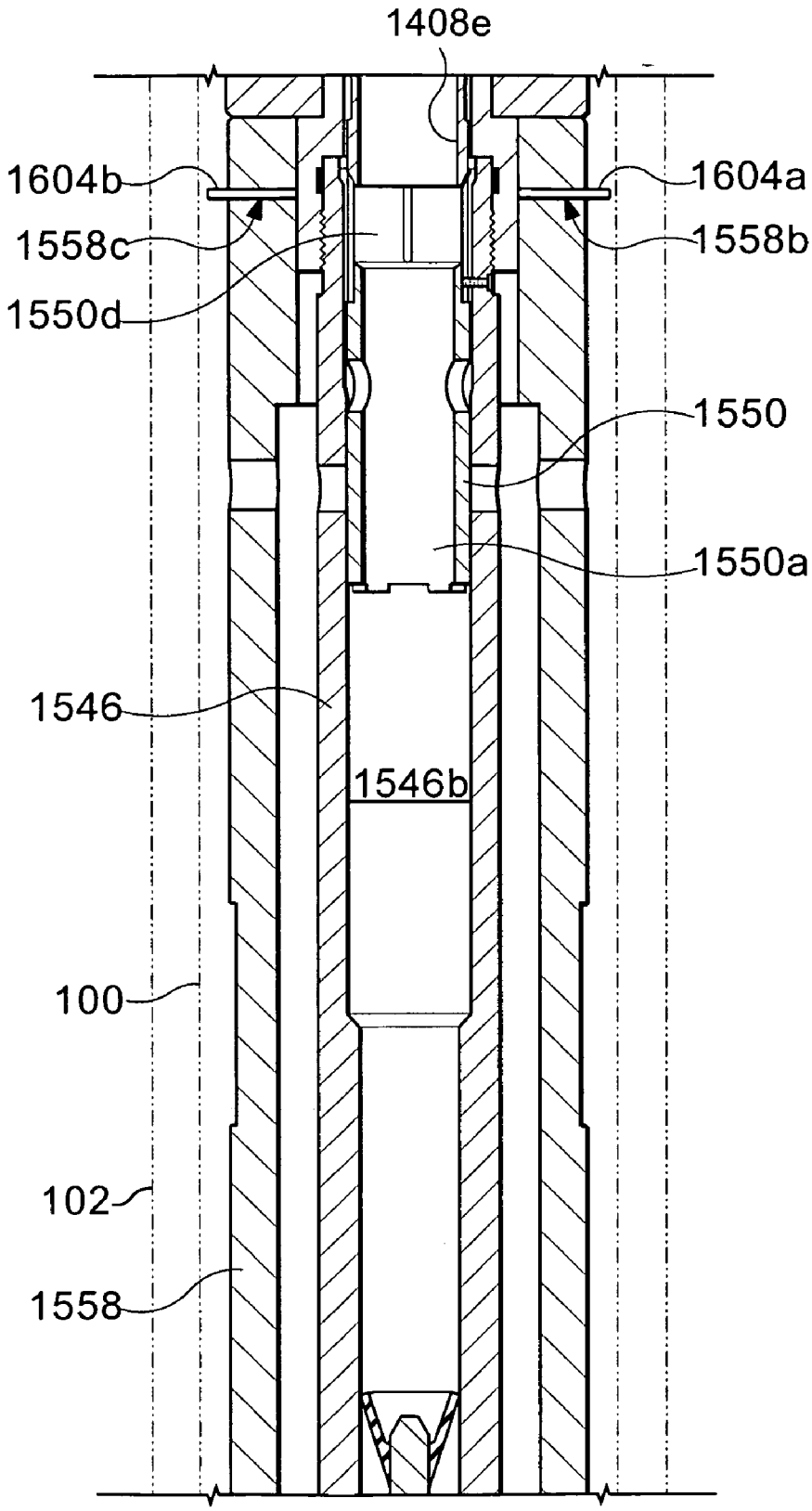
*Fig. 16B4*

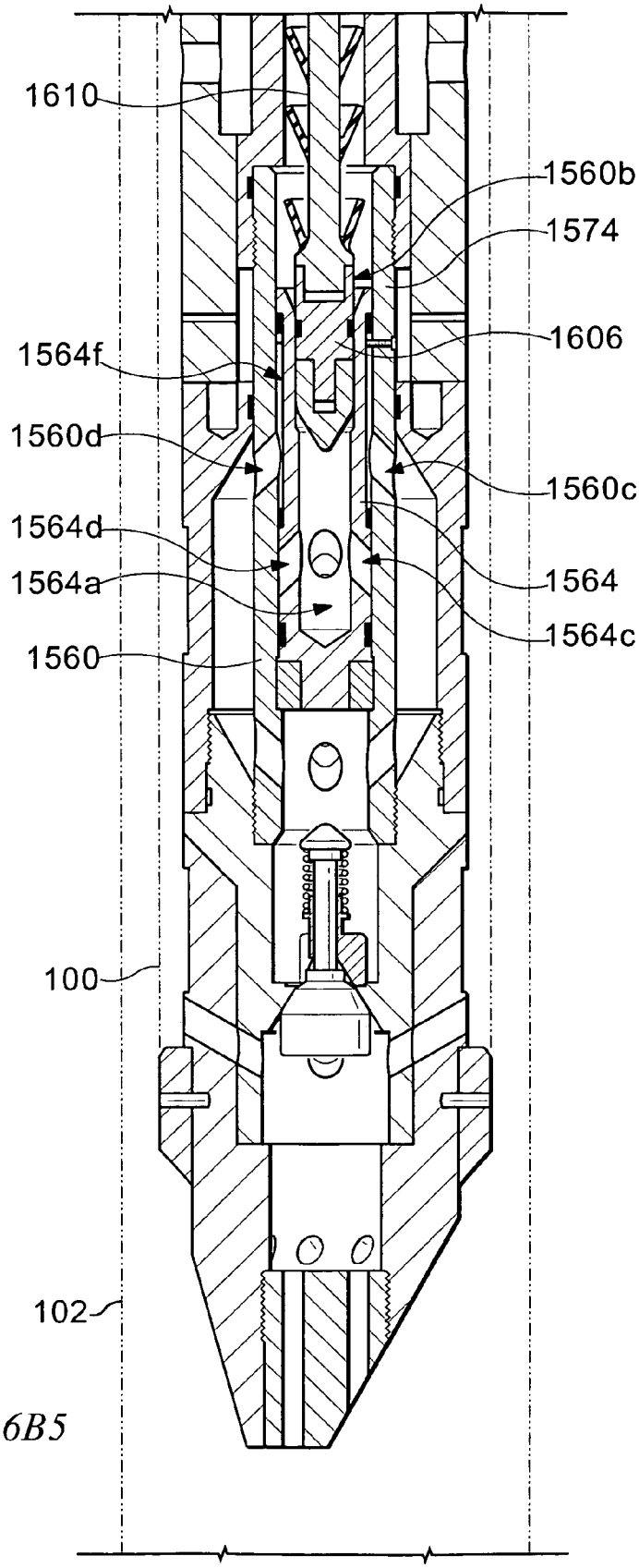
*Fig. 16B5*

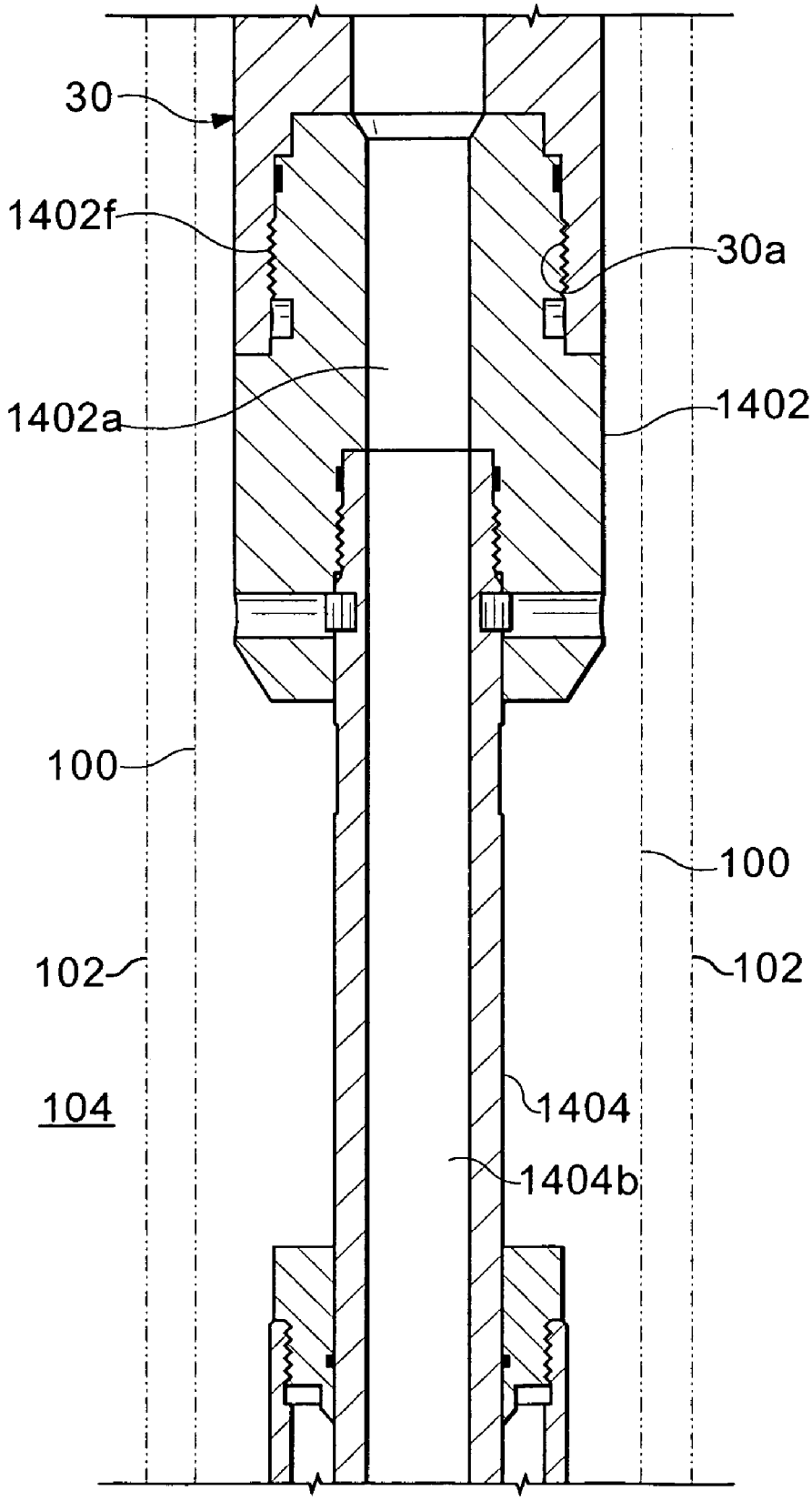
*Fig. 16C1*

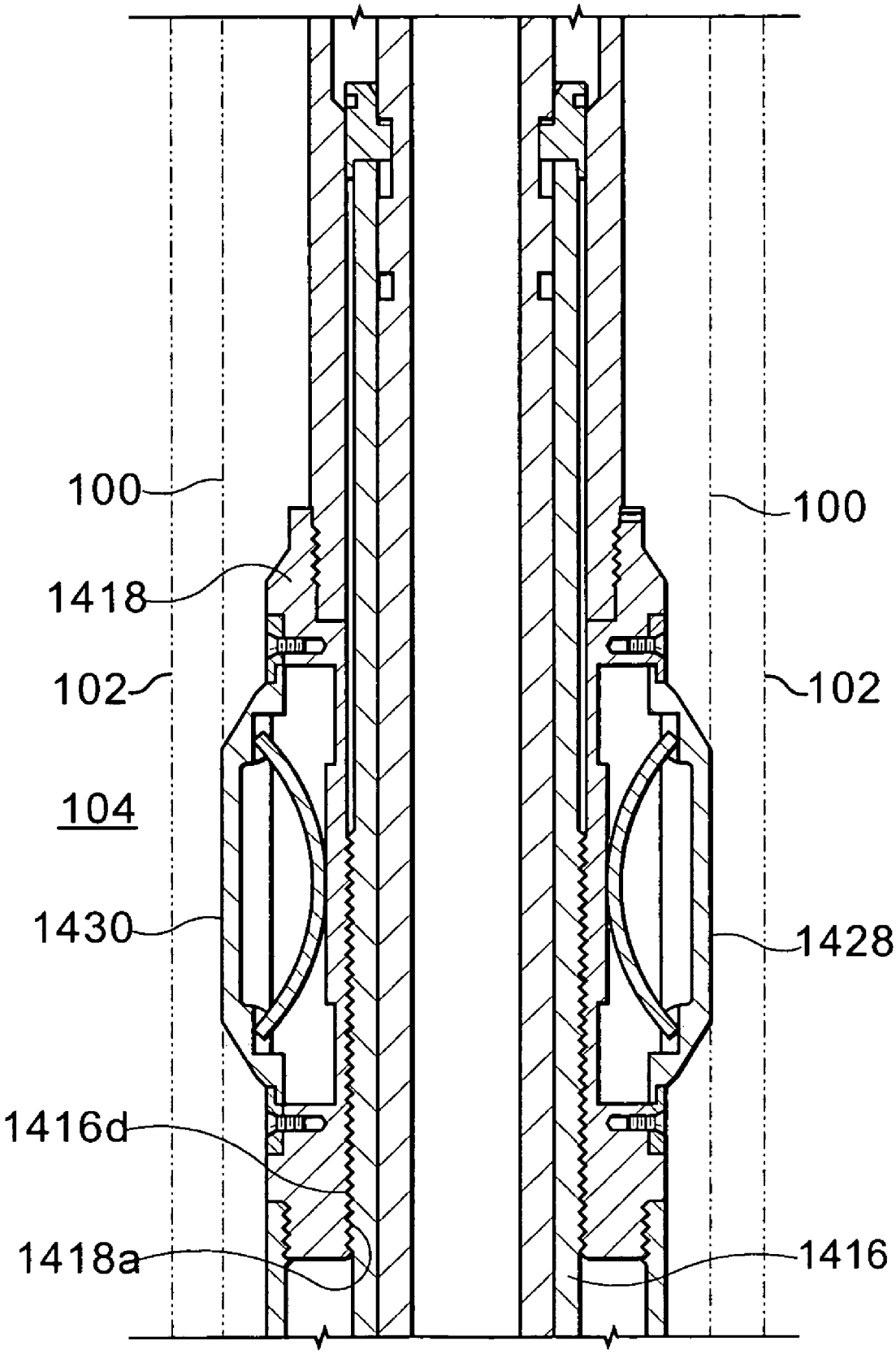
*Fig. 16C2*

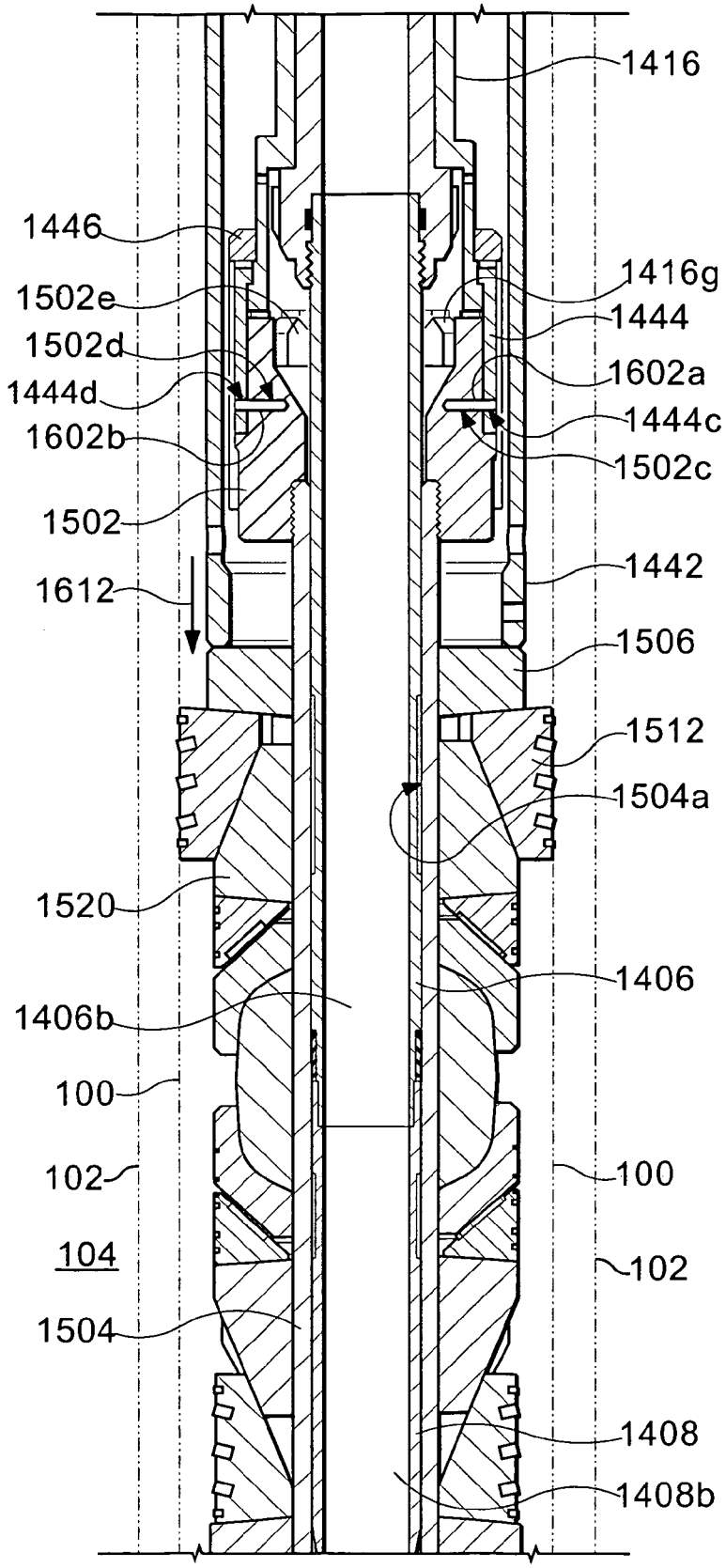
*Fig. 16C3*

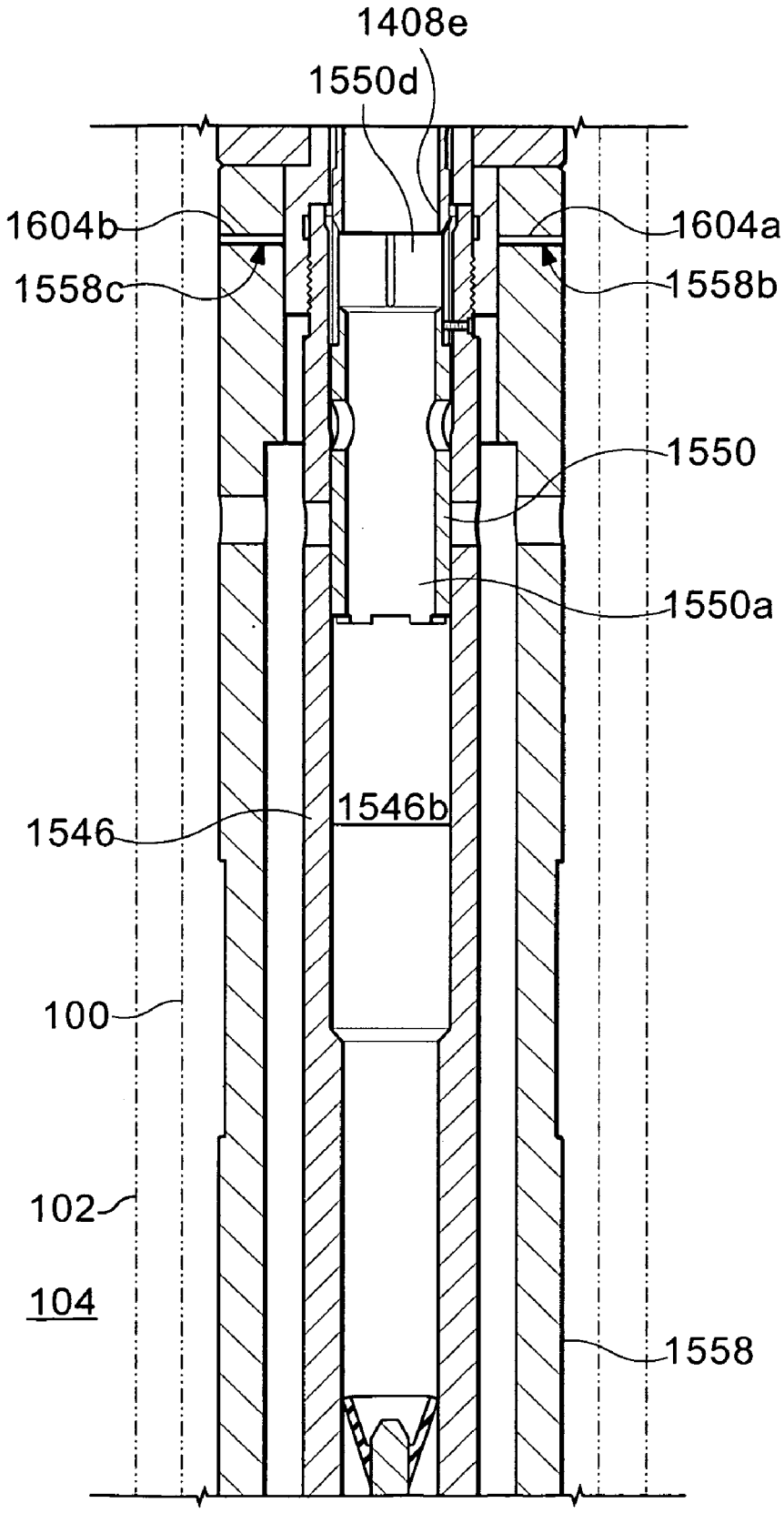
*Fig. 16C4*

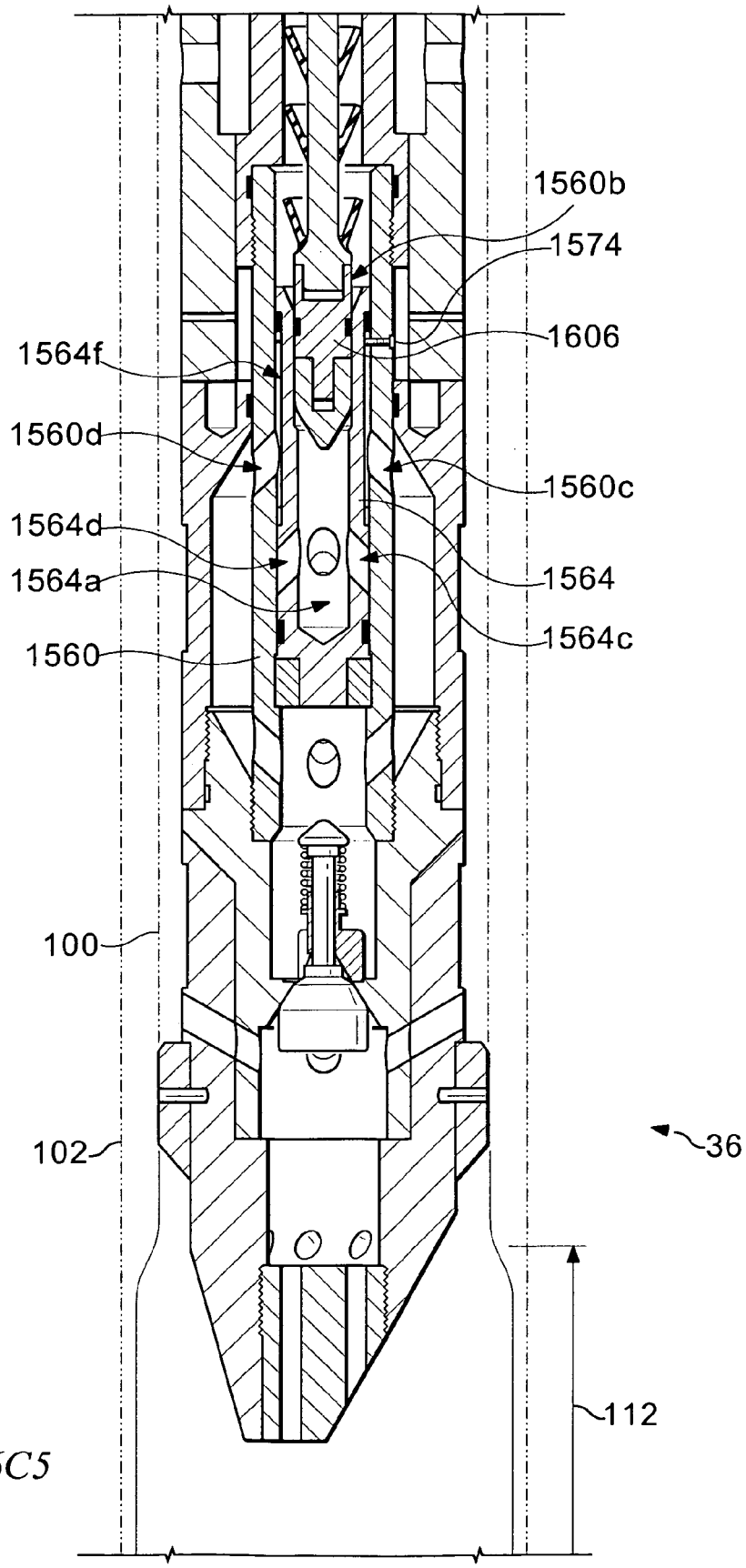
*Fig. 16C5*

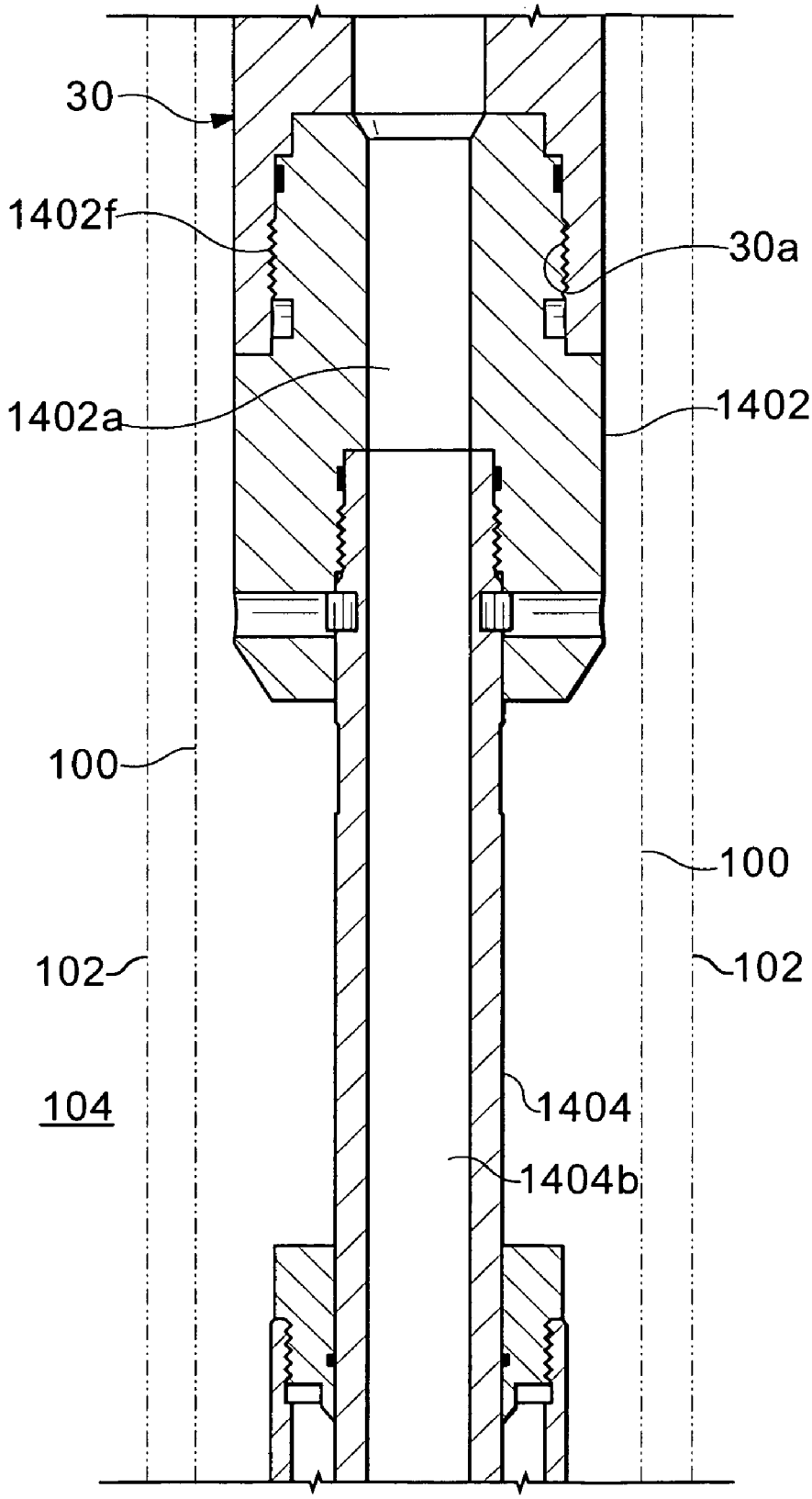
*Fig. 16D1*

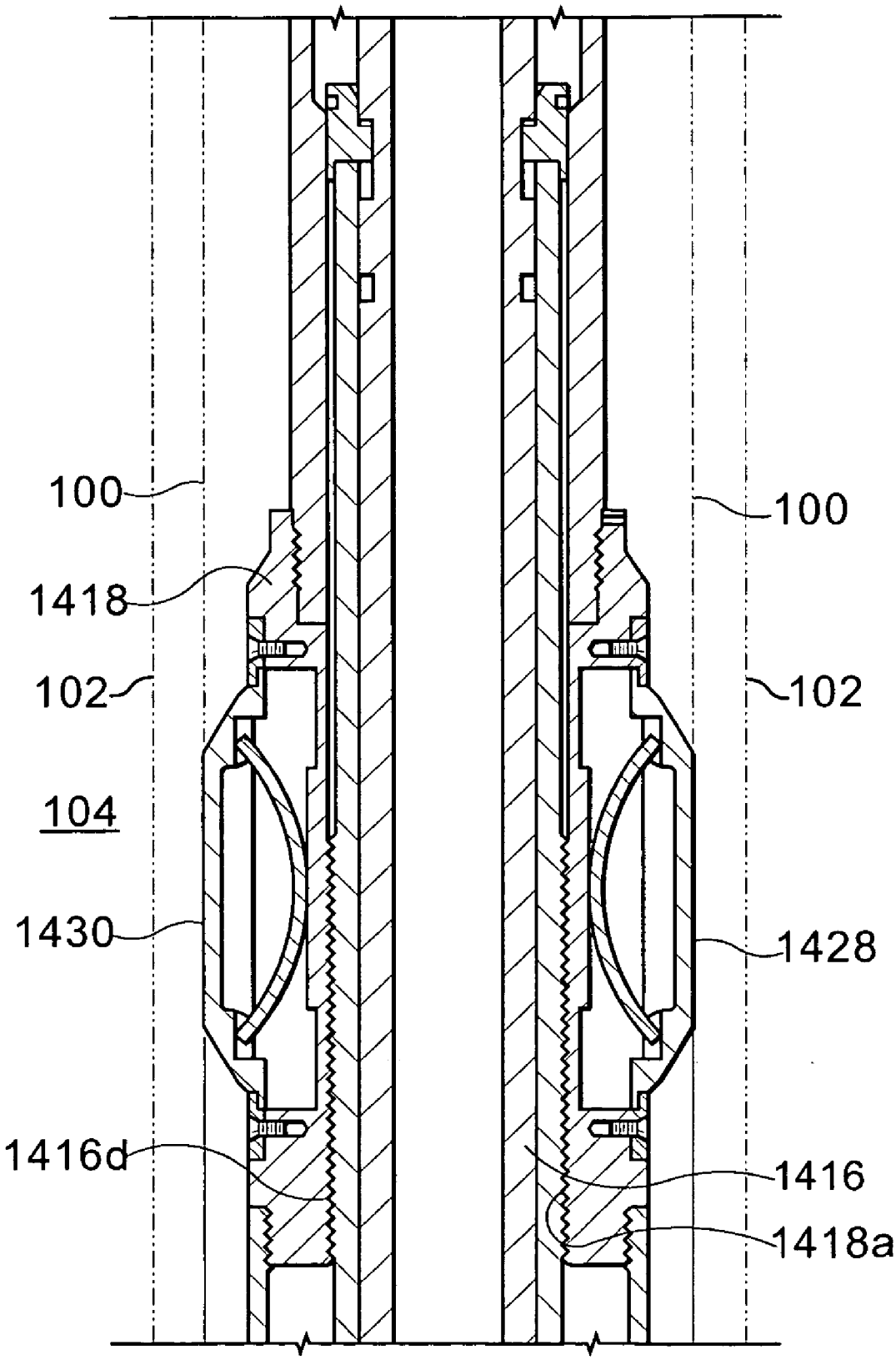
*Fig. 16D2*

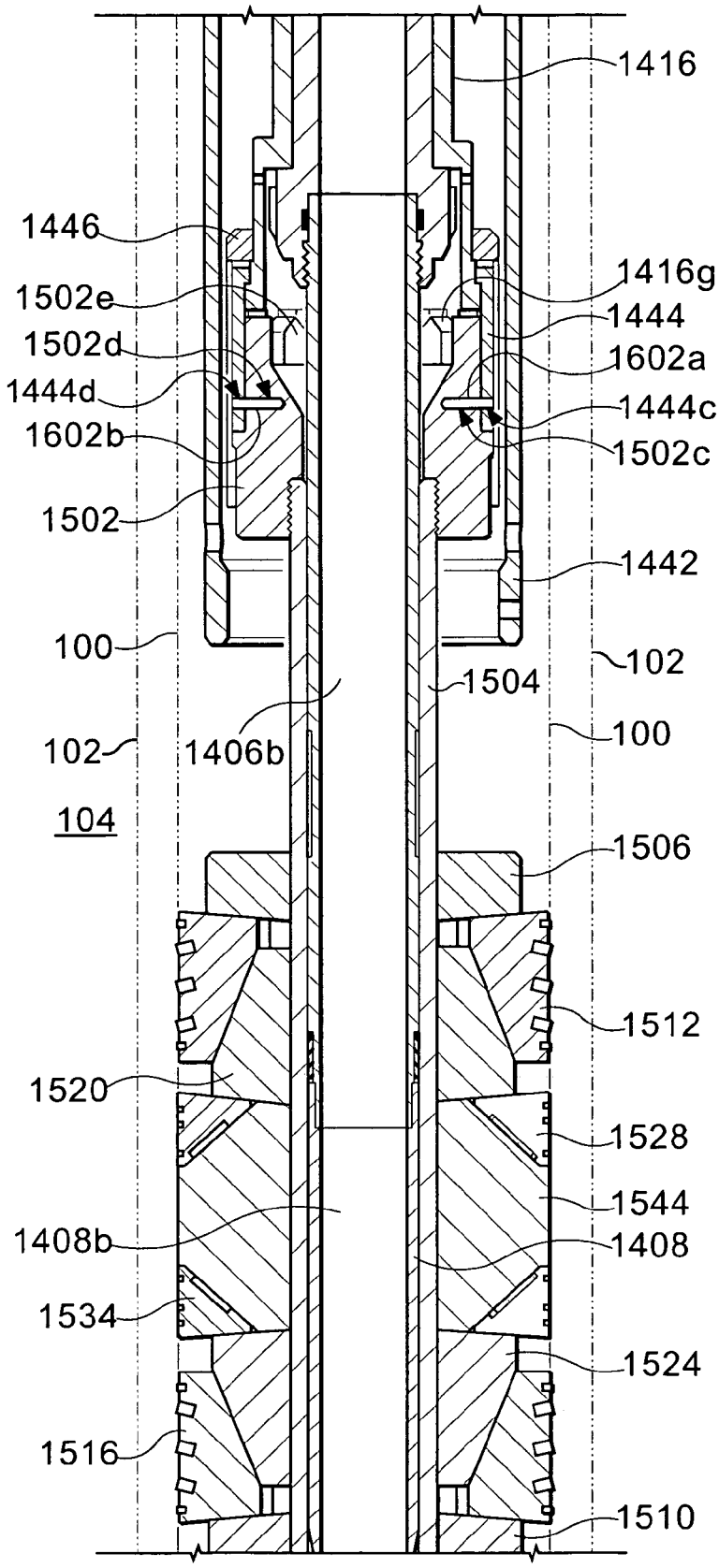
*Fig. 16D3*

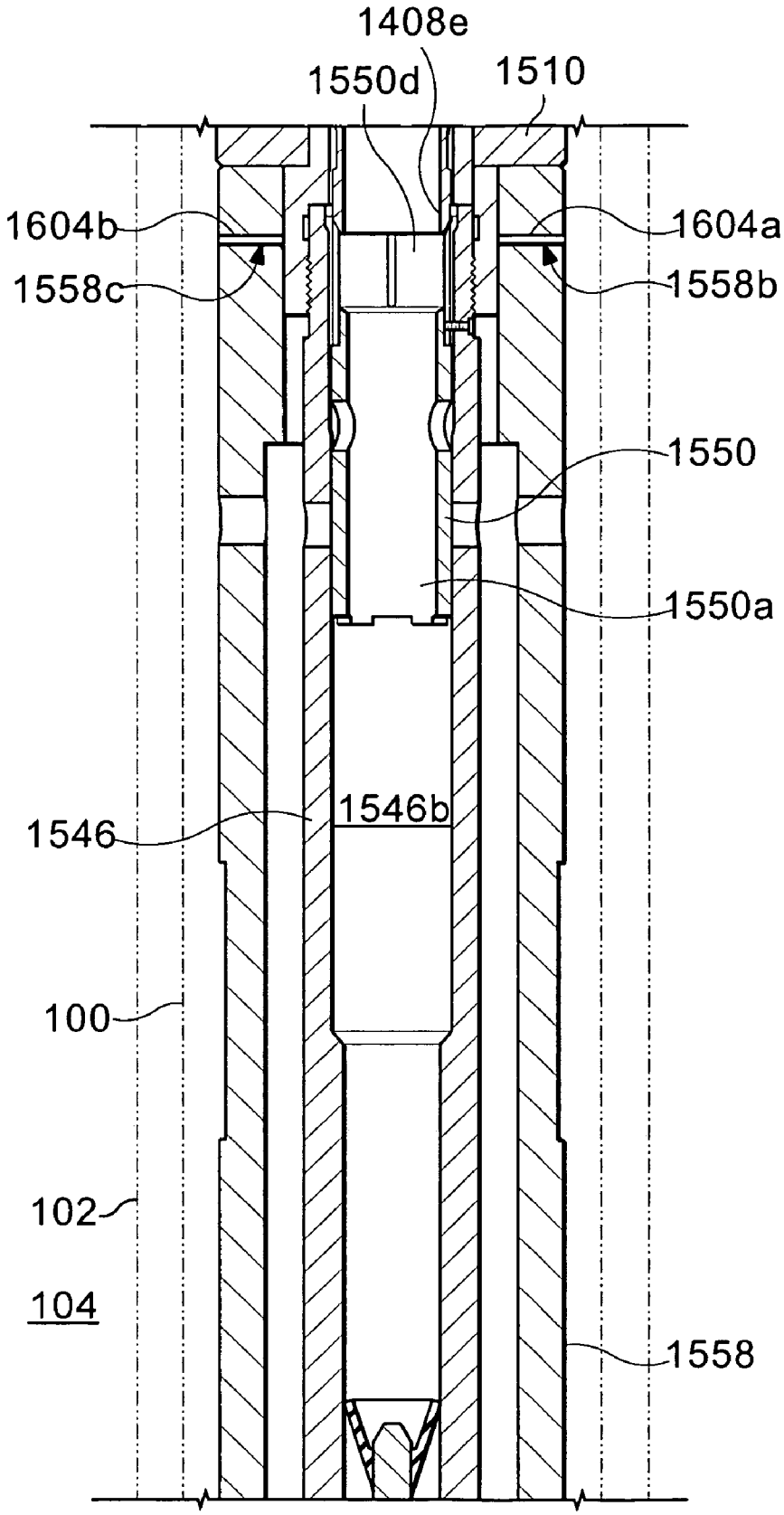
*Fig. 16D4*

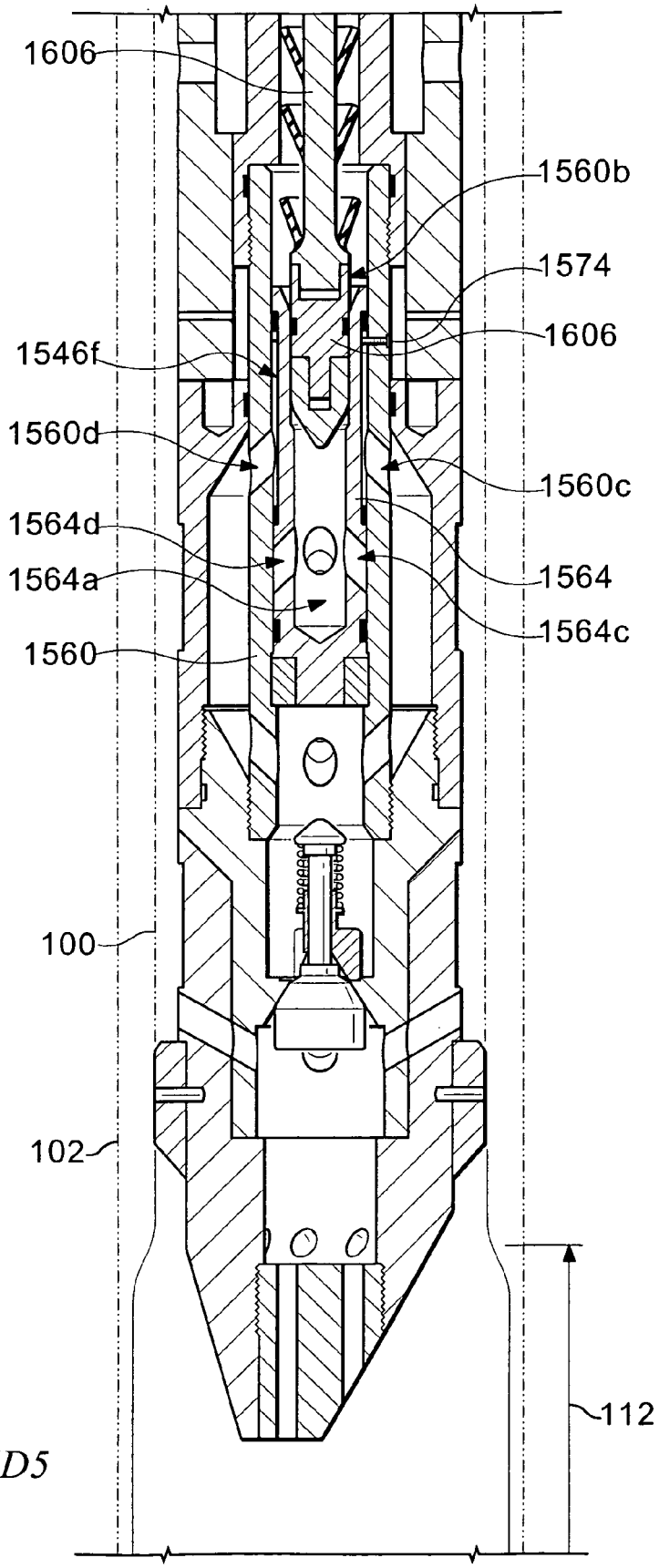
*Fig. 16D5*

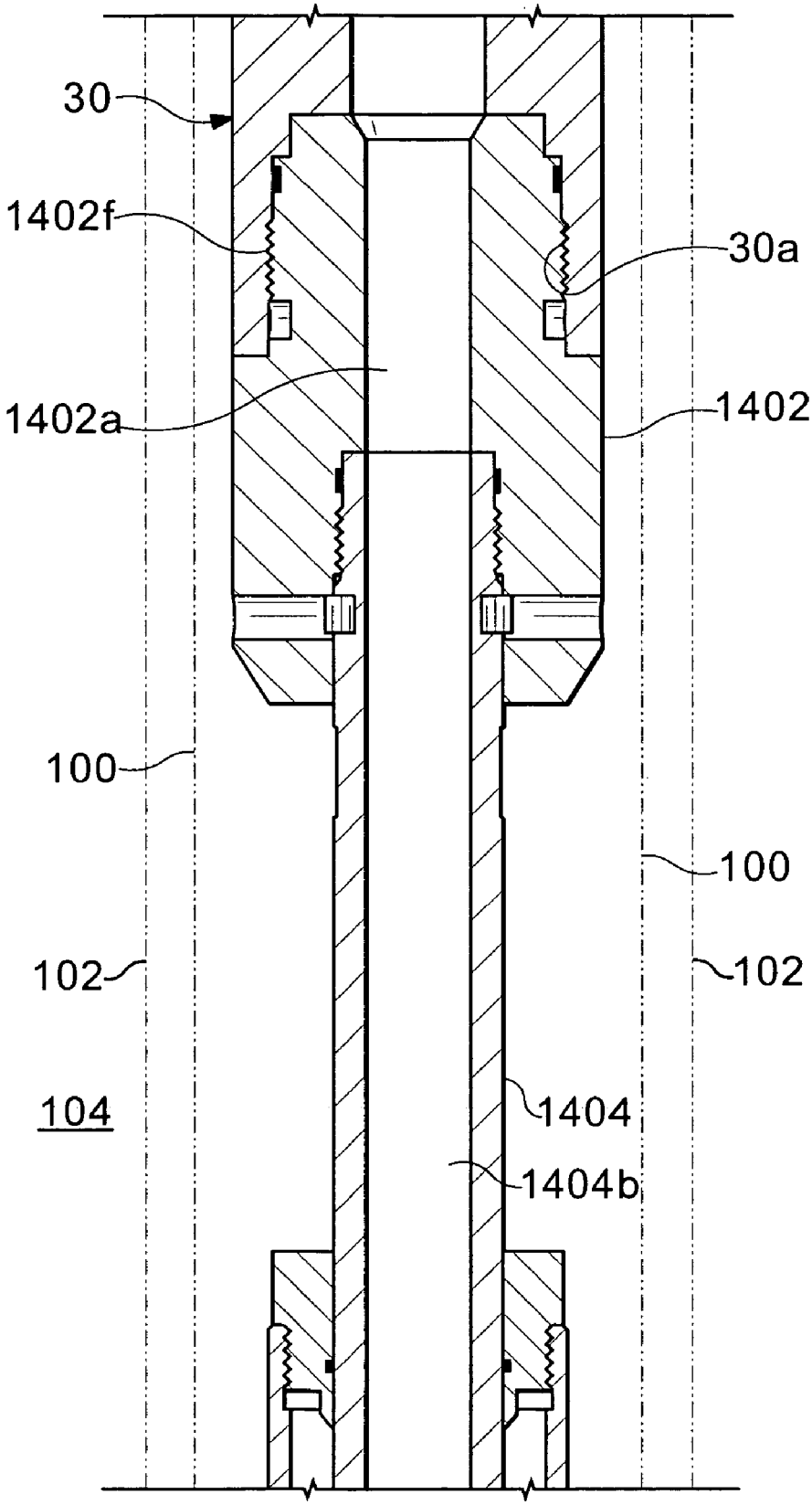
*Fig. 16E1*

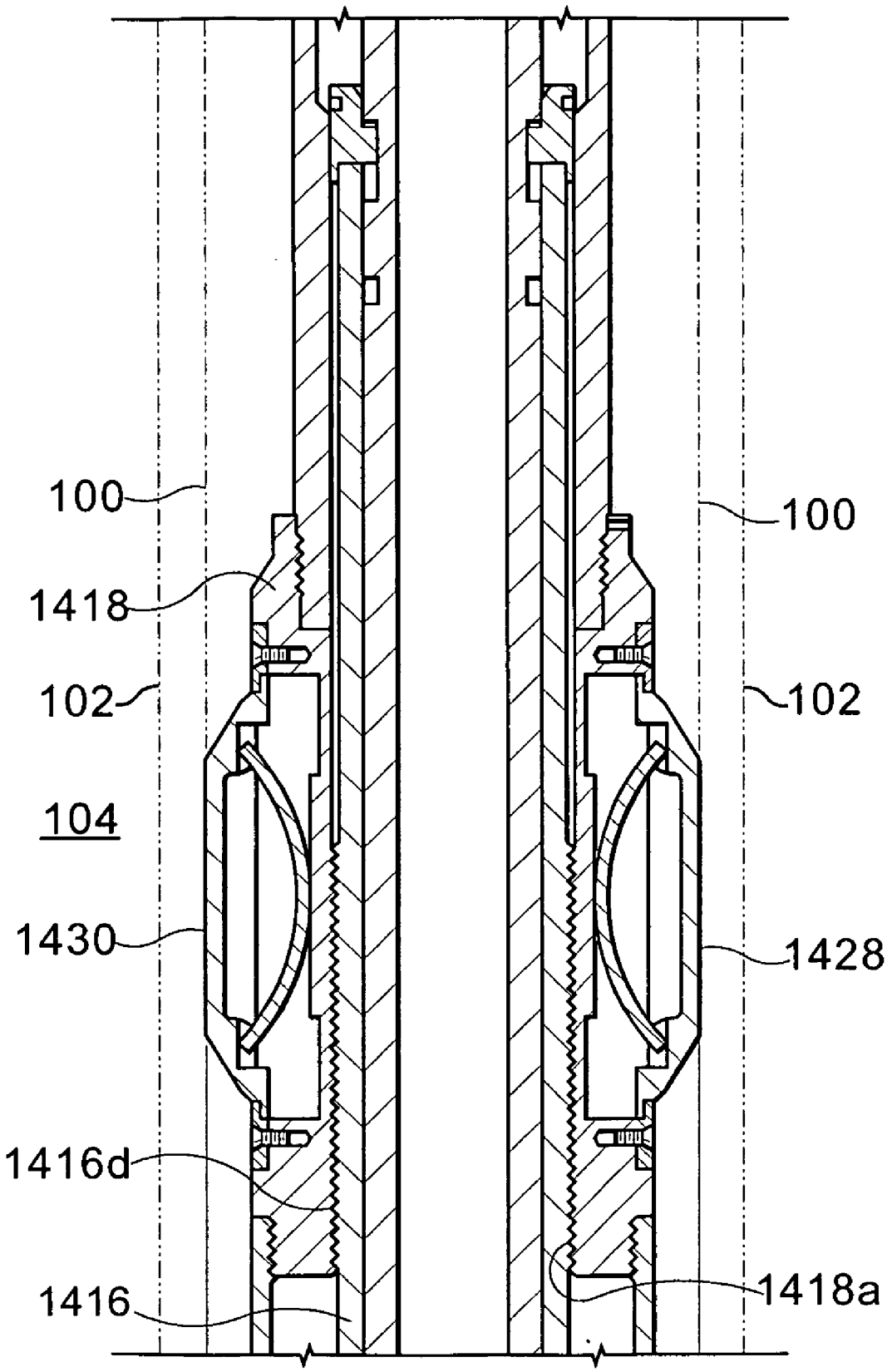
*Fig. 16E2*

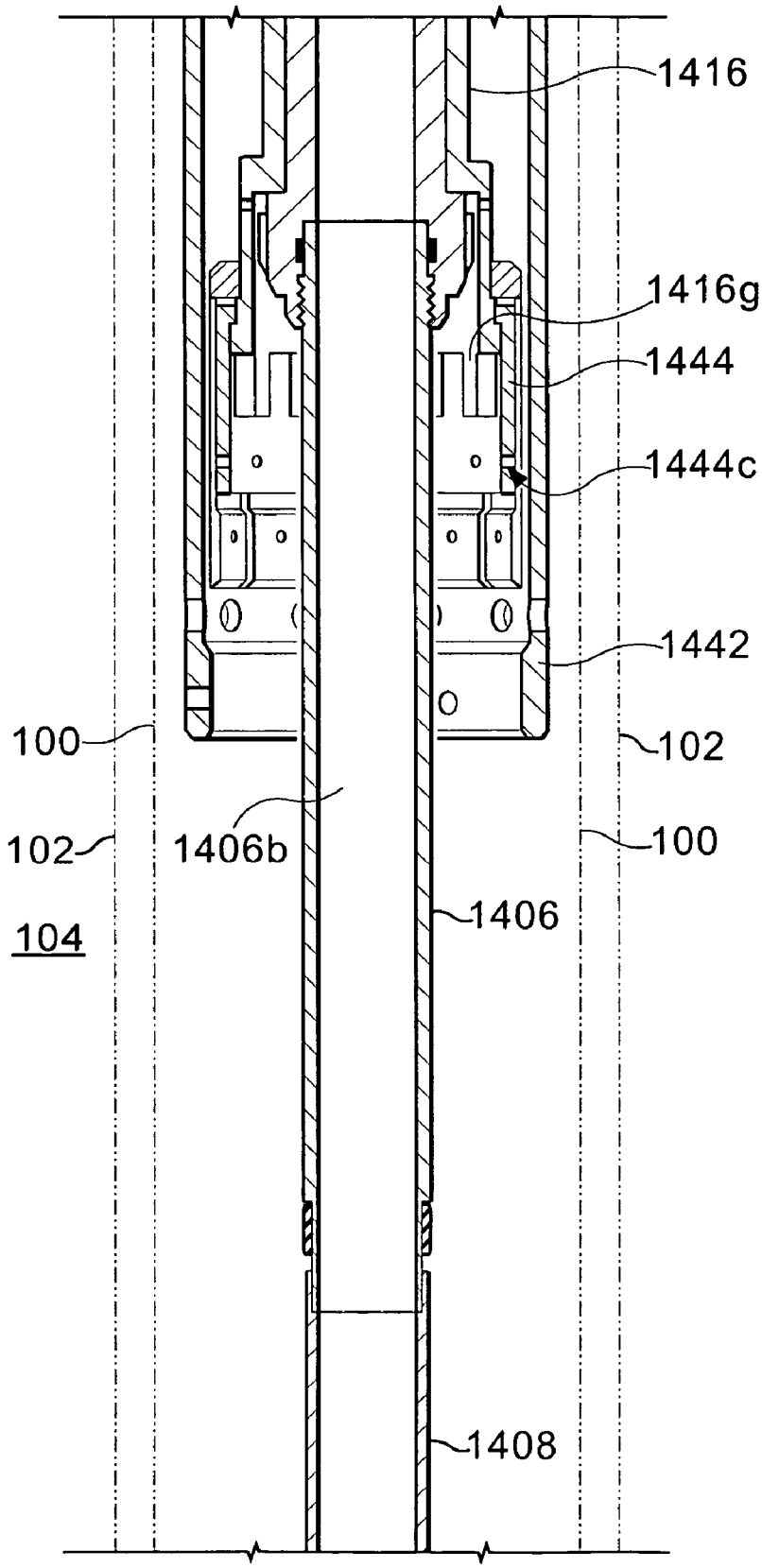
*Fig. 16E3*

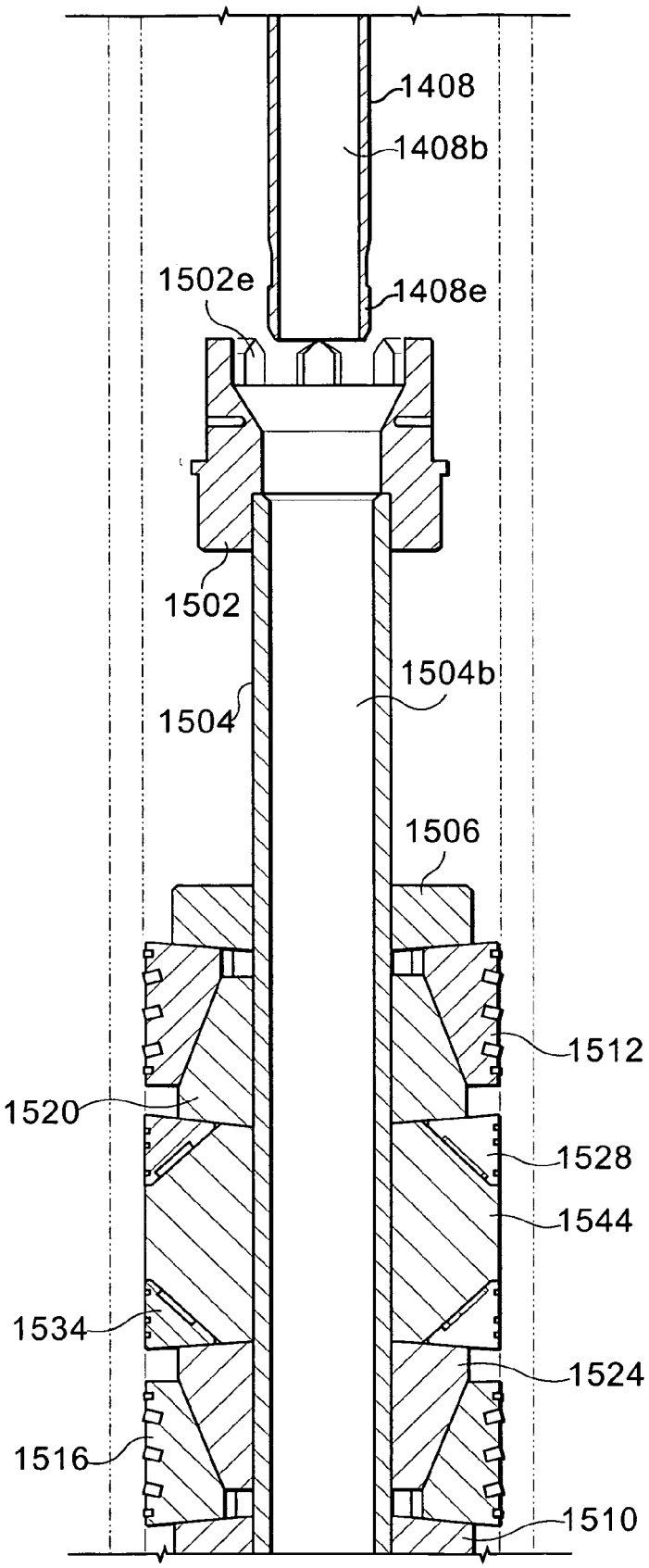
*Fig. 16E4*

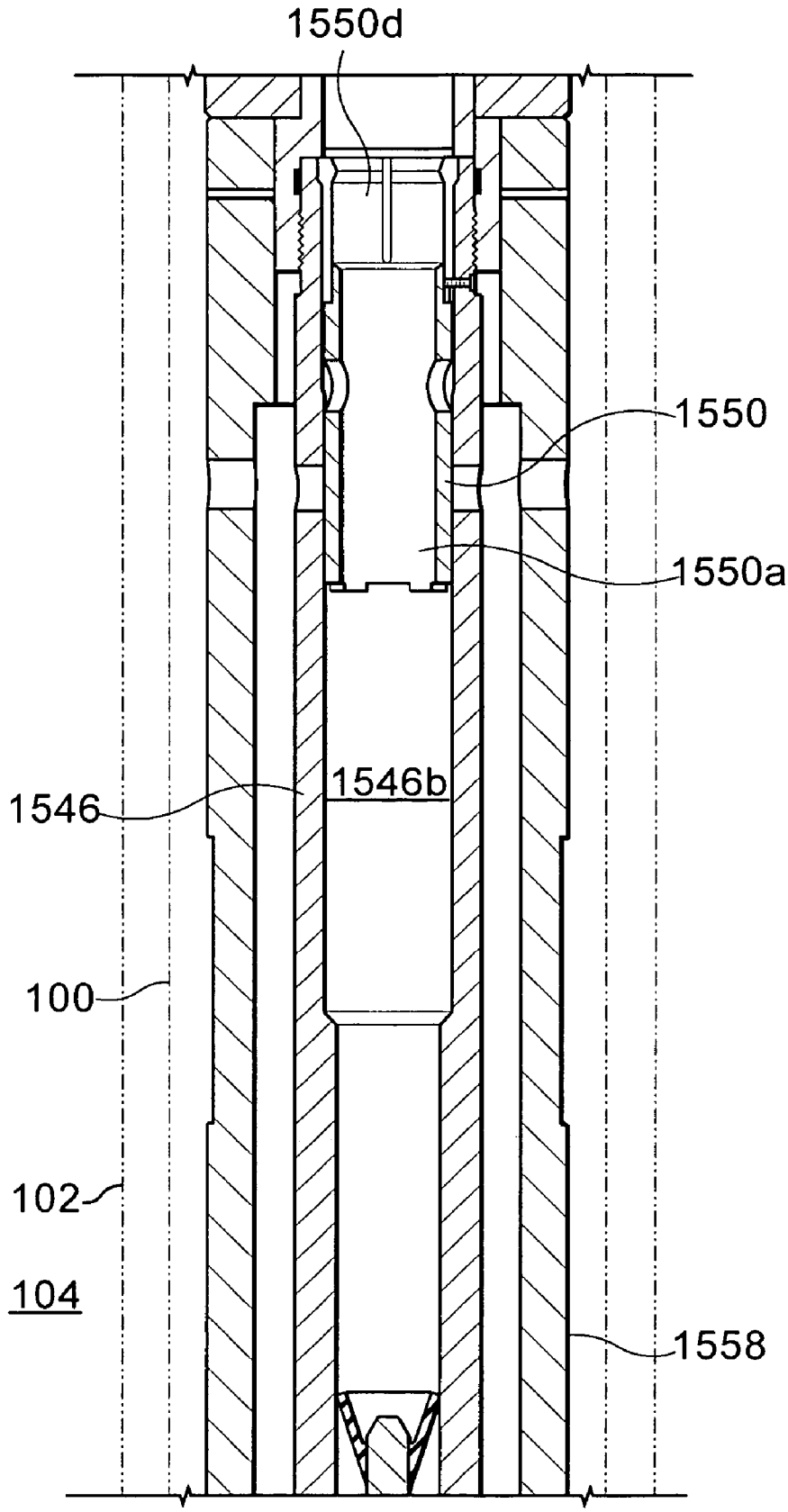
*Fig. 16E5*

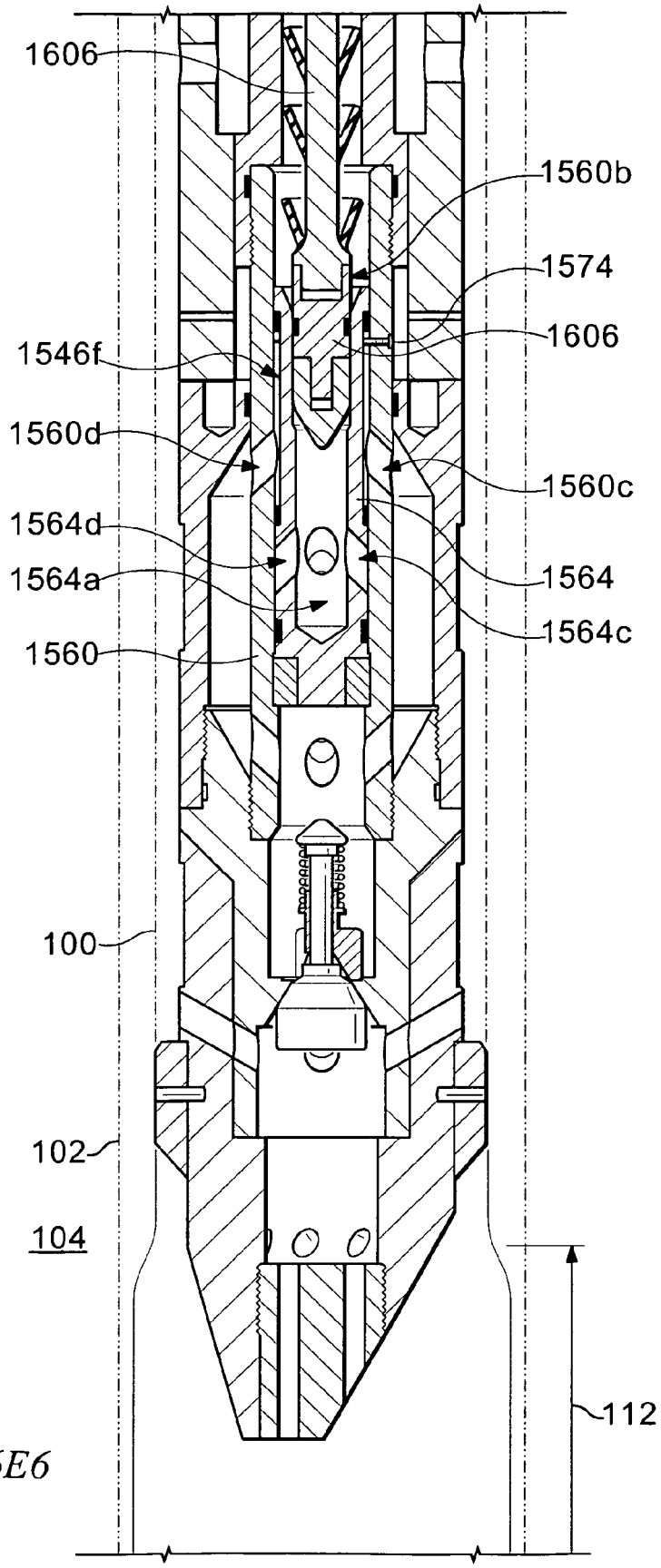
*Fig. 16E6*

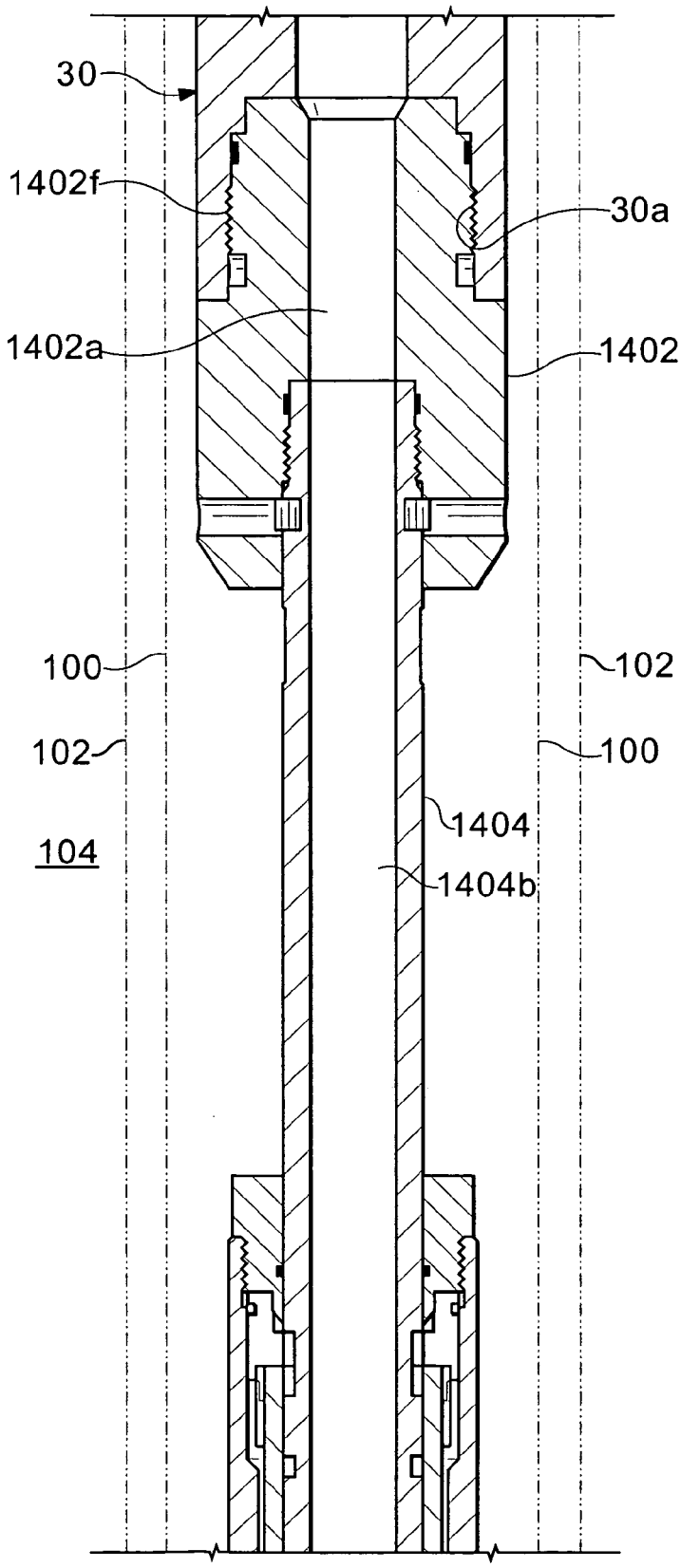
*Fig. 16F1*

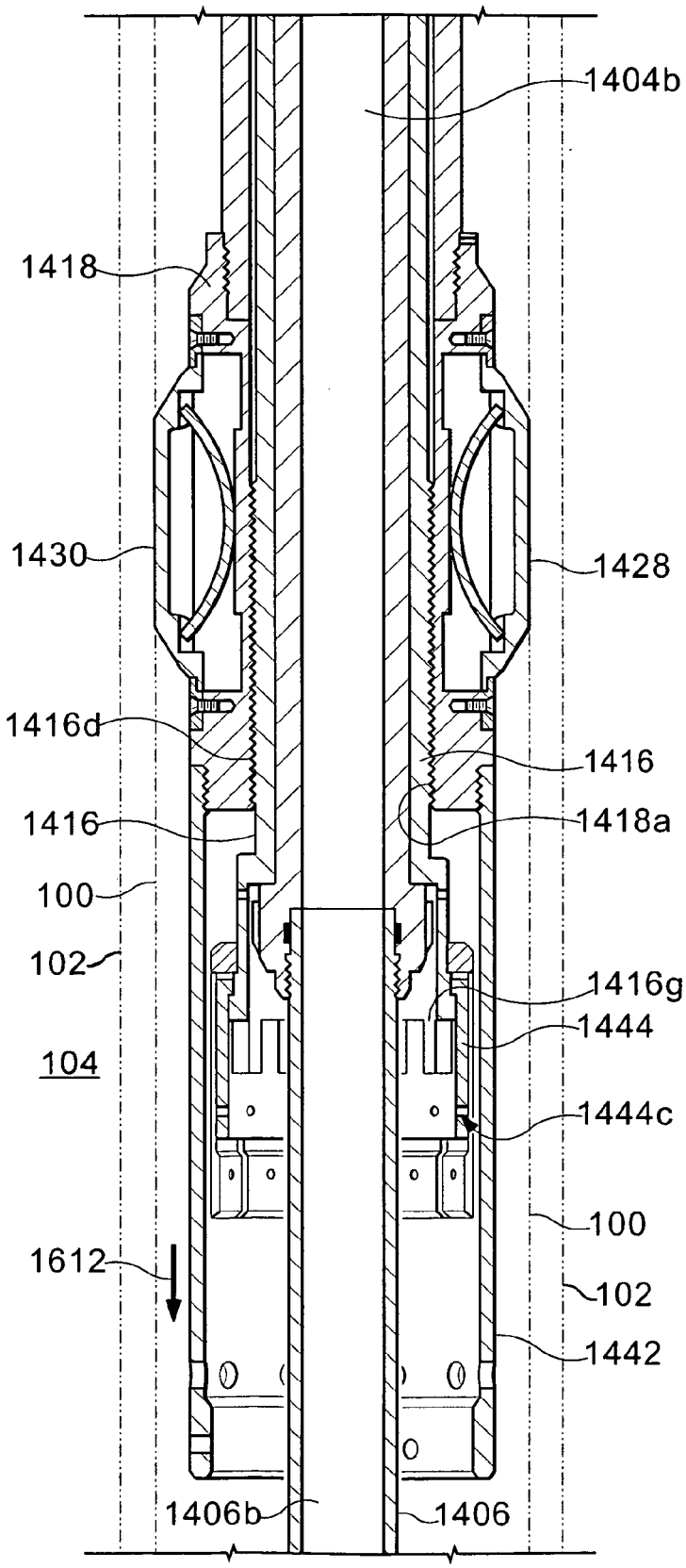
*Fig. 16F2*

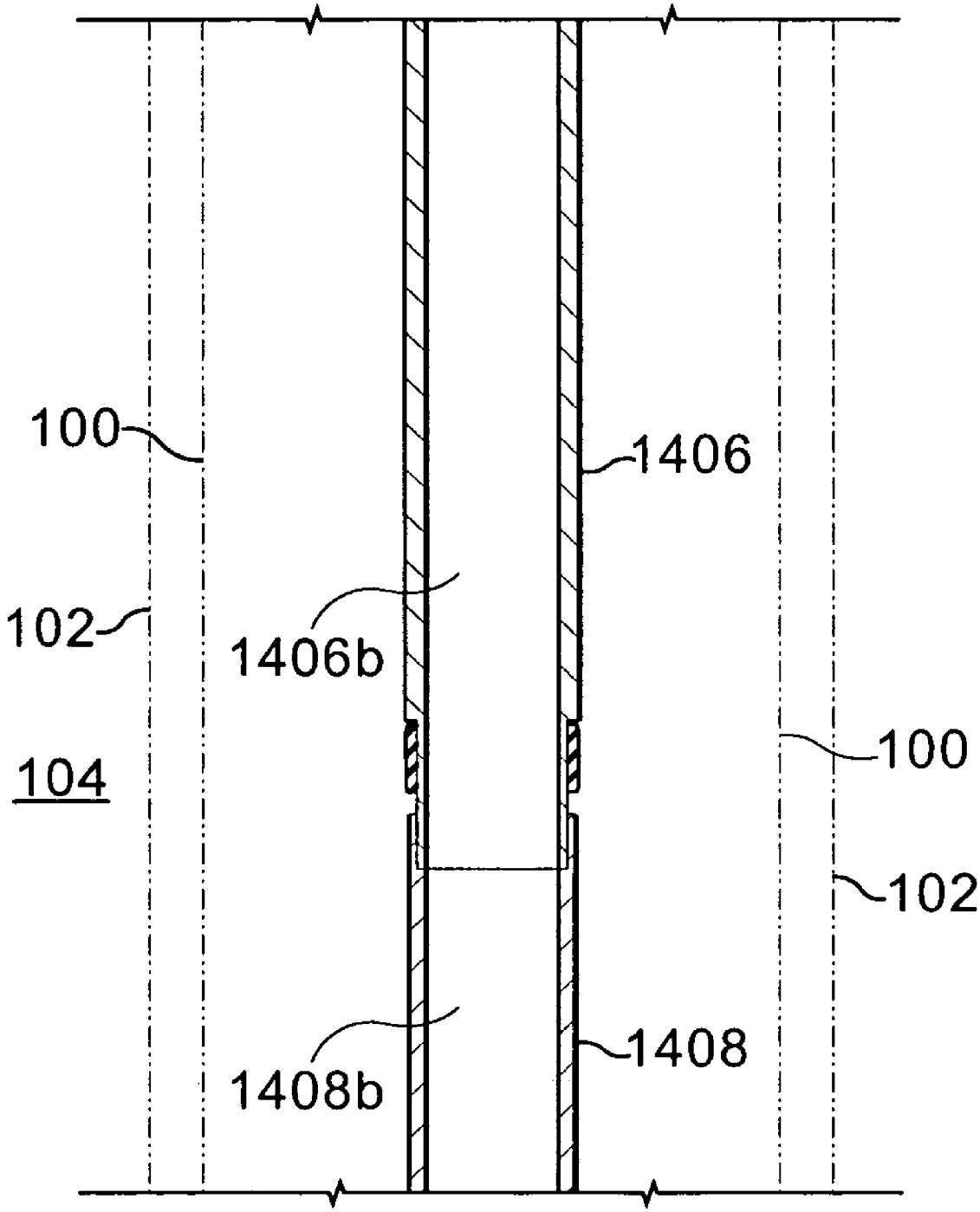
*Fig. 16F3*

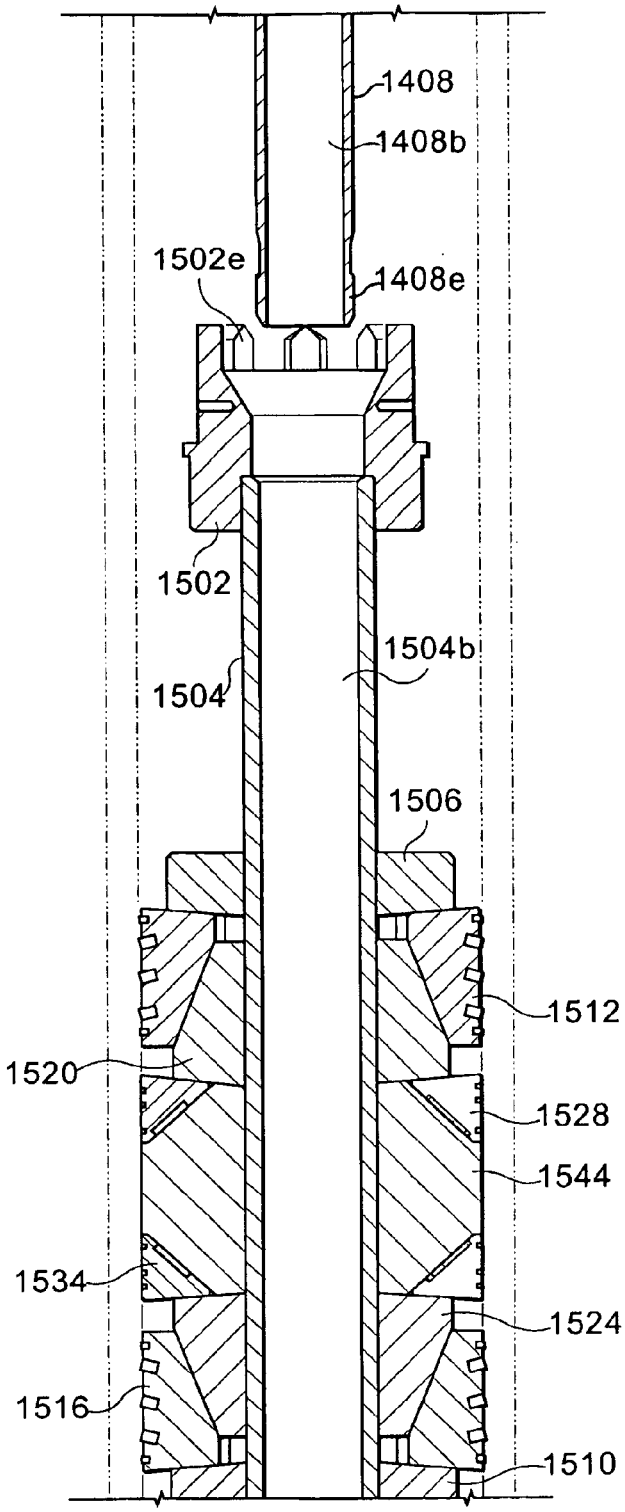
*Fig. 16F4*

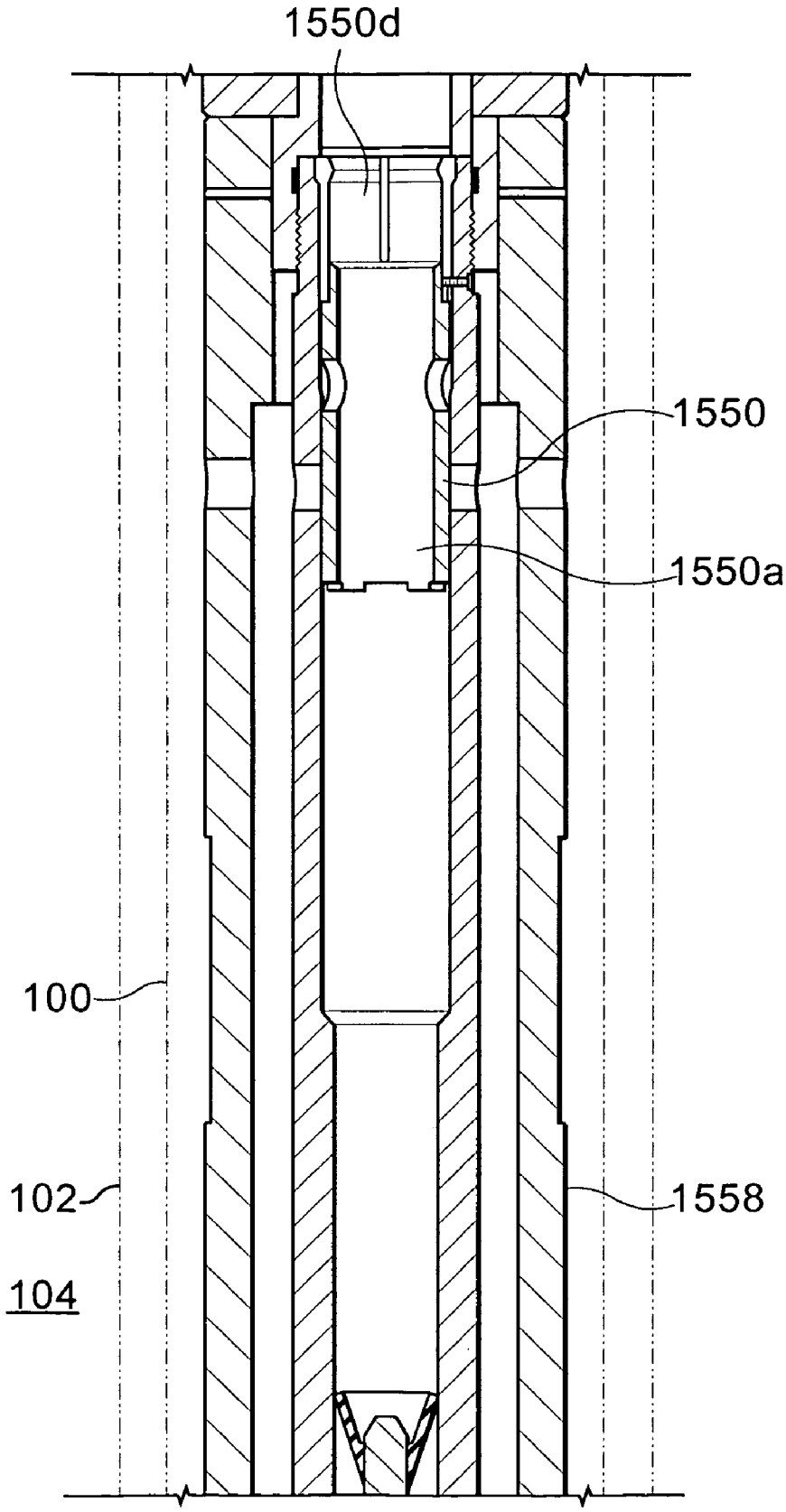
*Fig. 16F5*

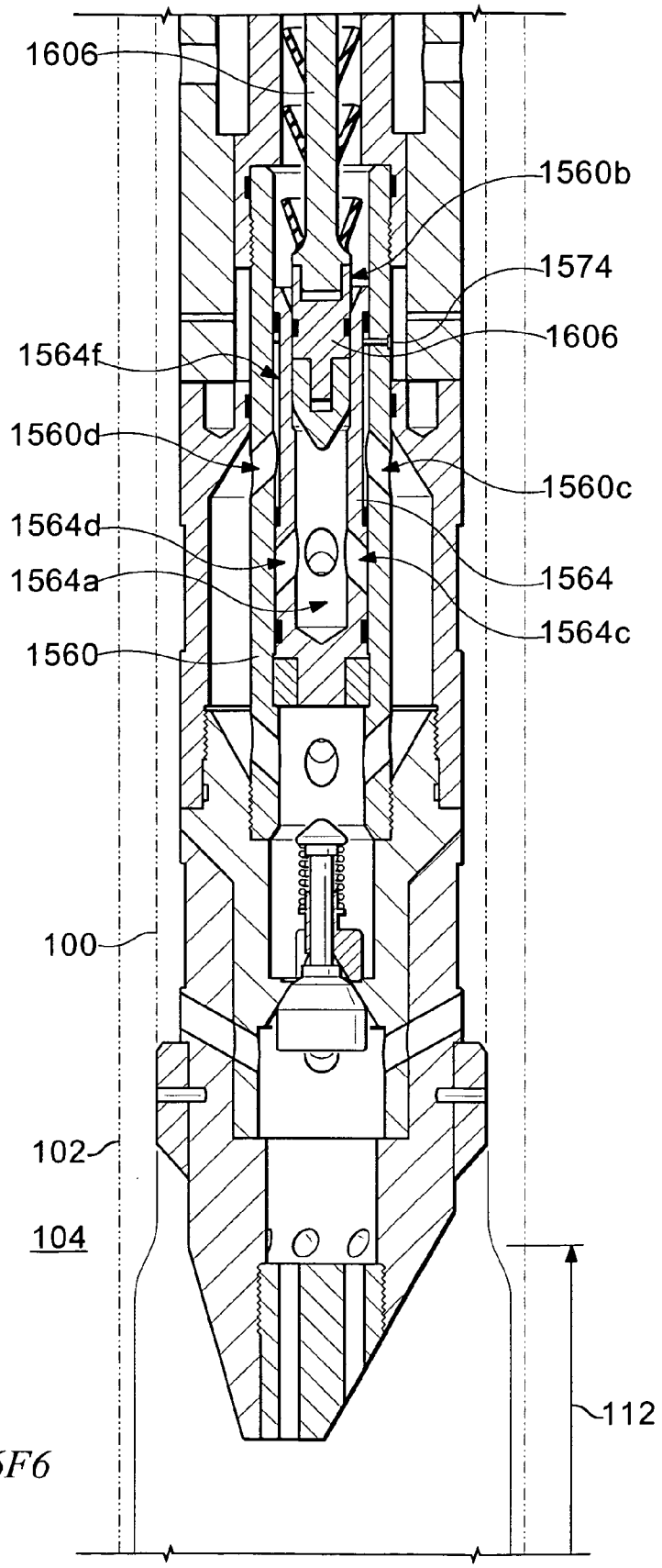
*Fig. 16F6*

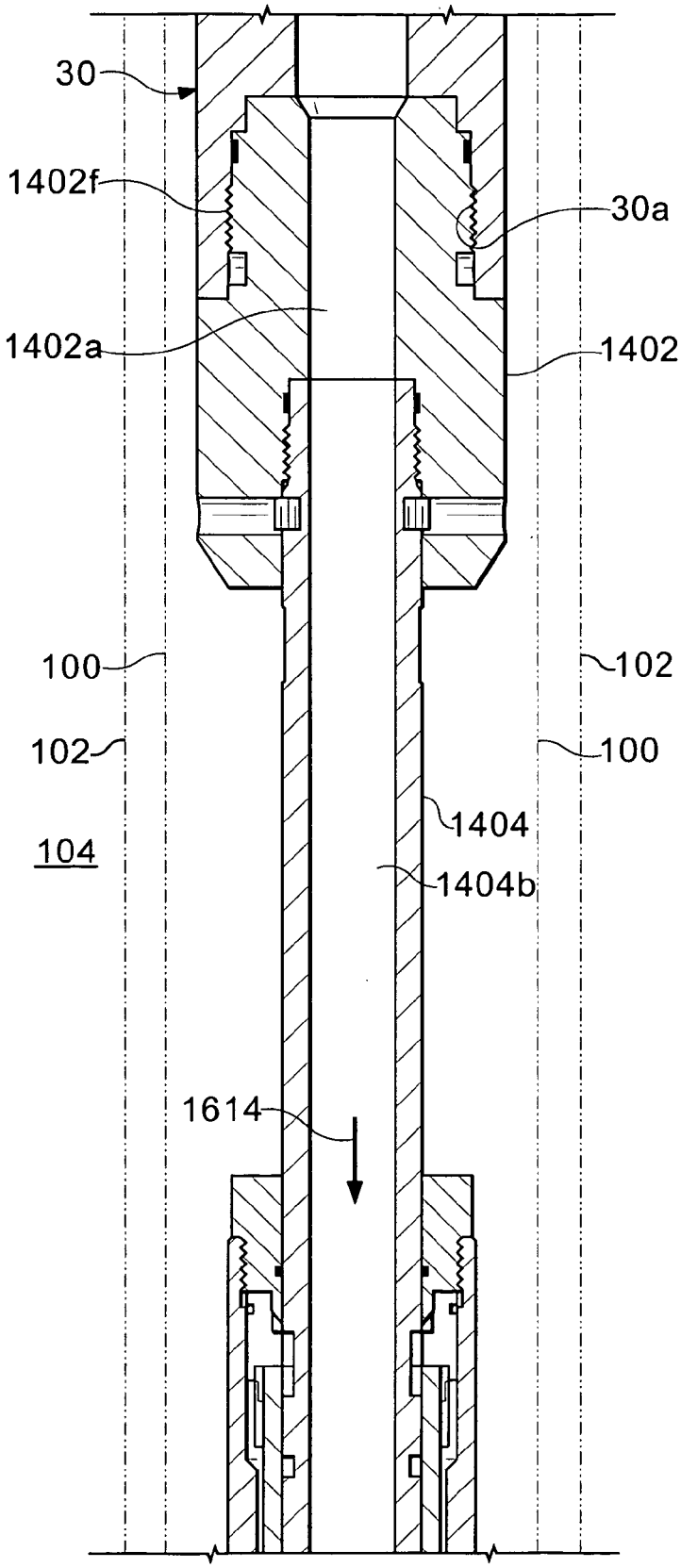
*Fig. 16G1*

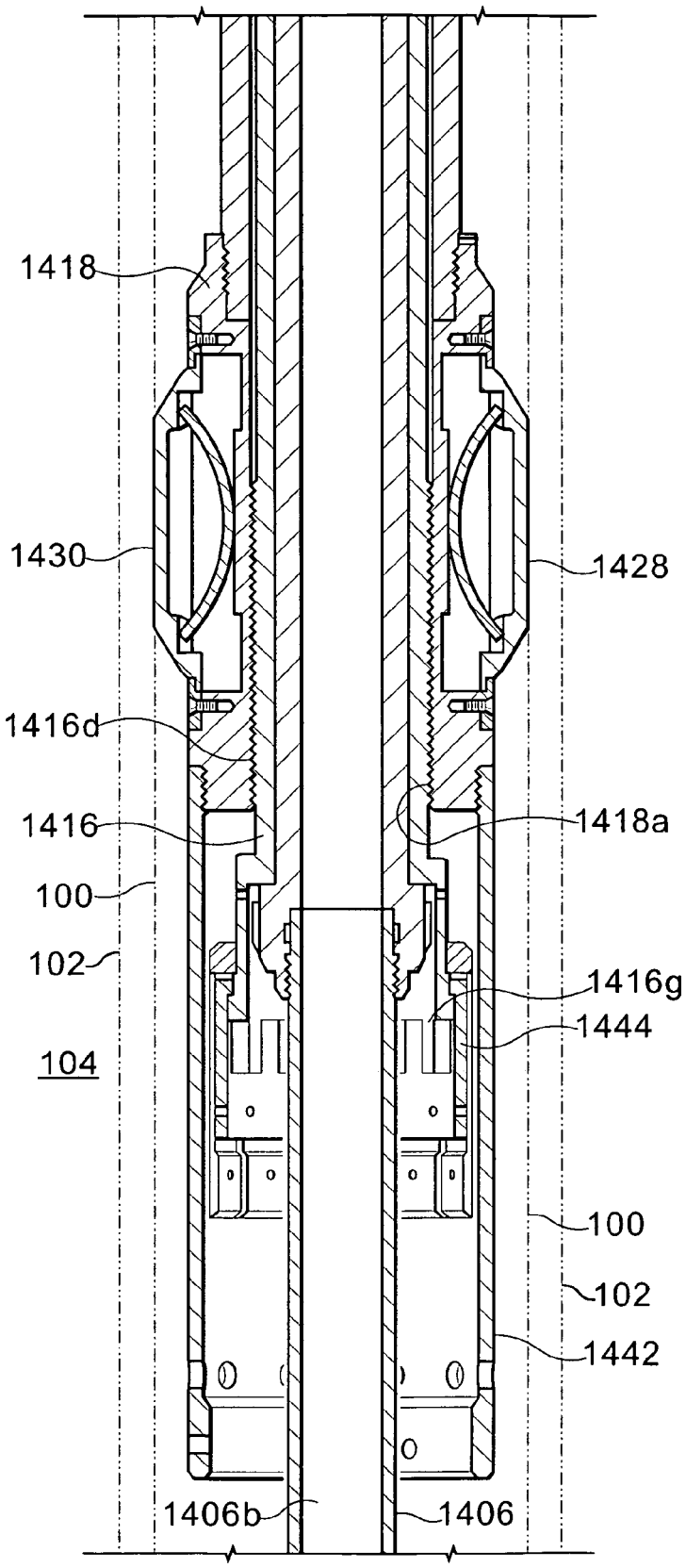
*Fig. 16G2*

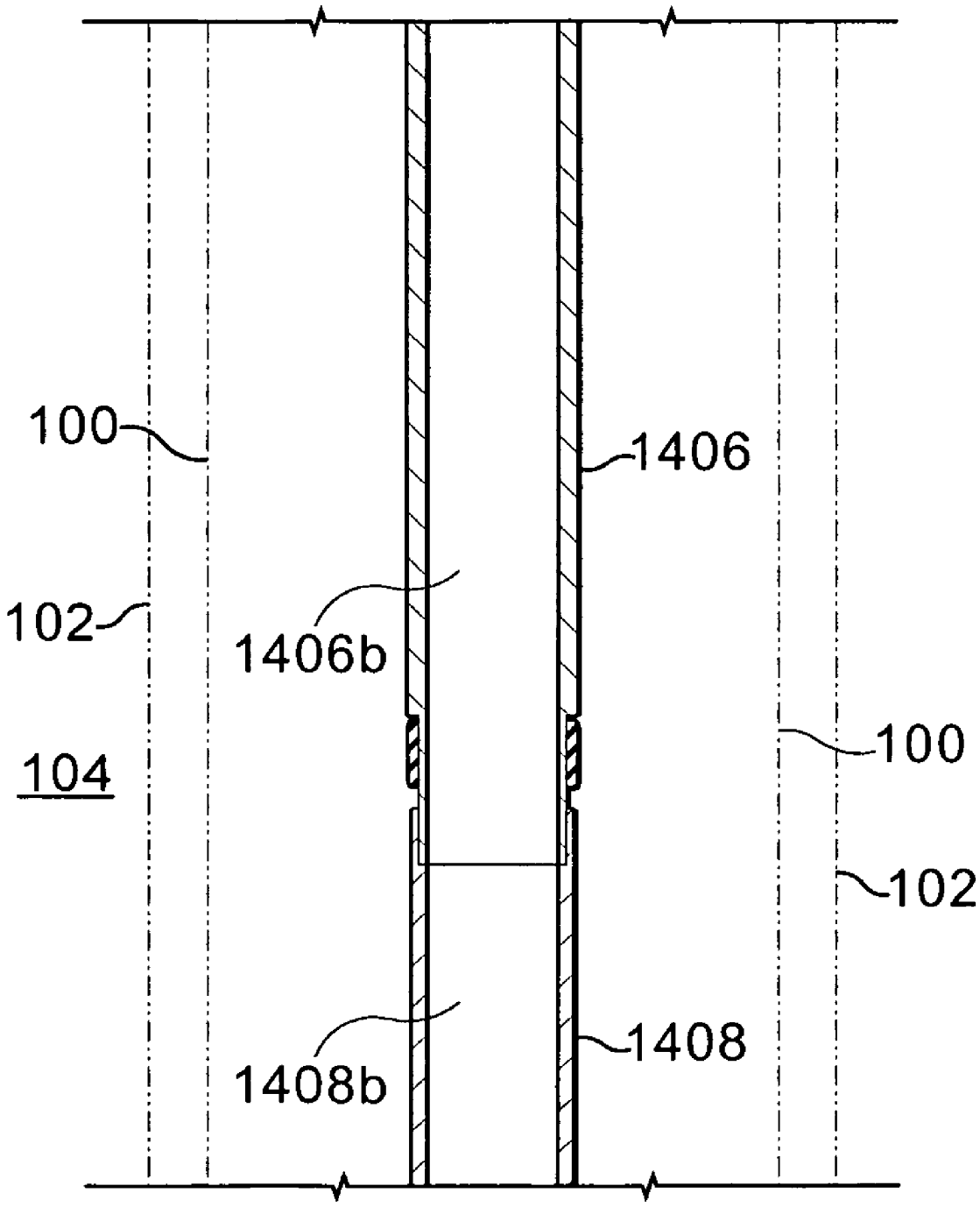
*Fig. 16G3*

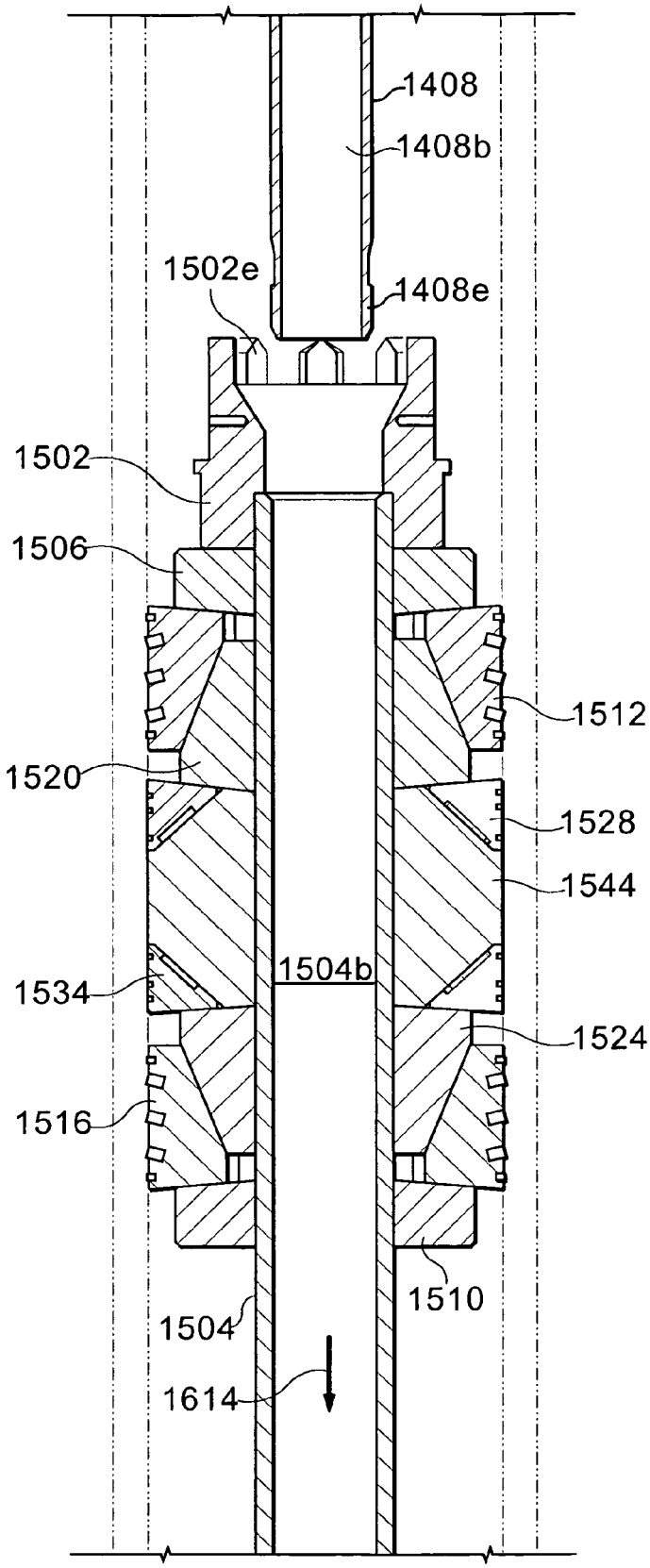
*Fig. 16G4*

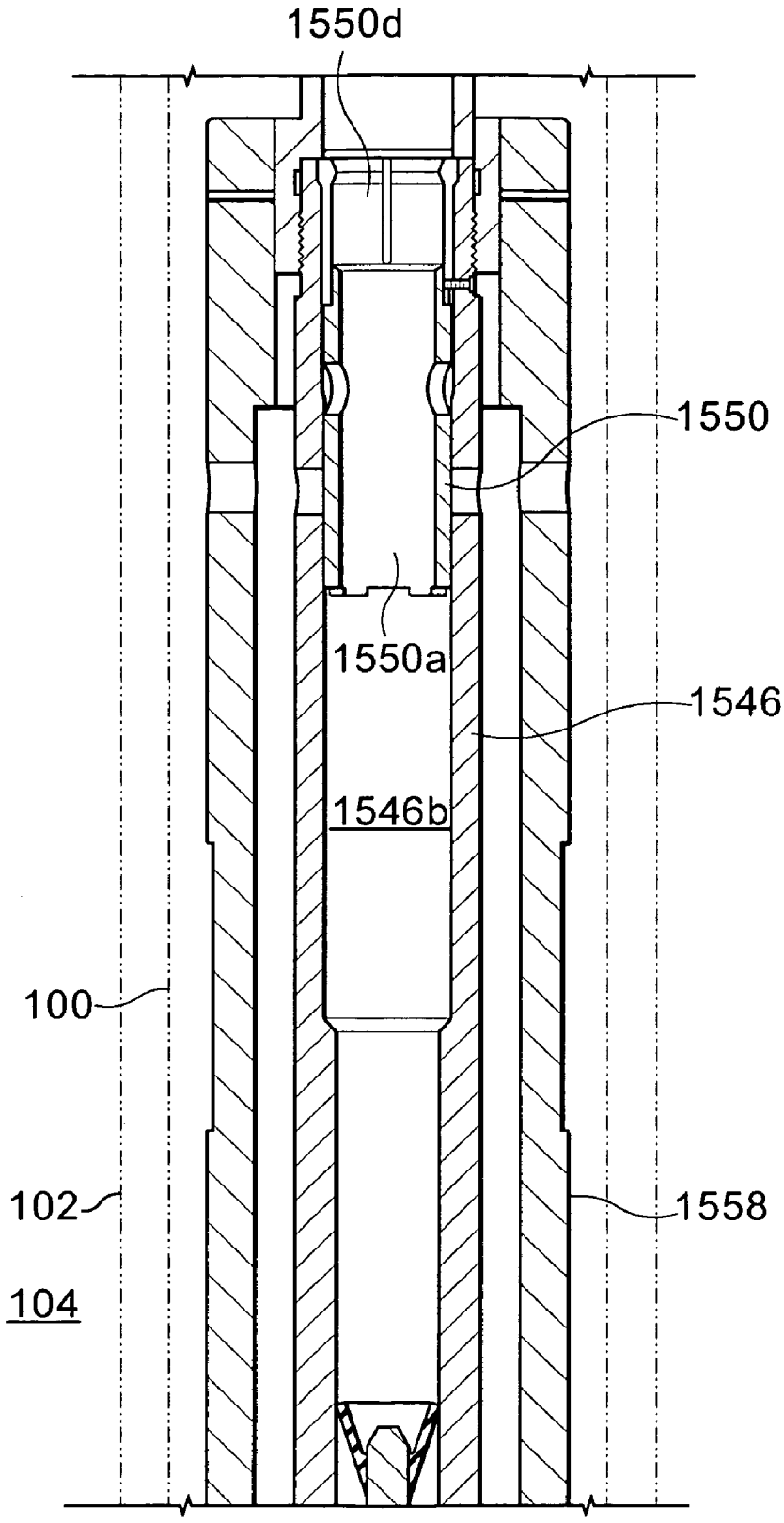
*Fig. 16G5*

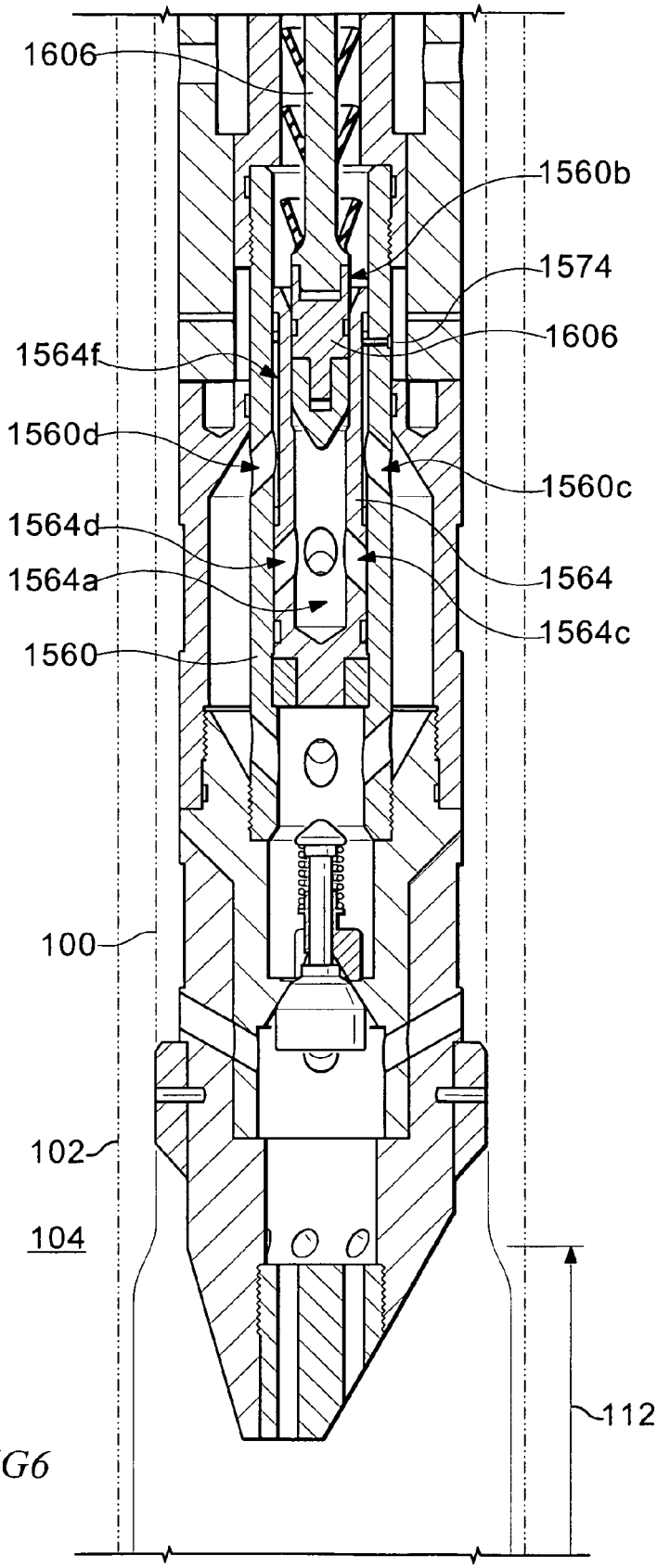
*Fig. 16G6*

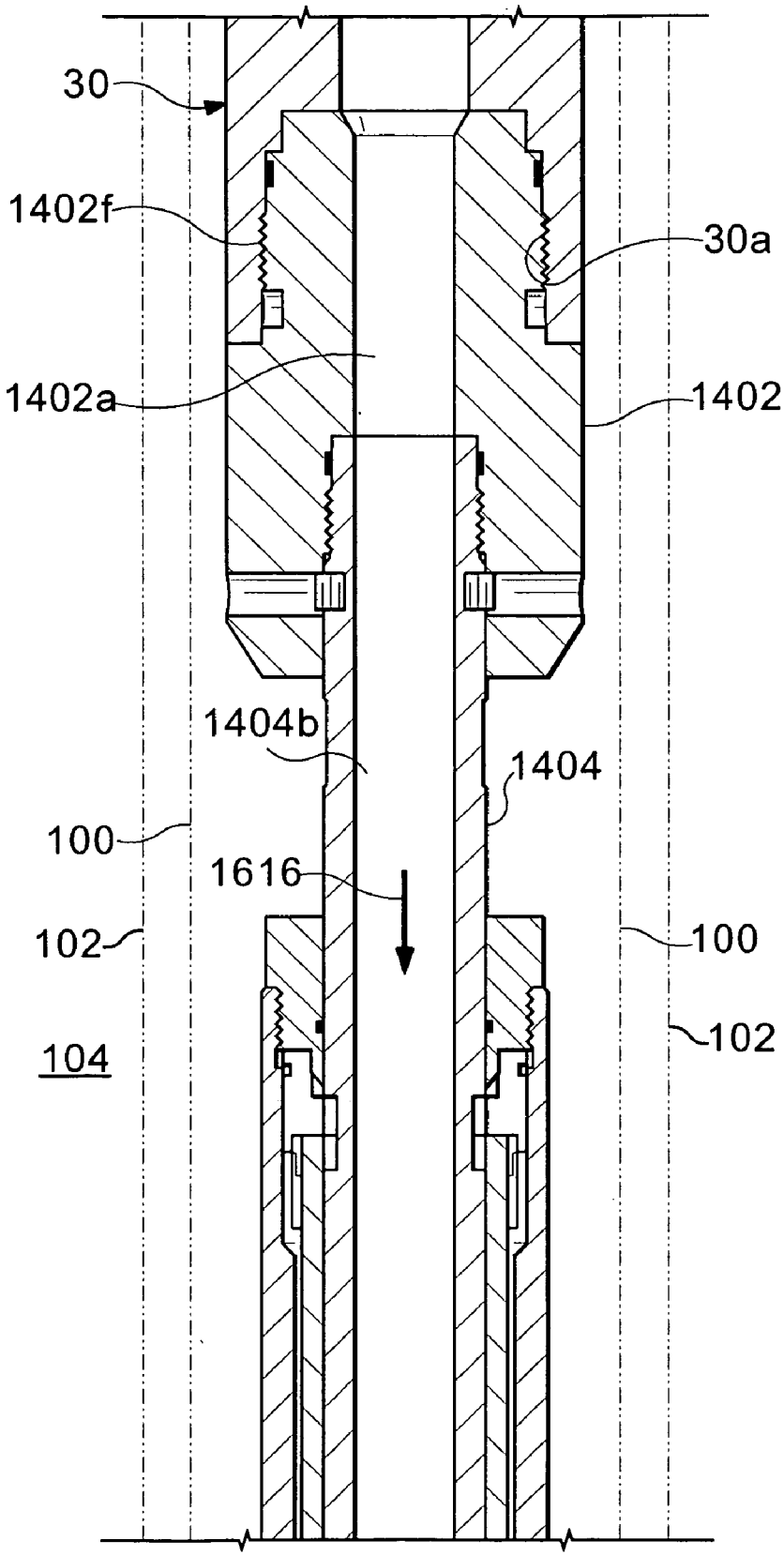
*Fig. 16H1*

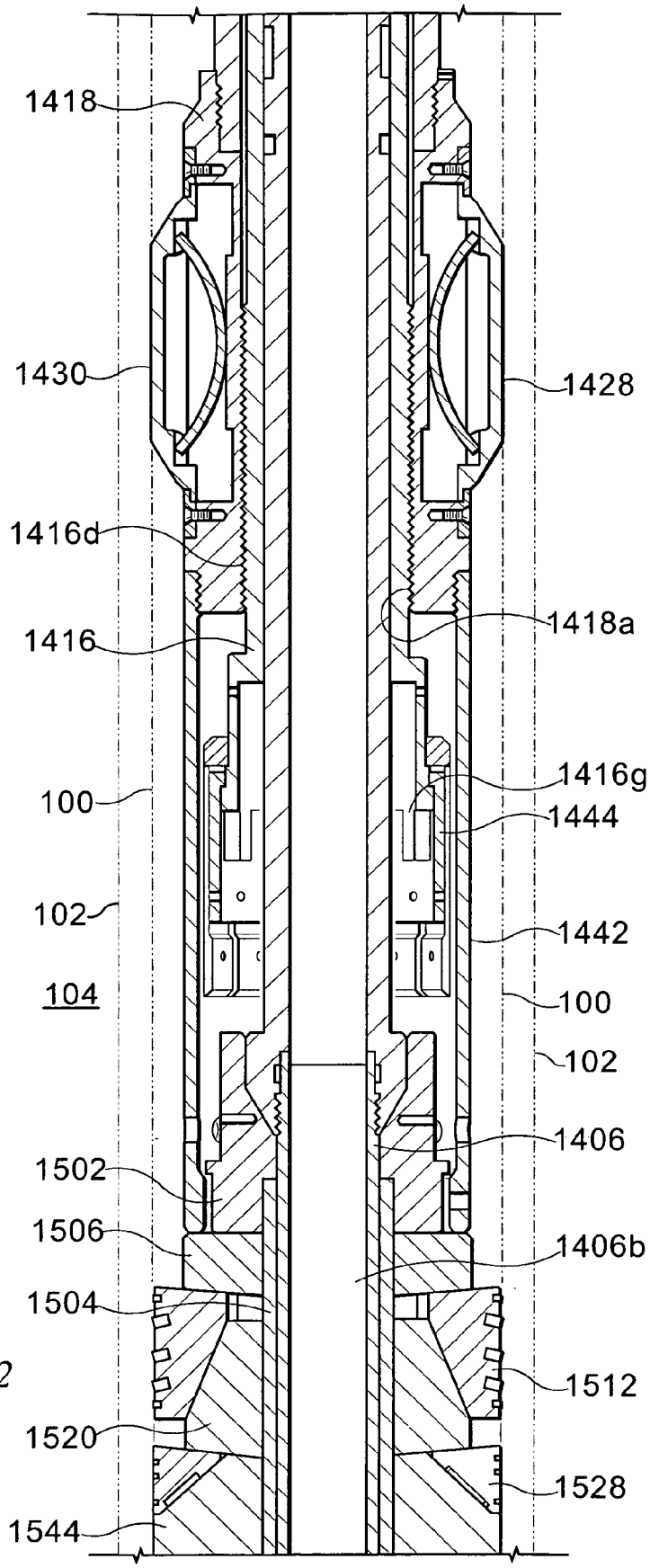
*Fig. 16H2*

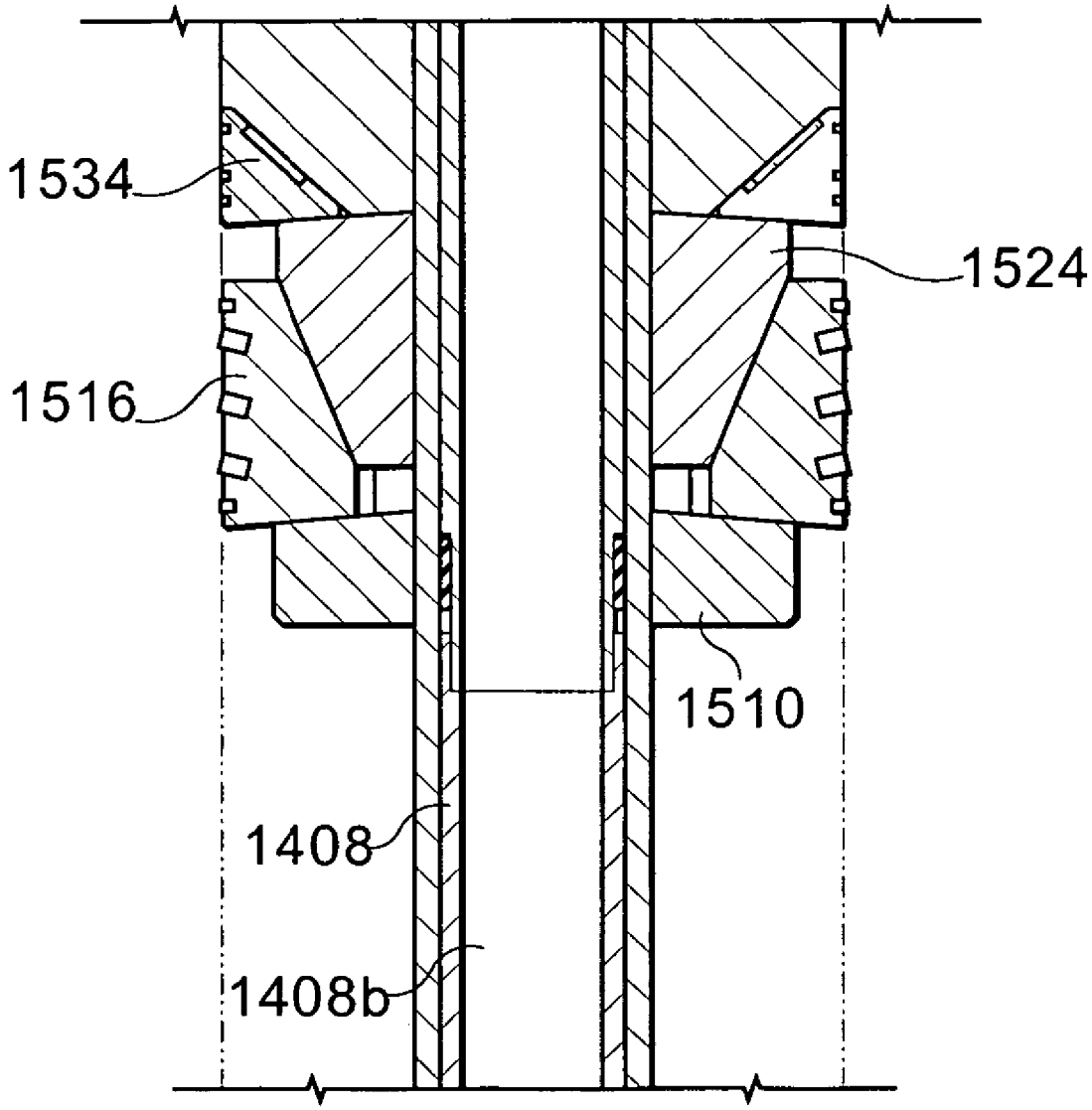
*Fig. 16H3*

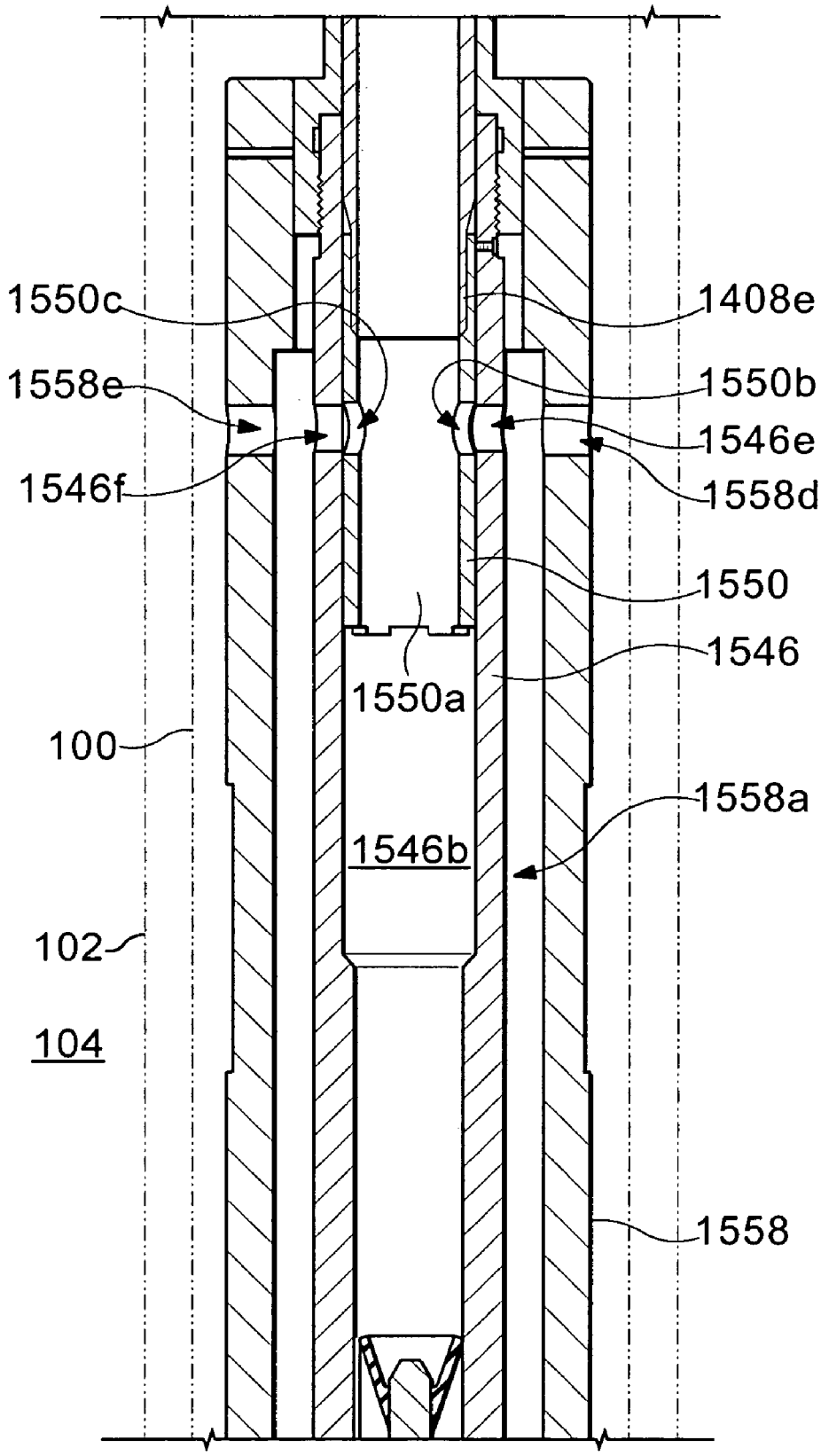
*Fig. 16H4*

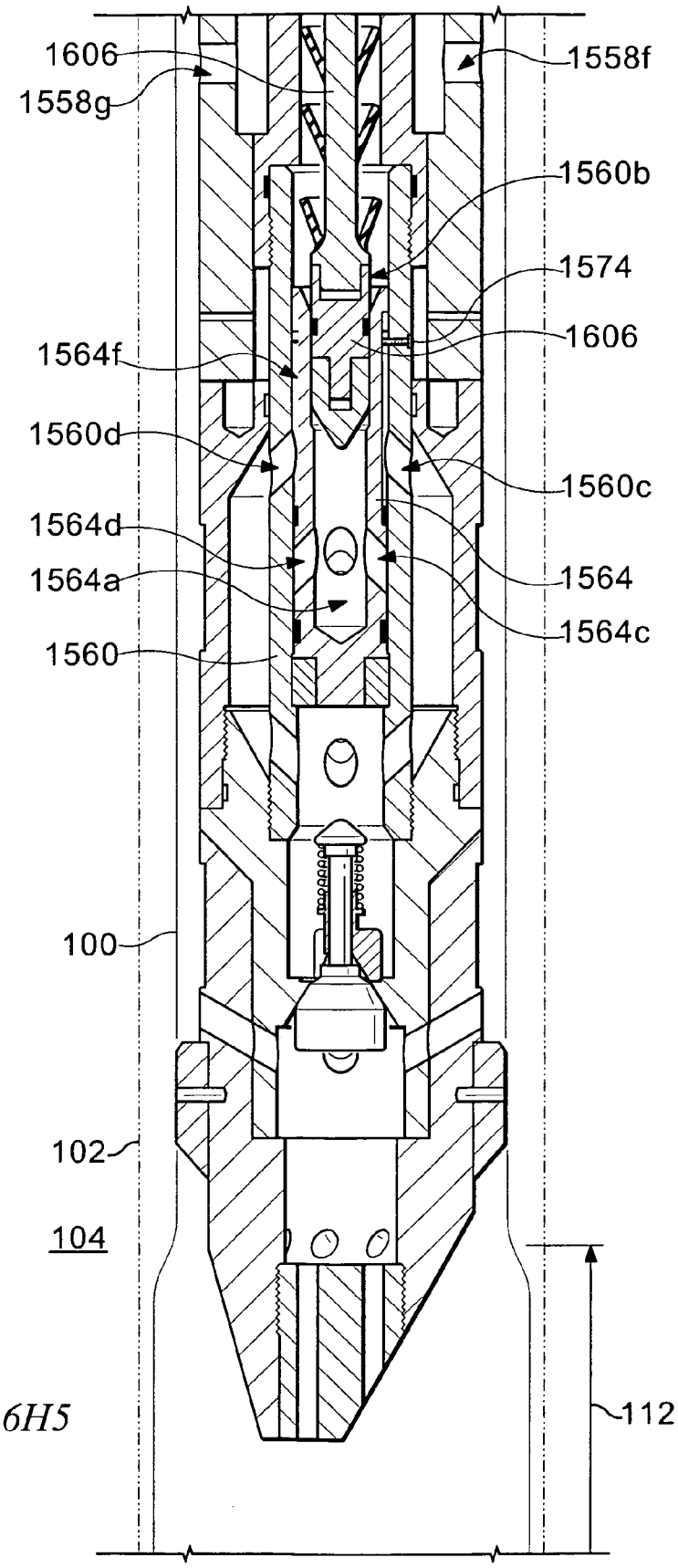
*Fig. 16H5*

APPARATUS FOR RADIALLY EXPANDING AND PLASTICALLY DEFORMING A TUBULAR MEMBER

CROSS REFERENCE TO RELATED APPLICATIONS

The present application claims the benefit of the filing date of U.S. provisional patent application Ser. No. 60/453,678, filed on Mar. 11, 2003, the disclosure of which is incorporated herein by reference.

The present application is a continuation-in-part of the following: (1) PCT patent application Ser. No. PCT/US02/36157, filed on Nov. 12, 2002, (2) PCT patent application Ser. No. PCT/US02/36267, filed on Nov. 12, 2002, (3) PCT patent application Ser. No. PCT/US03/04837, filed on Feb. 29, 2003, (4) PCT patent application Ser. No. PCT/US03/29859, filed on Sep. 22, 2003, (5) PCT patent application Ser. No. PCT/US03/14153, filed on Nov. 13, 2003, (6) PCT patent application Ser. No. PCT/US03/18530, filed on Jun. 11, 2003, (7) PCT patent application Ser. No. PCT/US03/29858, and (8) PCT patent application Ser. No. PCT/US03/29460, filed on Sep. 23, 2003, filed on Sep. 22, 2003, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application serial no. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct.

3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No.

10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on 1213/1999, which claims priority from provisional application 60/111,293, filed on Dec. 17, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, and (122) PCT patent application Ser. No. PCT/U.S.04/06246, filed on Feb. 26, 2004, the disclosures of which are incorporated herein by reference.

BACKGROUND OF THE INVENTION

This invention relates generally to oil and gas exploration, and in particular to forming and repairing wellbore casings to facilitate oil and gas exploration.

SUMMARY OF THE INVENTION

According to one aspect of the present invention, an apparatus for radially expanding and plastically deforming an expandable tubular member is provided that includes a support member, a cutting device for cutting the tubular member coupled to the support member, and an expansion device for radially expanding and plastically deforming the tubular member coupled to the support member.

According to another aspect of the present invention, an apparatus for radially expanding and plastically deforming an expandable tubular member is provided that includes a support member, an expansion device for radially expanding and plastically deforming the tubular member coupled to the support member, and an actuator coupled to the support member for displacing the expansion device relative to the support member.

According to another aspect of the present invention, an apparatus for radially expanding and plastically deforming an expandable tubular member is provided that includes a support member; an expansion device for radially expanding and plastically deforming the tubular member coupled to the support member; and a sealing assembly for sealing an annulus defined between the support member and the tubular member.

According to another aspect of the present invention, an apparatus for radially expanding and plastically deforming an expandable tubular member is provided that includes a support member; a first expansion device for radially expanding and plastically deforming the tubular member coupled to the support member; and a second expansion device for radially expanding and plastically deforming the tubular member coupled to the support member.

According to another aspect of the present invention, an apparatus for radially expanding and plastically deforming an expandable tubular member is provided that includes a support member; an expansion device for radially expanding and plastically deforming the tubular member coupled to the support member; and a packer coupled to the support member.

According to another aspect of the present invention, an apparatus for radially expanding and plastically deforming an expandable tubular member is provided that includes a support member; a cutting device for cutting the tubular member coupled to the support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member.

According to another aspect of the present invention, an apparatus for cutting a tubular member is provided that includes a support member; and a plurality of movable cutting elements coupled to the support member.

According to another aspect of the present invention, an apparatus for engaging a tubular member is provided that includes a support member; and a plurality of movable elements coupled to the support member.

According to another aspect of the present invention, an apparatus for gripping a tubular member is provided that includes a plurality of movable gripping elements.

According to another aspect of the present invention, an actuator is provided that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber.

According to another aspect of the present invention, an apparatus for controlling a packer is provided that includes a tubular support member; one or more drag blocks releasably coupled to the tubular support member; and a tubular stinger coupled to the tubular support member for engaging the packer.

According to another aspect of the present invention, a packer is provided that includes a support member defining a passage; a shoe comprising a float valve coupled to an end of the support member; one or more compressible packer elements movably coupled to the support member; and a sliding sleeve valve movably positioned within the passage of the support member.

According to another aspect of the present invention, a method of radially expanding and plastically deforming an expandable tubular member within a borehole having a preexisting wellbore casing is provided that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section.

According to another aspect of the present invention, a method for forming a mono diameter wellbore casing is provided that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; positioning the adjustable expansion device within a second expandable tubular member; supporting the second expandable tubular member and the adjustable expansion device within the borehole in overlapping relation to the first expandable tubular member; lowering the adjustable expansion device out of the second expandable tubular member; increasing the outside dimension of the adjustable expansion device; and displacing the adjustable expansion device upwardly relative to the second expandable tubular member n times to radially expand and plastically deform n portions of the second expandable tubular member within the borehole.

According to another aspect of the present invention, a method for radially expanding and plastically deforming an expandable tubular member within a borehole is provided that includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device;

displacing the adjustable expansion mandrel upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

According to another aspect of the present invention, a method for forming a mono diameter wellbore casing is provided that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; pressurizing an interior region of the first expandable tubular member above the adjustable expansion device during the radial expansion and plastic deformation of the first expandable tubular member within the borehole; positioning the adjustable expansion mandrel within a second expandable tubular member; supporting the second expandable tubular member and the adjustable expansion mandrel within the borehole in overlapping relation to the first expandable tubular member; lowering the adjustable expansion mandrel out of the second expandable tubular member; increasing the outside dimension of the adjustable expansion mandrel; displacing the adjustable expansion mandrel upwardly relative to the second expandable tubular member n times to radially expand and plastically deform n portions of the second expandable tubular member within the borehole; and pressurizing an interior region of the second expandable tubular member above the adjustable expansion mandrel during the radial expansion and plastic deformation of the second expandable tubular member within the borehole.

According to another aspect of the present invention, a method for radially expanding and plastically deforming an expandable tubular member within a borehole is provided that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; displacing the first adjustable expansion device and the second adjustable expansion device downwardly relative to the second expandable tubular member; decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

According to another aspect of the present invention, a method for radially expanding and plastically deforming an expandable tubular member within a borehole is provided that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; pressurizing an interior region of the expandable tubular member above the first adjustable expansion device during the radial expansion of the lower portion of the expandable tubular member by the first adjustable expansion device; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; pressurizing an interior region of the first expandable tubular member above the first adjustable expansion device during the radial expansion of the lower portion of the first expandable tubular member by the first adjustable expansion device; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; pressurizing an interior region of the first expandable tubular member above the second adjustable expansion device during the radial expansion of the portions of the first expandable tubular member above the lower portion of the first expandable tubular member by the second adjustable expansion device; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; pressurizing an interior region of the second expandable tubular member above the first adjustable expansion device during the radial expansion of the lower portion of the second expandable tubular member by the first adjustable expansion device; displacing the first adjustable expansion device and the second adjustable expansion device downwardly relative to the second expandable tubular member; decreasing the outside dimension of the first adjustable expansion device and increasing the outside dimension of the second adjustable expansion device; displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

According to another aspect of the present invention, a method for radially expanding and plastically deforming an expandable tubular member within a borehole is provided that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member.

According to another aspect of the present invention, a method for forming a mono diameter wellbore casing within a borehole that includes a preexisting wellbore casing is provided that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, a method of radially expanding and plastically deforming a tubular member is provided that includes positioning the tubular member within a preexisting structure; radially expanding and plastically deforming a lower portion of the tubular member to form a bell section; and radially expanding and plastically deforming a portion of the tubular member above the bell section.

According to another aspect of the present invention, a method of radially expanding and plastically deforming a tubular member is provided that includes applying internal pressure to the inside surface of the tubular member at a plurality of discrete location separated from one another.

According to another aspect of the present invention, a system for radially expanding and plastically deforming an expandable tubular member within a borehole having a preexisting wellbore casing is provided that includes means for positioning the tubular member within the borehole in overlapping relation to the wellbore casing; means for radially expanding and plastically deforming a portion of the tubular member to form a bell section; and means for radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section.

According to another aspect of the present invention, a system for forming a mono diameter wellbore casing is provided that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for positioning the adjustable expansion device within a second expandable tubular member; means for supporting the second expandable tubular member and the adjustable expansion device within the borehole in overlapping relation to the first expandable tubular member; means for lowering the adjustable expansion device out of the second expandable tubular member; means for increasing the outside dimension of the adjustable expansion device; and means for displacing the adjustable expansion device upwardly relative to the second expandable tubular member n times to radially expand and plastically deform n portions of the second expandable tubular member within the borehole.

According to another aspect of the present invention, a system for radially expanding and plastically deforming an expandable tubular member within a borehole is provided that includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; means for displacing the adjustable expansion mandrel upwardly relative to the expandable tubular member n times to radially expand and plastically deform n portions of the expandable tubular member within the borehole; and means for pressurizing an interior region of the expandable tubular member above the adjustable expansion device during the radial expansion and plastic deformation of the expandable tubular member within the borehole.

According to another aspect of the present invention, a system for forming a mono diameter wellbore casing is provided that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for pressurizing an interior region of the first expandable tubular member above the adjustable expansion device during the radial expansion and plastic deformation of the first expandable tubular member within the borehole; means for positioning the adjustable expansion mandrel within a second expandable tubular member; means for supporting the second expandable tubular member and the adjustable expansion mandrel within the borehole in overlapping relation to the first expandable tubular member; means for lowering the adjustable expansion mandrel out of the second expandable tubular member; means for increasing the outside dimension of the adjustable expansion mandrel; means for displacing the adjustable expansion mandrel upwardly relative to the second expandable tubular member n times to radially expand and plastically deform n portions of the second expandable tubular member within the borehole; and means for pressurizing an interior region of the second expandable tubular member above the adjustable expansion mandrel during the radial expansion and plastic deformation of the second expandable tubular member within the borehole.

According to another aspect of the present invention, a system for radially expanding and plastically deforming an expandable tubular member within a borehole is provided that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

According to another aspect of the present invention, a system for forming a mono diameter wellbore casing is provided that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; displacing the first adjustable expansion device upwardly relative to the first expandable tubular member to radially expand and plastically deform a lower portion of the first expandable tubular member; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the adjustable expansion device upwardly relative to the second expandable tubular member to radially expand and plastically deform a lower portion of the second expandable tubular member; means for displacing the first adjustable expansion device and the second adjustable expansion device downwardly relative to the second expandable tubular member; means for decreasing the outside dimension of the first adjustable expansion device and increasing the outside dimension of the second adjustable expansion device; and means for displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

According to another aspect of the present invention, a system for radially expanding and plastically deforming an expandable tubular member within a borehole is provided that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for pressurizing an interior region of the expandable tubular member above the first adjustable expansion device during the radial expansion of the lower portion of the expandable tubular member by the first adjustable expansion device; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; and means for pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

According to another aspect of the present invention, a system for forming a mono diameter wellbore casing is provided that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; means for displacing the first adjustable expansion device upwardly relative to the first expandable tubular member to radially expand and plastically deform a lower portion of the first expandable tubular member; means for pressurizing an interior region of the first expandable tubular member above the first adjustable expansion device during the radial expansion of the lower portion of the first expandable tubular member by the first adjustable expansion device; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for pressurizing an interior region of the first expandable tubular member above the second adjustable expansion device during the radial expansion of the portions of the first expandable tubular member above the lower portion of the first expandable tubular member by the second adjustable expansion device; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the first adjustable expansion device upwardly relative to the second expandable tubular member to radially expand and plastically deform a lower portion of the second expandable tubular member; means for pressurizing an interior region of the second expandable tubular member above the first adjustable expansion device during the radial expansion of the lower portion of the second expandable tubular member by the first adjustable expansion device; means for displacing the first adjustable expansion device and the second adjustable expansion device downwardly relative to the second expandable tubular member; means for decreasing the outside dimension of the first adjustable expansion device and increasing the outside dimension of the second adjustable expansion device; means for displacing the second adjustable expansion device upwardly relative to the second expandable tubular member to radially expand and plastically deform portions of the second expandable tubular member above the lower portion of the second expandable tubular member; and means for pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

According to another aspect of the present invention, a system for radially expanding and plastically deforming an expandable tubular member within a borehole is provided that includes means for supporting the expandable tubular member, an hydraulic actuator, and an adjustable expansion device within the borehole; means for increasing the size of the adjustable expansion device; and means for displacing the adjustable expansion device upwardly relative to the expandable tubular member using the hydraulic actuator to radially expand and plastically deform a portion of the expandable tubular member.

According to another aspect of the present invention, a system for forming a mono diameter wellbore casing within a borehole that includes a preexisting wellbore casing is provided that includes means for supporting the expandable tubular member, an hydraulic actuator, and an adjustable expansion device within the borehole; means for increasing the size of the adjustable expansion device; means for displacing the adjustable expansion device upwardly relative to the expandable tubular member using the hydraulic actuator to radially expand and plastically deform a portion of the expandable tubular member; and means for displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, a system for radially expanding and plastically deforming a tubular member is provided that includes means for positioning the tubular member within a preexisting structure; means for radially expanding and plastically deforming a lower portion of the tubular member to form a bell section; and means for radially expanding and plastically deforming a portion of the tubular member above the bell section.

According to another aspect of the present invention, a system of radially expanding and plastically deforming a tubular member is provided that includes a support member; and means for applying internal pressure to the inside surface of the tubular member at a plurality of discrete location separated from one another coupled to the support member.

According to another aspect of the present invention, a method of cutting a tubular member is provided that includes positioning a plurality of cutting elements within the tubular member; and bringing the cutting elements into engagement with the tubular member.

According to another aspect of the present invention, a method of gripping a tubular member is provided that includes positioning a plurality of gripping elements within the tubular member; bringing the gripping elements into engagement with the tubular member. In an exemplary embodiment, bringing the gripping elements into engagement with the tubular member includes displacing the gripping elements in an axial direction; and displacing the gripping elements in a radial direction.

According to another aspect of the present invention, a method of operating an actuator is provided that includes pressurizing a plurality of pressure chamber.

According to another aspect of the present invention, a method of injecting a hardenable fluidic sealing material into an annulus between a tubular member and a preexisting structure is provided that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

According to another aspect of the present invention, a system for cutting a tubular member is provided that includes means for positioning a plurality of cutting elements within the tubular member; and means for bringing the cutting elements into engagement with the tubular member.

According to another aspect of the present invention, a system for gripping a tubular member is provided that includes means for positioning a plurality of gripping elements within the tubular member; and means for bringing the gripping elements into engagement with the tubular member.

According to another aspect of the present invention, an actuator system is provided that includes a support member; and means for pressurizing a plurality of pressure chambers coupled to the support member. In an exemplary embodiment, the system further includes means for transmitting torsional loads.

According to another aspect of the present invention, a system for injecting a hardenable fluidic sealing material into an annulus between a tubular member and a preexisting structure is provided that includes means for positioning the tubular member into the preexisting structure; means for sealing off an end of the tubular member; means for operating a valve within the end of the tubular member; and means for injecting a hardenable fluidic sealing material through the valve into the annulus between the tubular member and the preexisting structure.

According to another aspect of the present invention, a method of engaging a tubular member is provided that includes positioning a plurality of elements within the tubular member; and bringing the elements into engagement with the tubular member.

According to another aspect of the present invention, a system for engaging a tubular member is provided that includes means for positioning a plurality of elements within the tubular member; and means for bringing the elements into engagement with the tubular member. In an exemplary embodiment, the elements include a first group of elements; and a second group of elements; wherein the first group of elements are interleaved with the second group of elements.

BRIEF DESCRIPTION OF THE DRAWINGS

FIGS. 11-1 and 11-2, 11A1 to 11A2, 11B1 to 11B2, 11C, 11D, 11E, 11F, 11G, 11H, 11I, **11*j*, and 11K** are fragmentary cross-sectional and perspective illustrations of an exemplary embodiment of a casing cutter assembly.

FIGS. 12A1 to 12A4 and 12C1 to 12C4 are fragmentary cross-sectional illustrations of an exemplary embodiment of a ball gripper assembly.

FIG. 12B is a top view of a portion of the ball gripper assembly of FIGS. 12A1 to 12A4 and 12C1 to 12C4.

FIGS. 13A1 to 13A8 and 13B1 to 13B7 are fragmentary cross-sectional illustrations of an exemplary embodiment of a tension actuator assembly.

FIGS. 15-1 to 15-5 is a fragmentary cross-sectional illustration of an exemplary embodiment of a packer assembly.

FIGS. 16A1 to 16A5, 16B1 to 16B5, 16C1 to 16C5, 16D1 to 16D5, 16E1 to 16E6, 16F1 to 16F6, 16G1 to 16G6, and 16H1 to 16H5, are fragmentary cross-sectional illustrations of an exemplary embodiment of the operation of the packer setting tool and the packer assembly of FIGS. 14A to 14C and 15-1 to 15-5.

DETAILED DESCRIPTION OF THE ILLUSTRATIVE EMBODIMENTS

Figure 1:
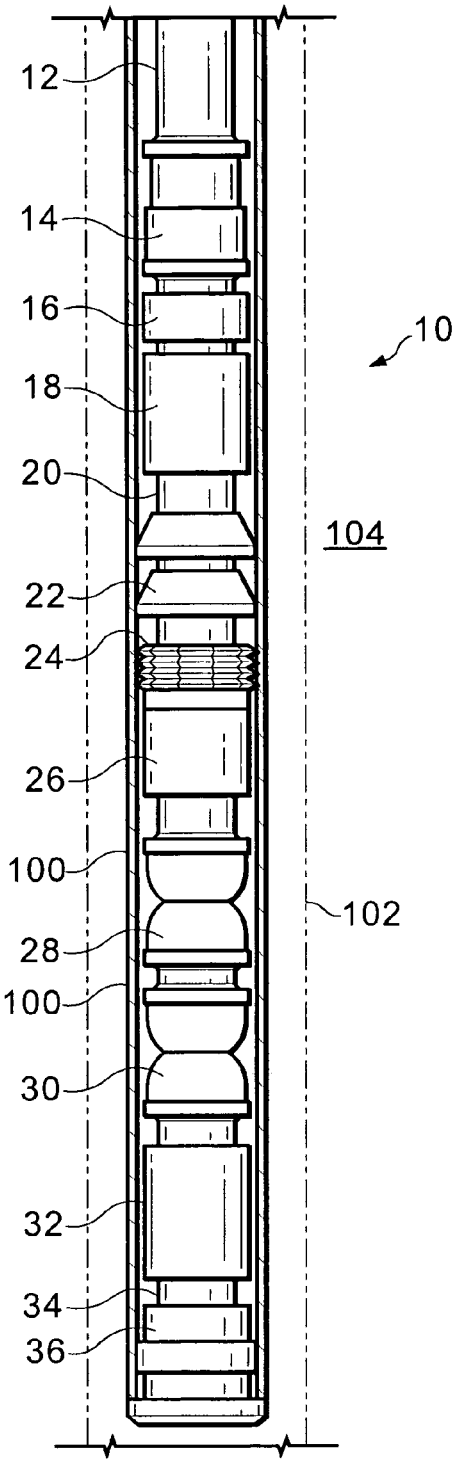
FIG. 1 is a fragmentary cross-sectional illustration of an embodiment of a system for radially expanding and plastically deforming wellbore casing, including a tubular support member, a casing cutter, a ball gripper for gripping a wellbore casing, a force multiplier tension actuator, a safety sub, a cup sub, a casing lock, an extension actuator, a bell section adjustable expansion cone assembly, a casing section adjustable expansion cone assembly, a packer setting tool, a packer, a stinger, and an expandable wellbore casing, during the placement of the system within a wellbore.

Referring initially to FIGS. 1-10, an exemplary embodiment of a system 10 for radially expanding and plastically deforming a wellbore casing includes a conventional tubular support 12 having an end that is coupled to an end of a casing cutter assembly 14. In an exemplary embodiment, the casing cutter assembly 14 may be, or may include elements, of one or more conventional commercially available casing cutters for cutting wellbore casing, or equivalents thereof.

An end of a ball gripper assembly 16 is coupled to another end of the casing cutter assembly 14. In an exemplary embodiment, the ball gripper assembly 14 may be, or may include elements, of one or more conventional commercially available ball grippers, or other types of gripping devices, for gripping wellbore casing, or equivalents thereof.

An end of a tension actuator assembly 18 is coupled to another end of the ball gripper assembly 16. In an exemplary embodiment, the tension actuator assembly 18 may be, or may include elements, of one or more conventional commercially actuators, or equivalents thereof.

An end of a safety sub assembly 20 is coupled to another end of the tension actuator assembly 18. In an exemplary embodiment, the safety sub assembly 20 may be, or may include elements, of one or more conventional apparatus that provide quick connection and/or disconnection of tubular members, or equivalents thereof.

An end of a sealing cup assembly 22 is coupled to another end of the safety sub assembly 20. In an exemplary embodiment, the sealing cup assembly 22 may be, or may include elements, of one or more conventional sealing cup assemblies, or other types of sealing assemblies, that sealingly engage the interior surfaces of surrounding tubular members, or equivalents thereof.

An end of a casing lock assembly 24 is coupled to another end of the sealing cup assembly 22. In an exemplary embodiment, the casing lock assembly 24 may be, or may include elements, of one or more conventional casing lock assemblies that lock the position of wellbore casing, or equivalents thereof.

An end of an extension actuator assembly 26 is coupled to another end of the casing lock assembly 24. In an exemplary embodiment, the extension actuator assembly 26 may be, or may include elements, of one or more conventional actuators, or equivalents thereof.

An end of an adjustable bell section expansion cone assembly 28 is coupled to another end of the extension actuator assembly 26. In an exemplary embodiment, the adjustable bell section expansion cone assembly 28 may be, or may include elements, of one or more conventional adjustable expansion devices for radially expanding and plastically deforming wellbore casing, or equivalents thereof.

An end of an adjustable casing expansion cone assembly 30 is coupled to another end of the adjustable bell section expansion cone assembly 28. In an exemplary embodiment, the adjustable casing expansion cone assembly 30 may be, or may include elements, of one or more conventional adjustable expansion devices for radially expanding and plastically deforming wellbore casing, or equivalents thereof.

An end of a packer setting tool assembly 32 is coupled to another end of the adjustable casing expansion cone assembly 30. In an exemplary embodiment, the packer setting tool assembly 32 may be, or may include elements, of one or more conventional adjustable expansion devices for controlling the operation of a conventional packer, or equivalents thereof.

An end of a stinger assembly 34 is coupled to another end of the packer setting tool assembly 32. In an exemplary embodiment, the stinger assembly 34 may be, or may include elements, of one or more conventional devices for engaging a conventional packer, or equivalents thereof.

An end of a packer assembly 36 is coupled to another end of the stinger assembly 34. In an exemplary embodiment, the packer assembly 36 may be, or may include elements, of one or more conventional packers.

As illustrated in FIG. 1, in an exemplary embodiment, during operation of the system 10, an expandable wellbore casing 100 is coupled to and supported by the casing lock assembly 24 of the system. The system 10 is then positioned within a wellbore 102 that traverses a subterranean formation 104 and includes a preexisting wellbore casing 106.

Figure 2:
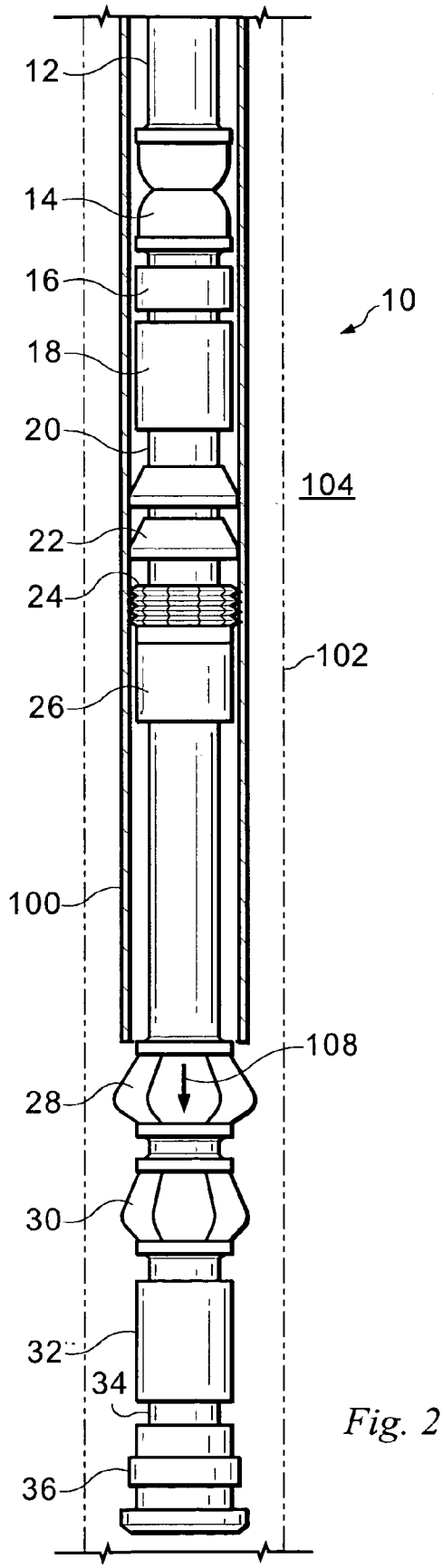
FIG. 2 is a fragmentary cross-sectional illustration of the system of FIG. 1 during the subsequent displacement of the bell section adjustable expansion cone assembly, the casing section adjustable expansion cone assembly, the packer setting tool, the packer, and the stinger downwardly out of the end of the expandable wellbore casing and the expansion of the size of the bell section adjustable expansion cone assembly and the casing section adjustable expansion cone assembly.

As illustrated in FIG. 2, in an exemplary embodiment, the extension actuator assembly 26 is then operated to move the adjustable bell section expansion cone assembly 28, adjustable casing expansion cone assembly 30, packer setting tool assembly 32, stinger assembly 34, packer assembly 36 downwardly in a direction 108 and out of an end of the expandable wellbore casing 100. After the adjustable bell section expansion cone assembly 28 and adjustable casing expansion cone assembly 30 have been moved to a position out of the end of the expandable wellbore casing 100, the adjustable bell section expansion cone assembly and adjustable casing expansion cone assembly are then operated to increase the outside diameters of the expansion cone assemblies. In an exemplary embodiment, the increased outside diameter of the adjustable bell section expansion cone assembly 28 is greater than the increased outside diameter of the adjustable casing expansion cone assembly 30.

Figure 3:
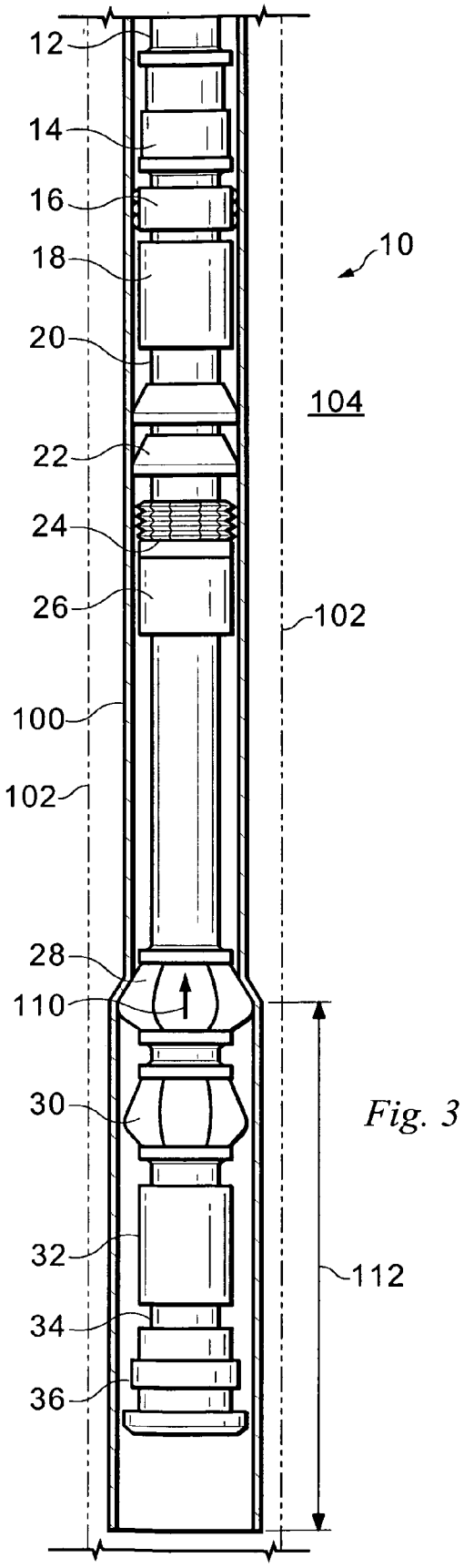
FIG. 3 is a fragmentary cross-sectional illustration of the system of FIG. 2 during the subsequent operation of the tension actuator to displace the bell section adjustable expansion cone assembly upwardly into the end of the expandable wellbore casing to form a bell section in the end of the expandable wellbore casing.

As illustrated in FIG. 3, in an exemplary embodiment, the ball gripper assembly 16 is then operated to engage and hold the position of the expandable tubular member 100 stationary relative to the tubular support member 12. The tension actuator assembly 18 is then operated to move the adjustable bell section expansion cone assembly 28, adjustable casing expansion cone assembly 30, packer setting tool assembly 32, stinger assembly 34, packer assembly 36 upwardly in a direction 110 into and through the end of the expandable wellbore casing 100. As a result, the end of the expandable wellbore casing 100 is radially expanded and plastically deformed by the adjustable bell section expansion cone assembly 28 to form a bell section 112. In an exemplary embodiment, during the operation of the system 10 described above with reference to FIG. 3, the casing lock assembly 24 may or may not be coupled to the expandable wellbore casing 100.

In an exemplary embodiment, the length of the end of the expandable wellbore casing 100 that is radially expanded and plastically deformed by the adjustable bell section expansion cone assembly 28 is limited by the stroke length of the tension actuator assembly 18. In an exemplary embodiment, once the tension actuator assembly 18 completes a stroke, the ball gripper assembly 16 is operated to release the expandable tubular member 100, and the tubular support 12 is moved upwardly to permit the tension actuator assembly to be re-set. In this manner, the length of the bell section 112 can be further extended by continuing to stroke and then re-set the position of the tension actuator assembly 18. Note, that, during the upward movement of the tubular support 12 to re-set the position of the tension actuator assembly 18, the expandable tubular wellbore casing 100 is supported by the expansion surfaces of the adjustable bell section expansion cone assembly 28.

Figure 4:
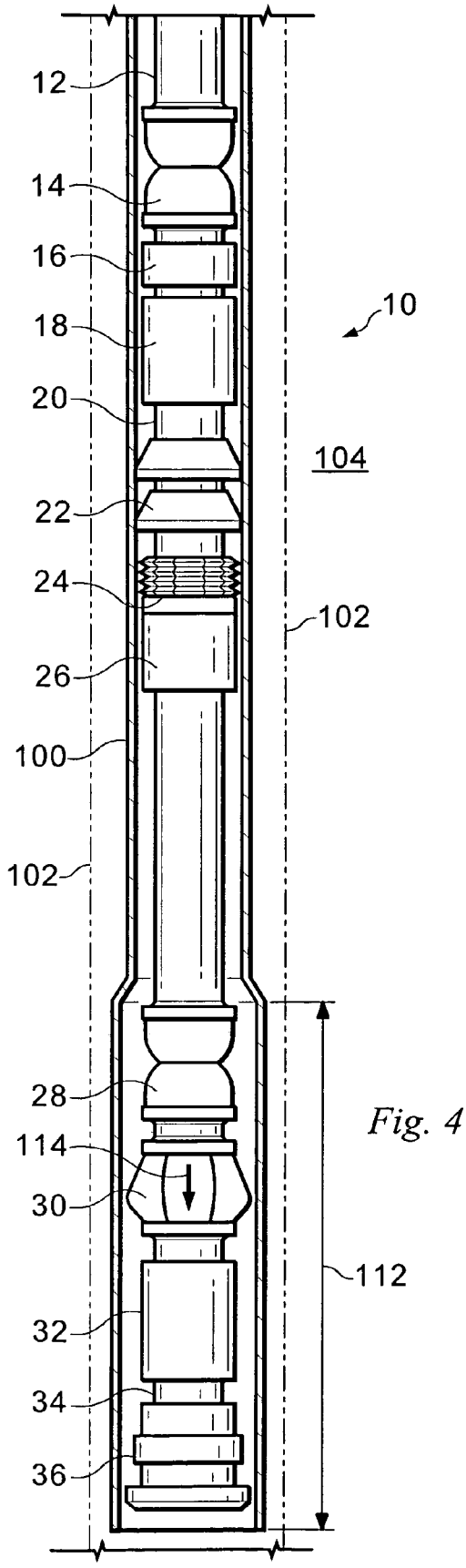
FIG. 4 is a fragmentary cross-sectional illustration of the system of FIG. 3 during the subsequent reduction of the bell section adjustable expansion cone assembly.

As illustrated in FIG. 4, in an exemplary embodiment, the casing lock assembly 24 is then operated to engage and maintain the position of the expandable wellbore casing 100 stationary relative to the tubular support 12. The adjustable bell section expansion cone assembly 28, adjustable casing expansion cone assembly 30, packer setting tool assembly 32, stinger assembly 34, and packer assembly 36 are displaced downwardly into the bell section 112 in a direction 114 relative to the expandable wellbore casing 100 by operating the extension actuator 26 and/or by displacing the system 10 downwardly in the direction 114 relative to the expandable wellbore casing. After the adjustable bell section expansion cone assembly 28 and adjustable casing expansion cone assembly 30 have been moved downwardly in the direction 114 into the bell section 112 of the expandable wellbore casing 100, the adjustable bell section expansion cone assembly is then operated to decrease the outside diameter of the adjustable bell section expansion cone assembly. In an exemplary embodiment, the decreased outside diameter of the adjustable bell section expansion cone assembly 28 is less than the increased outside diameter of the adjustable casing expansion cone assembly 30. In an exemplary embodiment, during the operation of the system illustrated and described above with reference to FIG. 4, the ball gripper 16 may or may not be operated to engage the expandable wellbore casing 100.

Figure 5:
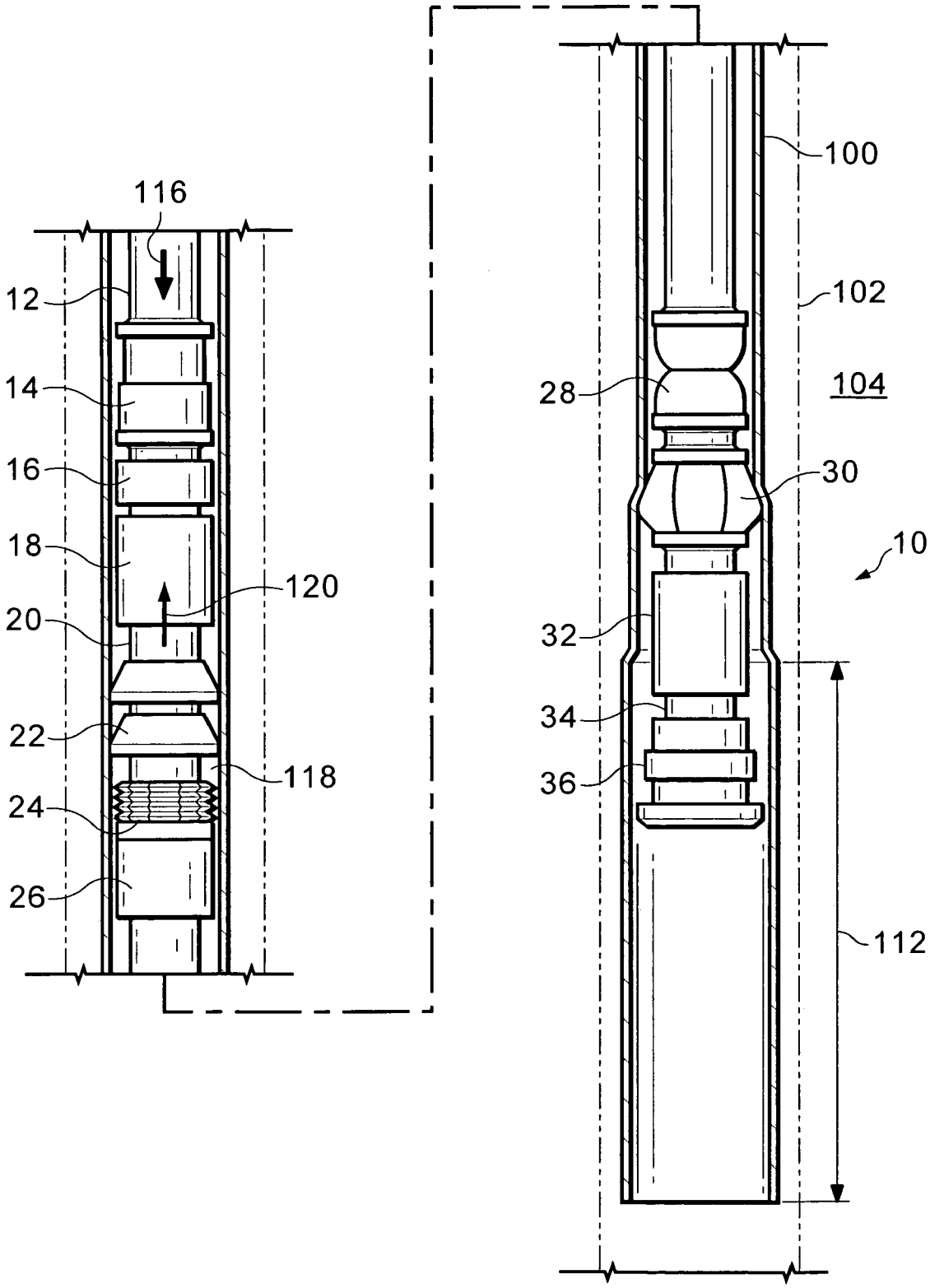
FIG. 5 is a fragmentary cross-sectional illustration of the system of FIG. 4 during the subsequent upward displacement of the expanded casing section adjustable expansion cone assembly to radially expand the expandable wellbore casing.

As illustrated in FIG. 5, in an exemplary embodiment, the casing lock assembly 24 is then disengaged from the expandable wellbore casing 100 and fluidic material 116 is then injected into the system 10 through the tubular support 12 to thereby pressurize an annulus 118 defined within the expandable wellbore casing below the cup sub assembly 22. As a result, a pressure differential is created across the cup seal assembly 22 that causes the cup seal assembly to apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing.

In an exemplary embodiment, the tension actuator assembly 16 may also be operated during the injection of the fluidic material 116 to displace the adjustable casing expansion cone assembly 30 upwardly relative to the tubular support 12. As a result, additional expansion forces may be applied to the expandable wellbore casing 100.

Figure 6:
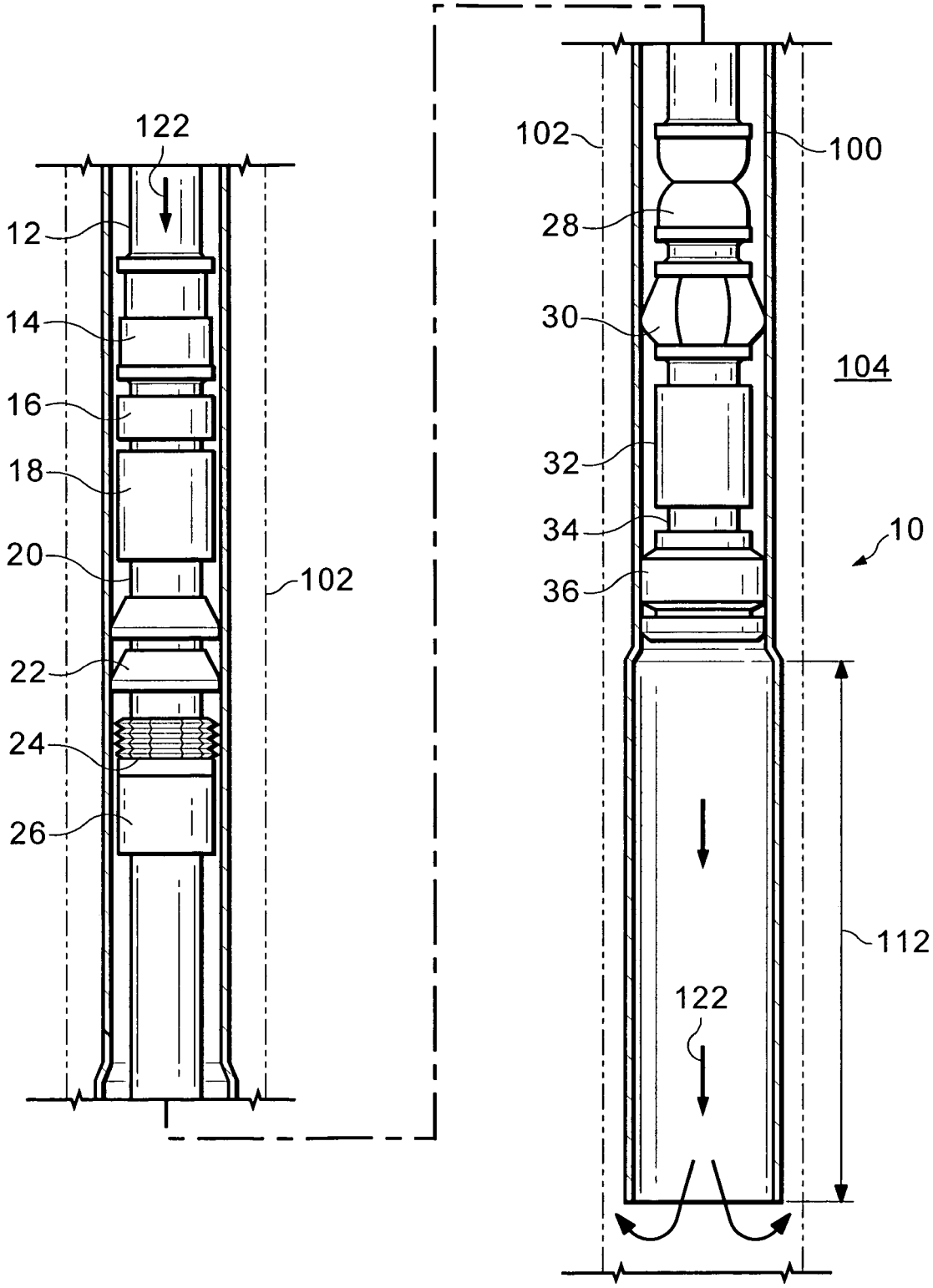
FIG. 6 is a fragmentary cross-sectional illustration of the system of FIG. 5 during the subsequent lowering of the tubular support member, casing cutter, ball gripper, a force multiplier tension actuator, safety sub, cup sub, casing lock, extension actuator, bell section adjustable expansion cone assembly, casing section adjustable expansion cone assembly, packer setting tool, packer, and stinger and subsequent setting of the packer within the expandable wellbore casing above the bell section.

As illustrated in FIG. 6, in an exemplary embodiment, the radial expansion and plastic deformation of the expandable wellbore casing using the adjustable casing expansion cone assembly 30 continues until the packer assembly 36 is positioned within a portion of the expandable tubular member above the bell section 112. The packer assembly 36 may then be operated to engage the interior surface of the expandable wellbore casing 100 above the bell section 112.

In an exemplary embodiment, after the packer assembly 36 is operated to engage the interior surface of the expandable wellbore casing 100 above the bell section 112, a hardenable fluidic sealing material 122 may then be injected into the system 10 through the tubular support 12 and then out of the system through the packer assembly to thereby permit the annulus between the expandable wellbore casing and the wellbore 102 to be filled with the hardenable fluidic sealing material. The hardenable fluidic sealing material 122 may then be allowed to cure to form a fluid tight annulus between the expandable wellbore casing 100 and the wellbore 102, before, during, or after the completion of the radial expansion and plastic deformation of the expandable wellbore casing.

Figure 7:
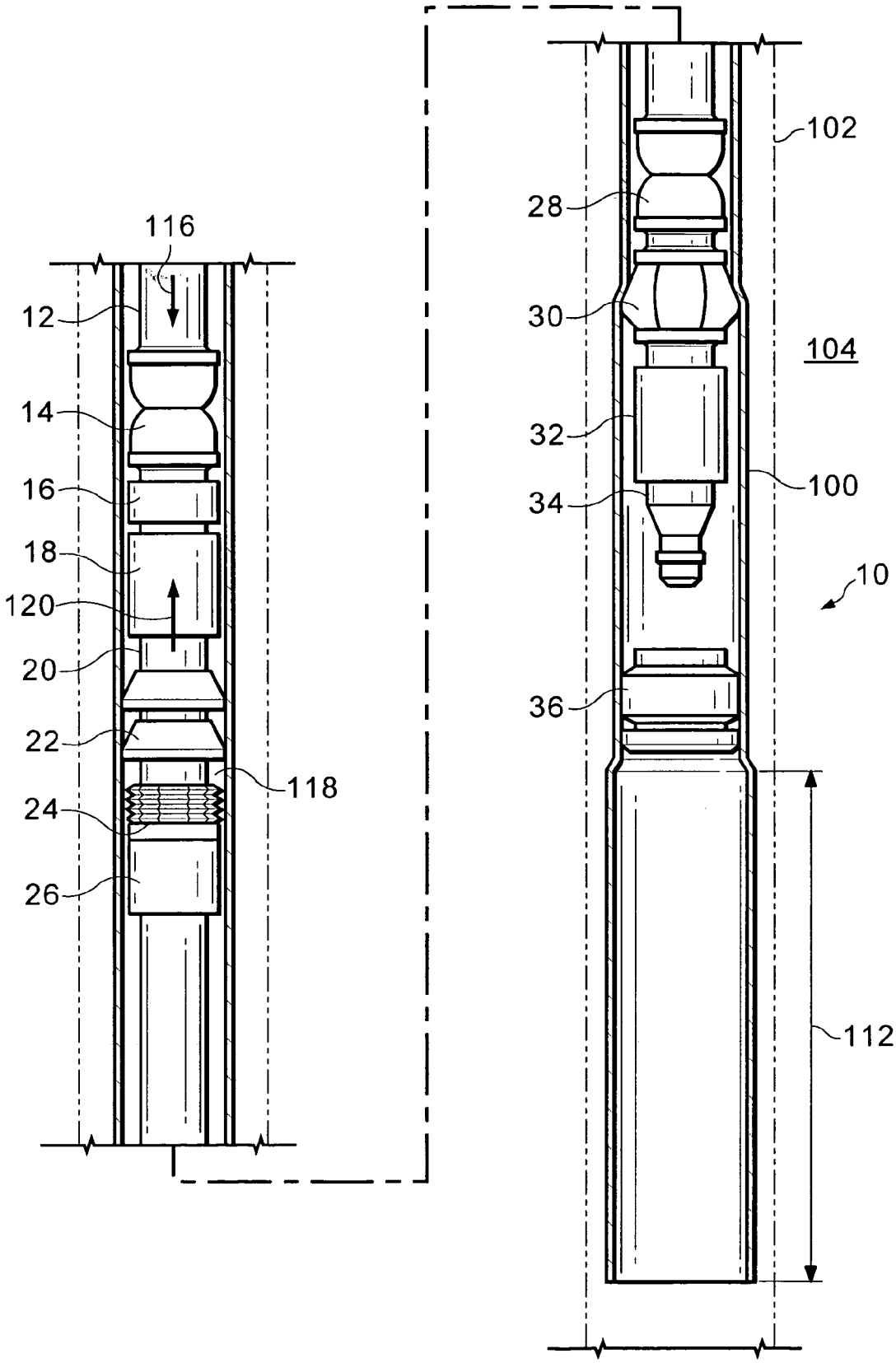
FIG. 7 is a fragmentary cross-sectional illustration of the system of FIG. 6 during the subsequent injection of fluidic materials into the system to displace the expanded casing section adjustable expansion cone assembly upwardly through the expandable wellbore casing to radially expand and plastically deform the expandable wellbore casing.

As illustrated in FIG. 7, in an exemplary embodiment, the fluidic material 116 is then re-injected into the system 10 through the tubular support 12 to thereby re-pressurize the annulus 118 defined within the expandable wellbore casing below the cup sub assembly 22. As a result, a pressure differential is once again created across the cup seal assembly 22 that causes the cup seal assembly to once again apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing and disengaging the stinger assembly 34 from the packer assembly 36. In an exemplary embodiment, during this operational mode, the packer assembly 36 prevents the flow of fluidic materials out of the expandable wellbore casing 100. As a result, the pressurization of the annulus 118 is rapid and efficient thereby enhancing the operational efficiency of the subsequent radial expansion and plastic deformation of the expandable wellbore casing 100.

In an exemplary embodiment, the tension actuator assembly 16 may also be operated during the re-injection of the fluidic material 116 to displace the adjustable casing expansion cone assembly 30 upwardly relative to the tubular support 12. As a result, additional expansion forces may be applied to the expandable wellbore casing 100.

Figure 8:
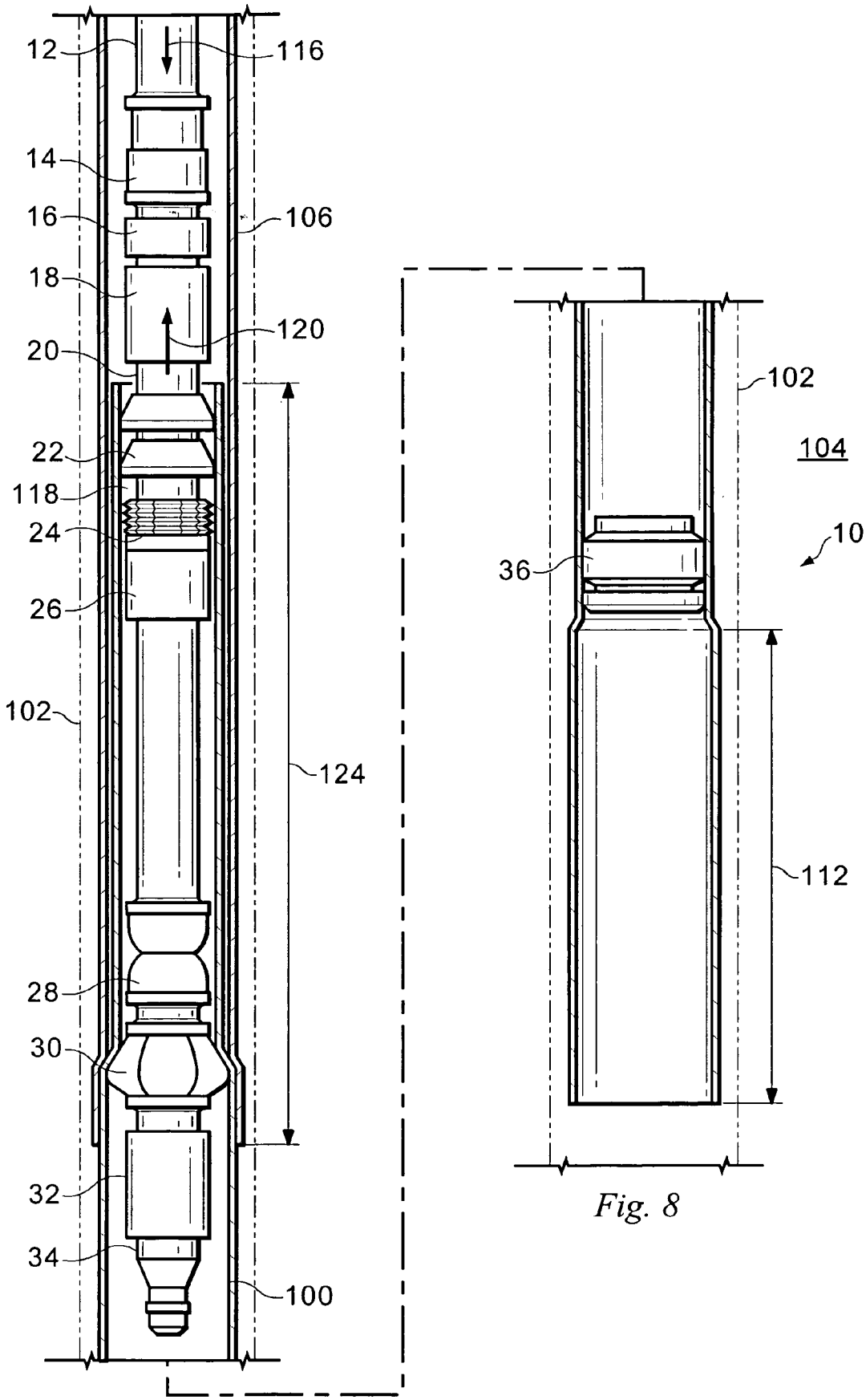
FIG. 8 is a fragmentary cross-sectional illustration of the system of FIG. 7 during the subsequent injection of fluidic materials into the system to displace the expanded casing section adjustable expansion cone assembly upwardly through the expandable wellbore casing and a surrounding preexisting wellbore casing to radially expand and plastically deform the overlapping expandable wellbore casing and the surrounding preexisting wellbore casing.

As illustrated in FIG. 8, in an exemplary embodiment, the radial expansion and plastic deformation of the expandable wellbore casing using the adjustable casing expansion cone assembly 30 continues until the adjustable casing expansion cone assembly 30 reaches the portion 124 of the expandable wellbore casing 100 that overlaps with the preexisting wellbore casing 106. At which point, the system 10 may radially expand the portion 124 of the expandable wellbore casing 100 that overlaps with the preexisting wellbore casing 106 and the surrounding portion of the preexisting wellbore casing. Consequently, in an exemplary embodiment, during the radial expansion of the portion 124 of the expandable wellbore casing 100 that overlaps with the preexisting wellbore casing 106, the tension actuator assembly 16 is also operated to displace the adjustable casing expansion cone assembly 30 upwardly relative to the tubular support 12. As a result, additional expansion forces may be applied to the expandable wellbore casing 100 and the preexisting wellbore casing 106 during the radial expansion of the portion 124 of the expandable wellbore casing that overlaps with the preexisting wellbore casing.

Figure 9:
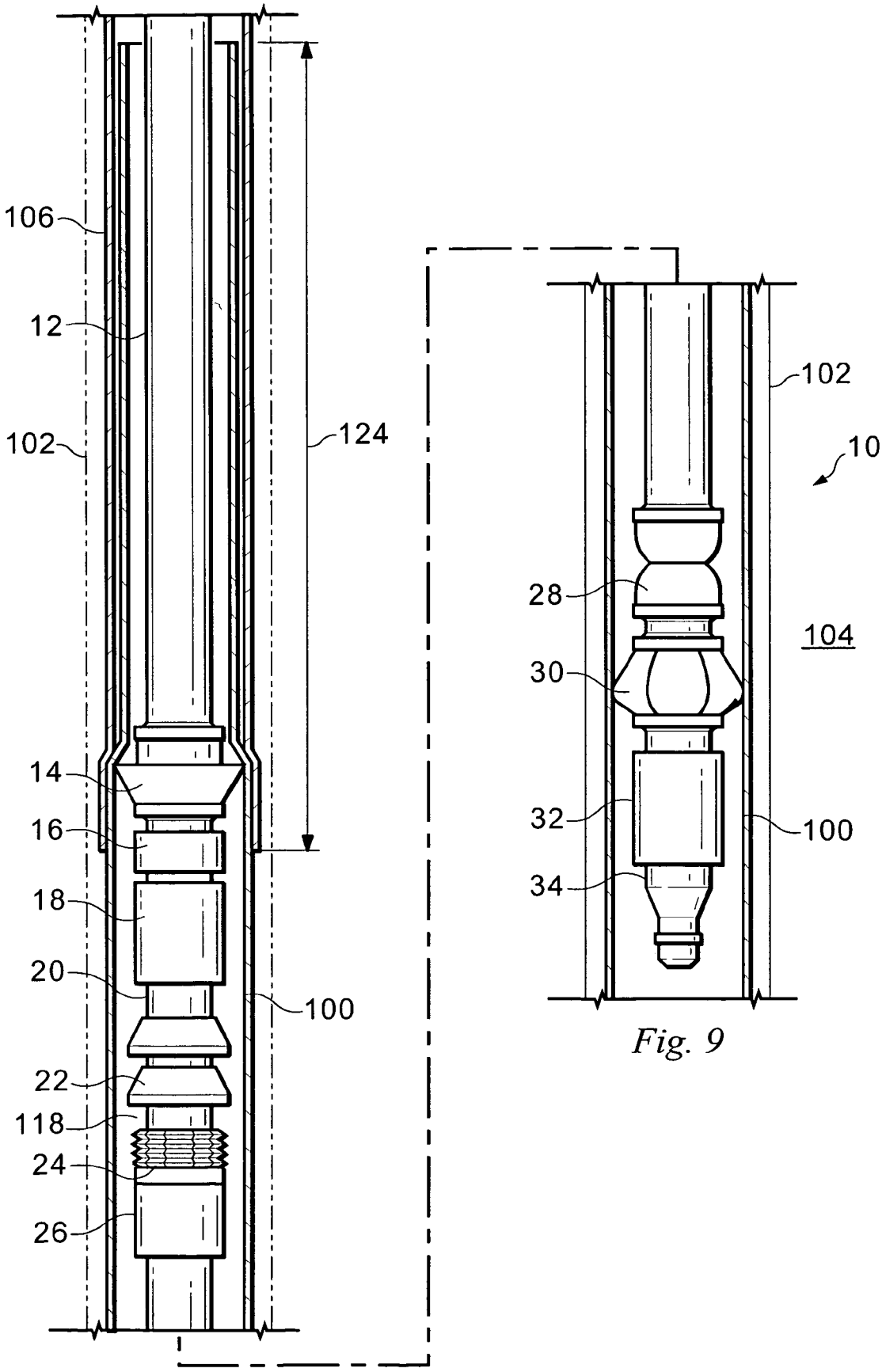
FIG. 9 is a fragmentary cross-sectional illustration of the system of FIG. 8 during the subsequent operation of the casing cutter to cut off an end of the expandable wellbore casing.

As illustrated in FIG. 9, in an exemplary embodiment, the entire length of the portion 124 of the expandable wellbore casing 100 that overlaps with the preexisting wellbore casing 106 is not radially expanded and plastically deformed. Rather, only part of the portion 124 of the expandable wellbore casing 100 that overlaps with the preexisting wellbore casing 106 is radially expanded and plastically deformed. The remaining part of the portion 124 of the expandable wellbore casing 100 that overlaps with the preexisting wellbore casing 106 is then cut away by operating the casing cutter assembly 14.

Figure 10:
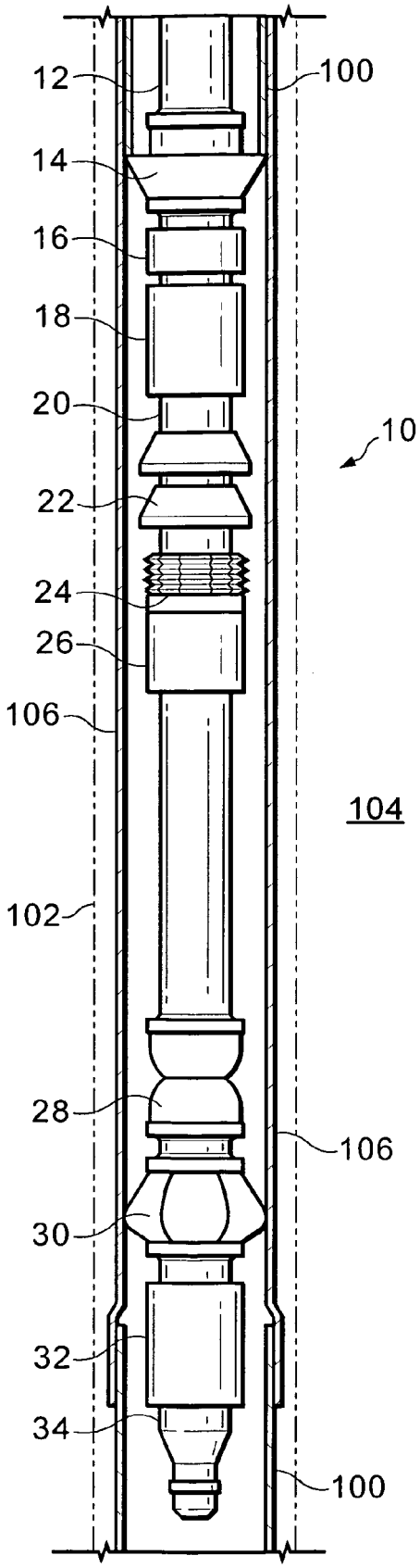
FIG. 10 is a fragmentary cross-sectional illustration of the system of FIG. 9 during the subsequent removal of the cut off end of the expandable wellbore casing.

As illustrated in FIG. 10, the remaining part of the portion 124 of the expandable wellbore casing 100 that overlaps with the preexisting wellbore casing 106 that is cut away by operating the casing cutter assembly 14 is then also carried out of the wellbore 102 using the casing cutter assembly.

Furthermore, in an exemplary embodiment, the inside diameter of the expandable wellbore casing 100 above the bell section 112 is equal to the inside diameter of the portion of the preexisting wellbore casing 106 that does not overlap with the expandable wellbore casing 100. As a result, a wellbore casing is constructed that includes overlapping wellbore casings that together define an internal passage having a constant cross-sectional area.

In several exemplary embodiments, the system 10 includes one or more of the methods and apparatus disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. no. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, attorney docket no. 25791.46.07, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No.

60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856,. filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 11, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on 8/8103, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, and (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, the disclosures of which are incorporated herein by reference.

In an exemplary embodiment, the casing cutter assembly 14 is provided and operates substantially, at least in part, as disclosed in PCT patent application Ser. No. PCT/US03/29858, filed on Sep. 22, 2003, the disclosure of which is incorporated herein by reference.

In an exemplary embodiment, as illustrated in FIGS. 11-1 and 11-2, 11A1 to 11A2, 11B1 to 11B2, 11C, 11D, 11E, 11F, 11G, 11H, 11I, 11J, and 11K, the casing cutter assembly 14 includes an upper tubular tool joint 11002 that defines a longitudinal passage 11002*a* and mounting holes, 11002*b* and 11002*c*, and includes an internal threaded connection 11002*d*, an inner annular recess 11002*e*, an inner annular recess 11002*f*, and an internal threaded connection 11002*g*. A tubular torque plate 11004 that defines a longitudinal passage 11004*a* and includes circumferentially spaced apart teeth 11004*b* is received within, mates with, and is coupled to the internal annular recess 11002*e* of the upper tubular tool joint 11002.

Circumferentially spaced apart teeth 11006*a* of an end of a tubular lower mandrel 11006 that defines a longitudinal passage 11006*b*, a radial passage 11006*ba*, and a radial passage 11006*bb* and includes an external threaded connection 11006*c*, an external flange 11006*d*, an external annular recess 11006*e* having a step 11006*f* at one end, an external annular recess 11006*g*, external teeth 11006*h*, an external threaded connection 11006*i*, and an external annular recess 11006*j* engage the circumferentially spaced apart teeth 11004*b* of the tubular torque plate 11004. An internal threaded connection 11008*a* of an end of a tubular toggle bushing 11008 that defines a longitudinal passage 11008*b*, an upper longitudinal slot 11008*c*, a lower longitudinal slot 11008*d*, mounting holes, 11008*e*, 11008*f*, 11008*g*, 11008*h*, 11008*i*, 11008*j*, 11008*k*, 11008*l*, 11008*m*, 11008*n*, 11008*o*, 11008*p*, 11008*q*, 11008*r*, 11008*s*, 11008*t*, 11008*u*, 11008*v*, 11008*w*, 11008*x*, 11008*xa*, and 11008*xb*, and includes an external annular recess 11008*y*, internal annular recess 11008*z*, external annular recess 11008*aa*, and an external annular recess 11008*ab* receives and is coupled to the external threaded connection 11006*c* of the tubular lower mandrel 11006.

A sealing element 11010 is received within the external annular recess 11008*y* of the tubular toggle bushing 11008 for sealing the interface between the tubular toggle bushing and the upper tubular tool joint 11002. A sealing element 11012 is received within the internal annular recess 11008*z* of the tubular toggle bushing 11008 for sealing the interface between the tubular toggle bushing and the tubular lower mandrel 11006.

Mounting screws, 11014*a* and 11014*b*, mounted within and coupled to the mounting holes, 11008*w* and 11008*x*, respectively, of the tubular toggle bushing 11008 are also received within the mounting holes, 11002*b* and 11002*c*, of the upper tubular tool joint 11002. Mounting pins, 11016*a*, 11016*b*, 11016*c*, 11016*d*, and 11016*e*, are mounted within the mounting holes, 11008*e*, 11008*f*, 11008*g*, 11008*h*, and 11008*i*, respectively. Mounting pins, 11018*a*, 11018*b*, 11018*c*, 11018*d*, and 11018*e*, are mounted within the mounting holes, 11008*t*, 11008*s*, 11008*r*, 11008*q*, and 11008*p*, respectively. Mounting screws, 11020*a* and 11020*b*, are mounted within the mounting holes, 11008*u* and 11008*v*, respectively.

A first upper toggle link 11022 defines mounting holes, 11022*a* and 11022*b*, for receiving the mounting pins, 11016*a* and 11016*b*, and includes a mounting pin 11022*c* at one end. A first lower toggle link 11024 defines mounting holes, 11024*a*, 11024*b*, and 11024*c*, for receiving the mounting pins, 11022*c*, 11016*c*, and 11016*d*, respectively and includes an engagement arm 11024*d*. A first trigger 11026 defines a mounting hole 11026*a* for receiving the mounting pin 11016*e* and includes an engagement arm 11026*b* at one end, an engagement member 11026*c*, and an engagement arm 11026*d* at another end.

A second upper toggle link 11028 defines mounting holes, 11028*a* and 11028*b*, for receiving the mounting pins, 11018*a* and 11018*b*, and includes a mounting pin 11028*c* at one end. A second lower toggle link 11030 defines mounting holes, 11030*a*, 11030*b*, and 11030*c*, for receiving the mounting pins, 11028*c*, 11018*c*, and 11018*d*, respectively and includes an engagement arm 11030*d*. A second trigger 11032 defines a mounting hole 11032*a* for receiving the mounting pin 11018*e* and includes an engagement arm 11032*b* at one end, an engagement member 11032*c*, and an engagement arm 11032*d* at another end.

An end of a tubular spring housing 11034 that defines a longitudinal passage 11034*a*, mounting holes, 11034*b* and 11034*c*, and mounting holes, 11034*ba* and 11034*ca*, and includes an internal flange 11034*d* and an internal annular recess 11034*e* at one end, and an internal flange 11034*f*, an internal annular recess 11034*g*, an internal annular recess 11034*h*, and an external threaded connection 11034*i* at another end receives and mates with the end of the tubular toggle bushing 11008. Mounting screws, 11035*a* and 11035*b*, are mounted within and coupled to the mounting holes, 11008*xb* and 11008*xa*, respectively, of the tubular toggle bushing 11008 and are received within the mounting holes, 11034*ba* and 11034*ca*, respectively, of the tubular spring housing 11034.

A tubular retracting spring ring 11036 that defines mounting holes, 11036*a* and 11036*b*, receives and mates with a portion of the tubular lower mandrel 11006 and is received within and mates with a portion of the tubular spring housing 11034. Mounting screws, 11038*a* and 11038*b*, are mounted within and coupled to the mounting holes, 11036*a* and 11036*b*, respectively, of the tubular retracting spring ring 11036 and extend into the mounting holes, 11034*b* and 11034*c*, respectively, of the tubular spring housing 11034.

Casing diameter sensor springs, 11040*a* and 11040*b*, are positioned within the longitudinal slots, 11008*c* and 1108*d*, respectively, of the tubular toggle bushing 11008 that engage the engagement members, 11026*c* and 11032*c*, and engagement arms, 11026*d* and 11032*d*, of the first and second triggers, 11026 and 11032, respectively. An inner flange 11042*a* of an end of a tubular spring washer 11042 mates with and receives a portion of the tubular lower mandrel 11006 and an end face of the inner flange of the tubular spring washer is positioned proximate and end face of the external flange 11006*d* of the tubular lower mandrel. The tubular spring washer 11042 is further received within the longitudinal passage 11034*a* of the tubular spring housing 11034.

An end of a retracting spring 11044 that receives the tubular lower mandrel 11006 is positioned within the tubular spring washer 11042 in contact with the internal flange 11042*a* of the tubular spring washer and the other end of the retracting spring is positioned in contact with an end face of the tubular retracting spring ring 11036.

A sealing element 11046 is received within the external annular recess 11006*j* of the tubular lower mandrel 11006 for sealing the interface between the tubular lower mandrel and the tubular spring housing 11034. A sealing element 11048 is received within the internal annular recess 11034*h* of the tubular spring housing 11034 for sealing the interface between the tubular spring housing and the tubular lower mandrel 11006.

An internal threaded connection 11050*a* of an end of a tubular upper hinge sleeve 11050 that includes an internal flange 11050*b* and an internal pivot 11050*c* receives and is coupled to the external threaded connection 11034*i* of the end of the tubular spring housing 11034.

An external flange 11052*a* of a base member 11052*b* of an upper cam assembly 11052, that is mounted upon and receives the lower tubular mandrel 11006, that includes an internal flange 11052*c* that is received within the external annular recess 11006*e* of the lower tubular mandrel 11006 and a plurality of circumferentially spaced apart cam arms 11052*d* extending from the base member mates with and is received within the tubular upper hinge sleeve 11050. An end face of the base member 11052*b* of the upper cam assembly 11052 is coupled to an end face of the tubular spring housing 11034 and an end face of the external flange 11052*a* of the base member of the upper cam assembly 11052 is positioned in opposing relation to an end face of the internal flange 11050*b* of the tubular upper hinge sleeve 11050. Each of the cam arms 11052*d* of the upper cam assembly 11052 include external cam surfaces 11052*e*. In an exemplary embodiment, the base member 11052*b* of the upper cam assembly 11052 further includes axial teeth for interleaving with and engaging axial teeth provided on the end face of the tubular spring housing 11034 for transmitting torsional loads between the tubular spring housing and the upper cam assembly.

A plurality of circumferentially spaced apart upper casing cutter segments 11054 are mounted upon and receive the lower tubular mandrel 11006 and each include an external pivot recess 11054*a* for mating with and receiving the internal pivot 11050*c* of the tubular upper hinge sleeve 11050 and an external flange 11054*b* and are pivotally mounted within the tubular upper hinge sleeve and are interleaved with the circumferentially spaced apart cam arms 11052*d* of the upper cam assembly 11052. A casing cutter element 11056 is coupled to and supported by the upper surface of each upper casing cutter segments 11054 proximate the external flange 11054*b*.

A plurality of circumferentially spaced apart lower casing cutter segments 11058 are mounted upon and receive the lower tubular mandrel 11006, are interleaved among the upper casing cutter segments 11054, are substantially identical to the upper casing cutter segments, and are oriented in the opposite direction to the upper casing cutter segments.

A lower cam assembly 11060 is mounted upon and receives the lower tubular mandrel 11006 that includes circumferentially spaced apart cam arms interleaved among the lower casing cutter segments 11058 is substantially identical to the upper cam assembly 11052 with the addition of mounting holes, 11060*a*, 11060*b*, 11060*c*, and 11060*d*. In an exemplary embodiment, the base member of the lower cam assembly 11060 further includes axial teeth for interleaving with and engaging axial teeth provided on the end face of the tubular sleeve 11066 for transmitting torsional loads between the tubular spring housing and the tubular sleeve.

Mounting screws, 11062*a*, 11062*b*, 11062*c*, and 11062*e*, are mounted within the mounting holes, 11060*a*, 11060*b*, 11060*c*, and 11060*d*, respectively, of the lower cam assembly 11060 and are received within the external annular recess 11006*g* of the lower cam assembly 11060.

A tubular lower hinge sleeve 11064 that receives the lower casing cutter segments 11058 and the lower cam assembly 11060 includes an internal flange 11064*a* for engaging the external flange of the base member of the lower cam assembly 11060, an internal pivot 11064*b* for pivotally mounting the lower casing cutter segments within the tubular lower hinge sleeve, and an internal threaded connection 11064*c*.

An external threaded connection 11066*a* of an end of a tubular sleeve 11066 that defines mounting holes, 11066*b* and 11066*c*, and includes an internal annular recess 11066*d* having a shoulder 11066*e*, an internal flange 11066*f*, and an internal threaded connection 11066*g* at another end is received within and coupled to the internal threaded connection 11064*c* of the tubular lower hinge sleeve 11064. An external threaded connection 11068*a* of an end of a tubular member 11068 that defines a longitudinal passage 11068*b* and mounting holes, 11068*c* and 11068*d*, and includes an external annular recess 11068*e*, and an external threaded connection 11068*f* at another end is received within and is coupled to the internal threaded connection 11066*g* of the tubular sleeve 11066.

Mounting screws, 11070*a* and 11070*b*, are mounted in and coupled to the mounting holes, 11068*c* and 11068*d*, respectively, of the tubular member 11068 that also extend into the mounting holes, 11066*b* and 11066*c*, respectively, of the tubular sleeve 11066. A sealing element 11072 is received within the external annular recess 11068*e* of the tubular member 11068 for sealing the interface between the tubular member and the tubular sleeve 11066.

An internal threaded connection 11074*a* of a tubular retracting piston 11074 that defines a longitudinal passage 11074*b* and includes an internal annular recess 11074*c* and an external annular recess 11074*d* receives and is coupled to the external threaded connection 11006*i* of the tubular lower mandrel 11006. A sealing element 11076 is received within the external annular recess 11074*d* of the tubular retracting piston 11074 for sealing the interface between the tubular retracting piston and the tubular sleeve 11066. A sealing element 11078 is received within the internal annular recess 11074*c* of the tubular retracting piston 11074 for sealing the interface between the tubular retracting piston and the tubular lower mandrel 11006.

Locking dogs 11080 mate with and receive the external teeth 11006*h* of the tubular lower mandrel 11006. A spacer ring 11082 is positioned between an end face of the locking dogs 11080 and an end face of the lower cam assembly 11060. A release piston 11084 mounted upon the tubular lower mandrel 11006 defines a radial passage 11084*a* for mounting a burst disk 11086 includes sealing elements, 11084*b*, 11084*c*, and 11084*d*. The sealing elements, 11084*b* and 11084*d*, sealing the interface between the release piston 11084 and the tubular lower mandrel 11006. An end face of the release piston 11084 is positioned in opposing relation to an end face of the locking dogs 11080.

A release sleeve 11088 that receives and is mounted upon the locking dogs 11080 and the release piston 11084 includes an internal flange 11088*a* at one end that sealingly engages the tubular lower mandrel 11006. A bypass sleeve 11090 that receives and is mounted upon the release sleeve 11088 includes an internal flange 11090*a* at one end.

In an exemplary embodiment, during operation of the casing cutter assembly 14, the retracting spring 11044 is compressed and thereby applies a biasing spring force in a direction 11092 from the lower tubular mandrel 11006 to the tubular spring housing 11034 that, in the absence of other forces, moves and/or maintains the upper cam assembly 11052 and the upper casing cutter segments 11054 out of engagement with the lower casing cutter segments 11058 and the lower cam assembly 11060. In an exemplary embodiment, during operation of the casing cutter assembly 14, an external threaded connection 12A1 to 12A4 of an end of the tubular support member 12 is coupled to the internal threaded connection 11002*d* of the upper tubular tool joint 11002 and an internal threaded connection 16*a* of an end of the ball gripper assembly 16 is coupled to the external threaded connection 11068*f* of the tubular member 11068.

The upper cam assembly 11052 and the upper casing cutter segments 11054 may be brought into engagement with the lower casing cutter segments 11058 and the lower cam assembly 11060 by pressurizing an annulus 11094 defined between the lower tubular mandrel 11006 and the tubular spring housing 11034. In particular, injection of fluid materials into the cam cutter assembly 14 through the longitudinal passage 11006*b* of the lower tubular mandrel 11006 and into the radial passage 11006*ba* may pressurize the annulus 11094 thereby creating sufficient operating pressure to generate a force in a direction 11096 sufficient to overcome the biasing force of the retracting spring 11044. As a result, the spring housing 11034 may be displaced in the direction 11096 relative to the lower tubular mandrel 11006 thereby displacing the tubular upper hinge sleeve 11050, upper cam assembly 11052, and upper casing cutter segments 11054 in the direction 11096.

Figures 1, 11:
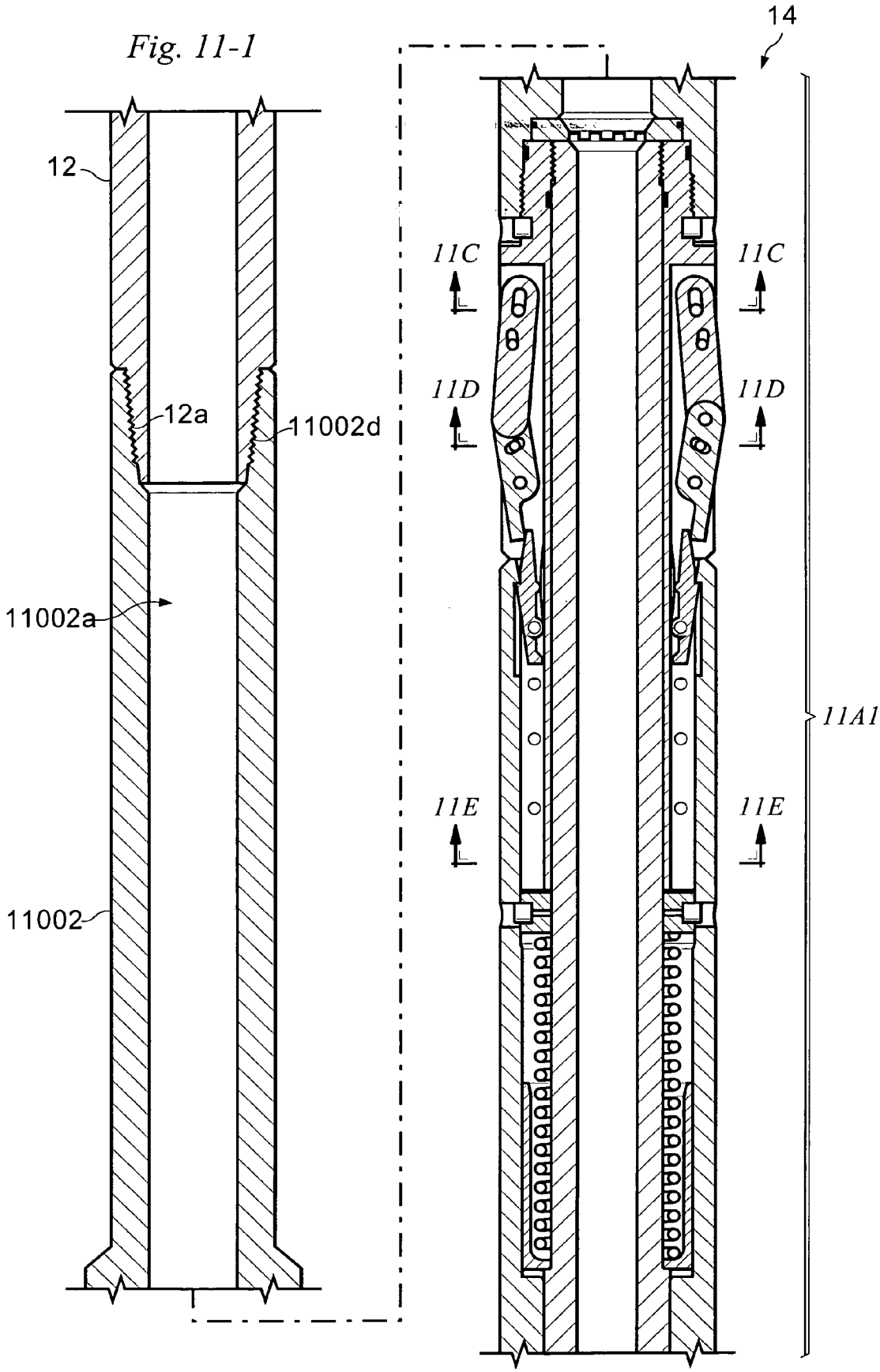
Figures 2, 11:
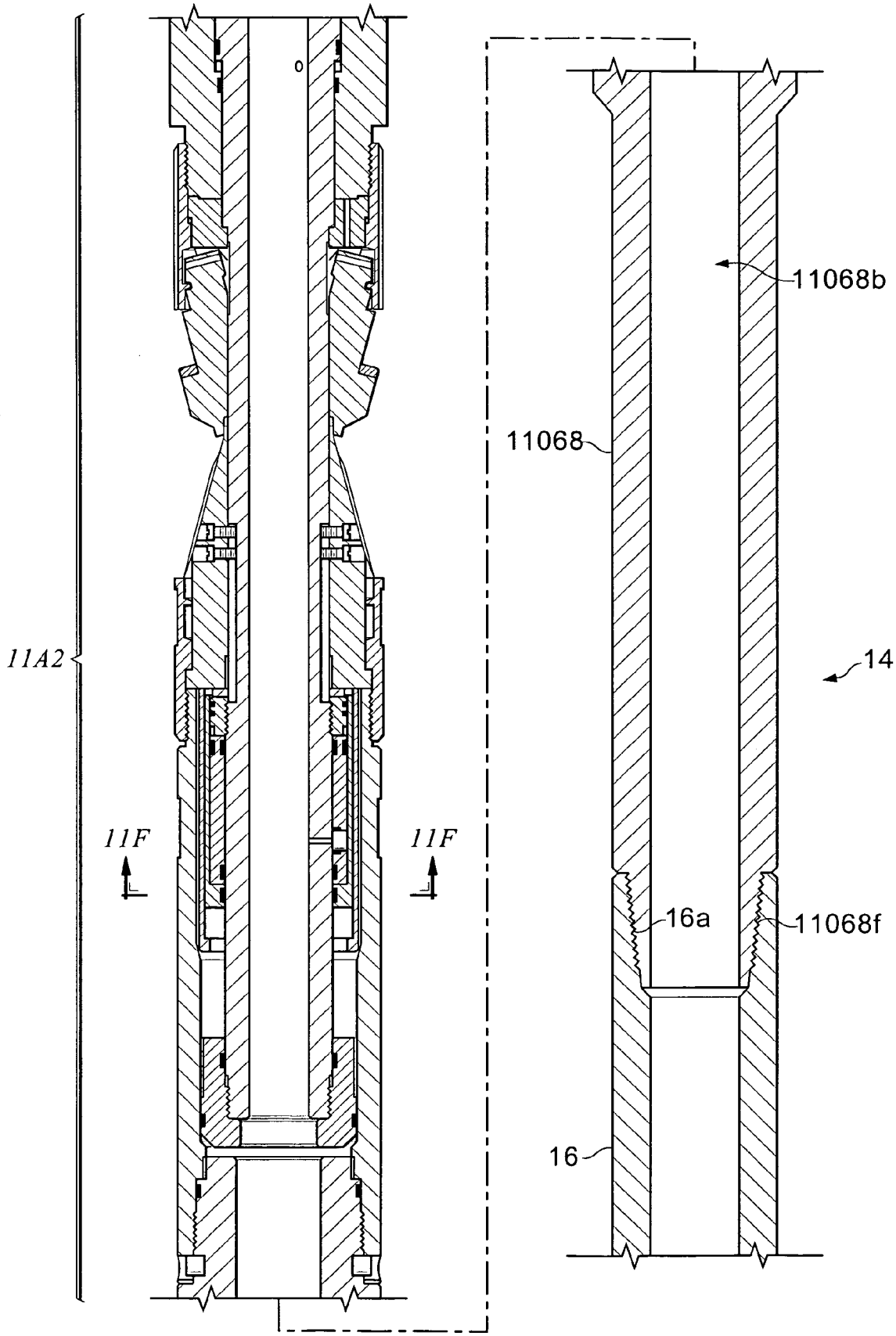
Figure 11C:
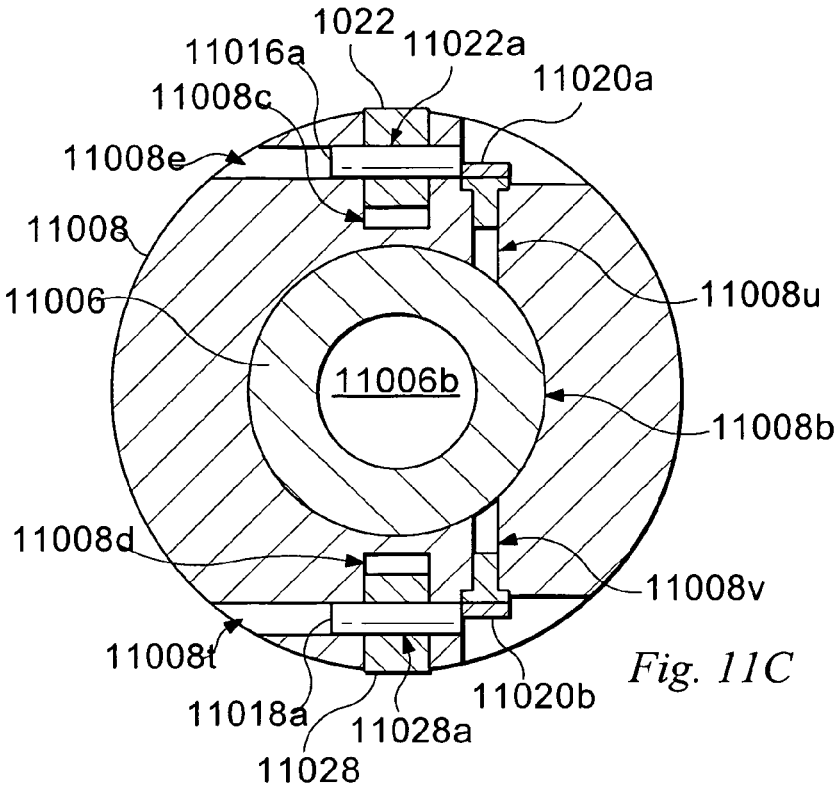
Figure 11D:
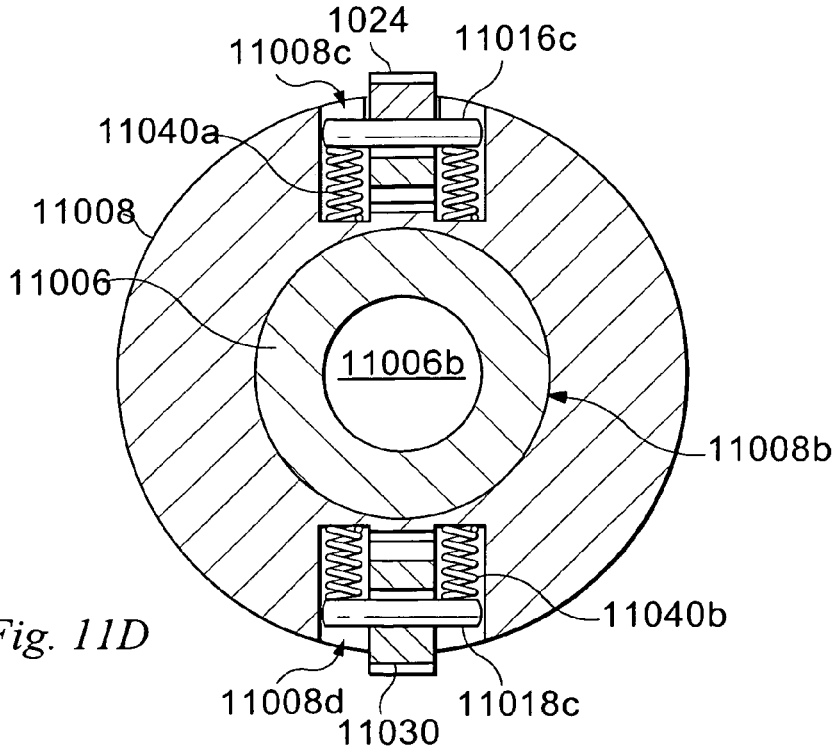
Figure 11E:
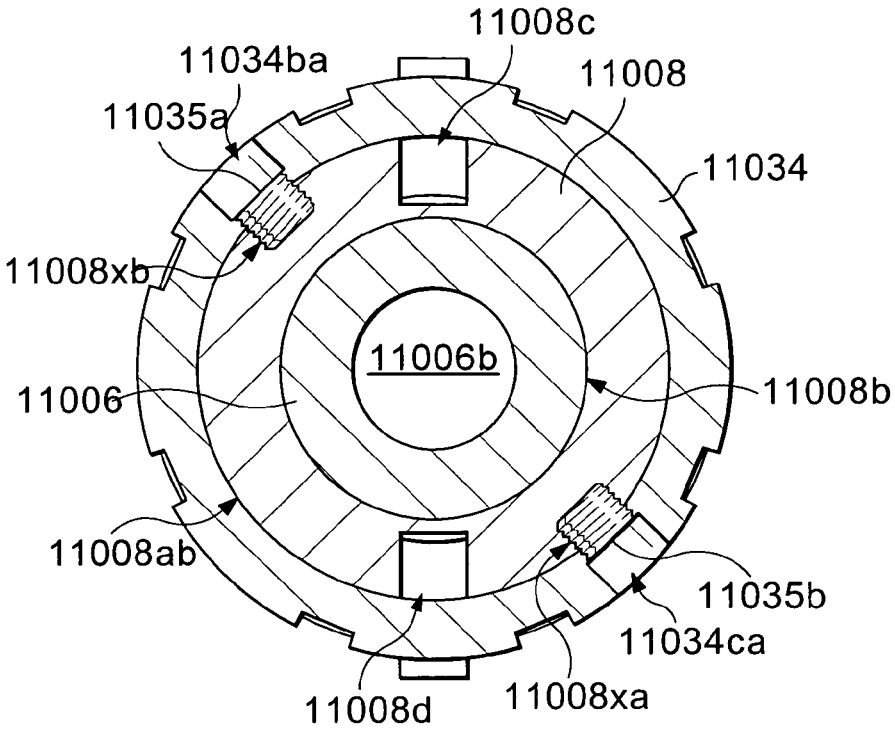
Figure 11F:
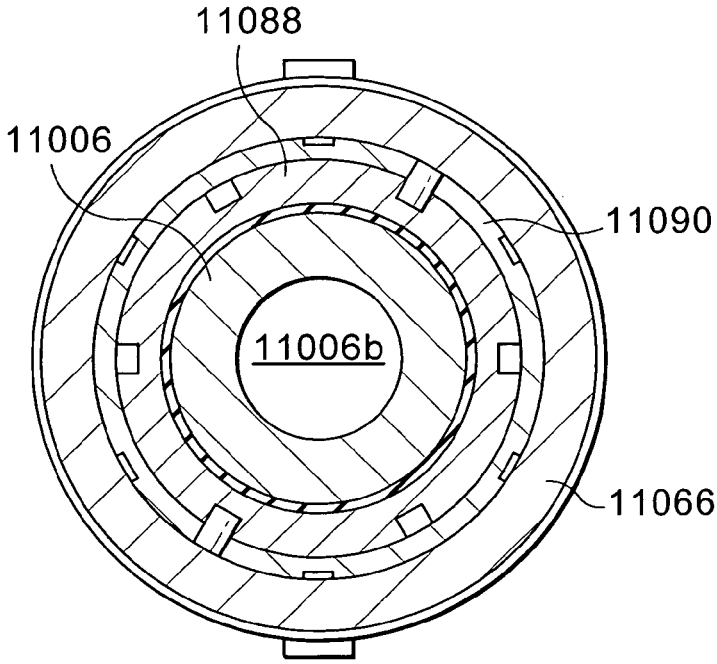
Figure 11G:
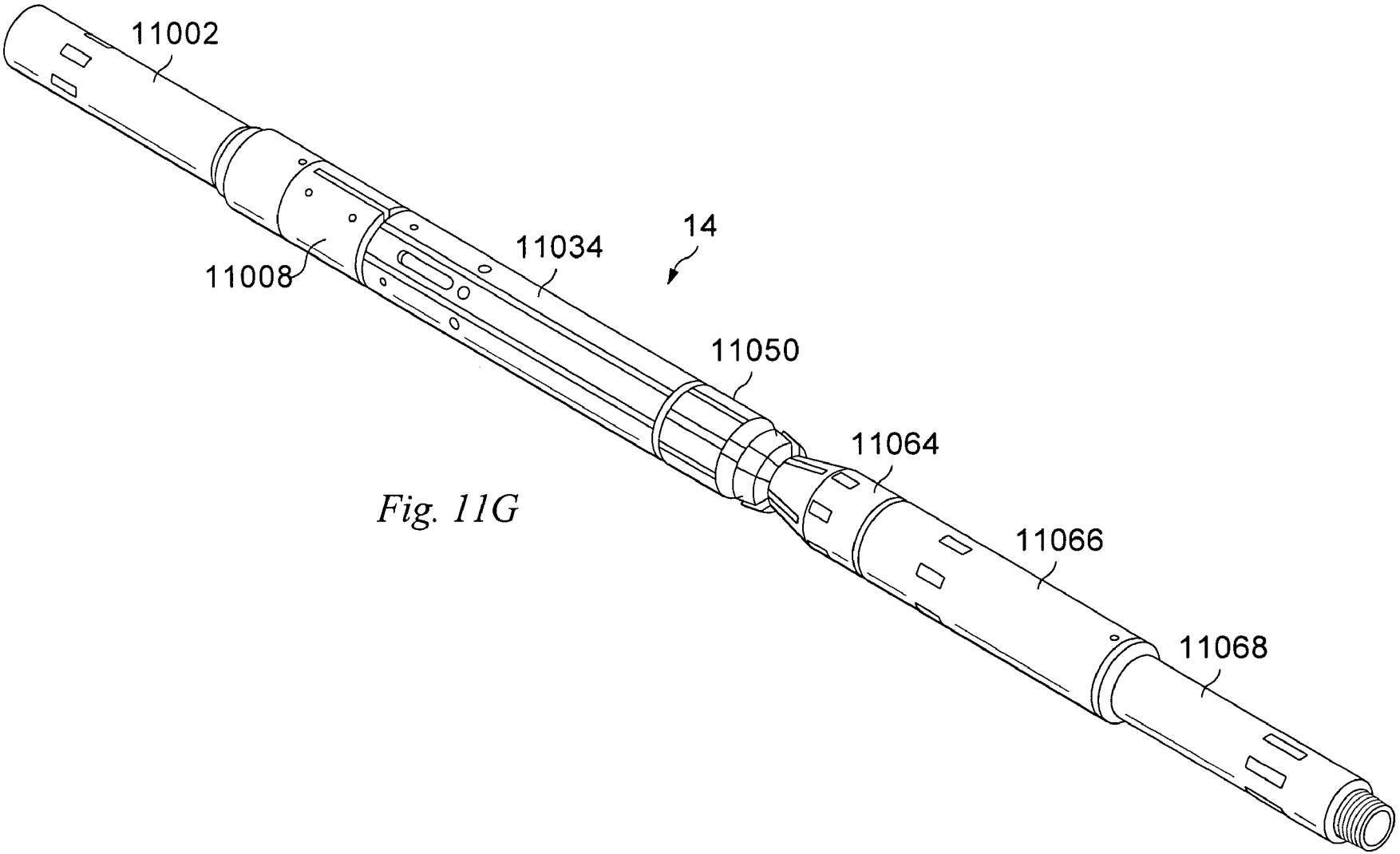
Figure 11H:
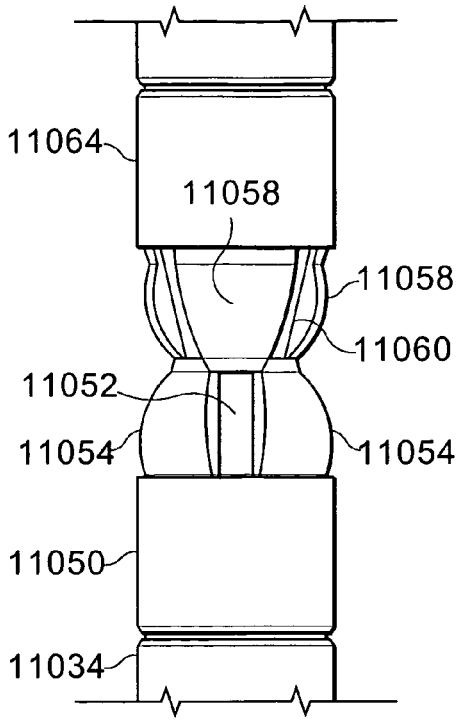
Figure 11I:
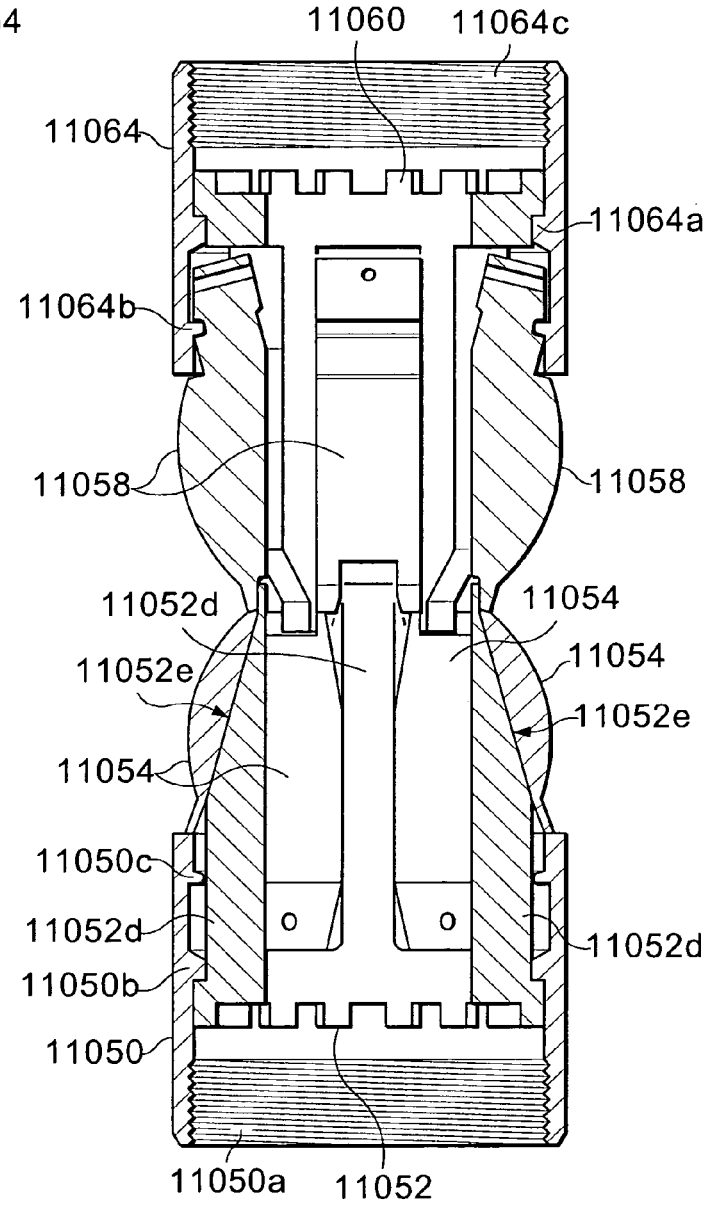
Figure 11J:
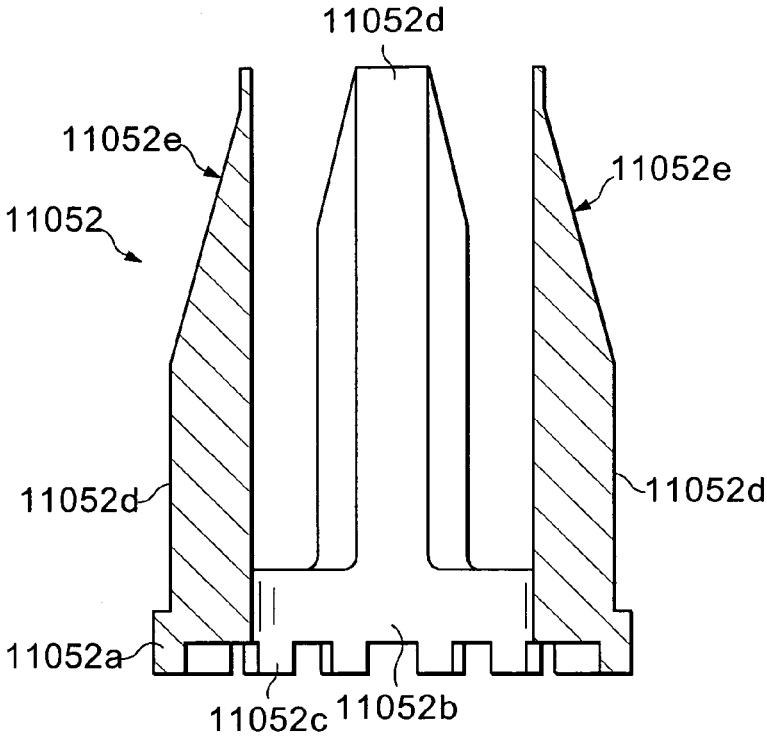
Figure 11K:
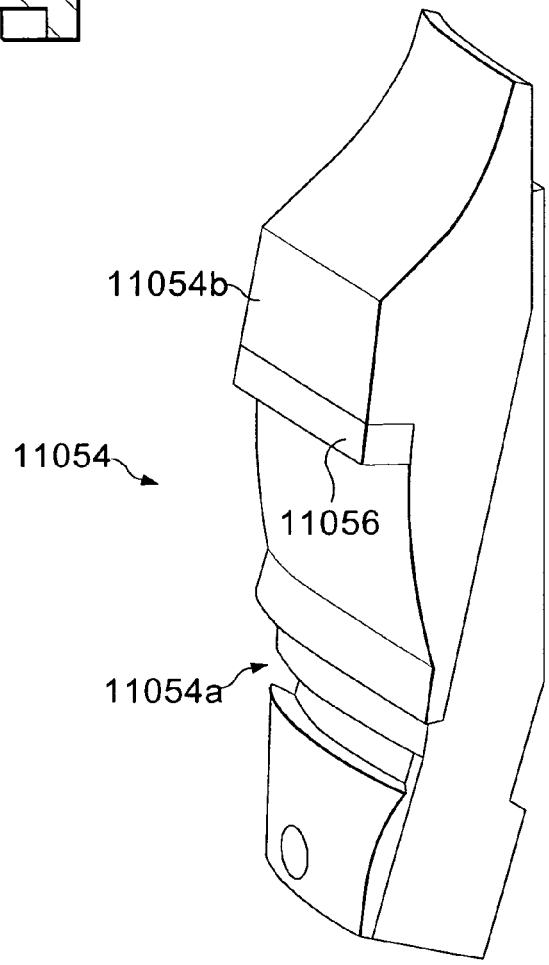
Figure 11L:
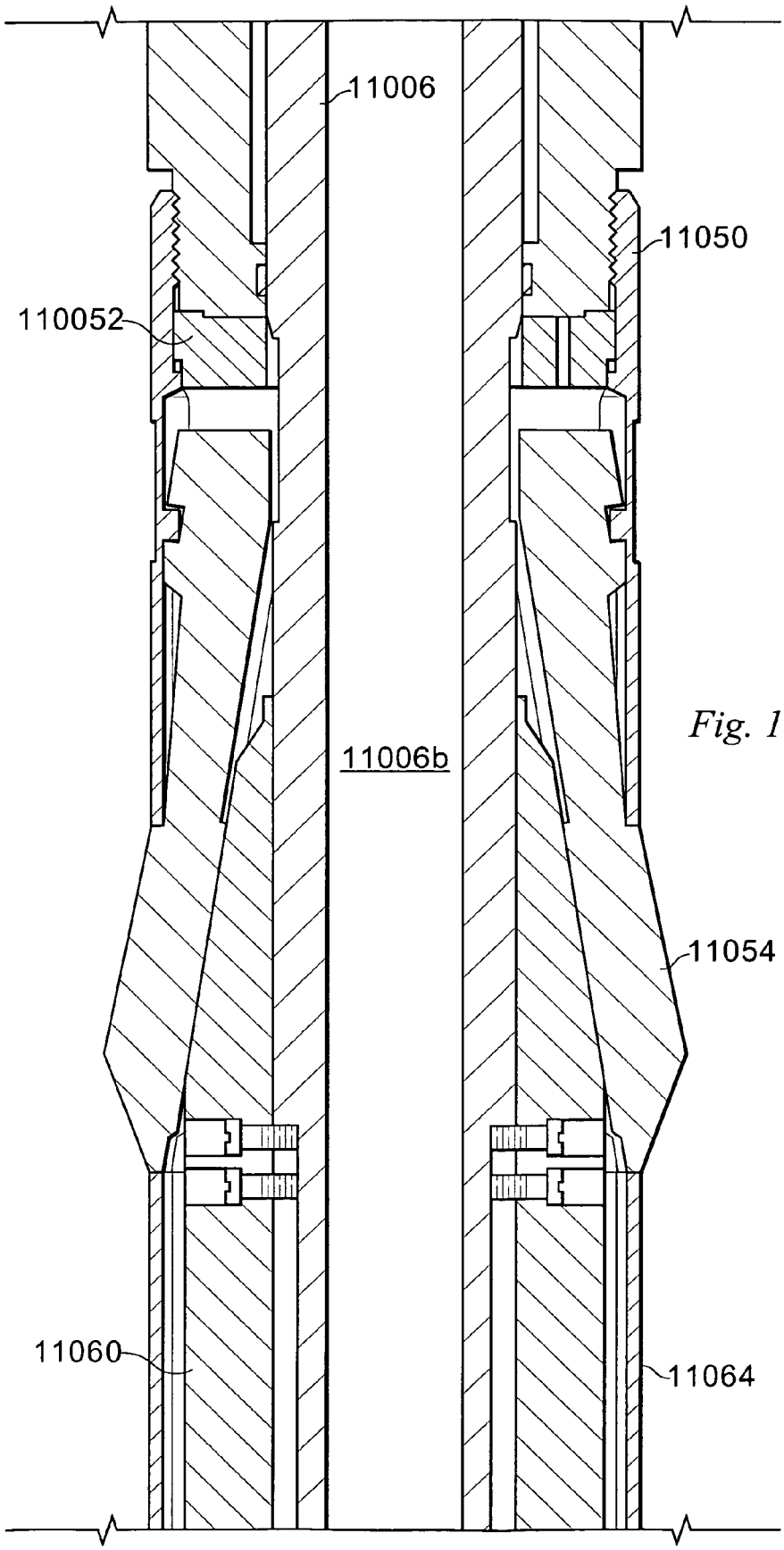
FIG. 11L are fragmentary cross-sectional illustrations of an exemplary embodiment of the operation of the casing cutter assembly of FIGS. 11-1 and 11-2, 11A1 to 11A2, 11B1 to 11B2, 11C, 11D, 11E, 11F, 11G, 11H, 11I, 11J, and 11K.
Figure 14A:
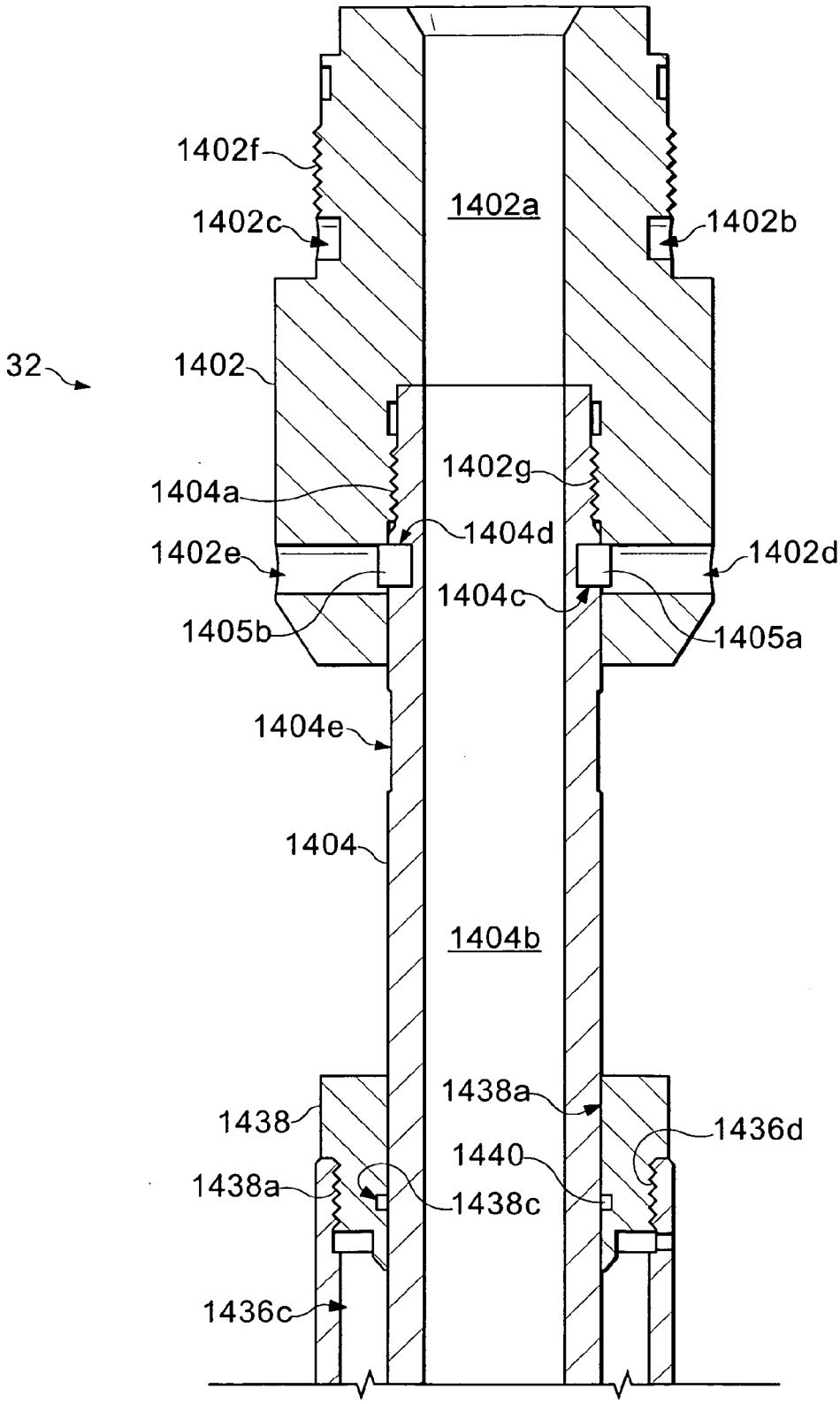
FIGS. 14A to 14C is a fragmentary cross-sectional illustration of an exemplary embodiment of a packer setting tool assembly.
Figure 14B:
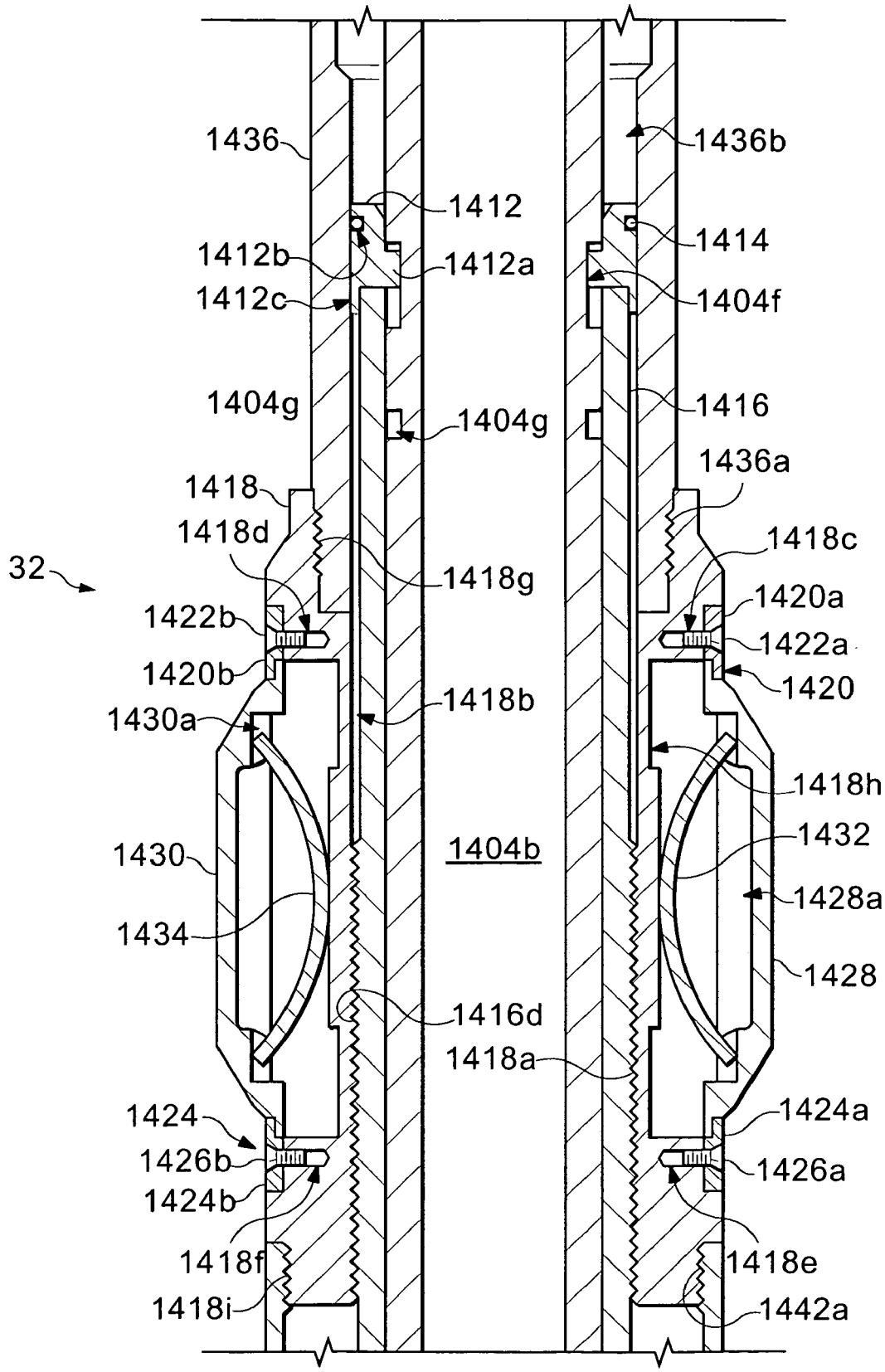
Figure 14C:
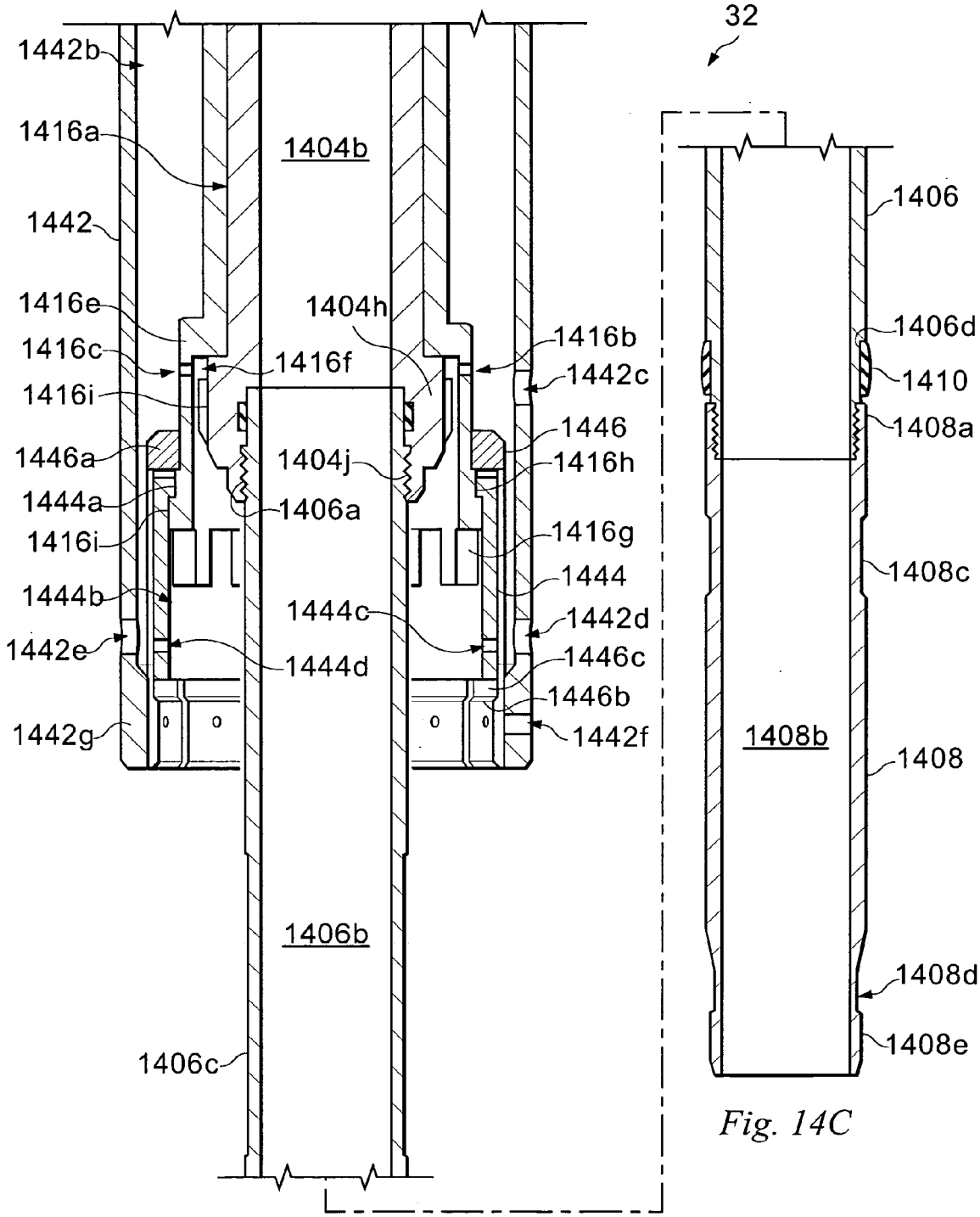

In an exemplary embodiment, as illustrated in FIG. 11L, the displacement of the upper cam assembly 11052 and upper casing cutter segments 11054 in the direction 11096 will cause the lower casing cutter segments 11058 to ride up the cam surfaces of the cam arms of the upper cam assembly 11052 while also pivoting about the lower tubular hinge segment 11064, and will also cause the upper casing cutter segments 11054 to ride up the cam surfaces of the cam arms of the lower cam assembly 11060 while also pivoting about the upper tubular hinge segment 11050.

In an exemplary embodiment, during the operation of the casing cutter assembly 14, when the upper and lower casing cutter segments, 11054 and 11058, brought into axial alignment in a radially expanded position, the casing cutter elements of the casing cutter segments are brought into intimate contact with the interior surface of a preselected portion of the expandable wellbore casing 100. The casing cutter assembly 14 may then be rotated to thereby cause the casing cutter elements to cut through the expandable wellbore casing. The portion of the expandable wellbore casing 100 cut away from the remaining portion on the expandable wellbore casing may then be carried out of the wellbore 102 with the cut away portion of the expandable wellbore casing supported by the casing cutter elements.

In an exemplary embodiment, the upper cam assembly 11052 and the upper casing cutter segments 11054 may be moved out of engagement with the lower casing cutter segments 11058 and the lower cam assembly 11060 by reducing the operating pressure within the annulus 11094.

In an alternative embodiment, during operation of the casing cutter assembly 14, the upper cam assembly 11052 and the upper casing cutter segments 11054 may also be moved out of engagement with the lower casing cutter segments 11058 and the lower cam assembly 11060 by sensing the operating pressure within the longitudinal passage 11006*b* of the lower tubular mandrel 11006. In particular, if the operating pressure within the longitudinal passage 11006*b* of the lower tubular mandrel 11006 exceeds a predetermined value, the burst disc 11086 will open thereby pressurizing the interior of the tubular release sleeve 11088 thereby displacing the tubular release sleeve downwardly away from engagement with the locking dogs 11080. As a result, the locking dogs 11080 are released from engagement with the lower tubular mandrel 11006 thereby permitting the lower casing cutter segments 11058 and the lower cam assembly 11060 to be displaced downwardly relative to the lower tubular mandrel. The retracting piston 11074 may then be displaced downwardly by the operating pressure thereby impacting the internal flange 11066*f* of the lower tubular mandrel 11066. As a result, the lower tubular mandrel 11066, the lower casing cutter segments 11058, the lower cam assembly 11060, and tubular lower hinge sleeve 11064 are displaced downwardly relative to the tubular spring housing 11034 thereby moving the lower casing cutter segments 11058 and the lower cam assembly 11060 out of engagement with the upper cam assembly 11052 and the upper casing cutter segments 11054.

In an exemplary embodiment, during operation of the casing cutter assembly 14, the casing cutter assembly 14 senses the diameter of the expandable wellbore casing 100 using the upper toggle links, 11022 and 11028, lower toggle links, 11024 and 11030, and triggers, 11026 and 11032, and then prevents the engagement of the upper cam assembly 11052 and the upper casing cutter segments 11054 with the lower casing cutter segments 11058 and the lower cam assembly 11060. In particular, anytime the upper toggle links, 11022 and 11028, and lower toggle links, 11024 and 11030, are positioned within a portion of the expandable wellbore casing 100 that has not been radially expanded and plastically deformed by the system 10, the triggers, 11026 and 11032, will be maintained in a position in which the triggers will engage the internal flange 11034*d* of the end of the tubular spring housing 11034 thereby preventing the displacement of the tubular spring housing in the direction 11096. As a result, the upper cam assembly 11052 and the upper casing cutter segments 11054 cannot be brought into engagement with the lower casing cutter segments 11058 and the lower cam assembly 11060.

Conversely, anytime the upper toggle links, 11022 and 11028, and lower toggle links, 11024 and 11030, are positioned within a portion of the expandable wellbore casing 100 that has been radially expanded and plastically deformed by the system 10, the triggers, 11026 and 11032, will be pivoted by the engagement arms, 11024*d* and 11030*d*, of the lower toggle links, 11024 and 11030, to a position in which the triggers will no longer engage the internal flange 11034*d* of the end of the tubular spring housing 11034 thereby permitting the displacement of the tubular spring housing in the direction 11096. As a result, the upper cam assembly 11052 and the upper casing cutter segments 11054 can be brought into engagement with the lower casing cutter segments 11058 and the lower cam assembly 11060.

In an alternative embodiment, the elements of the casing cutter assembly 14 that sense the diameter of the expandable wellbore casing 100 may be disabled or omitted.

In an exemplary embodiment, the ball gripper assembly 16 is provided and operates substantially, at least in part, as disclosed in one or more of the following: (1) PCT patent application Ser. No. PCT/US03/29859, filed on Sep. 22, 2003, and/or (2) PCT patent application Ser. No. PCT/US03/

14153, filed on Nov. 13, 2003, the disclosures of which are incorporated herein by reference.

In an exemplary embodiment, as illustrated in FIGS. 12A1 to 12A4, 12B and 12C1 to 12C4, the ball gripper assembly 16 includes an upper mandrel 1202 that defines a longitudinal passage 1202*a* and a radial passage 1202*b* and includes an internal threaded connection 1202*c* at one end, an external flange 1202*d* at an intermediate portion that includes an external annular recess 1202*e* having a shoulder 1202*f* and an external radial hole 1202*g*, an external annular recess 1202*h*, an external annular recess 1202*i*, an external annular recess 1202*j* having a tapered end 1202*k* including an external annular recess 1202*ka*, an external annular recess 12021, and an external annular recess 1202*m*, and an external annular recess 1202*n*, an external radial hole 1202*o*, an external annular recess 1202*p*, and an external annular recess 1202*q* at another end.

An upper tubular bushing 1204 defines an internally threaded radial opening 1204*a* and includes an external flange 1204*b* having an external annular recess 1204*c* and an internal annular recess 1204*d* mates with and receives the external flange 1202*d* of the upper mandrel 1202. In particular, the internal annular recess 1204*d* of the upper tubular bushing 1204 mates with the shoulder 1202*f* of the external annular recess 1202*e* of the upper mandrel 1202. A screw 1206 that is threadably coupled to the internally threaded radial opening 1204*a* of the upper tubular bushing 1204 extends into the external radial hole 1202*g* of the external flange 1202*d* of the upper mandrel 1202.

A deactivation tubular sleeve 1208 defines a radial passage 1208*a* and includes an internal annular recess 1208*b* that mates with and receives an end of the external annular recess 1204*c* of the external flange 1204*b* of the upper tubular bushing 1204, an internal annular recess 1208*c* that mates with and receives the external flange 1202*d* of the upper mandrel 1202, an internal annular recess 1208*d*, an internal annular recess 1208*e*, and an internal annular recess 1208*f*. A deactivation spring 1210 is received within an annulus 1212 defined between the internal annular recess 1208*b* of the deactivation tubular sleeve 1208, an end face of the external annular recess 1204*c* of the external flange 1204*b* of the upper tubular bushing 1204, and the external annular recess 1202*h* of the external flange 1202*d* of the upper mandrel 1202.

A sealing member 1214 is received with the external annular recess 1202*i* of the external flange 1202*d* of the upper mandrel 1202 for sealing the interface between the upper mandrel and the deactivation tubular sleeve 1208. An annular spacer element 1216 is received within the external annular recess 1202*ka* of the tapered end 1202*k* of the external annular recess 1202*j* of the upper mandrel 1202.

One or more inner engagement elements 1218*a* of a tubular coglet 1218 engage and are received within the external annular recess 1202*ka* of the tapered end 1202*k* of the external annular recess 1202*j* of the upper mandrel 1202 and one or more outer engagement elements 1218*b* of the coglet engage and are received within the internal annular recess 1208*d* of the deactivation tubular sleeve 1208.

An external annular recess 1220*a* of an end of a tubular coglet prop 1220 that includes an inner flange 1220*b* receives and mates with the inner surfaces of the outer engagement elements 1218*b* of the coglet 1218. The end of the tubular coglet prop 1220 further receives and mates with the external annular recess 1202*j* of the external flange 1202*d* of the upper mandrel 1202. A sealing element 1222 is received within the external annular recess 1202*l* of the upper mandrel 1202 for sealing the interface between the upper mandrel and the tubular coglet prop 1220.

An end of a tubular bumper sleeve 1224 that includes internal and external flanges, 1224*a* and 1224*b*, and a hole 1224*c* at another end mates with and receives the external annular recess 1202*m* of the external flange 1202*d* of the upper mandrel 1202. A coglet spring 1226 is received within an annulus 1228 defined between the external annular recess 1202*m* of the external flange 1202*d* of the upper mandrel 1202, the tubular coglet prop 1220, the inner flange 1220*b* of the tubular coglet prop, an end face of the tubular bumper sleeve 1224, and the internal annular recess 1208*c* of the deactivation tubular sleeve 1208.

A tubular ball race 1228 that defines a plurality of tapered annular recesses 1228*a* and an internally threaded radial opening 1228*b* and includes one or more axial engagement elements 1228*c* at one end and one or more axial engagement elements 1228*d* at another end receives and mates with the other end of the upper mandrel 1202. In an exemplary embodiment, the axial engagement elements 1228*c* of the tubular ball race 1228 are received within and are coupled to the hole 1224*c* of the tubular bumper sleeve 1224. An end of a tubular activation sleeve 1230 that defines a plurality of radial openings 1230*a*, a radial opening 1230*b*, a radial opening 1230*c*, and includes an internal annular recess 1230*d* receives and mates with the tubular ball race 1228. In an exemplary embodiment, an end face of an end of the tubular activation sleeve 1230 is positioned proximate and in opposing relation to an end face of an end of the deactivation sleeve 1208. In an exemplary embodiment, the radial openings 1230*a* are aligned with and positioned in opposing relation to corresponding of tapered annular recesses 1228*a* of the tubular ball race 1228, and the radial openings are also narrowed in cross section in the radial direction for reasons to be described.

Balls 1232 are received within each of the of tapered annular recesses 1228*a* and corresponding radial openings 1230*a* of the tubular ball race 1228 and tubular activation sleeve 1230, respectively. In an exemplary embodiment, the narrowed cross sections of the radial openings 1230*a* of the tubular activation sleeve 1230 will permit the balls 1232 to be displaced outwardly in the radial direction until at least a portion of the balls extends beyond the outer perimeter of the tubular activation sleeve to thereby permit engagement of the balls with an outer structure such as, for example, a wellbore casing.

A lower mandrel 1234 that defines a longitudinal passage 1234*a* and an internally threaded radial passage 1234*b* at one end and includes internal annular recesses, 1234*c* and 1234*d*, for receiving and mating with the external annular recesses, 1202*p* and 1202*q*, of the upper mandrel 1202, an internal annular recess 1234*e*, an external flange 1234*f*, and an externally threaded connection 1234*g* at another end. In an exemplary embodiment, as illustrated in FIG. 12B, the end of the lower mandrel 1234 further includes longitudinal recesses 1234*h* for receiving and mating with corresponding axial engagement elements 1228*d* of the tubular ball race 1228. A sealing element 1235 is received within the internal annular recess 1234*d* of the lower mandrel 1234 for sealing an interface between the lower mandrel and the external annular recess 1202*p* of the upper mandrel 1202.

A tubular spring retainer 1236 that defines a radial passage 1236*a* and includes an external annular recess 1236*b* at one end mates with and receives the end of the lower mandrel 1234 and is positioned proximate an end face of the external flange 1234*f* of the lower mandrel. A tubular spring retainer 1238 receives and mates with the end of the lower mandrel 1234 and is received and mates with the internal annular recess 1230*d* of the tubular activation sleeve 1230.

An activation spring 1240 is received within an annulus 1242 defined an end face of the tubular spring retainer 1238, an end face of the spring retainer 1236, the internal annular recess 1230*d* of the tubular activation sleeve 1230, and the end of the lower mandrel 1234. A retainer screw 1242 is received within and is threadably coupled to the internally threaded radial opening 1234*b* of the lower mandrel 1234 that also extends into the external radial hole 1202*o* of the upper mandrel 1202.

During operation of the ball gripper assembly 16, in an exemplary embodiment, as illustrated in FIGS. 12A1 to 12A4, the ball gripper assembly may be positioned within the expandable wellbore casing 100 and the internally threaded connection 1202*c* of the upper mandrel 1202 may be coupled to an externally threaded connection 14*a* of an end of the casing cutter assembly 14 and the externally threaded connection 1234*g* of the lower mandrel 1234 may be coupled to an internally threaded connection 18*a* of an end of the tension actuator assembly 18.

In an alternative embodiment, the internally threaded connection 1202*c* of the upper mandrel 1202 may be coupled to an externally threaded connection of an end of the tension actuator assembly 18 and the externally threaded connection 1234*g* of the lower mandrel 1234 may be coupled to an internally threaded connection of an end of casing cutter assembly 14.

In an exemplary embodiment, the deactivation spring 1210 has a greater spring rate than the activation spring 1240. As a result, in an initial operating mode, as illustrated in FIGS. 12A1 to 12A4, a biasing spring force is applied to the deactivation sleeve 1208 and activation sleeve 1230 in a direction 1244 that maintains the activation sleeve in a position relative to the tubular ball race 1228 that maintains the balls 1232 within the radially inward portions of the corresponding tapered annular recesses 1228*a* of the tubular ball race such that the balls do not extend beyond the perimeter of the activation sleeve to engage the expandable wellbore casing 100.

As illustrated in FIGS. 12C1 to 12C4, in an exemplary embodiment, the ball gripper 16 may be operated to engage the interior surface of the expandable wellbore casing 100 by injecting a fluidic material 1250 into the ball gripper assembly through the longitudinal passages 1202*a* and 1234*aa*, of the upper and lower mandrels, 1202 and 1234, respectively.

In particular, when the longitudinal and radial passages, 1202*a* and 1202*b*, respectively, of the upper mandrel 1202 are pressurized by the injection of the fluidic material 1250, the internal annular recess 1208*c* of the deactivation tubular sleeve 1208 is pressurized. When the operating pressure of the fluidic material 1250 within the internal annular recess 1208*c* of the deactivation tubular sleeve 1208 is sufficient to overcome the biasing spring force of the deactivation spring 1210, the deactivation tubular sleeve is displaced in a direction 1252. As a result, the spring force provided by the activation spring 1240 then may displace the activation tubular sleeve 1230 in the direction 1252 thereby moving the balls 1232 on the corresponding tapered annular recesses 1228*a* of the tubular ball race 1228 outwardly in a radial direction into engagement with the interior surface of the expandable wellbore casing 100. In an exemplary embodiment, the operating pressure of the fluidic material 1250 sufficient to overcome the biasing spring force of the deactivation spring 1210 was about 100 psi.

In an exemplary embodiment, when the operating pressure of the fluidic material 1250 is reduced, the operating pressure of the fluidic material 1250 within the internal annular recess 1208*c* of the deactivation tubular sleeve 1208 is no longer sufficient to overcome the biasing spring force of the deactivation spring 1210, and the deactivation tubular sleeve and the activation tubular sleeve 1230 are displaced in a direction opposite to the direction 1252 thereby moving the balls 1232 radially inwardly and out of engagement with the interior surface of the expandable wellbore casing 100.

In an exemplary embodiment, the ball gripper assembly 16 is operated to engage the interior surface of the expandable wellbore casing 100 in combination with the operation of the tension actuator assembly 18 to apply an upward tensile force to one or more elements of the system 10 coupled to and positioned below the tension actuator assembly. As a result, a reaction force comprising a downward tensile force is applied to the lower mandrel 1234 of the ball gripper assembly 16 in a direction opposite to the direction 1252 during the operation of the tension actuator assembly 18. Consequently, due to the geometry of the tapered 1228*a* of the tubular ball race 1228, the balls 1232 are driven up the tapered annular recesses 1228*a* of the tubular ball race 1228 with increased force and the contact force between the balls 1232 and the interior surface of the expandable wellbore casing 100 is significantly increased thereby correspondingly increasing the gripping force and effect of the ball gripper assembly.

In an exemplary embodiment, the ball gripper assembly 16 may be operated to radially expand and plastically deform discrete portions of the expandable wellbore casing 100 by controlling the amount of contact force applied to the interior surface of the expandable wellbore casing by the balls 1232 of the ball gripper assembly. In an experimental test of an exemplary embodiment of the ball gripper assembly 16, an expandable wellbore casing was radially expanded and plastically deformed. This was an unexpected result.

In an exemplary embodiment, the tension actuator assembly 18 operates and is provided substantially, at least in part, as disclosed in one or more of the following: (1) PCT patent application Ser. No. PCT/US02/36267, filed on Nov. 12, 2002, (2) PCT patent application Ser. No. PCT/US03/29859, filed on Sep. 22, 2003, (3) PCT patent application Ser. No. PCT/US03/14153, filed on Nov. 13, 2003, and/or (4) PCT patent application Ser. No. PCT/US03/29460, filed on Sep. 23, 2003, the disclosures of which are incorporated herein by reference.

In an exemplary embodiment, as illustrated in FIGS. 13A1 to 13A8 and 13B1 to 13B7, the tension actuator assembly 18 includes an upper tubular support member 13002 that defines a longitudinal passage 13002*a*, and external internally threaded radial openings, 13002*b* and 13002*c*, and an external annular recess 13002*d* and includes an internally threaded connection 13002*e* at one end and an external flange 13002*f*, an external annular recess 13002*g* having an externally threaded connection, and an internal annular recess 13002*h* having an internally threaded connection at another end. An end of a tubular actuator barrel 13004 that defines radial passages, 13004*a* and 13004*b*, at one end and radial passages, 13004*c* and 13004*d*, includes an internally threaded connection 13004*e* at one end that mates with, receives, and is threadably coupled to the external annular recess 13002*g* of the upper tubular support member 13002 and abuts and end face of the external flange 13002*f* of the upper tubular support member and an internally threaded connection 13004*f* at another end.

Torsional locking pins, 13006*a* and 13006*b*, are coupled to and mounted within the external radial mounting holes, 13002*b* and 13002*c*, respectively, of the upper tubular support member and received within the radial passages, 13004*a* and 13004*b*, of the end of the tubular actuator barrel 13004. The other end of the tubular actuator barrel 13004 receives and is threadably coupled to an end of a tubular barrel connector 13008 that defines an internal annular recess 13008*a*, external radial mounting holes, 13008*b* and 13008*c*, radial passages, 13008*d* and 13008*e*, and external radial mounting holes, 13008*f* and 13008*g* and includes circumferentially spaced apart teeth 13008*h* at one end. A sealing cartridge 13010 is received within and coupled to the internal annular recess 13008*a* of the tubular barrel connector 13008 for fluidicly sealing the interface between the tubular barrel connector and the sealing cartridge. Torsional locking pins, 13012*a* and 13012*b*, are coupled to and mounted within the external radial mounting holes, 13008*b* and 13008*c*, respectively, of the tubular barrel connector 13008 and received within the radial passages, 13004*c* and 13004*d*, of the tubular actuator barrel 13004.

A tubular member 13014 that defines a longitudinal passage 13014*a* having one or more internal splines 13014*b* at one end and circumferentially spaced apart teeth 13014*c* at another end for engaging the circumferentially spaced apart teeth 13008*h* of the tubular barrel connector 13008 mates with and is received within the actuator barrel 13004 and the one end of the tubular member abuts an end face of the other end of the upper tubular support member 13002 and at another end abuts and end face of the tubular barrel connector 13008. A tubular guide member 13016 that defines a longitudinal passage 13016*a* having a tapered opening 13016*aa*, and radial passages, 13016*b* and 13016*c*, includes an external flange 13016*d* having an externally threaded connection at one end that is received within and coupled to the internal annular recess 13002*h* of the upper tubular support member 13002.

The other end of the tubular barrel connector 13008 is threadably coupled to and is received within an end of a tubular actuator barrel 13018 that defines a longitudinal passage 13018*a*, radial passages, 13018*b* and 13018*c*, and radial passages, 13018*d* and 13018*e*. Torsional locking pins, 13020*a* and 13020*b*, are coupled to and mounted within the external radial mounting holes, 13008*f* and 13008*g*, respectively, of the tubular barrel connector 13008 and received within the radial passages, 13018*b* and 13018*c*, of the tubular actuator barrel 13018. The other end of the tubular actuator barrel 13018 receives and is threadably coupled to an end of a tubular barrel connector 13022 that defines an internal annular recess 13022*a*, external radial mounting holes, 13022*b* and 13022*c*, radial passages, 13022*d* and 13022*e*, and external radial mounting holes, 13022*f* and 13022*g*. A sealing cartridge 13024 is received within and coupled to the internal annular recess 13022*a* of the tubular barrel connector 13022 for fluidicly sealing the interface between the tubular barrel connector and the sealing cartridge. Torsional locking pins, 13024*a* and 13024*b*, are coupled to and mounted within the external radial mounting holes, 13022*b* and 13022*c*, respectively, of the barrel connector 13022 and received within the radial passages, 13018*d* and 13018*e*, of the tubular actuator barrel 13018.

The other end of the tubular barrel connector 13022 is threadably coupled to and is received within an end of a tubular actuator barrel 13026 that defines a longitudinal passage 13026*a*, radial passages, 13026*b* and 13026*c*, and radial passages, 13026*d* and 13026*e*. Torsional locking pins, 13028*a* and 13028*b*, are coupled to and mounted within the external radial mounting holes, 13022*f* and 13022*g*, respectively, of the tubular barrel connector 13022 and received within the radial passages, 13026*b* and 13026*c*, of the tubular actuator barrel 13026. The other end of the tubular actuator barrel 13026 receives and is threadably coupled to an end of a tubular barrel connector 13030 that defines an internal annular recess 13030*a*, external radial mounting holes, 13030*b* and 13030*c*, radial passages, 13030*d* and 13030*e*, and external radial mounting holes, 13030*f* and 13030*g*. A sealing cartridge 13032 is received within and coupled to the internal annular recess 13030*a* of the tubular barrel connector 13030 for fluidicly sealing the interface between the tubular barrel connector and the sealing cartridge. Torsional locking pins, 13034*a* and 13034*b*, are coupled to and mounted within the external radial mounting holes, 13030*b* and 13030*c*, respectively, of the tubular barrel connector 13030 and received within the radial passages, 13026*d* and 13026*e*, of the tubular actuator barrel 13026.

The other end of the tubular barrel connector 13030 is threadably coupled to and is received within an end of a tubular actuator barrel 13036 that defines a longitudinal passage 13036*a*, radial passages, 13036*b* and 13036*c*, and radial passages, 13036*d* and 13036*e*. Torsional locking pins, 13038*a* and 13038*b*, are coupled to and mounted within the external radial mounting holes, 13030*f* and 13030*g*, respectively, of the tubular barrel connector 13030 and received within the radial passages, 13036*b* and 13036*c*, of the tubular actuator barrel 13036. The other end of the tubular actuator barrel 13036 receives and is threadably coupled to an end of a tubular barrel connector 13040 that defines an internal annular recess 13040*a*, external radial mounting holes, 13040*b* and 13040*c*, radial passages, 13040*d* and 13040*e*, and external radial mounting holes, 13040*f* and 13040*g*. A sealing cartridge 13042 is received within and coupled to the internal annular recess 13040*a* of the tubular barrel connector 13040 for fluidicly sealing the interface between the tubular barrel connector and the sealing cartridge. Torsional locking pins, 13044*a* and 13044*b*, are coupled to and mounted within the external radial mounting holes, 13040*b* and 13040*c*, respectively, of the tubular barrel connector 13040 and received within the radial passages, 13036*d* and 13036*e*, of the tubular actuator barrel 13036.

The other end of the tubular barrel connector 13040 is threadably coupled to and is received within an end of a tubular actuator barrel 13046 that defines a longitudinal passage 13046*a*, radial passages, 13046*b* and 13046*c*, and radial passages, 13046*d* and 13046*e*. Torsional locking pins, 13048*a* and 13048*b*, are coupled to and mounted within the external radial mounting holes, 13040*f* and 13040*g*, respectively, of the tubular barrel connector 13040 and received within the radial passages, 13046*b* and 13046*c*, of the tubular actuator barrel 13046. The other end of the tubular actuator barrel 13046 receives and is threadably coupled to an end of a tubular barrel connector 13050 that defines an internal annular recess 13050*a*, external radial mounting holes, 13050*b* and 13050*c*, radial passages, 13050*d* and 13050*e*, and external radial mounting holes, 13050*f* and 13050*g*. A sealing cartridge 13052 is received within and coupled to the internal annular recess 13050*a* of the tubular barrel connector 13050 for fluidicly sealing the interface between the tubular barrel connector and the sealing cartridge. Torsional locking pins, 13054*a* and 13054*b*, are coupled to and mounted within the external radial mounting holes, 13050*b* and 13050*c*, respectively, of the tubular barrel connector 13050 and received within the radial passages, 13046*d* and 13046*e*, of the tubular actuator barrel 13046.

The other end of the tubular barrel connector 13050 is threadably coupled to and is received within an end of a tubular actuator barrel 13056 that defines a longitudinal passage 13056*a*, radial passages, 13056*b* and 13056*c*, and radial passages, 13056*d* and 13056*e*. Torsional locking pins, 13058*a* and 13058*b*, are coupled to and mounted within the external radial mounting holes, 13050*f* and 13050*g*, respectively, of the tubular barrel connector 13050 and received within the radial passages, 13056*b* and 13056*c*, of the tubular actuator barrel 13056. The other end of the tubular actuator barrel 13056 receives and is threadably coupled to an end of a tubular lower stop 13060 that defines an internal annular recess 13060*a*, external radial mounting holes, 13060*b* and 13060*c*, and an internal annular recess 13060*d* that includes one or more circumferentially spaced apart locking teeth 13060*e* at one end and one or more circumferentially spaced apart locking teeth 13060*f* at the other end. A sealing cartridge 13062 is received within and coupled to the internal annular recess 13060*a* of the tubular lower stop 13060 for fluidicly sealing the interface between the tubular lower stop and the sealing cartridge. Torsional locking pins, 13064*a* and 13064*b*, are coupled to and mounted within the external radial mounting holes, 13060*b* and 13060*c*, respectively, of the tubular lower stop 13060 and received within the radial passages, 13056*d* and 13056*e*, of the tubular actuator barrel 13056.

A connector tube 13066 that defines a longitudinal passage 13066*a* and radial mounting holes, 13066*b* and 13066*c*, and includes external splines 13066*d* at one end for engaging the internal splines 13014*b* of the tubular member 13014 and radial mounting holes, 13066*e* and 13066*f*, at another end is received within and sealingly and movably engages the interior surface of the sealing cartridge 13010 mounted within the annular recess 13008*a* of the tubular barrel connector 13008. In this manner, during longitudinal displacement of the connector tube 13066 relative to the tubular barrel connector 13008, a fluidic seal is maintained between the exterior surface of the connector tube and the interior surface of the tubular barrel connector. An end of the connector tube 13066 also receives and mates with the other end of the tubular guide member 13016. Mounting screws, 13068*a* and 13068*b*, are coupled to and received within the radial mounting holes, 13066*b* and 13066*c*, respectively of the connector tube 13066.

The other end of the connector tube 13066 is received within and threadably coupled to an end of a tubular piston 13070 that defines a longitudinal passage 13070*a*, radial mounting holes, 13070*b* and 13070*c*, radial passages, 13070*d* and 13070*e*, and radial mounting holes, 13070*f* and 13070*g*, that includes a flange 13070*h* at one end. A sealing cartridge 13072 is mounted onto and sealingly coupled to the exterior of the tubular piston 13070 proximate the flange 13070*h*. The sealing cartridge 13072 also mates with and sealingly engages the interior surface of the tubular actuator barrel 13018. In this manner, during longitudinal displacement of the tubular piston 13070 relative to the actuator barrel 13018, a fluidic seal is maintained between the exterior surface of the piston and the interior surface of the actuator barrel. Mounting screws, 13074*a* and 13074*b*, are coupled to and mounted within the external radial mounting holes, 13070*b* and 13070*c*, respectively, of the tubular piston 13070 and received within the radial passages, 13066*e* and 13066*f*, of the connector tube 13066.

The other end of the tubular piston 13070 receives and is threadably coupled to an end of a connector tube 13076 that defines a longitudinal passage 13076*a*, radial mounting holes, 13076*b* and 13076*c*, at one end and radial mounting holes, 13076*d* and 13076*e*, at another end. The connector tube 13076 is received within and sealingly and movably engages the interior surface of the sealing cartridge 13024 mounted within the annular recess 13022*a* of the tubular barrel connector 13022. In this manner, during longitudinal displacement of the connector tube 13076 relative to the tubular barrel connector 13022, a fluidic seal is maintained between the exterior surface of the connector tube and the interior surface of the barrel connector. Mounting screws, 13078*a* and 13078*b*, are coupled to and mounted within the external radial mounting holes, 13070*f* and 13070*g*, respectively, of the tubular piston 13070 and received within the radial passages, 13076*b* and 13076*c*, of the connector tube 13076.

The other end of the connector tube 13076 is received within and threadably coupled to an end of a tubular piston 13080 that defines a longitudinal passage 13080*a*, radial mounting holes, 13080*b* and 13080*c*, radial passages, 13080*d* and 13080*e*, and radial mounting holes, 13080*f* and 13080*g*, that includes a flange 13080*h* at one end. A sealing cartridge 13082 is mounted onto and sealingly coupled to the exterior of the tubular piston 13080 proximate the flange 13080*h*. The sealing cartridge 13082 also mates with and sealingly engages the interior surface of the tubular actuator barrel 13026. In this manner, during longitudinal displacement of the tubular piston 13080 relative to the tubular actuator barrel 13026, a fluidic seal is maintained between the exterior surface of the piston and the interior surface of the actuator barrel. Mounting screws, 13084*a* and 13084*b*, are coupled to and mounted within the external radial mounting holes, 13080*b* and 13080*c*, respectively, of the tubular piston 13080 and received within the radial passages, 13076*e* and 13076*f*, of the connector tube 13076.

The other end of the tubular piston 13080 receives and is threadably coupled to an end of a connector tube 13086 that defines a longitudinal passage 13086*a*, radial mounting holes, 13086*b* and 13086*c*, at one end and radial mounting holes, 13086*d* and 13086*e*, at another end. The connector tube 13086 is received within and sealingly and movably engages the interior surface of the sealing cartridge 13032 mounted within the annular recess 13030*a* of the tubular barrel connector 13030. In this manner, during longitudinal displacement of the connector tube 13086 relative to the tubular barrel connector 13030, a fluidic seal is maintained between the exterior surface of the connector tube and the interior surface of the barrel connector. Mounting screws, 13088*a* and 13088*b*, are coupled to and mounted within the external radial mounting holes, 13080*f* and 13080*g*, respectively, of the tubular piston 13080 and received within the radial passages, 13086*b* and 13086*c*, of the connector tube 13086.

The other end of the connector tube 13086 is received within and threadably coupled to an end of a tubular piston 13090 that defines a longitudinal passage 13090*a*, radial mounting holes, 13090*b* and 13090*c*, radial passages, 13090*d* and 13090*e*, and radial mounting holes, 13090*f* and 13090*g*, that includes a flange 13090*h* at one end. A sealing cartridge 13092 is mounted onto and sealingly coupled to the exterior of the tubular piston 13090 proximate the flange 13090*h*. The sealing cartridge 13092 also mates with and sealingly engages the interior surface of the tubular actuator barrel 13036. In this manner, during longitudinal displacement of the tubular piston 13090 relative to the tubular actuator barrel 13036, a fluidic seal is maintained between the exterior surface of the piston and the interior surface of the actuator barrel. Mounting screws, 13094*a* and 13094*b*, are coupled to and mounted within the external radial mounting holes, 13090*b* and 13090*c*, respectively, of the tubular piston 13090 and received within the radial passages, 13086*e* and 13086*f*, of the connector tube 13086.

The other end of the tubular piston 13090 receives and is threadably coupled to an end of a connector tube 13096 that defines a longitudinal passage 13096*a*, radial mounting holes, 13096*b* and 13096*c*, at one end and radial mounting holes, 13096*d* and 13096*e*, at another end. The connector tube 13096 is received within and sealingly and movably engages the interior surface of the sealing cartridge 13042 mounted within the annular recess 13040*a* of the tubular barrel connector 13040. In this manner, during longitudinal displacement of the connector tube 13096 relative to the tubular barrel connector 13040, a fluidic seal is maintained between the exterior surface of the connector tube and the interior surface of the barrel connector. Mounting screws, 13098*a* and 13098*b*, are coupled to and mounted within the external radial mounting holes, 13090*f* and 13090*g*, respectively, of the tubular piston 13090 and received within the radial passages, 13096*b* and 13096*c*, of the connector tube 13096.

The other end of the connector tube 13096 is received within and threadably coupled to an end of a tubular piston 13100 that defines a longitudinal passage 13100*a*, radial mounting holes, 13100*b* and 13100*c*, radial passages, 13100*d* and 13100*e*, and radial mounting holes, 13100*f* and 13100*g*, that includes a flange 13100*h* at one end. A sealing cartridge 13102 is mounted onto and sealingly coupled to the exterior of the tubular piston 13100 proximate the flange 13100*h*. The sealing cartridge 13102 also mates with and sealingly engages the interior surface of the tubular actuator barrel 13046. In this manner, during longitudinal displacement of the tubular piston 13100 relative to the tubular actuator barrel 13046, a fluidic seal is maintained between the exterior surface of the piston and the interior surface of the actuator barrel. Mounting screws, 13104*a* and 13104*b*, are coupled to and mounted within the external radial mounting holes, 13100*b* and 13100*c*, respectively, of the tubular piston 13100 and received within the radial passages, 13096*e* and 13096*f*, of the connector tube 13096.

The other end of the tubular piston 13100 receives and is threadably coupled to an end of a connector tube 13106 that defines a longitudinal passage 13106*a*, radial mounting holes, 13106*b* and 13106*c*, at one end and radial mounting holes, 13106*d* and 13106*e*, at another end. The connector tube 13106 is received within and sealingly and movably engages the interior surface of the sealing cartridge 13052 mounted within the annular recess 13050*a* of the tubular barrel connector 13050. In this manner, during longitudinal displacement of the connector tube 13106 relative to the tubular barrel connector 13050, a fluidic seal is maintained between the exterior surface of the connector tube and the interior surface of the barrel connector. Mounting screws, 13108*a* and 13108*b*, are coupled to and mounted within the external radial mounting holes, 13100*f* and 13100*g*, respectively, of the tubular piston 13100 and received within the radial passages, 13106*b* and 13106*c*, of the connector tube 13106.

The other end of the connector tube 13106 is received within and threadably coupled to an end of a tubular piston 13110 that defines a longitudinal passage 13110*a*, radial mounting holes, 13110*b* and 13110*c*, radial passages, 13110*d* and 13110*e*, radial mounting holes, 13110*f* and 13110*g*, that includes a flange 13110*h* at one end and circumferentially spaced teeth 13110*i* at another end for engaging the one or more circumferentially spaced apart locking teeth 13060*e* of the tubular lower stop 13060. A sealing cartridge 13112 is mounted onto and sealingly coupled to the exterior of the tubular piston 13110 proximate the flange 13110*h*. The sealing cartridge 13112 also mates with and sealingly engages the interior surface of the actuator barrel 13056. In this manner, during longitudinal displacement of the tubular piston 13110 relative to the actuator barrel 13056, a fluidic seal is maintained between the exterior surface of the piston and the interior surface of the actuator barrel. Mounting screws, 13114*a* and 13114*b*, are coupled to and mounted within the external radial mounting holes, 13110*b* and 13110*c*, respectively, of the tubular piston 13110 and received within the radial passages, 13106*d* and 13106*e*, of the connector tube 13106.

The other end of the tubular piston 13110 receives and is threadably coupled to an end of a connector tube 13116 that defines a longitudinal passage 13116*a*, radial mounting holes, 13116*b* and 13116*c*, at one end and radial mounting holes, 13116*d* and 13116*e*, at another end that includes an external flange 13116*f* that includes circumferentially spaced apart teeth 13116*g* that extend from an end face of the external flange for engaging the teeth 13060*f* of the tubular lower stop 13060, and an externally threaded connection 13116*h* at another end. The connector tube 13116 is received within and sealingly and movably engages the interior surface of the sealing cartridge 13062 mounted within the annular recess 13060*a* of the lower tubular stop 13060. In this manner, during longitudinal displacement of the connector tube 13116 relative to the lower tubular stop 13060, a fluidic seal is maintained between the exterior surface of the connector tube and the interior surface of the lower tubular stop. Mounting screws, 13118*a* and 13118*b*, are coupled to and mounted within the external radial mounting holes, 13110*f* and 13110*g*, respectively, of the tubular piston 13110 and received within the radial passages, 13116*b* and 13116*c*, of the connector tube 13116.

In an exemplary embodiment, as illustrated in FIGS. 13A1 to 13A8, the internally threaded connection 13002*e* of the upper tubular support member 13002 receives and is coupled to the externally threaded connection 1234*g* of the lower mandrel 1234 of the ball grabber assembly 16 and the externally threaded connection 13116*h* of the connector tube 13116 is received within and is coupled to an internally threaded connection 20*a* of an end of the safety sub assembly 20.

In an exemplary embodiment, as illustrated in FIGS. 13A1 to 13A8, during operation of the tension actuator assembly 18, the tension actuator assembly is positioned within the expandable wellbore casing 100 and fluidic material 13200 is injected into the tension actuator assembly through the passages 13002*a*, 13016*a*, 13066*a*, 13070*a*, 13076*a*, 13080*a*, 13086*a*, 13090*a*, 13096*a*, 13100*a*, 13106*a*, 13110*a*, and 13116*a*. The injected fluidic material 13200 will also pass through the radial passages, 13070*d* and 13070*e*, 13080*d* and 13080*e*, 13090*d* and 13090*e*, 13100*d* and 13100*e*, 13110*d* and 13110*e*, of the tubular pistons, 13070, 13080, 13090, 13100, and 13110, respectively, into annular piston chambers, 13202, 13204, 13206, 13208, 13208, and 13210.

As illustrated in FIGS. 13B1 to 13B7, the operating pressure of the fluidic material 13200 may then be increased by, for example, controllably blocking or limiting the flow of the fluidic material through the passage 13116*a* and/or increasing the operating pressure of the outlet of a pumping device for injecting the fluidic material 13200 into the tension actuator assembly 18. As a result, of the increased operating pressure of the fluidic material 13200 within the tension actuator assembly 18, the operating pressures of the annular piston chambers, 13202, 13204, 13206, 13208, 13208, and 13210, will be increased sufficiently to displace the tubular pistons, 13070, 13080, 13090, 13100, and 13110, upwardly in the direction 13212 thereby also displacing the connector tube 13116. As a result, a upward tensile force is applied to all elements of the system 10 coupled to and positioned below the connector tube 13116. In an exemplary embodiment, during the upward displacement of the tubular pistons, 13070, 13080, 13090, 13100, and 13110, fluidic materials displaced by the tubular pistons within discharge annular chambers, 13214, 13216, 13218, 13220, and 13222 are exhausted out of the tension actuator assembly 18 through the radial passages, 13008*d* and 13008*e*, 13022*d* and 13022*e*, 13030*d* and 13030*e*, 13040*d* and 13040*e*, 13050*d* and 13050*e*, respectively. Furthermore, in an exemplary embodiment, the upward displacement of the tubular pistons, 13070, 13080, 13090, 13100, and 13110, further causes the external splines 13066*d* of the connector tube 13066 to engage the internal splines 13014*b* of the tubular member 13014 and the circumferentially spaced apart teeth 13116*g* of the connector tube 13116 to engage the circumferentially spaced teeth 13060*f* of the tubular lower stop 13060. As a result of the interaction of the external splines 13066*d* of the connector tube 13066 to engage the internal splines 13014*b* of the tubular member 13014 and the circumferentially spaced apart teeth 13116*g* of the connector tube 13116 to engage the circumferentially spaced teeth 13060*f* of the tubular lower stop 13060, torsional loads may be transmitted through the tension actuator assembly 18.

In an exemplary embodiment, the sealing cup assembly 22 operates and is provided substantially, at least in part, as disclosed in one or more of the following: (1) PCT patent application Ser. No. PCT/US02/36157, filed on Nov. 12, 2002, (2) PCT patent application Ser. No. PCT/US02/36267, filed on Nov. 12, 2002, (3) PCT patent application Ser. No. PCT/US03/04837, filed on Feb. 29, 2003, (4) PCT patent application Ser. No. PCT/US03/29859, filed on Sep. 22, 2003, (5) PCT patent application Ser. No. PCT/US03/14153, filed on Nov. 13, 2003, and/or (6) PCT patent application Ser. No. PCT/US03/18530, filed on Jun. 11, 2003, the disclosures of which are incorporated herein by reference.

In an exemplary embodiment, the casing lock assembly 24 operates and is provided substantially, at least in part, as disclosed in one or more of the following: (1) PCT patent application Ser. No. PCT/US02/36267, filed on Nov. 12, 2002, (2) PCT patent application Ser. No. PCT/US03/29859, filed on Sep. 22, 2003, and/or (3) PCT patent application serial number PCT/US03/14153, filed on Nov. 13, 2003, the disclosures of which are incorporated herein by reference.

In an exemplary embodiment, the adjustable bell section expansion cone assembly 28 operates and is provided substantially, at least in part, as disclosed in one or more of the following: (1) PCT patent application Ser. No. PCT/US02/36157, filed on Nov. 12, 2002, (2) PCT patent application Ser. No. PCT/US02/36267, filed on Nov. 12, 2002, (3) PCT patent application Ser. No. PCT/US03/04837, filed on Feb. 29, 2003, (4) PCT patent application Ser. No. PCT/US03/29859,. filed on Sep. 22, 2003, (5) PCT patent application Ser. No. PCT/US03/14153, filed on Nov. 13, 2003, and/or (6) PCT patent application Ser. No. PCT/US03/18530, filed on Jun. 11, 2003, the disclosures of which are incorporated herein by reference.

In an alternative embodiment, the adjustable bell section expansion cone assembly 28 further incorporates one or more of the elements and/or teachings of the casing cutter assembly 14 for sensing the internal diameter of the expandable wellbore casing 100.

In an exemplary embodiment, the adjustable casing expansion cone assembly 30 operates and is provided substantially, at least in part, as disclosed in one or more of the following: (1) PCT patent application Ser. No. PCT/US02/36157, filed on Nov. 12, 2002, (2) PCT patent application Ser. No. PCT/US02/36267, filed on Nov. 12, 2002, (3) PCT patent application Ser. No. PCT/US03/04837, filed on 2129/03, (4) PCT patent application Ser. No. PCT/US03/29859, filed on Sep. 22, 2003, (5) PCT patent application Ser. No. PCT/US03/14153, filed on Nov. 13, 2003, and/or (6) PCT patent application Ser. No. PCT/US03/18530, filed on Jun. 11, 2003, the disclosures of which are incorporated herein by reference.

In an alternative embodiment, the adjustable casing expansion cone assembly 30 further incorporates one or more of the elements and/or teachings of the casing cutter assembly 14 for sensing the internal diameter of the expandable wellbore casing 100.

In an exemplary embodiment, as illustrated in 14A to 14C, the packer setting tool assembly 32 includes a tubular adaptor 1402 that defines a longitudinal passage 1402*a*, radial external mounting holes, 1402*b* and 1402*c*, radial passages, 1402*d* and 1402*e*, and includes an external threaded connection 1402*f* at one end and an internal annular recess 1402*g* having an internal threaded connection at another end. An external threaded connection 1404*a* of an end of a tubular upper mandrel 1404 that defines a longitudinal passage 1404*b*, internally threaded external mounting holes, 1404*c* and 1404*d*, and includes an external annular recess 1404*e*, external annular recess 1404*f*, external annular recess 1404*g*, external flange 1404*h*, external splines 1404*i*, and an internal threaded connection 1404*j* at another end is received within and is coupled to the internally threaded connection of the internal annular recess 1402*g* of the other end of the tubular adaptor 1402. Mounting screws, 1405*a* and 1405*b*, are received within and coupled to the mounting holes, 1404*c* and 1404*d*, of the tubular upper mandrel 1404 that also extend into the radial passages, 1402*d* and 1402*e*, of the tubular adaptor 1402.

An external threaded connection 1406*a* of an end of a mandrel 1406 that defines a longitudinal passage 1406*b* and includes an external annular recess 1406*c* and an external annular recess 1406*d* having an external threaded connection is received within and is coupled to the internal threaded connection 1404*j* of the tubular upper mandrel 1404. An internal threaded connection 1408*a* of a tubular stinger 1408 that defines a longitudinal passage 1408*b* and includes an external annular recess 1408*c*, and an external tapered annular recess 1408*d* and an engagement shoulder 1408*e* at another end receives and is coupled to the external threaded connection of the external annular recess 1406*d* of the mandrel 1406. A sealing member 1410 is mounted upon and coupled to the external annular recess 1406*d* of the mandrel 1406.

An internal flange 1412*a* of a tubular key 1412 that includes an external annular recess 1412*b* at one end and an internal annular recess 1412*c* at another end is movably received within and engages the external annular recess 1404*f* of the tubular upper mandrel 1404. A garter spring 1414 is received within and engages the external annular recess 1412*b* of the tubular key 1412.

An end of a tubular bushing 1416 that defines a longitudinal passage 1416*a* for receiving and mating with the upper mandrel 1404, and radial passages, 1416*b* and 1416*c*, and includes an external threaded connection 1416*d* at an intermediate portion, and an external flange 1416*e*, an internal annular recess 1416*f*, circumferentially spaced apart teeth 1416*g*, and external flanges, 1416*h* and 1416*i*, at another end is received within and mates with the internal annular recess 1412*c* of the tubular key 1412. An internal threaded connection 1418*a* of a tubular drag block body 1418 that defines a longitudinal passage 1418*b* for receiving the tubular bushing 1416, mounting holes, 1418*c* and 1418*d*, mounting holes, 1418*e* and 1418*f*, and includes an internal threaded connection 1418*g* at one end, a centrally positioned external annular recess 1418*h*, and an external threaded connection 1418*i* at another end is received within and coupled to the external threaded connection 1416*d* of the tubular bushing 1416.

A first tubular keeper 1420 that defines mounting holes, 1420*a* and 1420*b*, is coupled to an end of the tubular drag block body 1418 by mounting screws, 1422*a* and 1422*b*, that are received within and are coupled to the mounting holes, 1418*c* and 1418*d*, of the tubular drag block body. A second tubular keeper 1424 that defines mounting holes, 1424*a* and 1424*b*, is coupled to an end of the tubular drag block body 1418 by mounting screws, 1426*a* and 1426*b*, that are received within and are coupled to the mounting holes, 1418*e* and 1418*f*, of the tubular drag block body.

Drag blocks, 1428 and 1430, that are received within the external annular recess 1418*h* of the tubular drag block body 1418, include ends that mate with and are received within the end of the first tubular keeper 1420, and other ends that mate with and are received within the end of the second tubular keeper 1424. The drag blocks, 1428 and 1430, further include internal annular recesses, 1428*a* and 1430*a*, respectively, that receive and mate with ends of springs, 1432 and 1434, respectively. The springs, 1432 and 1434, also receive and mate with the external annular recess 1418*h* of the tubular drag block body 1418.

An external threaded connection 1436*a* of an end of a tubular releasing cap extension 1436 that defines a longitudinal passage 1436*b* and includes an internal annular recess 1436*c* and an internal threaded connection 1436*d* at another end is received within and is coupled to the internal threaded connection 1418*g* of the tubular drag block body 1418. An external threaded connection 1438*a* of an end of a tubular releasing cap 1438 that defines a longitudinal passage 1438*b* and includes an internal annular recess 1438*c* is received within and coupled to the internal threaded connection 1436*d* of the tubular releasing cap extension 1436. A sealing element 1440 is received within the internal annular recess 1438*c* of the tubular releasing cap 1438 for fluidicly sealing the interface between the tubular releasing cap and the upper mandrel 1404.

An internal threaded connection 1442*a* of an end of a tubular setting sleeve 1442 that defines a longitudinal passage 1442*b*, radial passage 1442*c*, radial passages, 1442*d* and 1442*e*, radial passage 1442*f*, and includes an internal flange 1442*g* at another end receives the external threaded connection 1418*i* of the tubular drag block body 1418. An internal flange 1444*a* of a tubular coupling ring 1444 that defines a longitudinal passage 1444*b* and radial passages, 1444*c* and 1444*d*, receives and mates with the external flange 1416*h* of the tubular bushing 1416 and an end face of the internal flange of the tubular coupling ring is positioned proximate and in opposing relation to an end face of the external flange 1416*i* of the tubular bushing.

An internal flange 1446*a* of a tubular retaining collet 1446 that includes a plurality of axially extending collet fingers 1446*b*, each having internal flanges 1446*c* at an end of each collet finger, for engaging and receiving the tubular coupling ring 1444 receives and mates with external flange 1416*e* of the tubular bushing 1416 and an end face of the internal flange of the tubular retaining collet is positioned proximate and in opposing relation to an end face of the external flange 1416*h* of the tubular bushing.

In an exemplary embodiment, the packer assembly 36 operates and is provided substantially, at least in part, as disclosed in one or more of the following: (1) PCT patent application Ser. No. PCT/US03/14153, filed on Nov. 13, 2003, and/or (2) PCT patent application Ser. No. PCT/US03/29460, filed on Sep. 23, 2003, the disclosures of which are incorporated herein by reference.

Figures 1, 15:
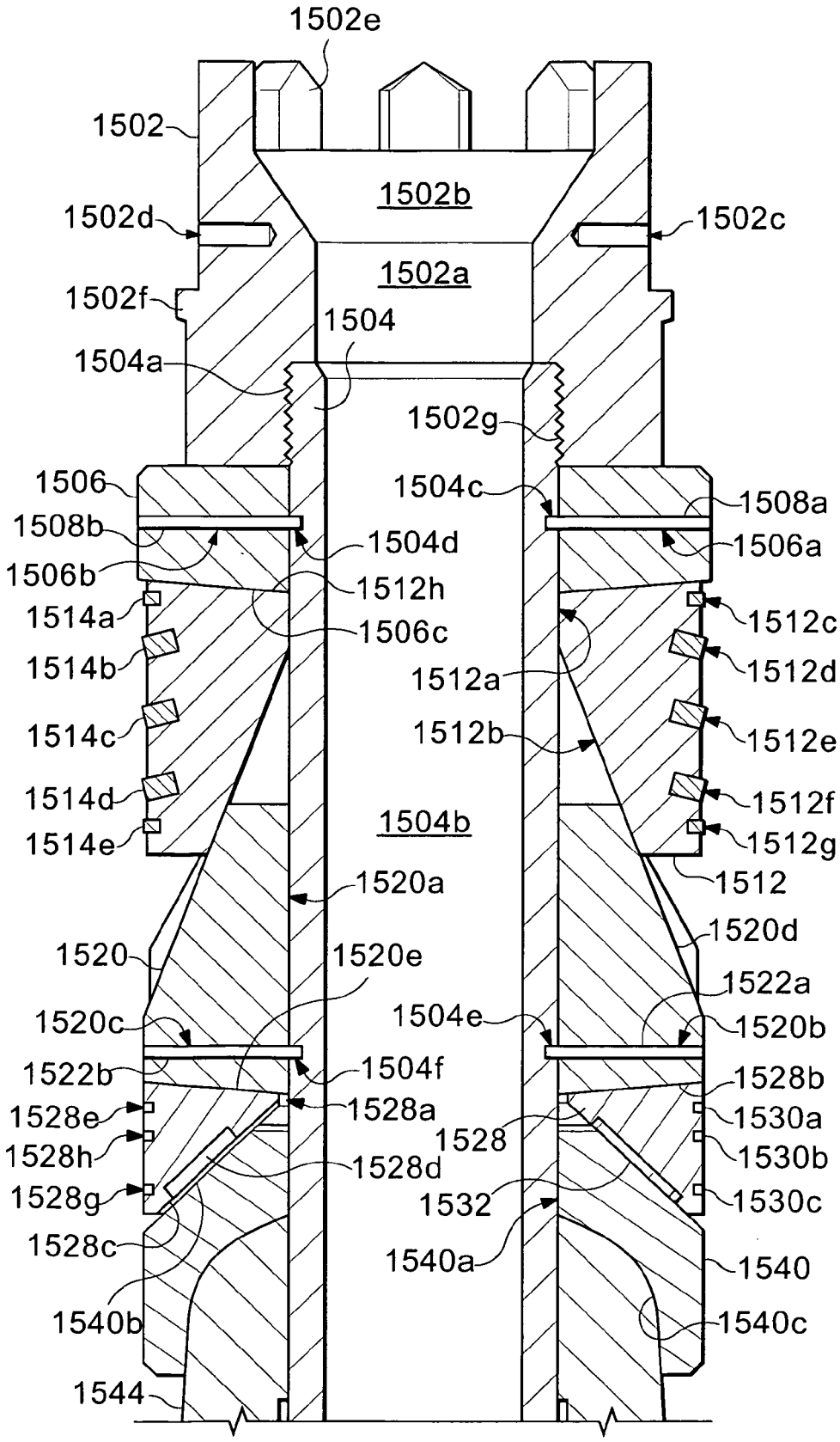
Figures 2, 15:
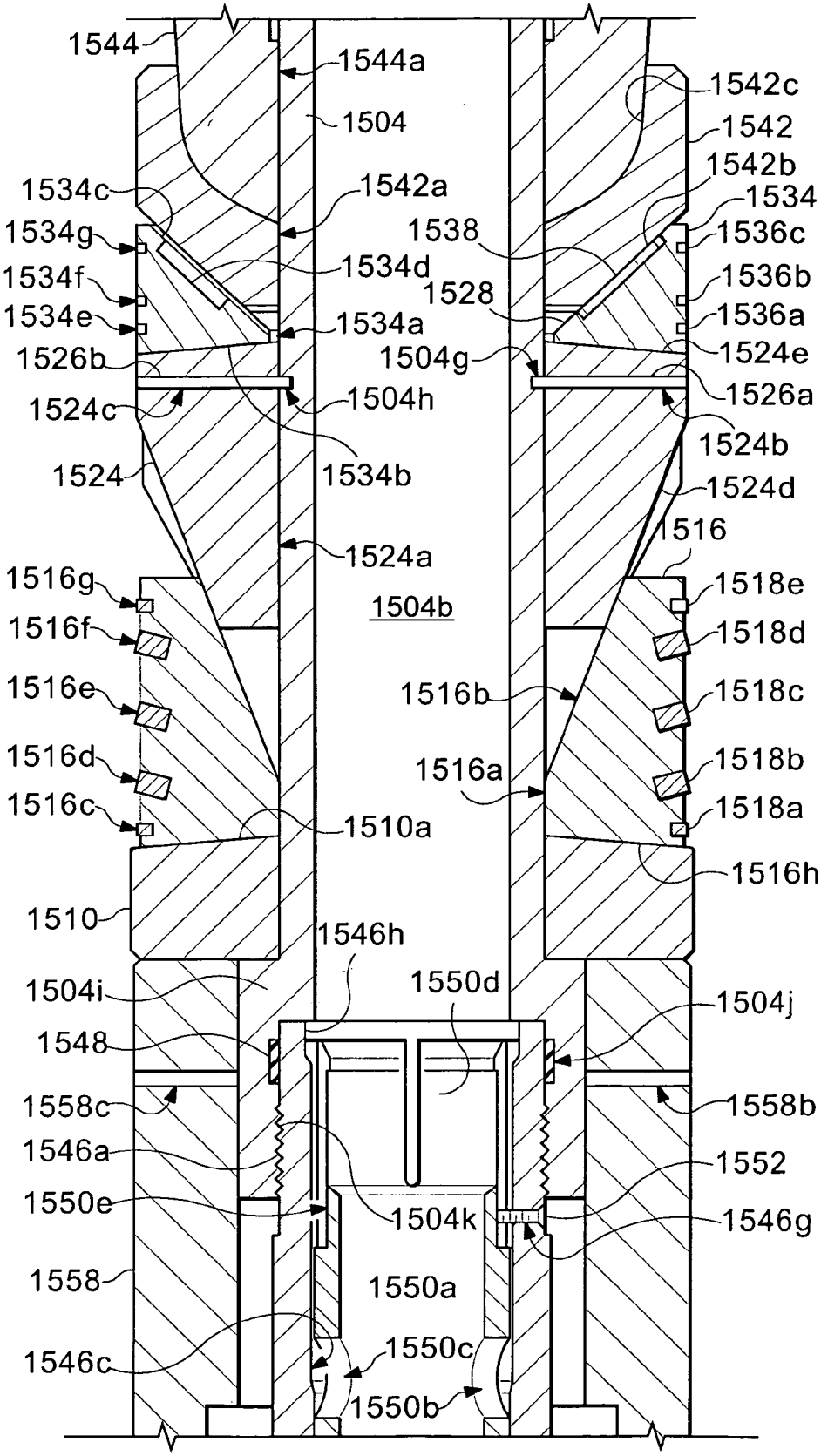
Figures 3, 15:
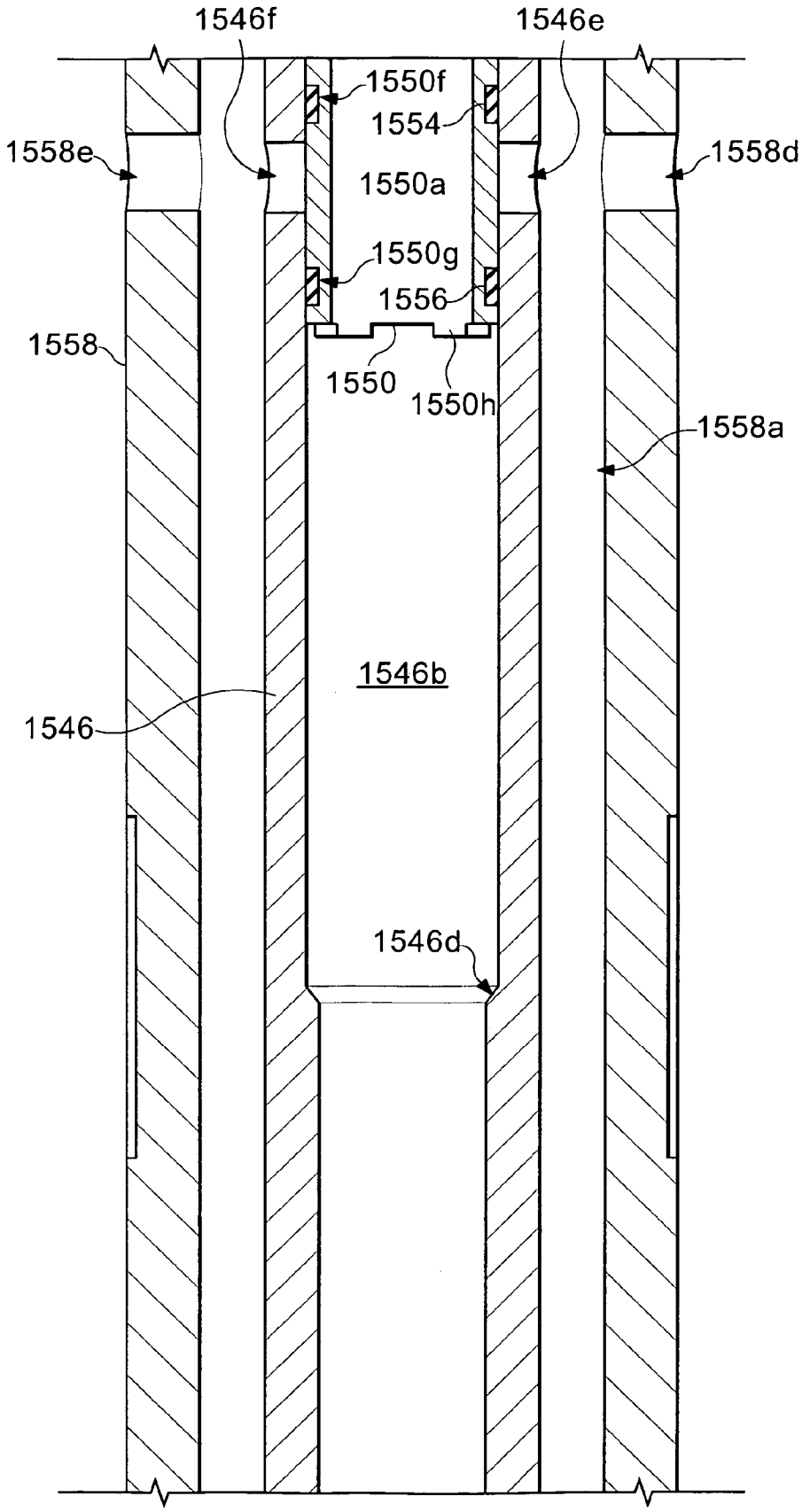
Figures 4, 15:
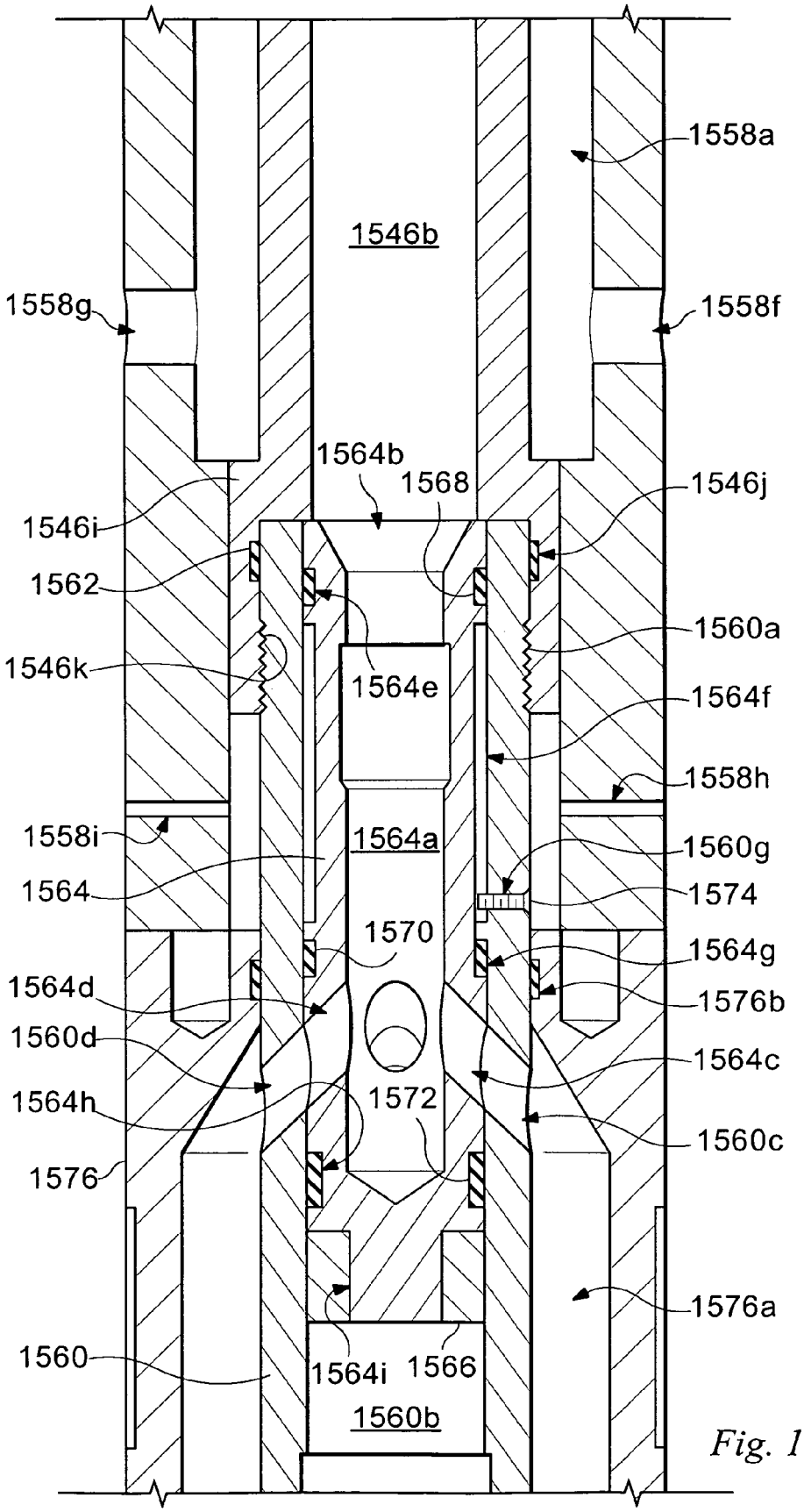
Figures 5, 15:
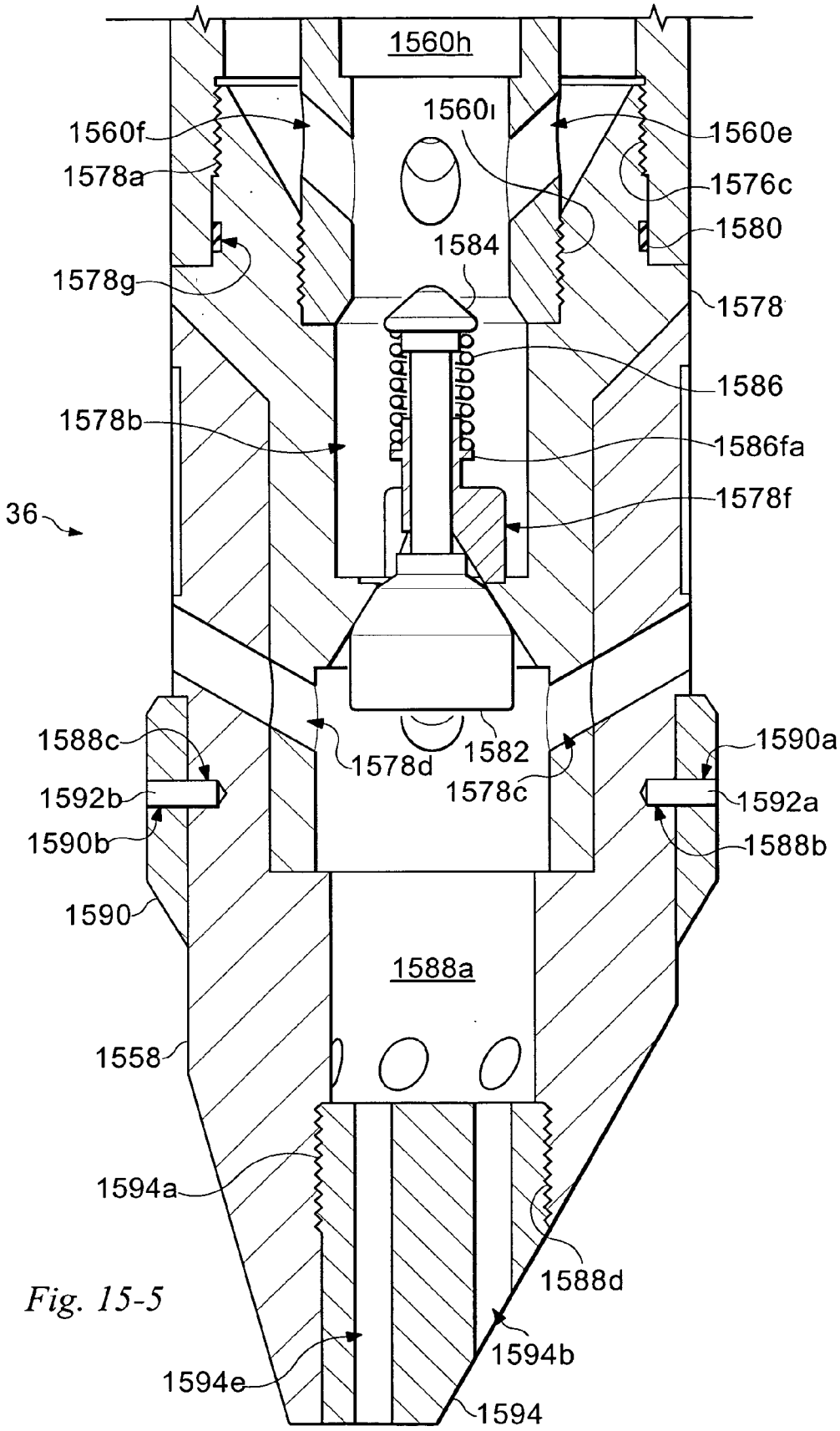

In an exemplary embodiment, as illustrated in FIGS. 15-1 to 15-5, the packer assembly 36 includes a tubular upper adaptor 1502 that defines a longitudinal passage 1502*a* having a tapered opening 1502*b* and mounting holes, 1502*c* and 1502*d*, that includes a plurality of circumferentially spaced apart teeth 1502*e* at one end, an external flange 1502*f*, and an internal threaded connection 1502*g* at another end. In an exemplary embodiment, the tubular upper adaptor 1502 is fabricated from aluminum. An external threaded connection 1504*a* of an end of a tubular upper mandrel 1504 that defines a longitudinal passage 1504*b*, mounting holes, 1504*c* and 1504*d*, mounting holes, 1504*e* and 1504*f*, and mounting holes, 1504*g* and 1504*h*, and includes an external flange 1504*i*, an internal annular recess 1504*j*, and an internal threaded connection 1504*k* at another end is received within and coupled to the internal threaded connection 1502*g* of the tubular upper adaptor 1502. In an exemplary embodiment, the tubular upper mandrel 1504 is fabricated from aluminum.

An upper tubular spacer ring 1506 that defines mounting holes, 1506*a* and 1506*b*, receives and mates with the end of the tubular upper mandrel 1504 and includes an angled end face 1506*c* and another end face that is positioned proximate to an end face of the tubular upper adaptor 1502 is coupled to the tubular upper mandrel by shear pins, 1508*a* and 1508*b*, that are mounted within and coupled to the mounting holes, 1504*c* and 1506*a*, and, 1504*d* and 1506*b*, respectively, of the tubular upper mandrel and upper tubular spacer ring, respectively. A lower tubular spacer ring 1510 that includes an angled end face 1510*a* receives, mates, and is coupled to the other end of the tubular upper mandrel 1504 and includes another end face that is positioned proximate to an end face of the external flange 1504*i* of the tubular upper mandrel 1504. In an exemplary embodiment, the upper and tubular spacer rings, 1506 and 1510, are fabricated from a composite material.

An upper tubular slip 1512 that receives and is movably mounted upon the tubular upper mandrel 1504 defines a longitudinal passage 1512*a* having a tapered opening 1512*b* and includes external annular recesses, 1512*c*, 1512*d*, 1512*e*, 1512*f*, and 1512*g*, and an angled end face 1512*h* that mates with and is positioned proximate the angled end face 1506*c* of the upper tubular spacer ring 1506. Slip retaining bands, 1514*a*, 1514*b*, 1514*c*, 1514*d*, and 1514*e*, are received within and coupled to the external annular recesses, 1512*c*, 1512*d*, 1512*e*, 1512*f*, and 1512*g*, of the upper tubular slip 1512. A lower tubular slip 1516 that receives and is movably mounted upon the tubular upper mandrel 1504 defines a longitudinal passage 1516*a* having a tapered opening 1516*b* and includes external annular recesses, 1516*c*, 1516*d*, 1516*e*, 1516*f*, and 1516*g*, and an angled end face 1516*h* that mates with and is positioned proximate the angled end face 1510*a* of the lower tubular spacer ring 1510. Slip retaining bands, 1518*a*, 1518*b*, 1518*c*, 1518*d*, and 1518*e*, are received within and coupled to the external annular recesses, 1516*c*, 1516*d*, 1516*e*, 1516*f*, and 1516*g*, of the lower tubular slip 1516. In an exemplary embodiment, the upper and lower tubular slips, 1512 and 1516, are fabricated from composite materials, and at least some of the slip retaining bands, 1514*a*, 1514*b*, 1514*c*, 1514*d*, 1514*e*, 1518*a*, 1518*b*, 1518*c*, 1518*d*, and 1518*e* are fabricated from carbide insert materials.

An upper tubular wedge 1520 that defines an longitudinal passage 1520*a* for receiving the tubular upper mandrel 1504 and mounting holes, 1520*b* and 1520*c*, and includes an angled end face 1520*d* at one end that is received within and mates with the tapered opening 1512*b* of the upper tubular slip 1512, and an angled end face 1520*e* at another end is coupled to the tubular upper mandrel by shear pins, 1522*a* and 1522*b*, mounted within and coupled to the mounting holes, 1504*e* and 1520*b*, and, 1504*f* and 1520*c*, respectively, of the tubular upper mandrel and upper tubular wedge, respectively. A lower tubular wedge 1524 that defines an longitudinal passage 1524*a* for receiving the tubular upper mandrel 1504 and mounting holes, 1524*b* and 1524*c*, and includes an angled end face 1524*d* at one end that is received within and mates with the tapered opening 1516*b* of the lower tubular slip 1516, and an angled end face 1524*e* at another end is coupled to the tubular upper mandrel by shear pins, 1526*a* and 1526*b*, mounted within and coupled to the mounting holes, 1504*g* and 1524*b*, and, 1504*h* and 1524*c*, respectively, of the tubular upper mandrel and lower tubular wedge, respectively. In an exemplary embodiment, the upper and lower tubular wedges, 1520 and 1524, are fabricated from composite materials.

An upper tubular extrusion limiter 1528 that defines a longitudinal passage 1528*a* for receiving the tubular upper mandrel 1504 includes an angled end face 1528*b* at one end that mates with the angled end face 1520*e* of the upper tubular wedge 1520, an angled end face 1528*c* at another end having recesses 1528*d*, and external annular recesses, 1528*e*, 1528*f* and 1528*g*. Retaining bands, 1530*a*, 1530*b*, and 1530*c*, are mounted within and coupled to the external annular recesses, 1528*e*, 1528*f* and 1528*g*, respectively, of the upper tubular extrusion limiter 1528. Circular disc-shaped extrusion preventers 1532 are coupled and mounted within the recesses 1528*d*. A lower tubular extrusion limiter 1534 that defines a longitudinal passage 1534*a* for receiving the tubular upper mandrel 1504 includes an angled end face 1534*b* at one end that mates with the angled end face 1524*e* of the lower tubular wedge 1524, an angled end face 1534*c* at another end having recesses 1534*d*, and external annular recesses, 1534*e*, 1534*f* and 1534*g*. Retaining bands, 1536*a*, 1536*b*, and 1536*c*, are mounted within and coupled to the external annular recesses, 1534*e*, 1534*f* and 1534*g*, respectively, of the lower tubular extrusion limiter 1534. Circular disc-shaped extrusion preventers 1538 are coupled and mounted within the recesses 1534*d*. In an exemplary embodiment, the upper and lower extrusion limiters, 1528 and 1534, are fabricated from composite materials.

An upper tubular elastomeric packer element 1540 that defines a longitudinal passage 1540*a* for receiving the tubular upper mandrel 1504 includes an angled end face 1540*b* at one end that mates with and is positioned proximate the angled end face 1528*c* of the upper tubular extrusion limiter 1528 and an curved end face 1540*c* at another end. A lower tubular elastomeric packer element 1542 that defines a longitudinal passage 1542*a* for receiving the tubular upper mandrel 1504 includes an angled end face 1542*b* at one end that mates with and is positioned proximate the angled end face 1534*c* of the lower tubular extrusion limiter 1534 and an curved end face 1542*c* at another end.

A central tubular elastomeric packer element 1544 that defines a longitudinal passage 1544*a* for receiving the tubular upper mandrel 1504 includes a curved outer surface 1544*b* for mating with and engaging the curved end faces, 1540*c* and 1542*c*, of the upper and lower tubular elastomeric packer elements, 1540 and 1542, respectively.

An external threaded connection 1546*a* of a tubular lower mandrel 1546 that defines a longitudinal passage 1546*b* having throat passages, 1546*c* and 1546*d*, and flow ports, 1546*e* and 1546*f*, and a mounting hole 1546*g*, and includes an internal annular recess 1546*h* at one end, and an external flange 1546*i*, internal annular recess 1546*j*, and internal threaded connection 1546*k* at another end. In an exemplary embodiment, the tubular lower mandrel 1546 is fabricated from aluminum. A sealing element 1548 is received within the inner annular recess 1504*j* of the other end of the tubular upper mandrel 1504 for sealing an interfaces between the tubular upper mandrel and the tubular lower mandrel 1546.

A tubular sliding sleeve valve 1550 that defines a longitudinal passage 1550*a* and radial flow ports, 1550*b* and 1550*c*, and includes collet fingers 1550*d* at one end for engaging the internal annular recess 1546*h* of the lower tubular mandrel 1546, an external annular recess 1550*e*, an external annular recess 1550*f*, an external annular recess 1550*g*, and circumferentially spaced apart teeth 1550*h* at another end is received within and is slidably coupled to the longitudinal passage 1546*b* of the tubular lower mandrel 1546. In an exemplary embodiment, the tubular sliding sleeve valve 1550 is fabricated from aluminum. A set screw 1552 is mounted within and coupled to the mounting hole 1546*g* of the tubular lower mandrel 1546 that is received within the external annular recess 1550*e* of the tubular sliding sleeve 1550. Sealing elements, 1554 and 1556, are mounted within the external annular recesses, 1550*f* and 1550*g*, respectively, of the tubular sliding sleeve valve 1550 for sealing an interface between the tubular sliding sleeve valve and the tubular lower mandrel 1546.

An end of a tubular outer sleeve 1558 that defines a longitudinal passage 1558*a*, radial passages, 1558*b* and 1558*c*, upper flow ports, 1558*d* and 1558*e*, lower flow ports, 1558*f* and 1558*g*, and radial passages, 1558*h* and 1558*i*, receives, mates with, and is coupled to the other end of the tubular upper mandrel 1504 and an end face of the end of the tubular outer sleeve is positioned proximate and end face of the lower tubular spacer ring 1510. The other end of the tubular outer sleeve 1558 receives, mates with, and is coupled to the other end of the tubular lower mandrel 1546.

An external threaded connection 1560*a* of an end of a tubular bypass mandrel 1560 that defines a longitudinal passage 1560*b*, upper flow ports, 1560*c* and 1560*d*, lower flow ports, 1560*e* and 1560*f*, and a mounting hole 1560*g* and includes an internal annular recess 1560*h* and an external threaded connection 1560*i* at another end is received within and coupled to the internal threaded connection 1546*k* of the tubular lower mandrel 1546. A sealing element 1562 is received within the internal annular recess 1546*j* of the tubular lower mandrel 1546 for sealing an interface between the tubular lower mandrel and the tubular bypass mandrel 1560.

A tubular plug seat 1564 that defines a longitudinal passage 1564*a* having a tapered opening 1564*b* at one end, and flow ports, 1564*c* and 1564*d*, and includes an external annular recess 1564*e*, an external annular recess 1564*f*, an external annular recess 1564*g*, an external annular recess 1564*h*, and an external annular recess 1564*i* having an external threaded connection at another end is received within and is movably coupled to the longitudinal passage 1560*b* of the tubular bypass mandrel 1560. A tubular nose 1566 is threadably coupled to and mounted upon the external annular recess 1564*i* of the tubular plug seat 1564. In an exemplary embodiment, the tubular plug seat 1564 is fabricated from aluminum. Sealing elements, 1568, 1570, and 1572, are received within the external annular recesses, 1564*e*, 1564*g*, and 1564*h*, respectively, of the tubular plug seat 1564 for sealing an interface between the tubular plug seat and the tubular bypass mandrel 1560. A set screw 1574 is mounted within and coupled to the mounting hole 1560*g* of the tubular bypass mandrel 1560 that is received within the external annular recess 1564*f* of the tubular plug seat 1564.

An end of a tubular bypass sleeve 1576 that defines a longitudinal passage 1576*a* and includes an internal annular recess 1576*b* at one end and an internal threaded connection 1576*c* at another end is coupled to the other end of the tubular outer sleeve 1558 and mates with and receives the tubular bypass mandrel 1560. In an exemplary embodiment, the tubular bypass sleeve 1576 is fabricated from aluminum.

An external threaded connection 1578*a* of a tubular valve seat 1578 that defines a longitudinal passage 1578*b* including a valve seat 1578*c* and up-jet flow ports, 1578*d* and 1578*e*, and includes a spring retainer 1578*f* and an external annular recess 1578*g* is received within and is coupled to the internal threaded connection 1576*c* of the tubular bypass sleeve 1576. In an exemplary embodiment, the tubular valve seat 1578 is fabricated from aluminum. A sealing element 1580 is received within the external annular recess 1578*g* of the tubular valve seat 1578 for fluidicly sealing an interface between the tubular valve seat and the tubular bypass sleeve 1576.

A poppet valve 1582 mates with and is positioned within the valve seat 1578*c* of the tubular valve seat 1578. An end of the poppet valve 1582 is coupled to an end of a stem bolt 1584 that is slidingly supported for longitudinal displacement by the spring retainer 1578*f* A valve spring 1586 that surrounds a portion of the stem bolt 1584 is positioned in opposing relation to the head of the stem bolt and a support 1578*fa* of the spring retainer 1578*f*. for biasing the poppet valve 1582 into engagement with the valve seat 1578*c* of the tubular valve seat 1578.

An end of a composite nose 1588 that defines a longitudinal passage 1588*a* and mounting holes, 1588*b* and 1588*c*, and includes an internal threaded connection 1588*d* at another end receives, mates with, and is coupled to the other end of the tubular valve seat 1578. A tubular nose sleeve 1590 that defines mounting holes, 1590*a* and 1590*b*, is coupled to the composite nose 1588 by shear pins, 1592*a* and 1592*b*, that are mounted in and coupled to the mounting holes, 1588*b* and 1590*a*, and, 1588*c* and 1590*b*, respectively, of the composite nose and tubular nose sleeve, respectively.

An external threaded connection 1594*a* of a baffle nose 1594 that defines longitudinal passages, 1594*b* and 1594*c*, is received within and is coupled to the internal threaded connection internal threaded connection 1588*d* of the composite nose 1588.

In an exemplary embodiment, as illustrated in FIGS. 16A1 to 16A5, during the operation of the packer setting tool assembly 32 and packer assembly 36, the packer setting tool and packer assembly are coupled to one another by inserting the end of the tubular upper adaptor 1502 into the other end of the tubular coupling ring 1444, bringing the circumferentially spaced teeth 1416*g* of the other end of the tubular bushing 1416 into engagement with the circumferentially spaced teeth 1502*e* of the end of the tubular upper adaptor, and mounting shear pins, 1602*a* and 1602*b*, within the mounting holes, 1444*c* and 1502*c*, and, 1444*d* and 1502*d*, respectively, of the tubular coupling ring and tubular upper adaptor, respectively. As a result, the tubular mandrel 1406 and tubular stinger 1408 of the packer setting tool assembly 32 are thereby positioned within the longitudinal passage 1504*a* of the tubular upper mandrel 1504 with the 1408*e* of the tubular stinger positioned within the longitudinal passage 1546*b* of the tubular lower mandrel 1546 proximate the collet fingers 1550*d* of the tubular sliding sleeve valve 1550.

Furthermore, in an exemplary embodiment, during the operation of the packer setting tool 32 and packer assembly 36, as illustrated in FIGS. 16A1 to 16A5, the packer setting tool and packer assembly are positioned within the expandable wellbore casing 100 and an internal threaded connection 30*a* of an end of the adjustable casing expansion cone assembly 30 receives and is coupled to the external threaded connection 1402*f* of the end of the tubular adaptor 1402 of the packer setting tool assembly. Furthermore, shear pins, 1604*a* and 1604*b*, mounted within the mounting holes, 1558*b* and 1558*c*, of the tubular outer sleeve 1558 couple the tubular outer sleeve to the expandable wellbore casing. As a result, torsion loads may transferred between the tubular outer sleeve 1558 and the expandable wellbore casing 100.

In an exemplary embodiment, as illustrated in FIGS. 16B1 to 16B5, a conventional plug 1606 is then injected into the setting tool assembly 32 and packer assembly 36 by injecting a fluidic material 1608 into the setting tool assembly and packer assembly through the longitudinal passages, 1402*a*, 1404*b*, 1406*b*, 1408*b*, 1550*a*, 1546*a*, 1560*b*, and 1564*a* of the tubular adaptor 1402, tubular upper mandrel 1404, tubular mandrel 1406, tubular stinger 1408, tubular sliding sleeve valve 1550, tubular lower mandrel 1546, tubular bypass mandrel 1560, and tubular plug seat 1564, respectively. The plug 1606 is thereby positioned within the longitudinal passage 1564*a* of the tubular plug seat 1564. Continued injection of the fluidic material 1608 following the seating of the plug 1606 within the longitudinal passage 1564*a* of the tubular plug seat 1564 causes the plug and the tubular plug seat to be displaced downwardly in a direction 1610 until further movement of the tubular plug seat is prevented by interaction of the set screw 1574 with the external annular recess 1564*f* of the tubular plug seat. As a result, the flow ports, 1564*c* and 1564*d*, of the tubular plug seat 1564 are moved out of alignment with the upper flow ports, 1560*c* and 1560*d*, of the tubular bypass mandrel 1560.

In an exemplary embodiment, as illustrated in FIGS. 16C1 to 16C5, after the expandable wellbore casing 100 has been radially expanded and plastically deformed to form at least the bell section 112 of the expandable wellbore casing 100 thereby shearing the shear pins, 1604*a* and 1604*b*, the setting tool assembly 32 and packer assembly 36 are then moved upwardly to a position within the expandable wellbore casing 100 above the bell section. The tubular adaptor 1402 is then rotated, by rotating the tool string of the system 10 above the setting tool assembly 32, to displace and position the drag blocks, 1428 and 1430, into engagement with the interior surface of the expandable wellbore casing 100.

As a result of the engagement of the drag blocks, 1428 and 1430, with the interior surface of the expandable wellbore casing 100, further rotation of the drag blocks relative to the wellbore casing is prevented. Consequently, due to the operation and interaction of the threaded connections, 1416*d* and 1418*a*, of the tubular bushing 1416 and tubular drag block body 1418, respectively, further rotation of the tubular adaptor 1402 causes the tubular drag block body and setting sleeve 1442 to be displaced downwardly in a direction 1612 relative to the remaining elements of the setting tool assembly 32 and packer assembly 36. As a result, the setting sleeve 1442 engages and displaces the upper tubular spacer ring 1506 thereby shearing the shear pins, 1522*a* and 1522*b*, and driving the upper tubular slip 1512 onto and up the angled end face 1520*d* of the upper tubular wedge 1520 and into engagement with the interior surface of the expandable wellbore casing 100. As a result, longitudinal displacement of the upper tubular slip 1512 relative to the expandable wellbore casing 100 is prevented. Furthermore, as a result, the 1446*b* collet fingers of the tubular retaining collet 1446 are disengaged from the tubular upper adaptor 1502.

In an alternative embodiment, after the drag blocks, 1428 and 1430, engage the interior surface of the expandable wellbore casing 100, an upward tensile force is applied to the tubular support member 12, and the ball gripper assembly 16 is then operate to engage the interior surface of the expandable wellbore casing. The tension actuator assembly 18 is then operated to apply an upward tensile force to the tubular adaptor 1402 thereby pulling the upper tubular spacer ring

1506, lower tubular spacer ring 1510, upper tubular slip 1512, lower tubular slip 1516, upper tubular wedge 1520, lower tubular wedge 1524, upper tubular extrusion limiter 1528, lower tubular extrusion limiter 1534, and central tubular elastomeric element 1544 upwardly into contact with the 1442 thereby compressing the upper tubular spacer ring, lower tubular spacer ring, upper tubular slip, lower tubular slip, upper tubular wedge, lower tubular wedge, upper tubular extrusion limiter, lower tubular extrusion limiter, and central tubular elastomeric element. As a result, the upper tubular slip 1512, lower tubular slip 1516, and central tubular elastomeric element 1544 engage the interior surface of the expandable wellbore casing 100.

In an exemplary embodiment, as illustrated in FIGS. 16D1 to 16D5, an upward tensile force is then applied to the tubular adaptor 1402 thereby compressing the lower tubular slip 1516, lower tubular wedge 1524, central elastomeric packer element 1544, upper tubular extrusion limiter 1528, and upper tubular wedge 1520 between the lower tubular spacer ring 1510 and the stationary upper tubular slip 1512. As a result, the lower tubular slip 1516 is driven onto and up the angled end face 1524*d* of the lower tubular wedge 1524 and into engagement with the interior surface of the expandable wellbore casing 100, and the central elastomeric packer element 1544 is compressed radially outwardly into engagement with the interior surface of the expandable tubular member. As a result, further longitudinal displacement of the upper tubular slip 1512, lower tubular slip 1516, and central elastomeric packer element 1544 relative to the expandable wellbore casing 100 is prevented.

In an exemplary embodiment, as illustrated in FIGS. 16E1 to 16E6, continued application of the upward tensile force to tubular adaptor 1402 will then shear the shear pins, 1602*a* and 1602*b*, thereby disengaging the setting tool assembly 32 from the packer assembly 36.

In an exemplary embodiment, as illustrated in FIGS. 16F1 to 16F6, with the drag blocks, 1428 and 1430, in engagement with the interior surface of the expandable wellbore casing 100, the tubular adaptor 102 is further rotated thereby causing the tubular drag block body 1418 and setting sleeve 1442 to be displaced further downwardly in the direction 1612 until the tubular drag block body and setting sleeve are disengaged from the tubular stinger 1408. As a result, the tubular stinger 1408 of the setting tool assembly 32 may then be displaced downwardly into complete engagement with the tubular sliding sleeve valve 1550.

In an exemplary embodiment, as illustrated in FIGS. 16G1 to 16G6, a fluidic material 1614 is then injected into the setting tool assembly 32 and the packer assembly 36 through the longitudinal passages 1402*a*, 1404*b*, 1406*b*, 1408*b*, 1504*b*, 1550*a*, and 1546*b* of the tubular adaptor 1402, tubular upper mandrel 1404, tubular mandrel 1406, tubular stinger 1408, tubular upper mandrel 1504, tubular sliding sleeve valve 1550, and tubular lower mandrel 1546, respectively. Because, the plug 1606 is seated within and blocks the longitudinal passage 1564*a* of the tubular plug seat 1564, the longitudinal passages 1504*b*, 1550*a*, and 1546*b* of the tubular upper mandrel 1504, tubular sliding sleeve valve 1550, and tubular lower mandrel 1546 are pressurized thereby displacing the tubular upper adaptor 1502 and tubular upper mandrel 1504 downwardly until the end face of the tubular upper mandrel impacts the end face of the upper tubular spacer ring 1506.

In an exemplary embodiment, as illustrated in FIGS. 16H1 to 16H5, the setting tool assembly 32 is brought back into engagement with the packer assembly 36 until the engagement shoulder 1408*e* of the other end of the tubular stinger 1408 engages the collet fingers 1550*d* of the end of the tubular sliding sleeve valve 1550. As a result, further downward displacement of the tubular stinger 1408 displaces the tubular sliding sleeve valve 1550 downwardly until the radial flow ports, 1550*b* and 1550*c*, of the tubular sliding sleeve valve are aligned with the flow ports, 1546*e* and 1546*f*, of the tubular lower mandrel 1546. A hardenable fluidic sealing material 1616 may then be injected into the setting tool assembly 32 and the packer assembly 36 through the longitudinal passages 1402*a*, 1404*b*, 1406*b*, 1408*b*, and 1550*a* of the tubular adaptor 1402, tubular upper mandrel 1404, tubular mandrel 1406, tubular stinger 1408, and tubular sliding sleeve valve 1550, respectively. The hardenable fluidic sealing material may then flow out of the packer assembly 36 through the upper flow ports, 1558*d* and 1558*e*, into the annulus between the expandable wellbore casing 100 and the wellbore 102.

The tubular sliding sleeve valve 1550 may then be returned to its original position, with the radial flow ports, 1550*b* and 1550*c*, of the tubular sliding sleeve valve out of alignment with the flow ports, 1546*e* and 1546*f*, of the tubular lower mandrel 1546. The hardenable fluidic sealing material 1616 may then be allowed to cure before, during, or after the continued operation of the system 10 to further radially expand and plastically deform the expandable wellbore casing.

In an exemplary embodiment, the system 10 is provided as illustrated in Appendix A to the present application. FIGS. 1-10, 11, 11*a*, 11*b*, 11*c*, 11*d*, 11*e*, 11*f*, 11*g*, 11*h*, 11*k*, 11*l*, 12*a*, 12*b*, 12*c*, 13*a*, 13*b*, 14, 15, 16*a*, 16*b*, 16*c*, 16*d*, 16*e*, 16*f*, 16*g*, and 16*h* of appendix A generally correspond to FIGS. 1-10, 11-1 to 11-2, 11A1 to 11A2, 11B1 to 11B2, 11C, 11D, 11E, 11F, 11G, 11H, 11I, 11J, 11K, 11L, 12A1 to 12A4, 12B, 12C1 to 12C4, 13A1 to 13A8, 13B1 to 13B7, 14A to 14C, 15-1 to 15-5, 16A1 to 16A5, 16B1 to 16B5, 16C1 to 16C5, 16D1 to 16D5, 16E1 to 16E6, 16F1 to 16F6, 16G1 to 16G6, and 16H1 to 16H5, respectively.

An apparatus for radially expanding and plastically deforming an expandable tubular member has been described that includes a support member, a cutting device for cutting the tubular member coupled to the support member, and an expansion device for radially expanding and plastically deforming the tubular member coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes: a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements includes a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, apparatus further includes an actuator coupled to the support member for moving the expansion elements between a first position and a second position; wherein in the first position, the expansion elements do not engage the tubular member, and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member, an expansion device for radially expanding and plastically deforming the tubular member coupled to the support member, and an actuator coupled to the support member for displacing the expansion device relative to the support member. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, the in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a sealing assembly for sealing an annulus defined between the support member and the tubular member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, the if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators comprise means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements includes a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a first expansion device for radially expanding and plastically deforming the tubular member coupled to the support member; and a second expansion device for radially expanding and plastically deforming the tubular member coupled to the support member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member, In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device for cutting the tubular member coupled to the support member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, at least one of the first second expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the first and second expansion devices comprise a plurality of expansion devices. In an exemplary embodiment, at least one of the first and second expansion device comprise an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a packer coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices comprises an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a cutting device for cutting the tubular member coupled to the support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the sealing device seals an annulus defines between the support member and the tubular member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cuffing elements are axially aligned with the second set of cutting elements. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in in the second position, the first set of expansion elements are axially aligned with the second set of expansion elements. In an exemplary embodiment, at least one of the adjustable expansion devices comprise a plurality of expansion devices. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for cutting a tubular member has been described that includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements.

An apparatus for engaging a tubular member has been described that includes a support member; and a plurality of movable elements coupled to the support member. In an exemplary embodiment, the apparatus further includes an actuator coupled to the support member for moving the elements between a first position and a second position; wherein in the first position, the elements do not engage the tubular member; and wherein in the second position, the elements engage the tubular member. In an exemplary embodiment, the apparatus further includes a sensor coupled to the support member for sensing the internal diameter of the tubular member. In an exemplary embodiment, the sensor prevents the elements from being moved to the second position if the internal diameter of the tubular member is less than a predetermined value. In an exemplary embodiment, the elements include a first set of elements; and a second set of elements; wherein the first set of elements are interleaved with the second set of elements. In an exemplary embodiment, in the first position, the first set of elements are not axially aligned with the second set of elements. In an exemplary embodiment, in the second position, the first set of elements are axially aligned with the second set of elements.

An apparatus for gripping a tubular member has been described that includes a plurality of movable gripping elements. In an exemplary embodiment, the gripping elements are moveable in a radial direction. In an exemplary embodiment, the gripping elements are moveable in an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction. In an exemplary embodiment, in a first axial direction, the gripping device grips the tubular member; and wherein, in a second axial direction, the gripping device does not grip the tubular member. In an exemplary embodiment, the apparatus further includes an actuator for moving the gripping elements. In an exemplary embodiment, the gripping elements include a plurality of separate and distinct gripping elements.

An actuator has been described that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber. In an exemplary embodiment, the actuator further includes means for transmitting torsional loads between the tubular housing and the tubular piston rod.

An apparatus for controlling a packer has been described that includes a tubular support member; one or more drag blocks releasably coupled to the tubular support member; and a tubular stinger coupled to the tubular support member for engaging the packer. In an exemplary embodiment, the apparatus further includes a tubular sleeve coupled to the drag blocks. In an exemplary embodiment, the tubular support member includes one or more axially aligned teeth for engaging the packer.

A packer has been described that includes a support member defining a passage; a shoe comprising a float valve coupled to an end of the support member; one or more compressible packer elements movably coupled to the support member; and a sliding sleeve valve movably positioned within the passage of the support member.

A method of radially expanding and plastically deforming an expandable tubular member within a borehole having a preexisting wellbore casing has been described that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, radially expanding and plastically deforming a portion of the tubular member to form a bell section includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; and displacing the adjustable expansion device upwardly relative to the expandable tubular member n times to radially expand and plastically deform n portions of the expandable tubular member, wherein n is greater than or equal to 1.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; positioning the adjustable expansion device within a second expandable tubular member; supporting the second expandable tubular member and the adjustable expansion device within the borehole in overlapping relation to the first expandable tubular member; lowering the adjustable expansion device out of the second expandable tubular member; increasing the outside dimension of the adjustable expansion device; and displacing the adjustable expansion device upwardly relative to the second expandable tubular member n times to radially expand and plastically deform n portions of the second expandable tubular member within the borehole.

A method for radially expanding and plastically deforming an expandable tubular member within a borehole has been described that includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; displacing the adjustable expansion mandrel upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; pressurizing an interior region of the first expandable tubular member above the adjustable expansion device during the radial expansion and plastic deformation of the first expandable tubular member within the borehole; positioning the adjustable expansion mandrel within a second expandable tubular member; supporting the second expandable tubular member and the adjustable expansion mandrel within the borehole in overlapping relation to the first expandable tubular member, lowering the adjustable expansion mandrel out of the second expandable tubular member; increasing the outside dimension of the adjustable expansion mandrel; displacing the adjustable expansion mandrel upwardly relative to the second expandable tubular member n times to radially expand and plastically deform n portions of the second expandable tubular member within the borehole; and pressurizing an interior region of the second expandable tubular member above the adjustable expansion mandrel during the radial expansion and plastic deformation of the second expandable tubular member within the borehole.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; displacing the first adjustable expansion device and the second adjustable expansion device downwardly relative to the second expandable tubular member; decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; pressurizing an interior region of the expandable tubular member above the first adjustable expansion device during the radial expansion of the lower portion of the expandable tubular member by the first adjustable expansion device; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; pressurizing an interior region of the first expandable tubular member above the first adjustable expansion device during the radial expansion of the lower portion of the first expandable tubular member by the first adjustable expansion device; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; pressurizing an interior region of the first expandable tubular member above the second adjustable expansion device during the radial expansion of the portions of the first expandable tubular member above the lower portion of the first expandable tubular member by the second adjustable expansion device; positioning first and second adjustable expansion devices within a second expandable tubular member, supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; pressurizing an interior region of the second expandable tubular member above the first adjustable expansion device during the radial expansion of the lower portion of the second expandable tubular member by the first adjustable expansion device; displacing the first adjustable expansion device and the second adjustable expansion device downwardly relative to the second expandable tubular member; decreasing the outside dimension of the first adjustable expansion device and increasing the outside dimension of the second adjustable expansion device; displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A method for radially expanding and plastically deforming an expandable tubular member within a borehole has been described that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and a preexisting structure after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform another portion of the expandable tubular member. In an exemplary embodiment, the method further includes if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

A method for forming a mono diameter wellbore casing within a borehole that includes a preexisting wellbore casing has been described that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and the borehole after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform the remaining portion of the expandable tubular member. In an exemplary embodiment, the method further includes not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A method of radially expanding and plastically deforming a tubular member has been described that includes positioning the tubular member within a preexisting structure; radially expanding and plastically deforming a lower portion of the tubular member to form a bell section; and radially expanding and plastically deforming a portion of the tubular member above the bell section. In an exemplary embodiment, positioning the tubular member within a preexisting structure includes locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, radially expanding and plastically deforming a lower portion of the tubular member to form a bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, radially expanding and plastically deforming a portion of the tubular member above the bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes fluidicly sealing an end of the tubular member; and pulling the expansion device through the tubular member. In an exemplary embodiment, the expansion device is adjustable. In an exemplary embodiment, the expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes overlapping the portion of the tubular member above the bell section with an end of a preexisting tubular member; and pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the overlapping portions of the tubular member and the preexisting tubular member includes gripping the tubular member; and pulling the expansion device through the overlapping portions of the tubular member and the preexisting tubular member. In an exemplary embodiment, gripping the tubular member includes permitting axial displacement of the tubular member in a first direction; and not permitting axial displacement of the tubular member in a second direction. In an exemplary embodiment, pulling the expansion device through the overlapping portions of the tubular member and the preexisting tubular member includes pulling the expansion device through the overlapping portions of the tubular member and the preexisting tubular member using an actuator. In an exemplary embodiment, pulling the expansion device through the overlapping portions of the tubular member and the preexisting tubular member includes pulling the expansion device through the overlapping portions of the tubular member and the preexisting tubular member using fluid pressure. In an exemplary embodiment, pulling the expansion device through the overlapping portions of the tubular member and the preexisting tubular member using fluid pressure includes pressurizing an annulus within the tubular member above the expansion device. In an exemplary embodiment, the method further includes cutting an end of the portion of the tubular member that overlaps with the preexisting tubular member. In an exemplary embodiment, the method further includes removing the cut off end of the expandable tubular member from the preexisting structure. In an exemplary embodiment, the method further includes injecting a hardenable fluidic sealing material into an annulus between the expandable tubular member and the preexisting structure. In an exemplary embodiment, the method further includes cutting off an end of the expandable tubular member. In an exemplary embodiment, the method further includes removing the cut off end of the expandable tubular member from the preexisting structure.

A method of radially expanding and plastically deforming a tubular member has been described that includes applying internal pressure to the inside surface of the tubular member at a plurality of discrete location separated from one another.

A system for radially expanding and plastically deforming an expandable tubular member within a borehole having a preexisting wellbore casing has been described that includes means for positioning the tubular member within the borehole in overlapping relation to the wellbore casing; means for radially expanding and plastically deforming a portion of the tubular member to form a bell section; and means for radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, means for radially expanding and plastically deforming a portion of the tubular member to form a bell section includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; and means for displacing the adjustable expansion device upwardly relative to the expandable tubular member n times to radially expand and plastically deform n portions of the expandable tubular member, wherein n is greater than or equal to 1.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for positioning the adjustable expansion device within a second expandable tubular member; means for supporting the second expandable tubular member and the adjustable expansion device within the borehole in overlapping relation to the first expandable tubular member; means for lowering the adjustable expansion device out of the second expandable tubular member; means for increasing the outside dimension of the adjustable expansion device; and means for displacing the adjustable expansion device upwardly relative to the second expandable tubular member n times to radially expand and plastically deform n portions of the second expandable tubular member within the borehole.

A system for radially expanding and plastically deforming an expandable tubular member within a borehole has been described that includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; means for displacing the adjustable expansion mandrel upwardly relative to the expandable tubular member n times to radially expand and plastically deform n portions of the expandable tubular member within the borehole; and means for pressurizing an interior region of the expandable tubular member above the adjustable expansion device during the radial expansion and plastic deformation of the expandable tubular member within the borehole.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for pressurizing an interior region of the first expandable tubular member above the adjustable expansion device during the radial expansion and plastic deformation of the first expandable tubular member within the borehole; means for positioning the adjustable expansion mandrel within a second expandable tubular member; means for supporting the second expandable tubular member and the adjustable expansion mandrel within the borehole in overlapping relation to the first expandable tubular member; means for lowering the adjustable expansion mandrel out of the second expandable tubular member; means for increasing the outside dimension of the adjustable expansion mandrel; means for displacing the adjustable expansion mandrel upwardly relative to the second expandable tubular member n times to radially expand and plastically deform n portions of the second expandable tubular member within the borehole; and means for pressurizing an interior region of the second expandable tubular member above the adjustable expansion mandrel during the radial expansion and plastic deformation of the second expandable tubular member within the borehole.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; displacing the first adjustable expansion device upwardly relative to the first expandable tubular member to radially expand and plastically deform a lower portion of the first expandable tubular member; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the adjustable expansion device upwardly relative to the second expandable tubular member to radially expand and plastically deform a lower portion of the second expandable tubular member; means for displacing the first adjustable expansion device and the second adjustable expansion device downwardly relative to the second expandable tubular member; means for decreasing the outside dimension of the first adjustable expansion device and increasing the outside dimension of the second adjustable expansion device; and means for displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for pressurizing an interior region of the expandable tubular member above the first adjustable expansion device during the radial expansion of the lower portion of the expandable tubular member by the first adjustable expansion device; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; and means for pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; means for displacing the first adjustable expansion device upwardly relative to the first expandable tubular member to radially expand and plastically deform a lower portion of the first expandable tubular member; means for pressurizing an interior region of the first expandable tubular member above the first adjustable expansion device during the radial expansion of the lower portion of the first expandable tubular member by the first adjustable expansion device; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for pressurizing an interior region of the first expandable tubular member above the second adjustable expansion device during the radial expansion of the portions of the first expandable tubular member above the lower portion of the first expandable tubular member by the second adjustable expansion device; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the first adjustable expansion device upwardly relative to the second expandable tubular member to radially expand and plastically deform a lower portion of the second expandable tubular member; means for pressurizing an interior region of the second expandable tubular member above the first adjustable expansion device during the radial expansion of the lower portion of the second expandable tubular member by the first adjustable expansion device; means for displacing the first adjustable expansion device and the second adjustable expansion device downwardly relative to the second expandable tubular member; means for decreasing the outside dimension of the first adjustable expansion device and increasing the outside dimension of the second adjustable expansion device; means for displacing the second adjustable expansion device upwardly relative to the second expandable tubular member to radially expand and plastically deform portions of the second expandable tubular member above the lower portion of the second expandable tubular member; and means for pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A system for radially expanding and plastically deforming an expandable tubular member within a borehole has been described that includes means for supporting the expandable tubular member, an hydraulic actuator, and an adjustable expansion device within the borehole; means for increasing the size of the adjustable expansion device; and means for displacing the adjustable expansion device upwardly relative to the expandable tubular member using the hydraulic actuator to radially expand and plastically deform a portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and a preexisting structure after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, system further includes means for displacing the adjustable expansion cone upwardly relative to the expandable tubular member to radially expand and plastically deform another portion of the expandable tubular member. In an exemplary embodiment, the system further includes if the end of the other portion of the expandable tubular member overlaps with a preexisting structure, then means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the other portion of the expandable tubular member that overlaps with the preexisting structure.

A system for forming a mono diameter wellbore casing within a borehole that includes a preexisting wellbore casing has been described that includes means for supporting the expandable tubular member, an hydraulic actuator, and an adjustable expansion device within the borehole; means for increasing the size of the adjustable expansion device; means for displacing the adjustable expansion device upwardly relative to the expandable tubular member using the hydraulic actuator to radially expand and plastically deform a portion of the expandable tubular member; and means for displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and the borehole after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, the system further includes means for displacing the adjustable expansion cone upwardly relative to the expandable tubular member to radially expand and plastically deform the remaining portion of the expandable tubular member. In an exemplary embodiment, the system further includes means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A system for radially expanding and plastically deforming a tubular member has been described that includes means for positioning the tubular member within a preexisting structure; means for radially expanding and plastically deforming a lower portion of the tubular member to form a bell section; and means for radially expanding and plastically deforming a portion of the tubular member above the bell section. In an exemplary embodiment, positioning the tubular member within a preexisting structure includes means for locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, means for radially expanding and plastically deforming a lower portion of the tubular member to form a bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for radially expanding and plastically deforming a portion of the tubular member above the bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for fluidicly sealing an end of the tubular member; and means for pulling the expansion device through the tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for overlapping the portion of the tubular member above the bell section with an end of a preexisting tubular member; and means for pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the overlapping portions of the tubular member and the preexisting tubular member includes means for gripping the tubular member; and means for pulling the expansion device through the overlapping portions of the tubular member and the preexisting tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the overlapping portions of the tubular member and the preexisting tubular member includes means for pulling the expansion device through the overlapping portions of the tubular member and the preexisting tubular member using an actuator. In an exemplary embodiment, means for pulling the expansion device through the overlapping portions of the tubular member and the preexisting tubular member includes means for pulling the expansion device through the overlapping portions of the tubular member and the preexisting tubular member using fluid pressure. In an exemplary embodiment, means for pulling the expansion device through the overlapping portions of the tubular member and the preexisting tubular member using fluid pressure includes means for pressurizing an annulus within the tubular member above the expansion device. In an exemplary embodiment, the system further includes means for cutting an end of the portion of the tubular member that overlaps with the preexisting tubular member. In an exemplary embodiment, the system further includes means for removing the cut off end of the expandable tubular member from the preexisting structure. In an exemplary embodiment, the system further includes means for injecting a hardenable fluidic sealing material into an annulus between the expandable tubular member and the preexisting structure. In an exemplary embodiment, the system further includes means for cutting off an end of the expandable tubular member. In an exemplary embodiment, the system further includes means for removing the cut off end of the expandable tubular member from the preexisting structure.

A system of radially expanding and plastically deforming a tubular member has been described that includes a support member; and means for applying internal pressure to the inside surface of the tubular member at a plurality of discrete location separated from one another coupled to the support member.

A method of cutting a tubular member has been described that includes positioning a plurality of cutting elements within the tubular member; and bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, bringing the cutting elements into engagement with the tubular member includes bringing the cutting elements into axial alignment. In an exemplary embodiment, bringing the cutting elements into engagement with the tubular member further includes pivoting the cutting elements. In an exemplary embodiment, bringing the cutting elements into engagement with the tubular member further includes translating the cutting elements. In an exemplary embodiment, bringing the cutting elements into engagement with the tubular member further includes pivoting the cutting elements; and translating the cutting elements. In an exemplary embodiment, bringing the cutting elements into engagement with the tubular member includes rotating the cutting elements about a common axis. In an exemplary embodiment, bringing the cutting elements into engagement with the tubular member includes pivoting the cutting elements about corresponding axes; translating the cutting elements; and rotating the cutting elements about a common axis. In an exemplary embodiment, the method further includes preventing the cutting elements from coming into engagement with the tubular member if the inside diameter of the tubular member is less than a predetermined value. In an exemplary embodiment, preventing the cutting elements from coming into engagement with the tubular member if the inside diameter of the tubular member is less than a predetermined value includes sensing the inside diameter of the tubular member.

A method of gripping a tubular member has been described that includes positioning a plurality of gripping elements within the tubular member; bringing the gripping elements into engagement with the tubular member. In an exemplary embodiment, bringing the gripping elements into engagement with the tubular member includes displacing the gripping elements in an axial direction; and displacing the gripping elements in a radial direction. In an exemplary embodiment, the method further includes biasing the gripping elements against engagement with the tubular member.

A method of operating an actuator has been described that includes pressurizing a plurality of pressure chamber. In an exemplary embodiment, the method further includes transmitting torsional loads.

A method of injecting a hardenable fluidic sealing material into an annulus between a tubular member and a preexisting structure has been described that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

A system for cutting a tubular member has been described that includes means for positioning a plurality of cutting elements within the tubular member; and means for bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, means for bringing the cutting elements into engagement with the tubular member includes means for bringing the cutting elements into axial alignment. In an exemplary embodiment, means for bringing the cutting elements into engagement with the tubular member further includes means for pivoting the cutting elements. In an exemplary embodiment, means for bringing the cutting elements into engagement with the tubular member further includes means for translating the cutting elements. In an exemplary embodiment, means for bringing the cutting elements into engagement with the tubular member further includes means for pivoting the cutting elements; and means for translating the cutting elements. In an exemplary embodiment, means for bringing the cutting elements into engagement with the tubular member includes means for rotating the cutting elements about a common axis. In an exemplary embodiment, means for bringing the cutting elements into engagement with the tubular member includes means for pivoting the cutting elements about corresponding axes; means for translating the cutting elements; and means for rotating the cutting elements about a common axis. In an exemplary embodiment, the system further includes means for preventing the cutting elements from coming into engagement with the tubular member if the inside diameter of the tubular member is less than a predetermined value. In an exemplary embodiment, means for preventing the cutting elements from coming into engagement with the tubular member if the inside diameter of the tubular member is less than a predetermined value includes means for sensing the inside diameter of the tubular member.

A system for gripping a tubular member has been described that includes means for positioning a plurality of gripping elements within the tubular member; and means for bringing the gripping elements into engagement with the tubular member. In an exemplary embodiment, means for bringing the gripping elements into engagement with the tubular member includes means for displacing the gripping elements in an axial direction; and means for displacing the gripping elements in a radial direction. In an exemplary embodiment, the system further includes means for biasing the gripping elements against engagement with the tubular member.

An actuator system has been described that includes a support member; and means for pressurizing a plurality of pressure chambers coupled to the support member. In an exemplary embodiment, the system further includes means for transmitting torsional loads.

A system for injecting a hardenable fluidic sealing material into an annulus between a tubular member and a preexisting structure has been described that includes means for positioning the tubular member into the preexisting structure; means for sealing off an end of the tubular member; means for operating a valve within the end of the tubular member; and means for injecting a hardenable fluidic sealing material through the valve into the annulus between the tubular member and the preexisting structure.

A method of engaging a tubular member has been described that includes positioning a plurality of elements within the tubular member; and bringing the elements into engagement with the tubular member. In an exemplary embodiment, the elements include a first group of elements; and a second group of elements; wherein the first group of elements are interleaved with the second group of elements. In an exemplary embodiment, bringing the elements into engagement with the tubular member includes bringing the elements into axial alignment. In an exemplary embodiment, bringing the elements into engagement with the tubular member further includes pivoting the elements. In an exemplary embodiment, bringing the elements into engagement with the tubular member further includes translating the elements. In an exemplary embodiment, bringing the elements into engagement with the tubular member further includes pivoting the elements; and translating the elements. In an exemplary embodiment, bringing the elements into engagement with the tubular member includes rotating the elements about a common axis. In an exemplary embodiment, bringing the elements into engagement with the tubular member includes pivoting the elements about corresponding axes; translating the elements; and rotating the elements about a common axis. In an exemplary embodiment, the method further includes preventing the elements from coming into engagement with the tubular member if the inside diameter of the tubular member is less than a predetermined value. In an exemplary embodiment, preventing the elements from coming into engagement with the tubular member if the inside diameter of the tubular member is less than a predetermined value includes sensing the inside diameter of the tubular member.

A system for engaging a tubular member has been described that includes means for positioning a plurality of elements within the tubular member; and means for bringing the elements into engagement with the tubular member. In an exemplary embodiment, the elements include a first group of elements; and a second group of elements; wherein the first group of elements are interleaved with the second group of elements. In an exemplary embodiment, means for bringing the elements into engagement with the tubular member includes means for bringing the elements into axial alignment. In an exemplary embodiment, means for bringing the elements into engagement with the tubular member further includes means for pivoting the elements. In an exemplary embodiment, means for bringing the elements into engagement with the tubular member further includes means for translating the elements. In an exemplary embodiment, means for bringing the elements into engagement with the tubular member further includes means for pivoting the elements; and means for translating the elements. In an exemplary embodiment, means for bringing the elements into engagement with the tubular member includes means for rotating the elements about a common axis. In an exemplary embodiment, means for bringing the elements into engagement with the tubular member includes means for pivoting the elements about corresponding axes; means for translating the elements; and means for rotating the elements about a common axis. In an exemplary embodiment, the system further includes means for preventing the elements from coming into engagement with the tubular member if the inside diameter of the tubular member is less than a predetermined value. In an exemplary embodiment, means for preventing the elements from coming into engagement with the tubular member if the inside diameter of the tubular member is less than a predetermined value includes means for sensing the inside diameter of the tubular member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member;

a gripping device for gripping the tubular member coupled to the support member; and a cutting device for cutting the tubular member coupled to the support member, wherein the gripping device comprises a plurality of movable gripping elements, wherein the gripping elements are moveable in an axial direction relative to the support member.

2. The apparatus of claim 1, wherein the gripping elements are moveable in a radial and an axial direction relative to the support member.

3. The apparatus of claim 1, wherein the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member.

4. The apparatus of claim 1, wherein the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member.

5. The apparatus of claim 1, wherein, if the tubular member is displaced in a first axial direction, the gripping device grips the tubular member; and wherein, if the tubular member is displaced in a second axial direction, the gripping device does not grip the tubular member.

6. The apparatus of claim 1, wherein the gripping elements are moveable from a first position to a second position; wherein in the first position, the gripping elements do not engage the tubular member; wherein in the second position, the gripping elements do engage the tubular member; and wherein, the gripping elements are biased to remain in the first position.

7. The apparatus of claim 1, wherein the gripping device further composes:

an actuator for moving the gripping elements from a first position to a second position;

wherein in the first position, the gripping elements do not engage the tubular member;

wherein in the second position, the gripping elements do engage the tubular member; and wherein the actuator is a fluid powered actuator.

8. The apparatus of claim 1, further comprising a sealing assembly for sealing an annulus defined between the support member and the tubular member, wherein the sealing device seals an annulus defines between the support member and the tubular member.

9. The apparatus of claim 1, further comprising:

a locking device for locking the position of the tubular member relative to the support member.

10. The apparatus of claim 1, further comprising a packer assembly coupled to the support member, wherein the packer assembly comprises:

a packer; and a packer control device for controlling the operation of the packer coupled to the support member.

11. The apparatus of claim 10, wherein the packer comprises:

a support member defining a passage;

a shoe comprising a float valve coupled to an end of the support member;

one or more compressible packer elements movably coupled to the support member; and a sliding sleeve valve movably positioned within the passage of the support member.

12. The apparatus of claim 10, wherein the packer control device composes a support member;

one or more drag Hocks releasably coupled to the support member; and a stinger coupled to the support member for engaging the packer.

13. The apparatus of claim 10, wherein the packer comprises:

a support member defining a passage;

a shoe comprising a float valve coupled to an end of the support member;

one or more compressible packer elements movably coupled to the support member; and a sliding sleeve valve positioned within the passage of the support member; and wherein the packer control device comprises:

a support member;

one or more drag blocks releasably coupled to the support member; and a stinger coupled to the support member for engaging the sliding sleeve valve.

14. The apparatus of claim 1, wherein the actuator comprises:

a first actuator for pulling the expansion device; and a second actuator for pushing the expansion device.

15. The apparatus of claim 14, wherein the first and second actuators comprise means for transferring torsional loads between the support member and the expansion device

16. The apparatus of claim 1, wherein the actuator comprises means for transferring torsional loads between the support member and the expansion device.

17. The apparatus of claim 1, wherein the actuator comprises a plurality of pistons positioned within corresponding piston chambers.

18. The apparatus of claim 1, wherein the expansion device comprises an adjustable expansion device.

19. The apparatus of claim 1, wherein the expansion device comprises a plurality of expansion devices.

20. The apparatus of claim 19, wherein at least one of the expansion devices comprises an adjustable expansion device.

21. The apparatus of claim 20, wherein the adjustable expansion device comprises:

a support member; and a plurality of movable expansion elements coupled to the support member.

22. The apparatus of claim 21, further comprising:

an actuator coupled to the support member for moving the expansion elements between a first position and a second position;

wherein in the first position, the expansion elements do not engage the tubular member; and wherein in the second position, the expansion elements engage the tubular member.

23. The apparatus of claim 22, further comprising:

a sensor coupled to the support member for sensing the internal diameter of the tubular member.

24. The apparatus of claim 23, wherein the sensor prevents the expansion elements from being moved to the second position if the internal diameter of the tubular member is less than a predetermined value.

25. The apparatus of claim 22, wherein the expansion elements comprise:

a first set of expansion elements; and a second set of expansion elements;

wherein The first set of expansion elements are interleaved with the second set of expansion elements.

26. The apparatus of claim 22, wherein in the first position, the first set of expansion elements are not axially aligned with the second set of expansion elements.

27. The apparatus of claim 22, wherein in the second position, the first set of expansion elements are axially aligned with the second set of expansion elements.

28. An apparatus of claim for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member;

a gripping device for gripping the tubular member coupled to the support member;

a cutting device for cutting the tubular member coupled to the support member, wherein the cutting device comprises a support member and a plurality of movable cutting elements coupled to the support member;

an actuator coupled to the support member for moving the cutting elements between a first position and a second position, wherein the cutting elements do not engage the tubular member in the first position and the cutting elements engage the tubular member in the second position; and a sensor coupled to the support member for sensing the internal diameter of the tubular member.

29. The apparatus of claim 28, wherein the sensor prevents the cutting elements from being moved to the second position if the internal diameter of the tubular member is less than a predetermined value.

30. The apparatus of claim 28, wherein the cutting elements comprise:

a first set of cutting elements; and a second set of cutting elements;

wherein the first set of cutting elements are interleaved with the second set of cutting elements.

31. The apparatus of claim 30, wherein in the first position, the first set of cuffing elements are not axially aligned with the second set of cuffing elements.

32. The apparatus of claim 30, wherein in the second position, the first set of cuffing elements are axially aligned with the second set of cuffing elements.

* * * * *